US007789122B2

(12) United States Patent
Ito

(10) Patent No.: US 7,789,122 B2
(45) Date of Patent: Sep. 7, 2010

(54) COMBINED AWNING DEVICE AND WINDING ROLLER FOR A NUMBER OF CANVASES

(76) Inventor: Osamu Ito, Room 101, Mizuho-Sky Mansion, 5, Takoucho 2-chome, Mizuho-ku, Nagoya-shi, Aichi 467 2828 (JP)

( * ) Notice: Subject to any disclaimer, the term of this patent is extended or adjusted under 35 U.S.C. 154(b) by 0 days.

(21) Appl. No.: 12/137,785

(22) Filed: Jun. 12, 2008

(65) Prior Publication Data

US 2008/0308238 A1 Dec. 18, 2008

Related U.S. Application Data

(63) Continuation of application No. PCT/JP2005/023688, filed on Dec. 13, 2005.

(51) Int. Cl.
*E04F 10/06* (2006.01)

(52) U.S. Cl. ..... 160/55; 160/42; 160/54; 160/62; 160/67; 160/120; 160/121.1

(58) Field of Classification Search ..... 160/42, 160/45, 54, 55, 62, 64, 66, 67, 70, 79, 120, 160/121.1, 263, 242, 370.22, DIG. 5
See application file for complete search history.

(56) References Cited

U.S. PATENT DOCUMENTS 483,950 A * 10/1892 Vayre ..... 160/120

(Continued)

FOREIGN PATENT DOCUMENTS

FR 2653393 * 10/1989

OTHER PUBLICATIONS

Page 9-15 of "Awning sales manual" published by the Japan Awning Association in Jan. 2004 with English Translation.

(Continued)

*Primary Examiner*—Blair M. Johnson
(74) *Attorney, Agent, or Firm*—Hiroe & Associates; Taras P. Bemko

(57) ABSTRACT

A winding roller for winding and unwinding a corner projected canvas and a rectangular canvas in such a state that the canvases overlap is supported via a bearing and a slider for attaching a projected corner canvas to the winding roller and making the canvas freely slidable is incorporated. The front bar for the rectangular canvas is supported by a foldable arm in such a manner so as to be freely translatable and the front bar for the projected corner canvas is formed in the front bar for the rectangular canvas in such a manner so as to be freely slidable. Thus, the projected corner canvas and the rectangular canvas, which are wound around the winding roller in such a state that the canvases overlap are unwound so as to spread, and the spread projected corner canvas slides transversely along the winding roller and the front bar of the rectangular canvas, and thus, extends to the outside of a building which includes a corner space portion of a projected corner portion. The projected corner canvas which extends into the corner space portion transversely slides to the rear along the winding roller and the front bar of the rectangular canvas while remaining in a spread state, and after that, the projected corner canvas and the rectangular canvas are wound around the winding roller in such a state that the canvases overlap.

15 Claims, 64 Drawing Sheets

U.S. PATENT DOCUMENTS 584,075 A * 6/1897 Fogh ..... 160/58.1
619,957 A * 2/1899 Hettrick ..... 160/64
642,423 A * 1/1900 Brodie ..... 160/120
799,719 A * 9/1905 Cummings ..... 160/121.1
1,171,510 A * 2/1916 Forsyth ..... 160/82
1,361,747 A * 12/1920 Dare ..... 160/50
1,842,598 A * 1/1932 Fogh ..... 160/42
2,060,582 A * 11/1936 Leffert ..... 160/120
2,140,286 A * 12/1938 Frazce ..... 160/42
2,486,568 A * 11/1949 Lukaszevig ..... 160/25
2,498,094 A * 2/1950 Plaum ..... 160/29
3,389,738 A * 6/1968 Roth ..... 160/120
3,446,263 A * 5/1969 Roth ..... 160/120
4,979,775 A * 12/1990 Klose ..... 296/97.1
5,084,473 A * 1/1992 Mikami et al. ..... 514/390
6,012,505 A * 1/2000 Wurz et al. ..... 160/66
6,460,593 B1 * 10/2002 Floyd ..... 160/370.22
2006/0175019 A1 * 8/2006 Rewak ..... 160/67
2007/0246168 A1 * 10/2007 Ito ..... 160/22
2008/0053624 A1 * 3/2008 Ito ..... 160/75
2008/0277073 A1 * 11/2008 Ito ..... 160/67
2008/0308238 A1 * 12/2008 Ito ..... 160/67
2009/0050277 A1 * 2/2009 Ito ..... 160/67

OTHER PUBLICATIONS

International Search Report for International Application No. PCT/JP2005/023688 mailed Jan. 31, 2006.

* cited by examiner

Fig.12A
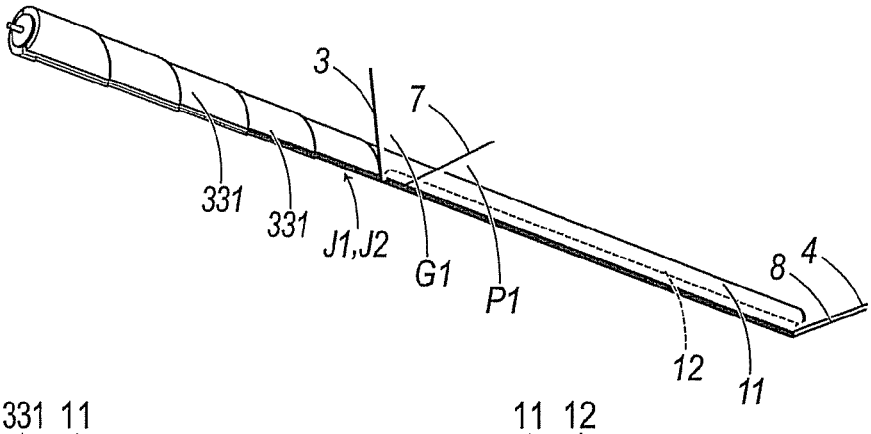
Fig.12B
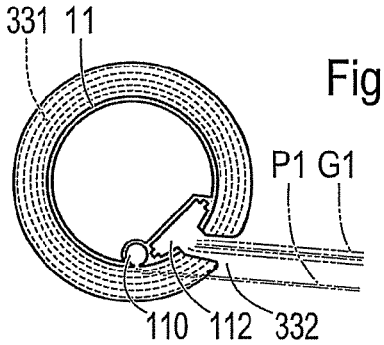
Fig.12C
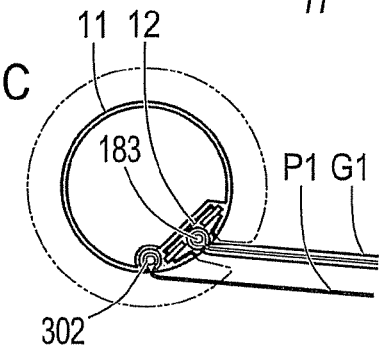
Fig.13A
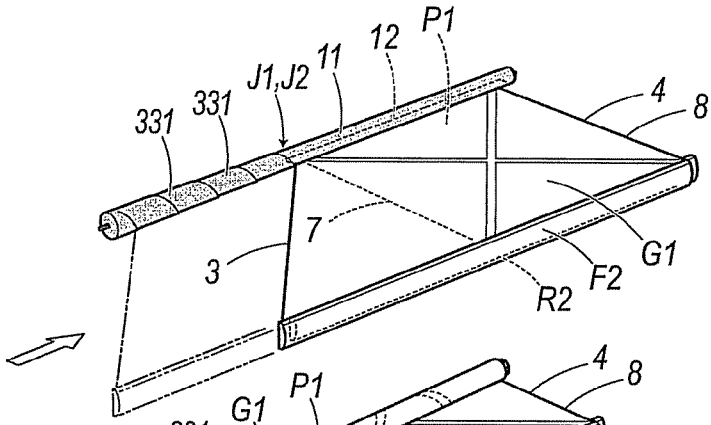
Fig.13B
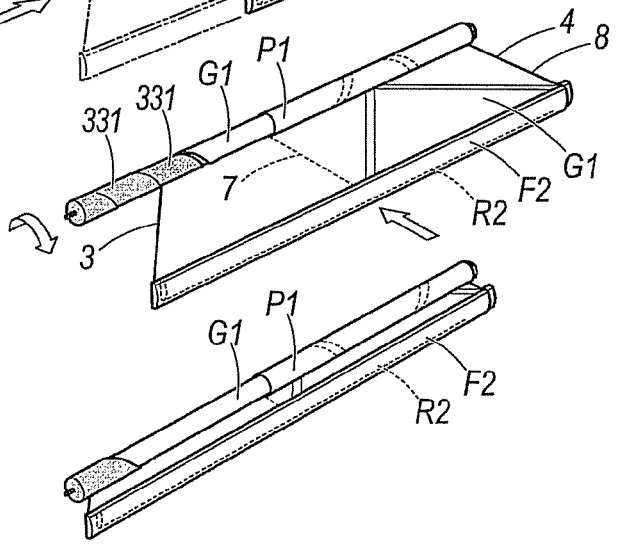
Fig.13C Fig.40A
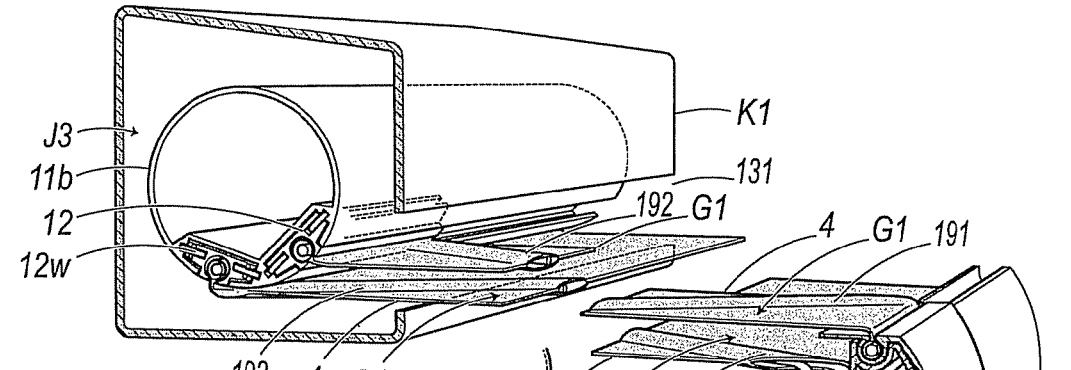
Fig.40B
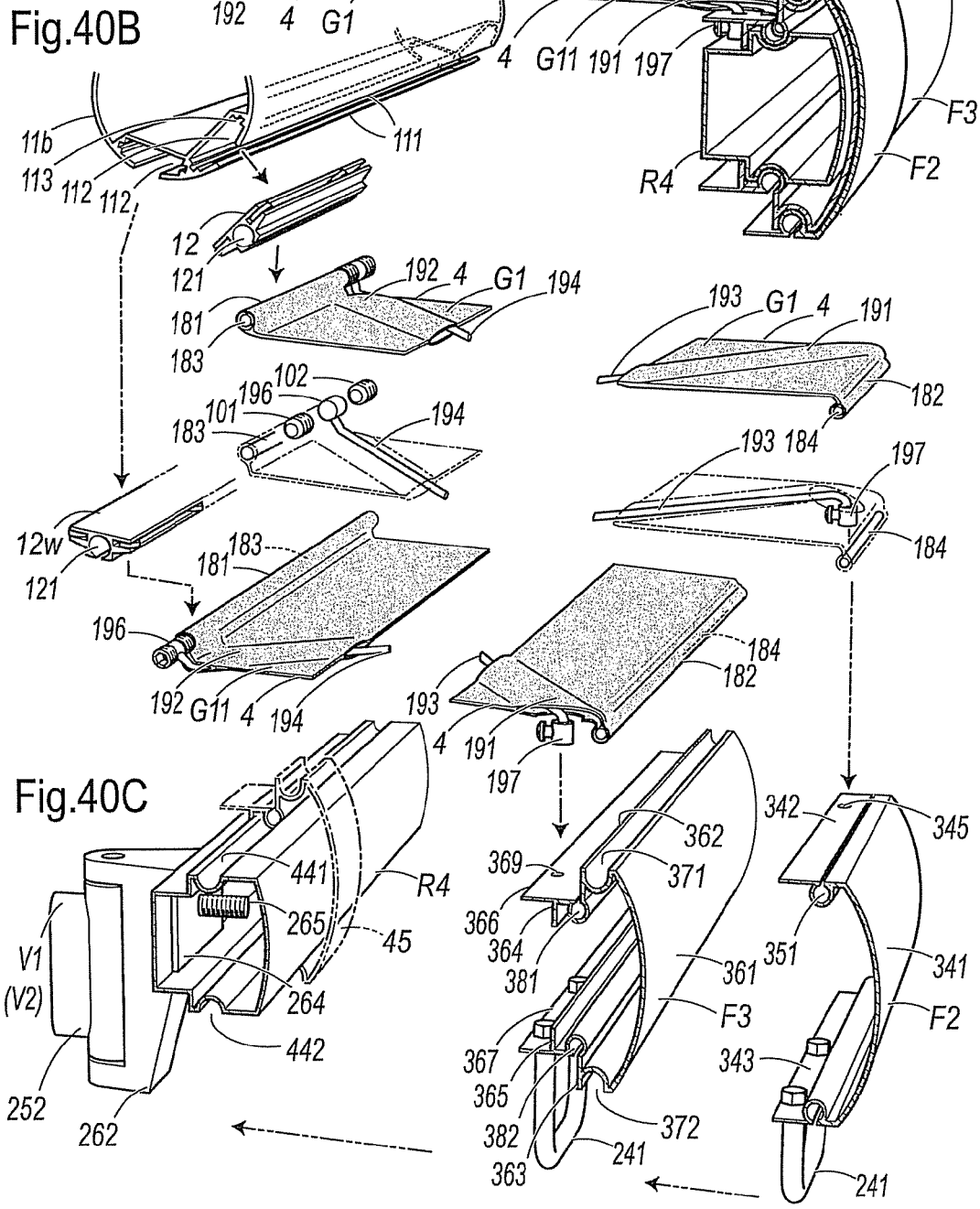
Fig.40C 601
561
562
602
135
K1
11
12
G1
P1
601
602
11
J5
R2
F2
60
561
562
611

671
S1
F2
G1
673
672
654
241
Q1
P2
654
R2
W2
H1
641
651
653
674
652
Z1
J1,J2
W1
H2
651
653
652
Z2

671
673
672
651
F2
241
R2
W2
H1
641
653
674
652
Z1
J1,J2
W1
H2
641
651
653
652
Z2

641
Z1
F2

641
R2
Z2

COMBINED AWNING DEVICE AND WINDING ROLLER FOR A NUMBER OF CANVASES

CROSS REFERENCE

This is a continuation of International Application No. PCT/JP2005/023688, filed on 13 Dec. 2005.

TECHNICAL FIELD

The present invention relates to a complex type movable awning device having a transverse sliding structure of projected corner canvases, that is to say, a complex awning device and a winding roller for a number of canvases which forms the main portion thereof, which are used to cover the corner space portion in the projected corner portion of various types of buildings and the outside of buildings, such as projected corner portions and recessed corner portions which include corner space portions, so that the appearance can be improved.

BACKGROUND OF THE INVENTION

Conventional movable awning devices wind and unwind a rectangular canvas which generally spreads to the front and diagonally downward around a winding roller supported by a bearing in a portion close to the wall of the building by means of a manually operable handle or an electrically driven motor, etc. A front bar to which the bottom hem of the above described canvas is attached is supported in such a manner so as to extend in a tense state by means of arms which are foldable in two or y-shaped arms which are freely foldable in the approximate horizontal direction (foldable arm type), or the two end portions of the front bar of the spread rectangular canvas are supported by means of foldable arms which can be operated to rise and lower in an approximate vertical direction or extendable links having a pantograph structure (lateral arm type). Many of these are provided as sun or rain shields around the outer periphery of terraces and shops, or portions for decorating buildings and shops (see for example the following Non-Patent Documents 1 and 2, hereinafter referred to as "the former").

Meanwhile, conventional movable awning devices having the following configurations (a) to (d) have been proposed in order to cover corner space portions of projected corner portions of buildings (see for example the following Patent Document 1, hereinafter referred to as "the latter").

(a) An awning support frame in which the entire device is supported by a fixed bracket in a corner end portion so as to be projected diagonally to the front. And two winding rollers for winding or unwinding a canvas by means of an electrically driven motor in the form of an approximate right angled triangle along the long side are supported by a bearing in the two end portions, front and rear, of the awning support frame.

(b) In addition, the base end portion of the foldable arm which is pressed in the direction in which it extends is attached to a portion in the vicinity of the middle of the base pipe and the top hem of the triangular canvas which is attached to the arm holder in the front end portion.

(c) A cosmetic panel is also provided in a front end portion of the awning support frame so as to be freely spreadable, and an arm holder is supported in such a manner so as to be freely slidable along a trench in a rear portion of this cosmetic panel.

(d) Furthermore, a portion close to the front end of the awning support frame is hung and supported by a wire rope and lifted upward to the rear of a corner end portion by means of a winding machine so that the entirety of the device is stored in an upside-down state.

LIST OF DOCUMENT INFORMATION ON PRIOR ART

Patent Document 1: Japanese Examined Utility Model Publication No. H4 (1992)-40336

Non-Patent Document 1: "Awning Sales Manual," Japan Awning Association, January 2004, pp. 9-15

Non-Patent Document 2: "Awning-Sunshield-Japan Awning Association-JAA" [online], Japan Awning Association, searched on the Internet, Aug. 17$^{th}$, 2004<URL: http//www.awning.org/index.html>

DISCLOSURE OF THE INVENTION

Problem to Be Solved by the Invention

The former awning devices are used in linear sections around the outside of buildings, and cannot cover corner space portions of projected corner portions. In the case where these awning devices are used to cover such portions, the winding roller is attached so as to protrude from the projected corner portion to the corner space portion.

In many cases, projected corner portions of a building face a sidewalk or a street in two directions, or an intersection, and thus are located in such a place as to be seen by the general public. Such places are blessed with good business conditions for shops and provide excellent effects for advertisement.

In the case where an awning device which is incorporated in such a conspicuous place must wind a rectangular canvas in such a state as to be projected from the projected corner portion and stored, the awning device is technically uninteresting, and the appearance is not good.

Meanwhile, in the latter awning device, a triangular canvas which spreads in a corner space portion is supported at one end by a corner end portion of a projected corner portion, and therefore, the load of the entirety of the device is concentrated on the fixed bracket, which is projected to the corner end portion. In addition, the awning support frame is hung by a wire rope, and therefore, the entire device easily moves left or right when the canvas is spread, in particular, the system is easily subjected to the effects of wind, and thus unstable. In addition, the entire device is hung by a wire rope and pulled up to the corner end portion so as to be stored upside-down in a vertical position, and therefore, there is a concern that the device might fall on somebody's head, taking into consideration the possibility that the wire rope being cut after deterioration. In addition, the rear of the whole device is exposed to the surface of the corner end portion at the time of upside-down storage, and thus, the appearance at the time of storage is poor.

Therefore, the present inventors have proposed a foldable arm type and a single type movable awning device where a corner canvas in a projected corner portion (hereinafter referred to as "projected corner canvas") is pushed out diagonally forward and in parallel to the corner space portion so as to spread while being unwound, or conversely, the spread projected corner canvas is drawn in diagonally backward and in parallel so as to be wound and stored while being wound, and thus, the above described technical problems can be addressed (see International Patent Application 1 below).

In addition, the inventors have proposed a foldable arm type and a complex type movable awning device gained by further developing and technically improving the above described prior art invention, and furthermore, it is made possible for the projected corner portion of a building and a linear section adjacent to the projected corner portion, a projected corner portion and a recessed corner portion, or the outside of a building, including two projected corner portions, to be efficiently covered with a projected corner canvas, a rectangular canvas and a recessed corner canvas, so that a better appearance can be provided (see International Patent Application 2 below).

Recently the ideas used for the above described single type and complex type movable awning devices have been changed, and new single type and complex type movable awning devices have been proposed, which are provided with a transverse sliding structure where a projected corner canvas which is spread from the wall side portion to the front is moved forward so as to be project into a corner space portion or to move backward so as to be wound up for storage when the canvas is stored (see International Patent Applications 3 and 4 below).

In the case of the complex awning devices described in these International Patent Applications 3 and 4, front bars for a number of canvases which relates to combinations, such of a projected corner canvas and a rectangular canvas or a recessed corner canvas, two projected corner canvases located on the two sides, front and rear, and a rectangular canvas in the middle portion, and furthermore, two projected corner canvases which are combined back-to-back so as to be located in the front and rear, are slidable relative to each other.

However, the winding rollers for winding these are formed so that a number of winding rollers which are supported by bearings at appropriate intervals in the up-down direction independently and separately wind and unwind individual canvases.

LIST OF PRIOR APPLICATIONS

International Patent Application 1: PCT/JP2004/9751 (filed Jan., 7, 2004)

International Patent Application 2: PCT/JP2005/4843 (filed Oct. 3, 2005)

International Patent Application 3: PCT/JP2005/18599 (filed Mar. 10, 2005)

International Patent Application 4: PCT/JP2005/18997 (filed Nov. 10, 2005)

Therefore, the present invention provides a complex awning device (hereinafter simply referred to as "complex device") where projected corner canvases from among a number of canvases which relate to the above described combination are made so as to be freely and transversely slidable, while the number of canvases which include the projected corner canvases can be wound and unwound around single winding rollers, and thus integrated into one complex device.

In addition, the present invention also provides a winding roller for a number of canvases which forms the main portion of the invention and is useful as a single product which can replace another roller.

In addition, accessory devices for dealing with various technological problems which relate to implementation of the present invention are also provided.

Means for Solving Problem

Concerning invention relating to complex devices SQII1 to 10 and SQL1 and 2 in first group (hereinafter referred to as first invention) and effects thereof.

Here, the symbols attached at the end of each section within parentheses indicate the embodiments of the disclosed complex devices and the winding rollers.

The first invention is characterized by being formed in such a manner so that (1) . . . winding rollers J1, J2 and J4 to J7 for winding and unwinding projected corner canvases G1 and G2 and rectangular canvases P1 and P2 in such a state that they overlap are supported by bearings, the above described rectangular canvases P1 and P2 are attached to these winding rollers J1, J2 and J4 to J7, and sliders 12 and 12*a* which are freely slidable and to which the above described projected corner canvases G1 and G2 are attached, the front bar R2 for the above described rectangular canvases P1 and P2 is supported by the foldable arms V1, V2, Y1, Y2, Z1, Z2, Z3 and Z4 in such a manner so as to be freely translatable, and the front bar F2 for the projected corner canvases G1 and G2 is formed in the above described front bar R2 so as to be freely slidable (SQII1 to 10, SQL1 and 2).

As a result, the outside of the building which includes a corner space portion of the corner space portion N1 is integrally covered, so that the appearance is improved, and the canvases are stored in a compact space in a portion near the wall, without protruding from the projected corner portion N1 when stored.

In the process of operation of the first invention, (2) . . . the projected corner canvases G1 and G2 and the rectangular canvases P1 and P2 that are wound around the winding rollers J1, J2 and J4 to J7 are unwound so as to spread, and from among these, the spread projected corner canvases G1 and G2 are transversely slid along the above described winding rollers J1, J2 and J4 to J7 and the front bar R2 for the rectangular canvases P1 and P2, and thus projected to the outside of the building which includes a corner space portion of the projected corner portion N1.

In addition, (3) . . . the projected corner canvases G1 and G2 that are projected to the outside of the building which includes a corner space portion of the projected corner portion N1 are transversely slid to the rear along the winding rollers J1, J2 and J4 to J7 and the front bar R2 for the rectangular canvases P1 and P2 while maintaining the spread state, and then wound around the above described winding rollers J1, J2 and J4 to J7 in such a state that the projected corner canvases G1 and G2 and the rectangular canvases P1 and P2 overlap.

As a result of the above described (2) and (3), the operation of unwinding and spreading the projected corner canvases G1 and G2 and the rectangular canvases P1 and P2 and the forward movement of the spread projected corner canvases G1 and G2 into the corner space portion, in addition to the backward movement of the projected corner canvases G1 and G2 that are spread into the corner space portion and the operation of winding the two canvases G1, G2, P3 and P4, can be carried out smoothly.

Concerning invention relating to complex devices SUII1 and 2 in second group (hereinafter referred to as second invention) and effects thereof.

In the second invention, (4) . . . the rectangular canvases P1 and P2 described in the above (1) are replaced with recessed corner canvases P3 and P4 (SUII1 and 2).

As a result, the outside of the building between the corner space portion of the projected corner portion N1 and the corner space portion of the recessed corner portion L is integrally covered so that the appearance is improved and the canvases are stored in a compact space in the wall without protruding from the projected corner portion N1 at the time of storage.

In the process of operation of the second invention, (5) . . . the projected corner canvases G1 and G2 as well as recessed corner canvases P3 and P4 that have been wound around the winding rollers J1, J2 and J4 to J7 are unwound and spread, and from among these, the spread projected corner canvases G1 and G2 are transversely slid along the above described winding rollers J1, J2 and J4 to J7 and the front bar R2 of the recessed corner canvases P3 and P4, and thus, projected to the outside of the building including the corner space portion of the projected corner portion N1.

In addition, (6) . . . the projected corner canvases G1 and G2 protruding to the outside of the building that includes the corner space portion of the projected corner portion N1 are transversely slid to the rear along the winding rollers J1, J2 and J4 to J7 and the front bar R2 of the recessed corner canvases P3 and P4 while maintaining the spread state thereof, and then, the projected corner canvases G1 and G2 as well as the recessed corner canvases P3 and P4 are wound around the above described winding rollers J1, J2 and J4 to J7 in such a state that the canvases overlap.

As a result of the above described (5) and (6), the operation of unwinding and spreading the projected corner canvases G1 and G2 and the recessed corner canvases P3 and P4 and the forward movement of the spread projected corner canvases G1 and G2 into the corner space portion, in addition to the backward movement of the projected corner canvases G1 and G2 that are spread into the corner space portion and the operation of winding the two canvases G1, G2, P3 and P4, can be carried out smoothly.

Concerning Invention Relating to Complex Device SQSIV in Third Group (Hereinafter Referred to as "Third Invention") and Effects Thereof The third invention is characterized in that (7) . . . winding rollers J1, J2 and J4 to J7 for winding and unwinding two projected corner canvases G1 or G2 and G11, front and rear, and the rectangular canvases P1 and P2 are in such a state that the canvases overlap are supported by bearings, and the above described rectangular canvases P1 and P2 are attached to these winding rollers J1, J2 and J4 to J7, and at the same time, sliders 12 and 12*a*, to which the above described projected corner canvases G1, G2 and G11 are attached to and freely slidable along, are incorporated, and the front bar R2 of the above described rectangular canvases P1 and P2 is supported by foldable arms V1 to V4, Y1, V2, V3 and Y4 so as to be freely translatable, and at the same time, the front bar F2 of the projected corner canvases G1, G2 and G11 is formed in the above described front bar R2 so as to be freely slidable (SQSIV).

As a result, the outside of a building where the two end portions, front and rear, are projected corner portions N1 and N2 and the portion between them becomes a straight line section having an appropriate length is integrally covered so that the appearance is improved.

In the process of operation of the third invention, (8) . . . two projected corner canvases G1 or G2, front and rear, and rectangular canvases P1 or P2, that have been wound around the winding rollers J1, J2 and J4 to J7 are unwound and spread, and from among these, the spread projected corner canvases G1, G2 and G11 are transversely slid along the above described winding rollers J1, J2 and J4 to J7 and the front bar R2 of the rectangular canvases P1 and P2 in the two directions, front and rear, and thus, projected to the outside of the building which includes the corner space portions of the two projected corner portions N1 and N2.

In addition, (9) . . . the projected corner canvases G1, G2 and G11 protruding to the outside of the building that includes the corner space portions of the two projected corner portions N1 and N2 are transversely slid along the winding rollers J1, J2 and J4 to J7 and the front bar R2 of the rectangular canvases P1 and P2 to the center portion of the device while maintaining the spread state thereof, and then, the two projected corner canvases G1 and G2 and the rectangular canvases P1 and P2 are wound around the above described winding rollers J1, J2 and J4 to J7 in such a state that the canvases overlap.

As a result of the above described (8) and (9), the spreading operation of the projected corner canvases G1, G2 and G11 located front and rear and the rectangular canvas P1 or P2, three canvases in total, and movement of the spread projected corner canvases G1, G2 and G11 to the corner space portion in addition to the movement of the two projected corner canvases G1 and G2 projecting to the corner space portion to the center of the device and the operation of winding the canvases G1, G2 and P1 or P2, three canvases in total, in such a state that the canvases overlap can be carried out smoothly.

Concerning Invention Relating to Complex Device SSII in Fourth Group (Hereinafter Referred to as Fourth Invention) and Effects Thereof The fourth invention is characterized in that (10) . . . the winding roller J3 for winding and unwinding the two projected corner canvases G1 and G11, front and rear, in such a state that the canvases overlap is supported by bearings, and sliders 12 and 12*w*, to which the above described projected corner canvases G1 and G11 are respectively attached and which are freely slidable, are incorporated into the above described winding roller J3, and the transverse guide rail R4 for supporting the respective front bars F2 and F3 of the above described projected corner canvases G1 and G11 is supported by foldable arms V1, V2, Y1 and Y2 so as to be freely translatable, and the two front bars F2 and F3 of the projected corner canvases G1 and G11 are formed in the above described transverse guide rail R4 so as to be freely slidable relative to each other (SSII).

As a result, the outside of the building where the two end portions, front and rear, are the projected corner portions N1 and N2 and the distance between these is a relatively short straight line section is integrally covered so that the appearance is improved.

In the process of operation of the fourth invention, (11) . . . the two projected corner canvases G1 and G11 that have been wound around the winding roller J3 are unwound and spread, and the two spread projected corner canvases G1 and G11 are transversely slid relative to each other in the two directions, front and rear, along the above described winding roller J3 and the transverse guide rail R4, and thus, projected to the outside of the building that includes the corner space portions of the two projected corner portions N1 and N2.

In addition, (12) . . . the projected corner canvases G1 and G11 projecting to the outside of the building that includes the corner space portions of the two projected corner portions N1 and N2 are transversely slid relative to each other in the two directions, front and rear, along the winding roller J3, the transverse guide rail R4 and the front bars F2 and F3 while maintaining the spread state thereof, and then, the two projected corner canvases G1 and G2 are wound around the above described winding roller J3 in such a state that the canvases overlap.

As a result of the above described (11) and (12), the operation of spreading the two projected corner canvases G1 and G11, front and rear, and the transverse movement of the spread projected corner canvases G1 and G11 to the corner space portion in addition to the transverse movement of the two projected corner canvases G1 and G11 protruding into the corner space portion, front and rear, relative to each other and the winding operation of the two canvases G1 and G11 in such a state that the canvases overlap can be carried out smoothly.

Next, the inventions according to the dependent claims concerning the winding rollers J1 to J7 of a number of canvases G1, G2, G11 and P1 to P4 and the sliders 12, 12*a* and 12*w* which are incorporated into these rollers J1 to J7 are listed.

(13) . . . canvas engaging trenches 110 for the rectangular canvases P1 and P2 or the recessed corner canvases P3 and P4 and a slide guide path 112 with a slit 111 are created parallel to each other in the winding rollers J1, J2 and J4 to J7 in the direction of the axis, and from among these, the sliders 12 and 12*a* of the projected corner canvases G1, G2 and G11 are incorporated into the slide guide path 112.

(14) . . . slide guide paths 112 in two parallel columns are created in the winding roller J3 in the direction of the axis, and the sliders 12 and 12*w* of the projected corner canvases G1 and G11 are incorporated into the respective slide guide paths 112.

(15) . . . a canvas engaging trench 121, into which the top hems 1 of the projected corner canvases G1, G2 and G11 are attached, is created in the center protrusions of the sliders 12, 12*a* and 12*w*, and the wing plate portions 123 which protrude to the two sides of the sliders 12, 12*a* and 12*w* are inserted into the side wall portions of the slide guide paths 112.

(16) . . . wing plate portions 123 having a slit trench 122 protrude from the two sides of the sliders 12, 12*a* and 12*w*, small wheels 124 are attached at appropriate intervals to the slit trench 122 so as to be freely rotatable, and the small wheels 124 are engaged in the rail trench 113 created in the side wall portion of the slide guide paths 112.

As a result of the above described (13) to (16), smoothly transverse sliding of the spread projected corner canvases G1 and G2 can be secured without fail.

In addition, the inventions according to the dependent claims concerning the projected corner canvases G1, G2 and G11, the winding rollers J1 to J7 and other concrete configurations of the present invention are listed in the following.

(17) . . . the projected corner canvases G1 and G11 are formed of a canvas main body portion X1 in rectangular form and a canvas protrusion X2 which protrudes to one side in such a state that they are in an approximate right angle trapezoid form when spread, the top hems 1 of the projected corner canvases G1 and G11 are attached to the sliders 12 and 12*w*, and the bottom hems 2 of the canvases are attached to the front bars F2 and F3.

(18) . . . connection members, such as wires 193 and 194 and belts, are stretched between the sliders 12 and 12*w* and the front bars F2 and F3.

(19) . . . the projected corner canvas G2 is formed in an approximate triangular form when spread, connection wires 541 and 542 penetrate through the diagonal portions 3*a* and 3*b* of the triangular canvas G2, the base end portions of these wires are attached to the two end portions, front and rear, of a relatively short slider 12*a*, and the front end portions of the wires are attached to the front bars F2 and F3 in the vicinity of the two ends, front and rear, of the bottom hem 2*a* of the canvas.

As a result of the above described (17) to (19), the corner space portion of the projected corner portion N1 is covered with the projected corner canvases G1 and G11 in a right angle trapezoid form and the projected corner canvas G2 in a triangular form in such a state that the appearance becomes excellent, and in addition, the projected corner canvases G1, G2 and G11 can be prevented from changing in form within the plane when the canvases are wound and transversely slid, and thus, a smooth transverse movement is made possible.

In addition, the projected corner canvases G1, G2 and G11 are well-balanced when being wound and unwound, and the spread projected corner canvases G1, G2 and G11 are supported in a tense state.

Here, substitute means which have the same function as the sliders 12, 12*a* and 12*w* of the present invention and of which the configurations are simplified are listed.

(20) . . . the sliders 12, 12*a* and 12*w*, to which the top hems 1 of the projected corner canvases G1, G2 and G11 are attached, are replaced with the slide caps 12*x* which are engaged in the top hems 1 of the projected corner canvases G1 and G2.

(21) . . . canvas engaging trenches 110 for the rectangular canvases P1 and P2 or the recessed corner canvases P3 and P4 and slide guide paths 114 are created in the winding roller J8 into which a slide cap 12*x* is incorporated, and slide caps 12*x* which are engaged in the top hems 1 of the projected corner canvases G1, G2 and G11 are incorporated in the slide guide paths 111 and 114 from among the above described trenches and paths.

(22) . . . the projected corner canvases G1 and G11 are formed of a canvas main body portion X1 in a rectangular form and a canvas protruding portion X2 which protrudes to one side of the canvas main body portion in an approximate right angle trapezoid form when spread, and connection members, such as wires 193 and 194 and a belt, are stretched between the slide caps 12*x* which are engaged in the top hems 1 of the projected corner canvases G1 and G11 and the front bars F2 to which the bottom hems 2 of the projected corner canvases G1 and G11 are attached.

(23) . . . the projected corner canvas G2 is formed in an approximate triangular form when spread, and connection wires 541 and 542 penetrate through diagonal portions 3*a* and 3*b* of the triangular canvas G2, the base end portions of these wires are attached to the two end portions, front and rear, of the slide cap 12*x*, and the front end portions of the wires are attached to the front bars F2 in the vicinity of the two ends, front and rear, of the bottom hem 2*a* of the canvas.

In these cases, the corner space portions of the projected corner portions N1 and N2 are covered with the projected corner canvas G1 in a right angle trapezoid form and the projected corner canvas G2 in a triangular form in such a state that the appearance becomes excellent in the same manner as in the above described cases, and in addition, the projected corner canvases G1, G2 and G11 can be prevented from changing in form within the plane when the canvases are wound and transversely slid, and a smooth transverse movement is made possible.

In addition, the projected corner canvases G1, G2 and G11 are well-balanced when being wound and unwound, and the spread projected corner canvases G1, G2 and G11 are supported in a tense state.

(24) . . . a bulk member of the roller main body 11 is attached to the winding rollers J1, J2 and J4 to J8.

(25) . . . the bulk member is a bulk ring 331 in spiral form, and the outer diameter of this ring increases step by step from the vicinity of the middle of the winding rollers J1, J2 and J4 to J8 towards the end portion of the roller or the two end portions, front and rear.

(26) . . . a bulk cloth 32 is attached to the diagonal portions 3 of the projected corner canvases G1 and G11.

As a result of the above described (24) to (26), the projected corner canvases G1 and G11 in a right angled trapezoid form can be well-balanced and made uniform when being wound.

(27) . . . a manually operable device or an electrically driven device for winding or unwinding a number of canvases G1, G2, G11 and P1 to P4 is incorporated into the axis end portion of the winding roller J1 into which the sliders 12, 12*a* and 12*w* are incorporated.

(28) . . . an electrically driven motor M1 for winding or unwinding a number of canvases G1, G2, G11 and P1 to P4 is incorporated inside the winding rollers J2 and J3 into which the sliders 12, 12*a* and 12*w* are incorporated.

(29) . . . a motor output axis 271 and an axis portion 272 for fixture are provided in the two end portions, front and rear, of the electrically driven motor M1, and the movement conveying socket 281 which is engaged in one motor output axis 271 is engaged inside the roller main body 11, and the rear end portion of the above described electrically driven motor M1 is inserted into the end cap 152 of the roller main body 11 while the other axis portion 272 for fixture is engaged with the end cap 142 of the casing K1 for storing the winding rollers J2 and J3.

Next, the configurations where the spread projected corner canvases G1, G2 and G11 are transversely slid to the corner space portions and slid backwards from the corner space portions as well as the inventions according to the dependent claims concerning these transverse devices are listed in the following.

(30) . . . stopping portions 241 for transverse movement operations of the projected corner canvases G1, G2 and G11 are provided in the front bars F2 and F3.

(31) . . . stopping flaps 242 for transverse movement operations of the projected corner canvases G1 and G11 are provided in the vicinity of the top hems 1 of the projected corner canvases G1 and G11.

(32) . . . movement conveying members 561, 562 and 66, such as ropes and wires, which transversely slide the front bars F2 and F3 of the projected corner canvases G1, G2 and G11 are stretched between foldable arms V1, Y1 and Z1 on one side and the front bars F2 and F3.

(33) . . . one of the movement conveying members 561 and 562 is used for backward movement and the other for forward movement, and they hang from the vicinity of the base end portions of the foldable arms V1 and Y1.

(34) . . . winding reels 60, 60*a* and 60*b* of the movement conveying wires 561 and 562 are attached to the end portions of the winding rollers J4 to J7, and these winding reels 60, 60*a* and 60*b* are rotated forwards and backwards, and thus, the spread projected corner canvases G1 and G2 are transversely slid.

(35) . . . movement conveying wires 561 and 562 for transversely sliding the front bars F2 and F3 backward and frontward are stretched between one of the foldable arms V1 and Y1 and the front bars F2 and F3 of the projected corner canvases G1, G2 and G11, and winding reels 60, 60*a* and 60*b* for winding one of the movement conveying wires 561 and 562 and unwinding the other is attached to the end portion of the winding rollers J4 to J7.

(36) . . . an electrically driven motor M4 for rotating forward and backward the winding reel 60 for winding one of the movement conveying wires 561 and 562 and unwinding the other and an electrically driven motor M1 for rotating forward and backward the winding roller J4 for winding and unwinding the projected corner canvases G1 and G2 are incorporated into the winding roller J4.

(37) . . . the rear half portion of the main body of the electrically driven motor M4 is inserted into the end portion of the winding roller J4 and the winding reel 60 is engaged with and secured to the front half portion of the main body of this electrically driven motor M4 and the front end axis portion 591 of this electrically driven motor M4 is secured to the end cap 146 of the casing K1.

(38) . . . one electrically driven motor M5 or M6 for rotating the winding rollers J5 to J7 and the winding reels 60, 60*a* and 60*b* forward and backward or a driving axis 73 is incorporated in the winding rollers J5 to J7, and when the movement of either the above described winding rollers J5 to J7 or the winding reels 60, 60*a* and 60*b* is regulated from the outside and thus the rotations thereof are stopped, the other winding rollers J5 to J7 and any of the winding reels 60, 60*a* and 60*b* recoil or rotate backward.

(39) . . . a means for regulating the rotation of the winding rollers J5 to J7 from the outside is made up of a rotation stopper 611 which is attached to the rear end portion of the winding rollers J5 to J7 and a guide protrusion 135 with which this rotation stopper 611 engages, and this guide protrusion 135 is provided in the inner wall portion on the rear surface of the casing K1 for winding and storing the projected corner canvases G1 and G2.

(40) . . . the rear half portion of the main body of the electrically driven motor M5 is inserted into the end portion of the winding roller J5, and the rear end output axis 594 of this electrically driven motor M5 is engaged into and secured to a movement conveying socket 281 which is inserted into and engaged with the winding roller J5, and a winding reel 60 is engaged with and secured to the front half portion of the main body of this electrically driven motor M5 and the front end supporting axis 593 of this electrically driven motor M5 is supported by the end cap 146 of the casing K1 for storing the winding roller J5 via bearings.

(41) . . . a sun gear 70 is engaged with the main body portion of the electrically driven motor M6 or a driving axis 73 which is manually rotated, and an internally-toothed gear 71 is formed in the winding reels 60*a* and 60*b* and a planetary gear 72 which engages with the above described sun gear 70 and the internally-toothed gear 71 is attached to the end portion of the winding rollers J6 and J7.

(42) . . . the rear half portion of the main body of the electrically driven motor M6 is inserted into the end portion of the winding roller J6 and the rear portion of the main body of this electrically driven motor M6 is inserted into and engaged with the movement conveying socket 283 which is inserted into and engaged with the above described winding roller J6, and a winding reel 60*a* is inserted into and engaged with the end portion of the electrically driven motor M6 and the front end axis portion 591 of this electrically driven motor M6 is secured to the end cap 146 of the casing K1 for storing the winding roller J6.

(43) . . . the rear half portion of the driving axis 73 is inserted into the end portion of the winding roller J7 and the portion of the driving axis 73 in the vicinity of the rear end is inserted into and engaged with the movement conveying socket 283 which is inserted into and engaged with the winding roller J7, and the winding reel 60*b* is inserted into and engaged with a portion of this driving axis 73 which is close to the front end, and at the same time, manually operable gear devices 161 and 162 are formed and the end portion of the above described driving axis 73 is supported by the end cap 146 of the casing K1 for storing the winding roller J7 via bearings.

(44) . . . the end cap 146 which works as a casing for the above described winding reels 60, 60*a* and 60*b* is attached to the front end portion of the casing K1 for the winding rollers J4 to J7 into which the winding reels 60, 60*a* and 60*b* are incorporated and guide long holes 148 and 149 through which movement conveying wires 561 and 562 for the above described winding reels 60, 60*a* and 60*b* penetrate are created in the bottom portion of the casing.

(45) . . . an fluctuation flap 62 for pushing up the bottom hems 2 and 2*a* of the projected corner canvases G1, G2 and G11 is attached to the rear end of the upper portions of the front bars F2 and F3 of the canvases G1, G2 and G11.

As a result, the canvas on the upper side can be easily prevented from slacking when stored.

(46) . . . an extendable net 631 is fabricated at the rear end of the upper portion of the front bars F2 and F3 of the projected corner canvases G1, G2 and G11 and on the rear surface of the projected corner canvases G1 and G2 close to the bottom hems 2 and 2*a*.

As a result, the canvas on the upper side is supported in a tense state when being spread and no slack is left when stored.

In addition, the inventions according to the dependant claims concerning the mutual relationship between the front bars and the structures thereof are listed in the following.

(47) . . . the front bar F2 for the projected corner canvases G1 and G2 is placed outside and the front bar R2 for the rectangular canvases P1 and P2 or the recessed corner canvases P3 and P4 is placed inside.

(48) . . . an engaging trench 351 in which the bottom hems 2 of the projected corner canvases G1, G2 and G11 are engaged and an engaging trench 352 for the front skirt 221 are respectively created in the front bar F2 on the outside in the longitudinal direction while an engaging trench 381 in which the bottom hems 6 of the rectangular canvases P1 and P2 or the recessed corner canvases P3 and P4 are engaged and an engaging trench 382 for a front skirt 391 are respectively created in the front bar R2 on the inside in the longitudinal direction.

(49) . . . sliding guide trenches 371 and 372 for the front bar F2 on the outside are created in the front bar R2 on the inside in the longitudinal direction.

(50) . . . the front bar F3 for the projected corner canvas G1 is engaged with the transverse guide rail R4 so as to be freely slidable, and the front bar F2 for the projected corner canvas G1 is engaged with the front bar F3 so as to be freely slidable.

(51) . . . an engaging trench 351 in which the bottom hem 2 of the projected corner canvas G1 is engaged and an engaging trench 352 for the front skirt 221 are respectively created in the front bar F2 in the longitudinal direction, and an engaging trench 381 in which the bottom hem 6 of the projected corner canvas G11 is engaged, an engaging trench 382 for the front skirt 391 and slide guide trenches 371 and 372 for the above described front bar F2 are respectively created in the front bar F3 in the longitudinal direction, and slide guide trenches 441 and 442 for the above described front bar F3 are created in the transverse guide rail R4 in the longitudinal direction.

In addition, the inventions according to the dependant claims where the front bar has a rotating structure are listed in the following.

(52) . . . when the front bar F5 on the outside is engaged with and guided along the front bar R5 on the inside so as to be freely rotatable, guide wheels 861 and 862 which horizontally rotate are incorporated in the rear end portion of the above described front bar F5, guide wheels 931 and 932 which horizontally rotate are provided in the front end portion of the above described front bar R5, these guide wheels 931 and 932 rotate on the inner surface of the above described front bar F5, and the above described guide wheels 861 and 862 rotate in the wheel chambers 881 and 882 formed above and beneath the above described front bar R5.

(53) . . . a wheel holder 92 is inserted into and secured to the front end portion of the front bar R5 on the inside, and guide wheels 931 and 932 which horizontally rotate are supported by this wheel holder 92 in the upper and lower end locations via bearings.

Finally, the inventions of winding rollers J1 to J7 for a number of canvases which form the main portion of the above described present invention and are useful as single products which can replace other rollers are listed in the following.

(54) . . . a canvas engaging trench 110 to which the rectangular canvases P1 and P2 or the recessed corner canvases P3 and P4 are attached and a slide guide path 112 are created parallel to the direction of the axis line in the roller main body 11 for winding or unwinding the projected corner canvases G1 and G2 and the rectangular canvases P1 and P2 or the recessed corner canvases P3 and P4 in such a state that the canvases overlap, and the invention is characterized in the sliders 12 and 12*a* for allowing the spread projected corner canvases G1 and G2 to be transversely and freely slidable are incorporated into the slide guide path 112 from among the trenches and the path (J1 to J7).

(55) . . . a manually operable device or an electrically driven device for winding or unwinding the projected corner canvases G1 and G2 and the rectangular canvases P1 and P2 or the recessed corner canvases P3 and P4 in such a state that the canvases overlap is incorporated into the axis end portion of the roller main body 11 into which the sliders 12 and 12*a* are incorporated (J1).

(56) . . . an electrically driven motor M1 for winding or unwinding the projected corner canvases G1 and G2 and the rectangular canvases P1 and P2 or the recessed corner canvases P3 and P4 in such a state that the canvases overlap is incorporated into the roller main body 11 into which the sliders 12 and 12*a* are incorporated (J2).

(57) . . . a motor output axis 271 and an axis portion 272 for fixture are provided in the two end portions, front and rear, of the electrically driven motor M1, where the movement conveying socket 281 which is engaged with one motor output axis 271 is inserted into and engaged with the roller main body 11, the rear portion of the above described electrically driven motor M1 is inserted into and engaged with the end cap 152 of the roller main body 11, and the other axis portion 272 for fixture is inserted into and engaged with the end cap 142 of the casing K1 for winding and storing the projected corner canvases G1 and G2 and the rectangular canvases P1 and P2 or the recessed corner canvases P3 and P4 in such a state that the canvases overlap (J2).

(58) . . . winding reels 60, 60*a* and 60*b* for the movement conveying wires 561 and 562 are incorporated in the front end portion of the roller main body 11 into which the sliders 12 and 12*a* are incorporated, and these winding reels 60, 60*a* and 60*b* are rotated forward and backward and thus the spread projected corner canvases G1 and G2 are transversely slid (J4 to J7).

(59) . . . an electrically driven motor M1 for winding or unwinding the projected corner canvases G1 and G2 and the rectangular canvases P1 and P2 or the recessed corner canvases P3 and P4 in such a state that the canvases overlap and an electrically driven motor M4 for rotating forward and backward a winding reel 60 for winding one of the movement conveying wires 561 and 562 and unwinding the other are incorporated into the roller main body 11 into which the sliders 12 and 12*a* are incorporated (J4).

(60) . . . the rear half portion of the main body of the electrically driven motor M4 is inserted into the front end portion of the roller main body 11, a winding reel 60 is inserted into and fixed to the front half portion of the main body of the electrically driven motor M4, and the front end axis portion 591 of this electrically driven motor M4 is secured to the end cap 146 of the casing K1 (J4).

(61) . . . winding rollers J5 to J7 are provided with the roller main body 11 into which the sliders 12 and 12*a* are incorporated and one electrically driven motor M5 or M6 or a driving axis 73 for rotating the winding reels 60, 60*a* and 60*b* for the movement conveying wires 561 and 562 forward and backward, where the operation of one of the above described roller main body 11 and the winding reels 60, 60*a* and 60*b* is regulated from the outside so that the rotation thereof is stopped so that another one of the roller main body 11 and the winding reels 60, 60*a* and 60*b* recoils or rotates backward (J5 to J7).

(62) . . . the latter half portion of the main body of the electrically driven motor M5 is inserted into the front end portion of the roller main body 11, the rear end output axis 594 for this electrically driven motor M5 is engaged with and secured to the movement conveying socket 281 which is inserted into the roller main body 11, the winding reel 60 is inserted into and secured to the front half portion of the main body of this electrically driven motor M5, and the front end support axis 593 for this electrically driven motor M5 is supported by the end cap 146 of the casing K1 via bearings (J5).

(63) . . . a sun gear 70 is engaged with the main body portion of the electrically driven motor M6 or the driving axis 73 which is manually rotated, an internally-toothed gear 71 is formed in the winding reels 60*a* and 60*b*, and a planetary gear 72 which engages the above described sun gear 70 and the internally-toothed gear 71 are attached to the front end portion of the roller main body 11 (J6 and J7).

(64) . . . the rear half portion of the electrically driven motor M6 is inserted into the front end portion of the roller main body 11, the rear portion of the main body of this electrically driven motor M6 is inserted into and engaged with the movement conveying socket 283 which is inserted into and engaged with the above described roller main body 11, the winding reel 60*a* is inserted into and engaged with the front end portion of this electrically driven motor M6, and the front end axis portion 591 for this electrically driven motor M6 is secured to the end cap 146 of the casing K1 (J6).

(65) . . . the rear half portion of the driving axis 73 is inserted into the front end portion of the roller main body 11, a portion of this driving axis 73 in the vicinity of the rear end is inserted into and engaged with the movement conveying socket 283 which is inserted into the above described roller main body 11, and the winding reel 60*b* is inserted into and engaged with a portion of the driving axis 73 which is close to the front end, at the same time manually operable gear devices 161 and 162 are formed and the front end portion of the above described driving axis 73 is supported by the end cap 146 of the casing K1 via bearings (J7).

BRIEF DESCRIPTION OF THE DRAWINGS

FIGS. 1(A) to 27(D) show foldable arm type complex devices in the first group where an awning device for a projected corner and a rectangular awning device are combined according to embodiments.

Though the canvases are usually opaque, the figures show the canvases in a see-through state if necessary in order to show the configuration on the rear side which would otherwise be hidden. In the same manner, the casings are shown in a see-through state if necessary in order to show a winding roller incorporated in the casing.

Here, though many figures three dimensionally show the awning devices which are attached to frames in L shape, in band plate form, in crank form, in C shape and the like so that the awning device becomes almost horizontal, this is for the sake of convenience in drawing figures. Usually the awning devices are attached so that the spread projected corner canvases and rectangular canvases are secured in such a state as being inclined appropriately or the angle can vary freely.

Figure 1A:
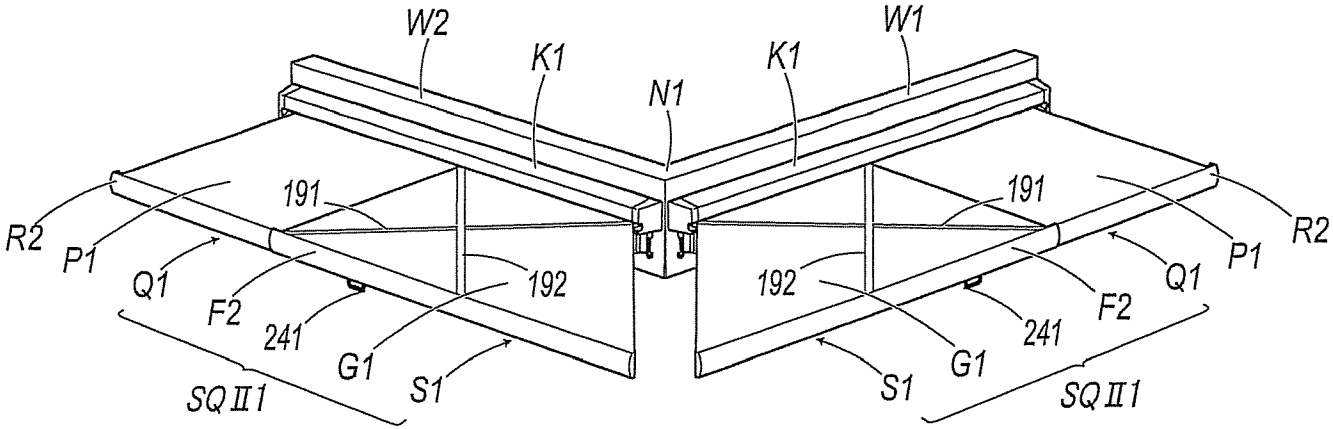
Figure 1B:
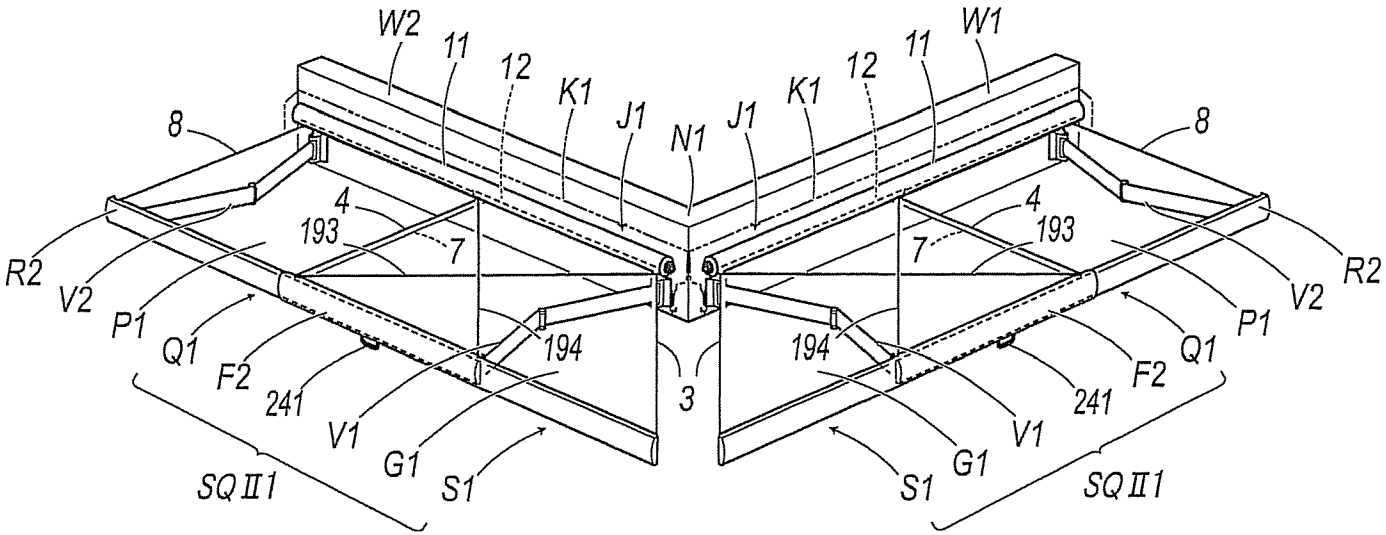
Figure 2A:
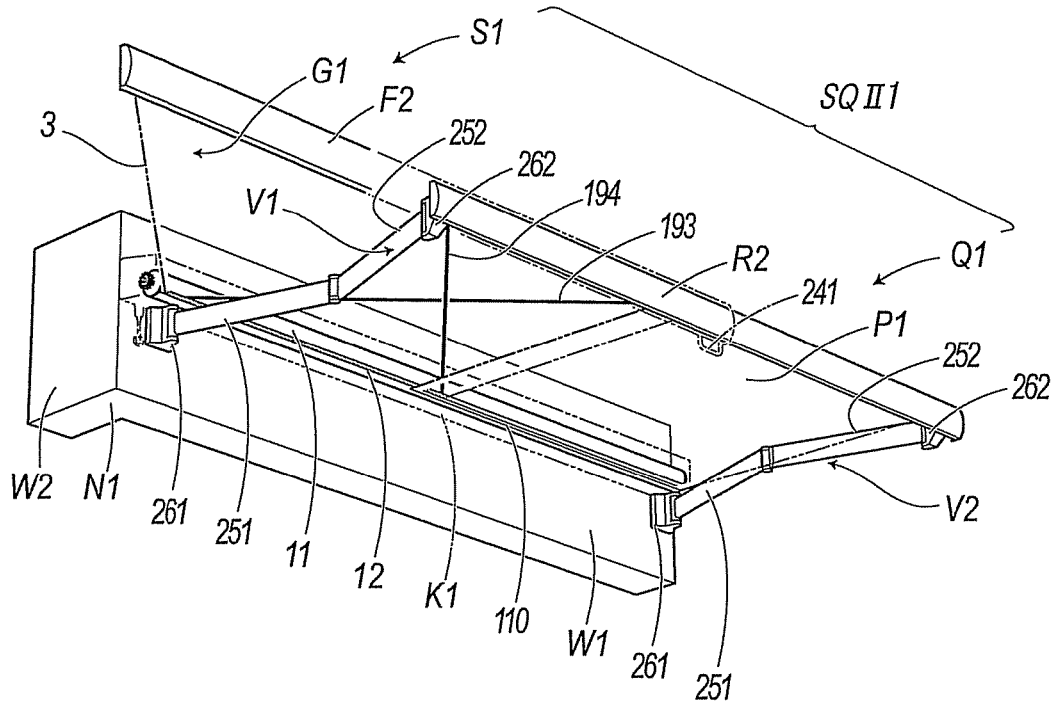
Figure 2B:
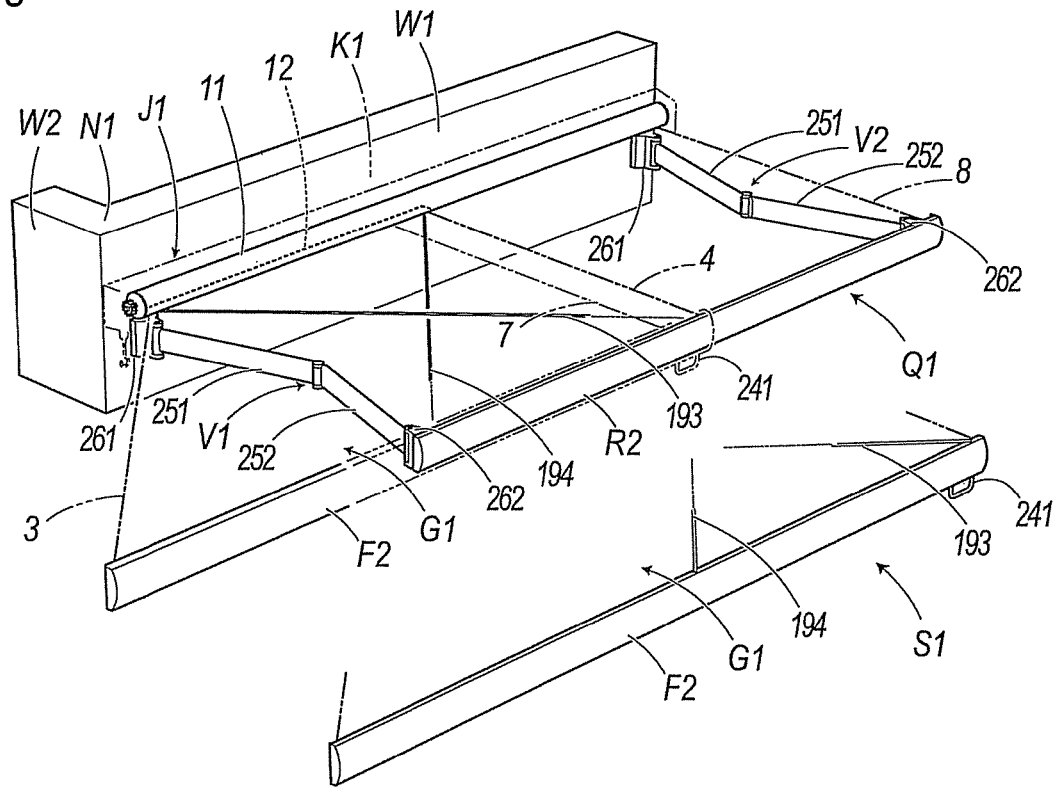
Figure 3A:
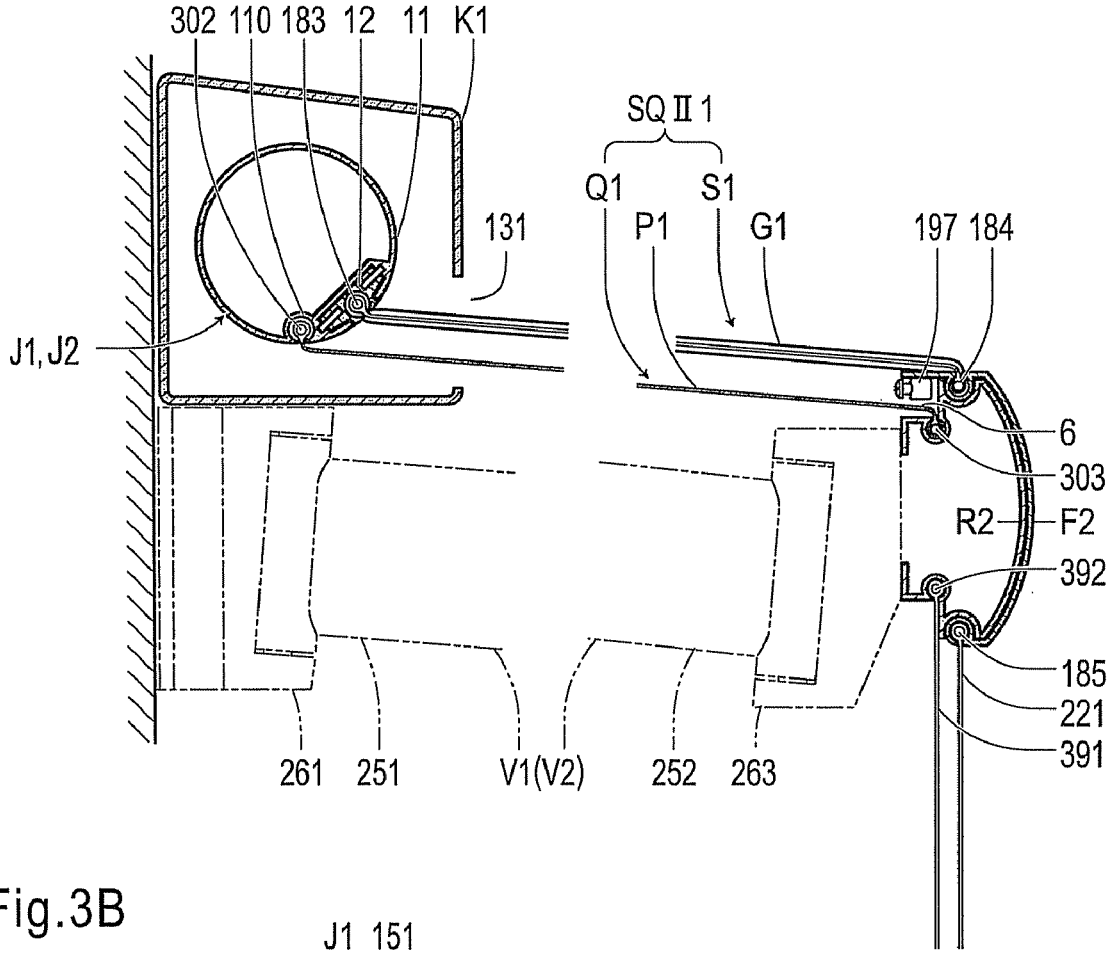
Figure 3B:
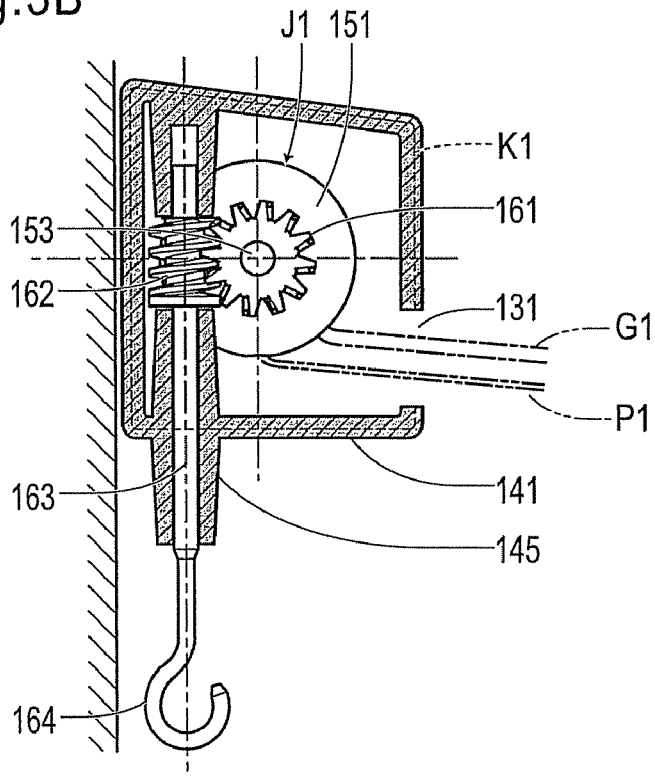
Figure 4A:
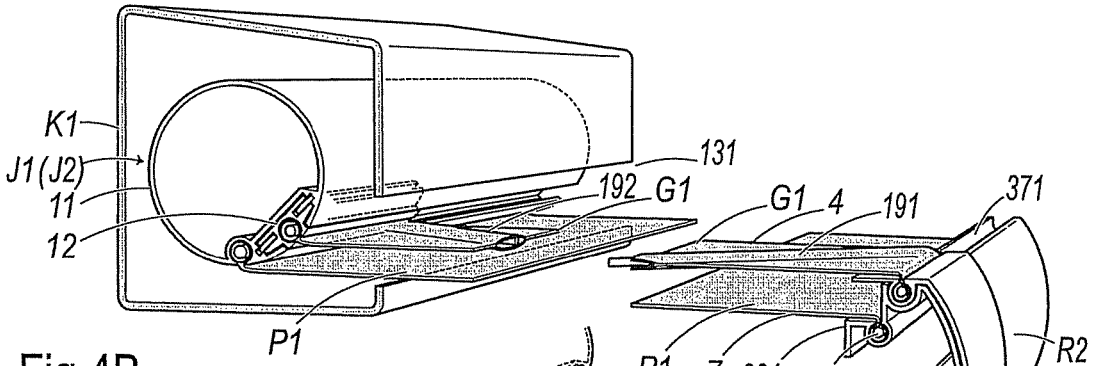
Figure 4B:
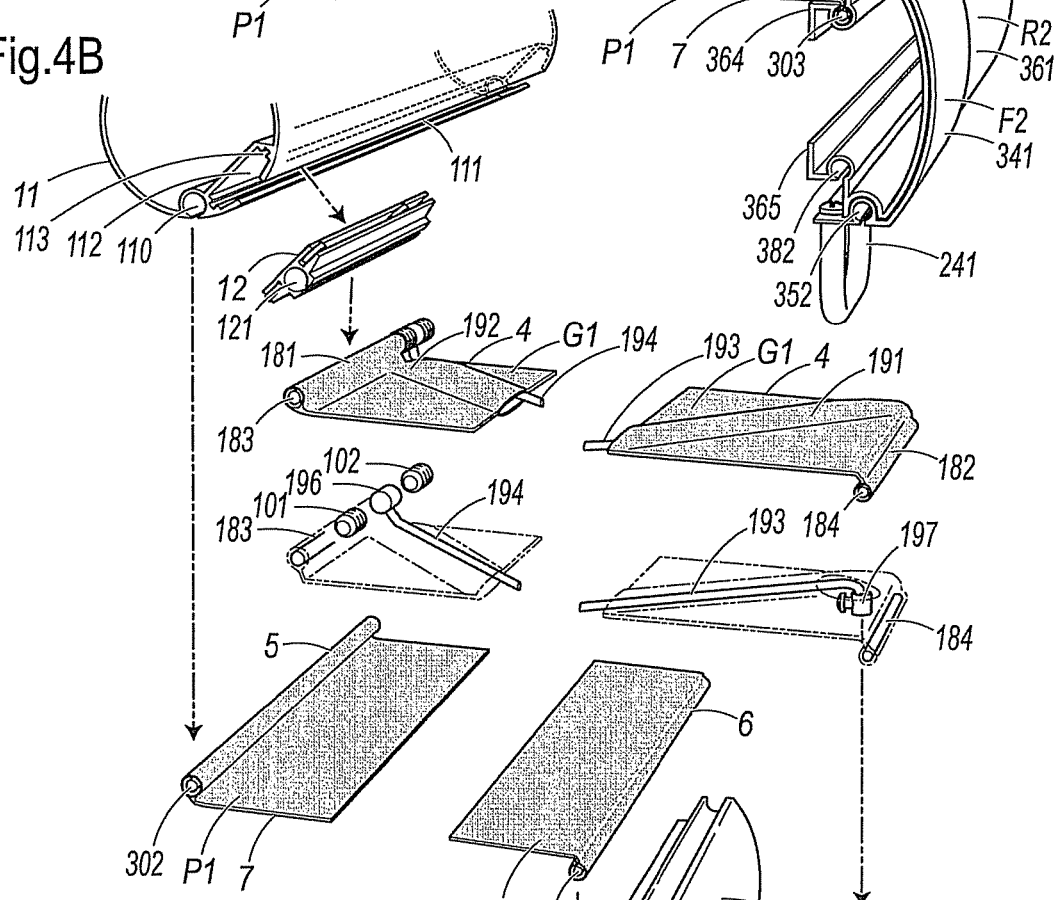
Figure 4C:
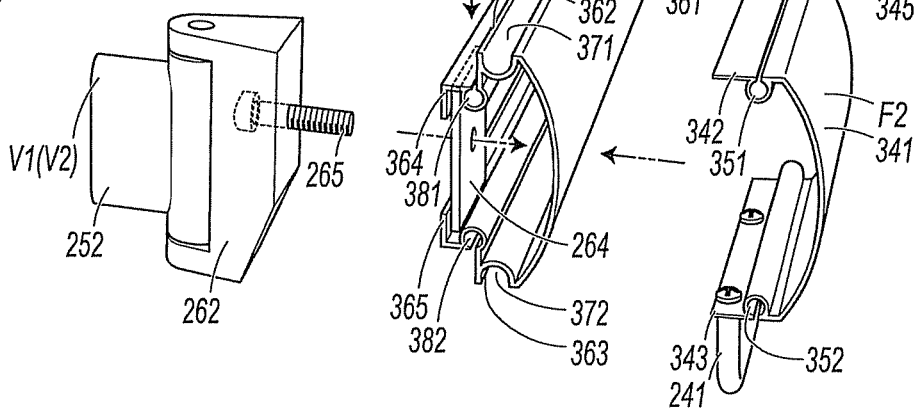
Figure 5A:
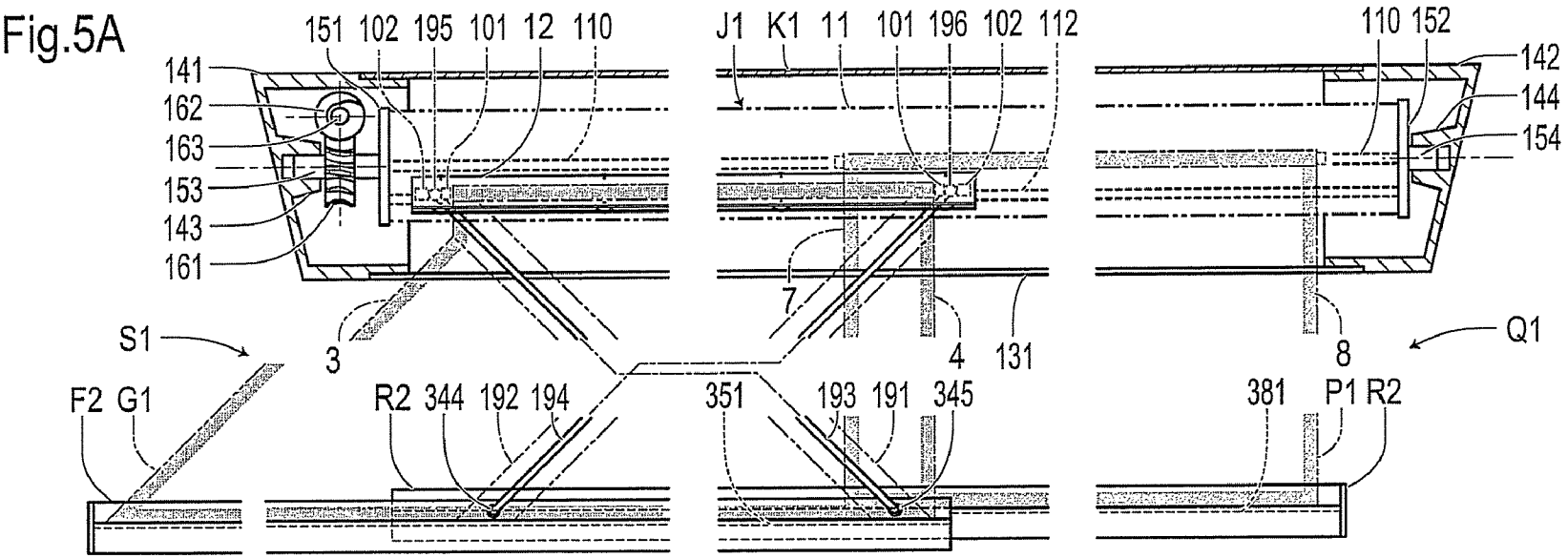
Figure 5B:
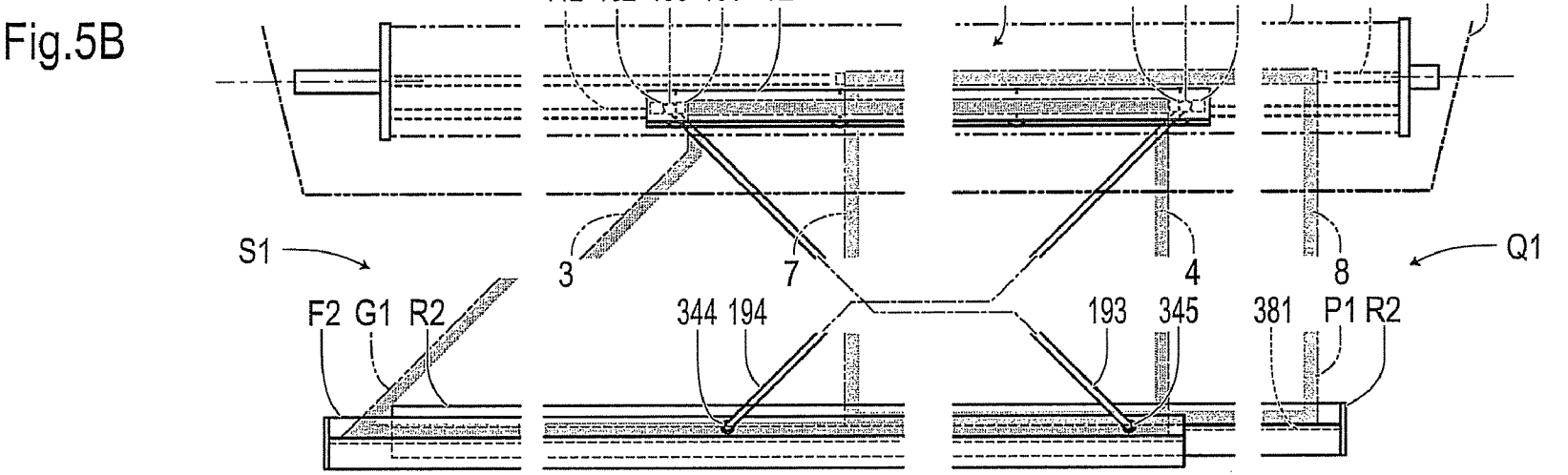
Figures 6A, 6B, 6C:
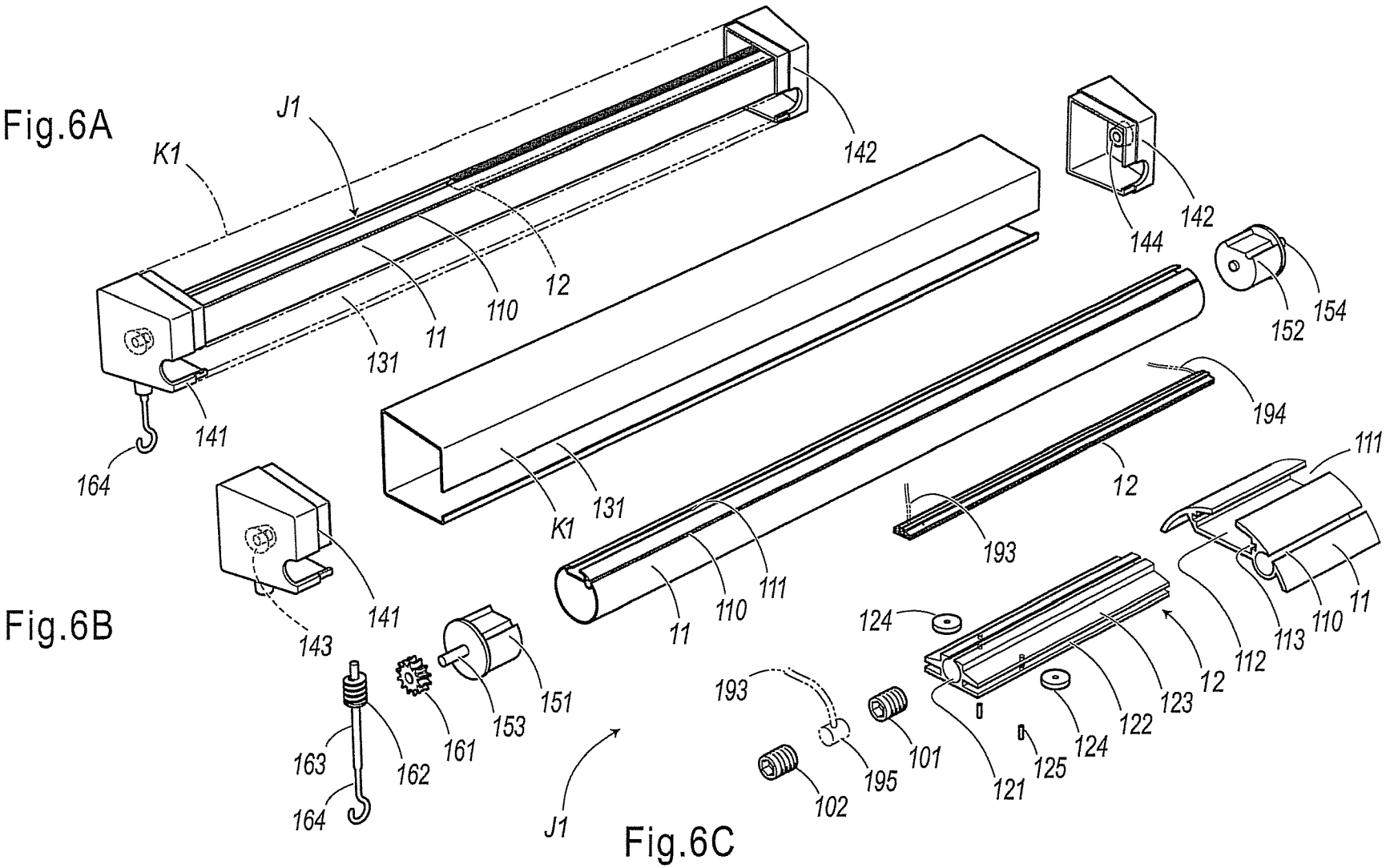
Figure 7A:
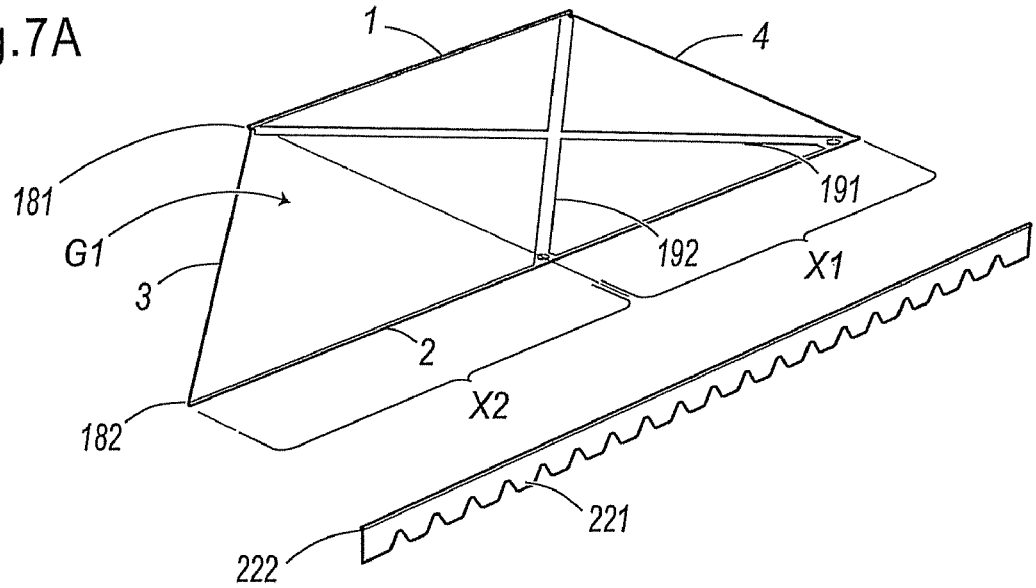
Figure 7B:
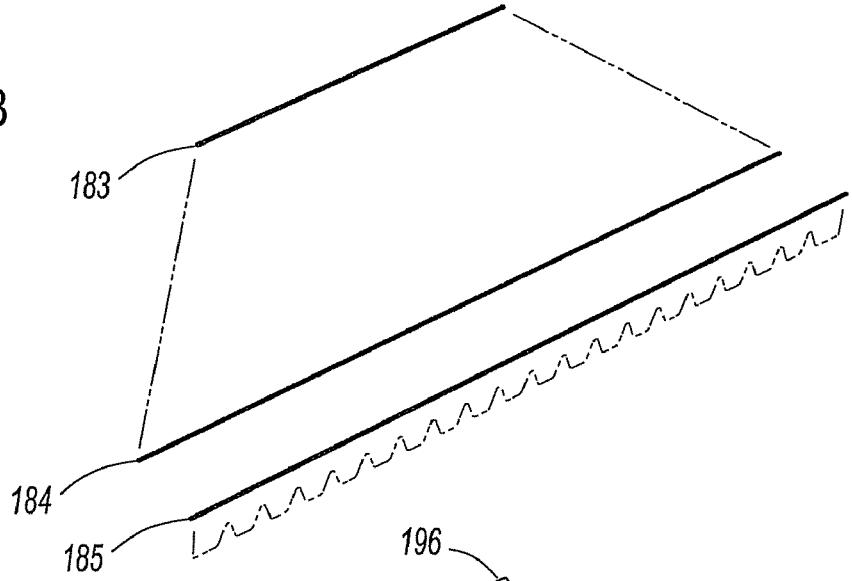
Figure 7C:
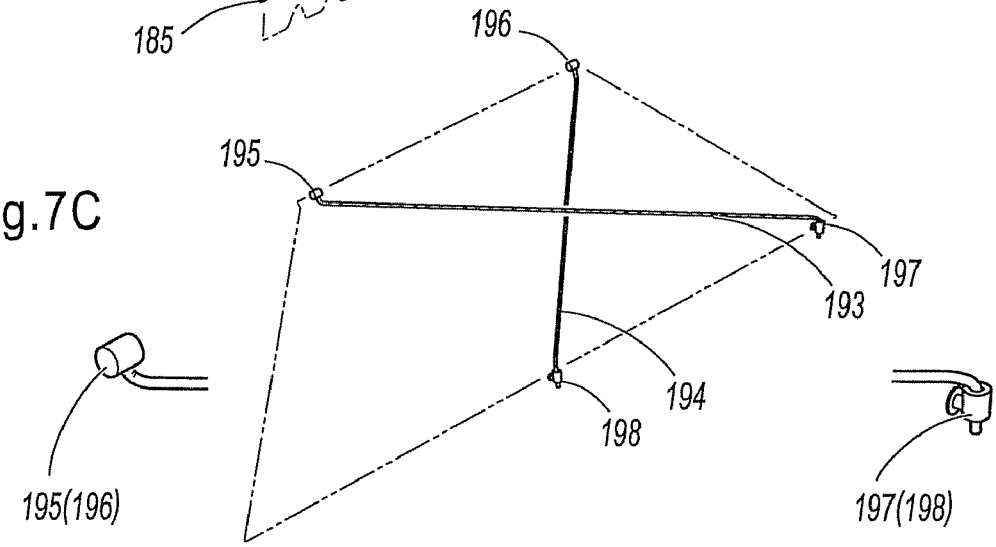
Figure 8A:
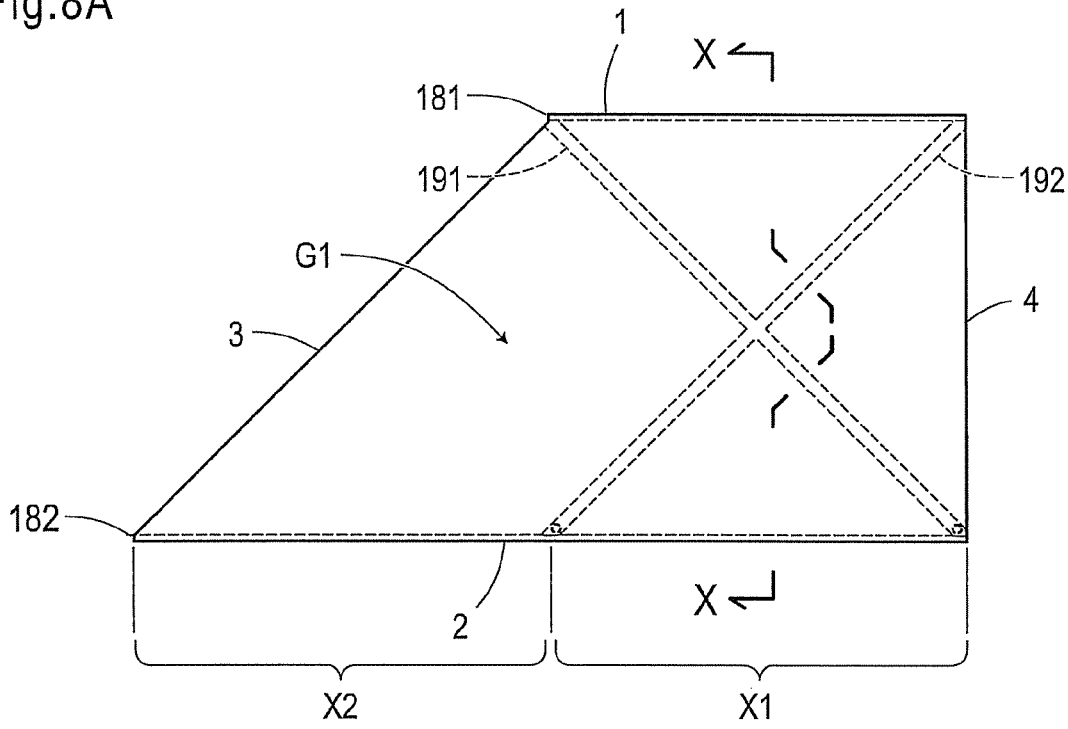
Figure 8B:
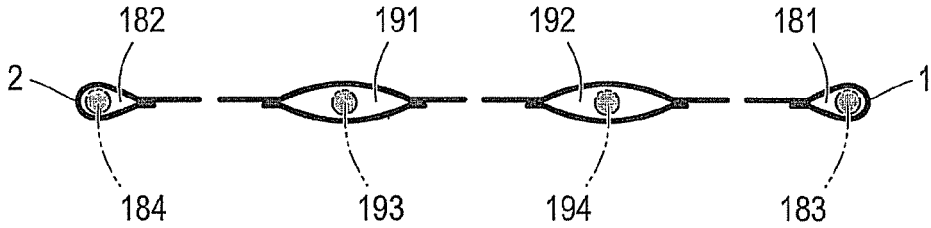
Figure 8C:
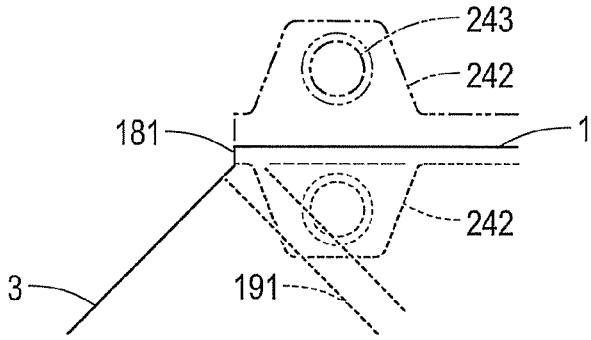
Figures 9A, 9B:
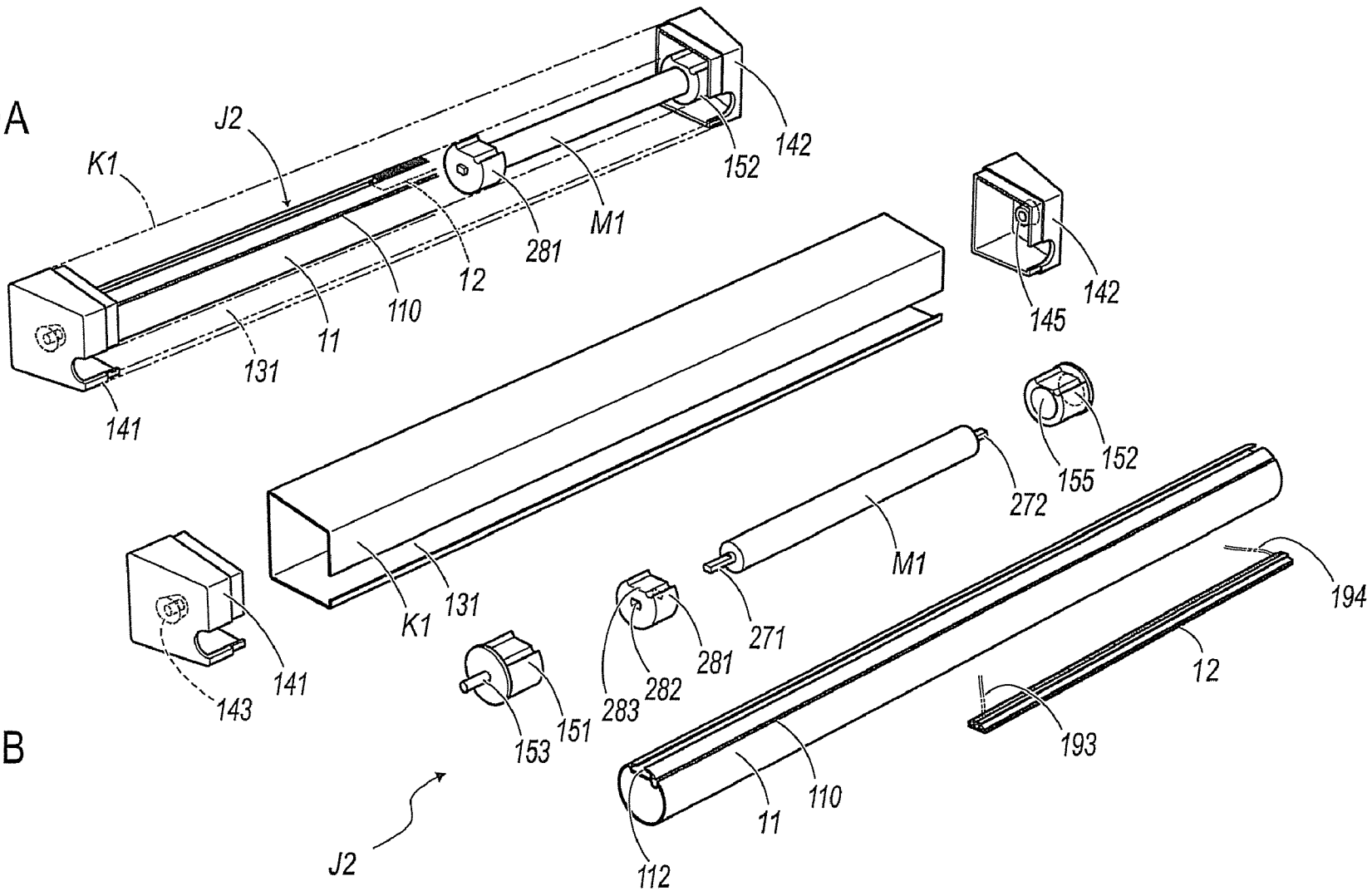
Figure 16A:
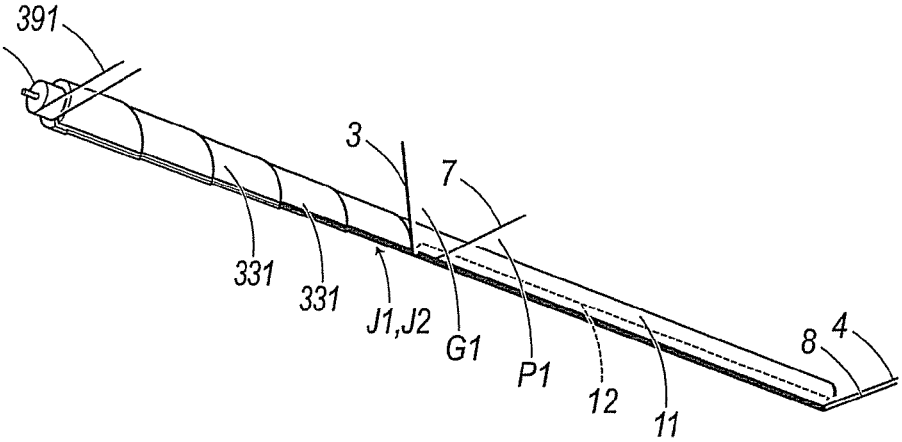
Figure 16B:
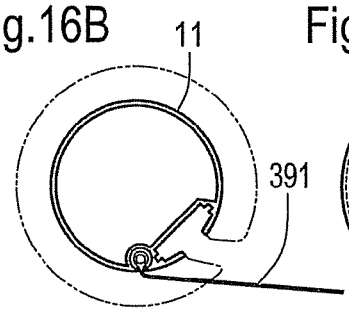
Figure 16C:
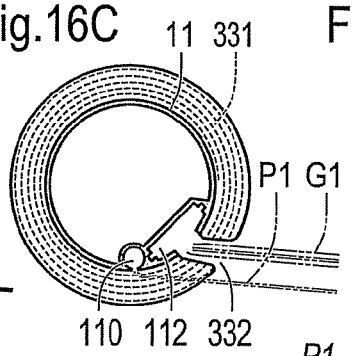
Figure 16D:
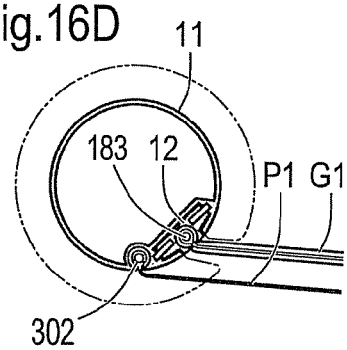
Figure 17A:
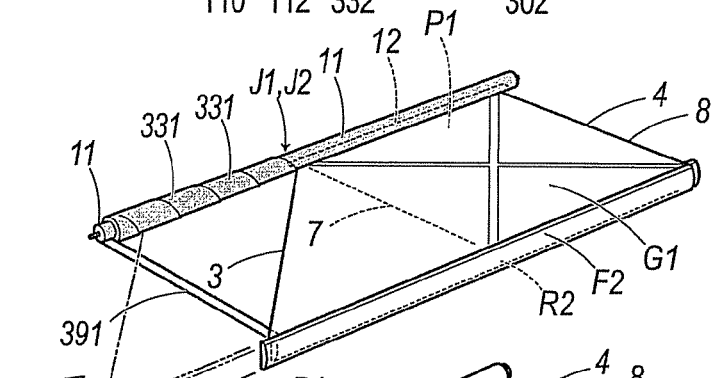
Figure 17B:
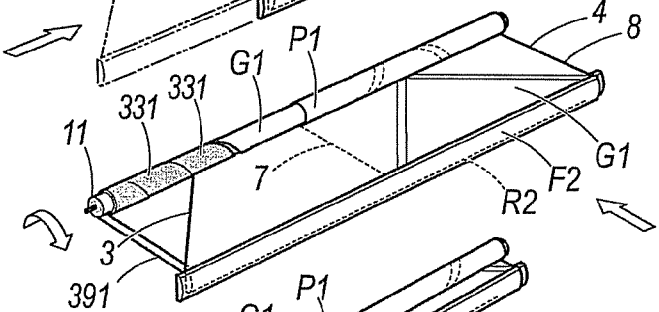
Figure 17C:
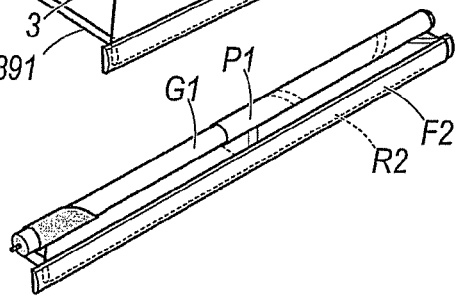
Figure 18A:
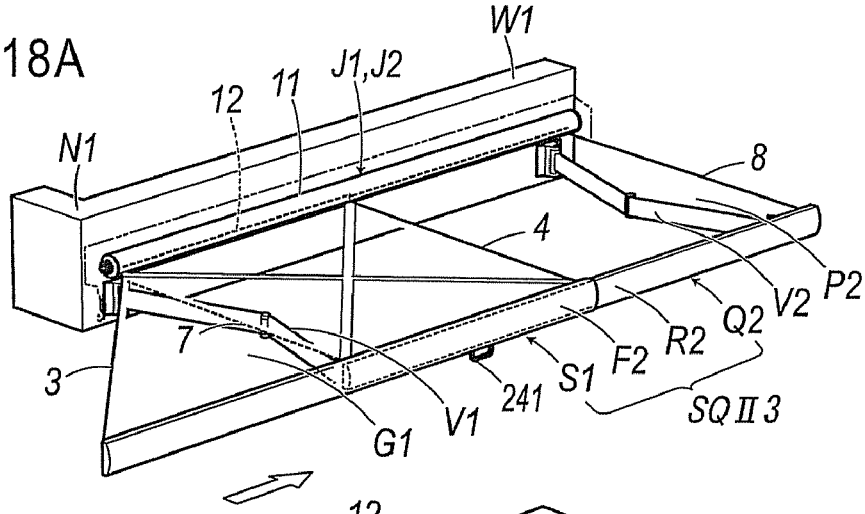
Figure 18B:
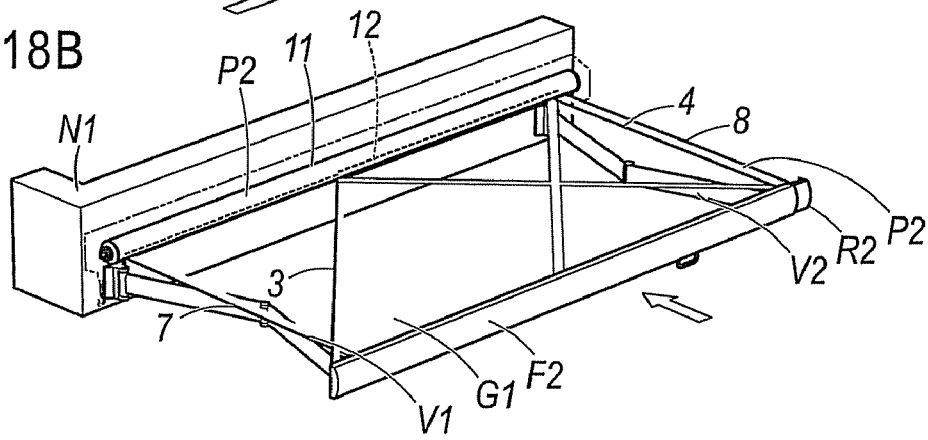
Figure 18C:
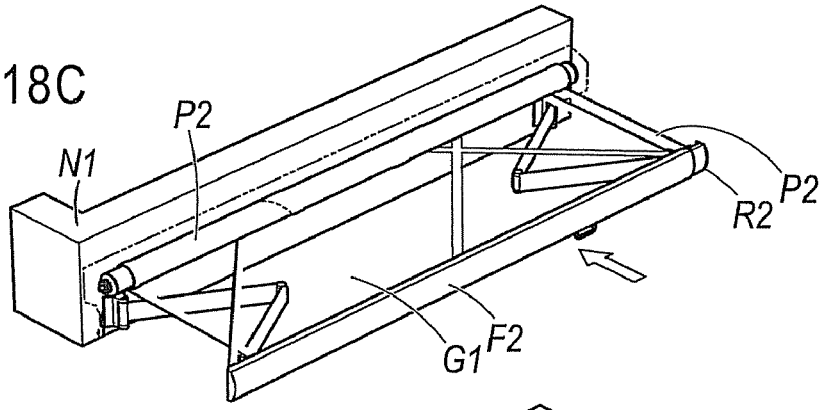
Figure 18D:
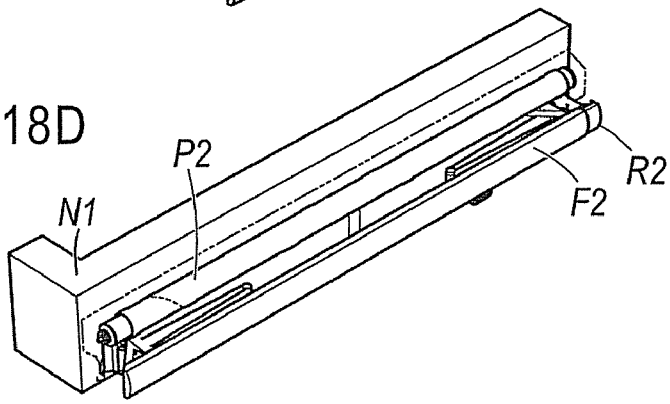
Figure 19A:
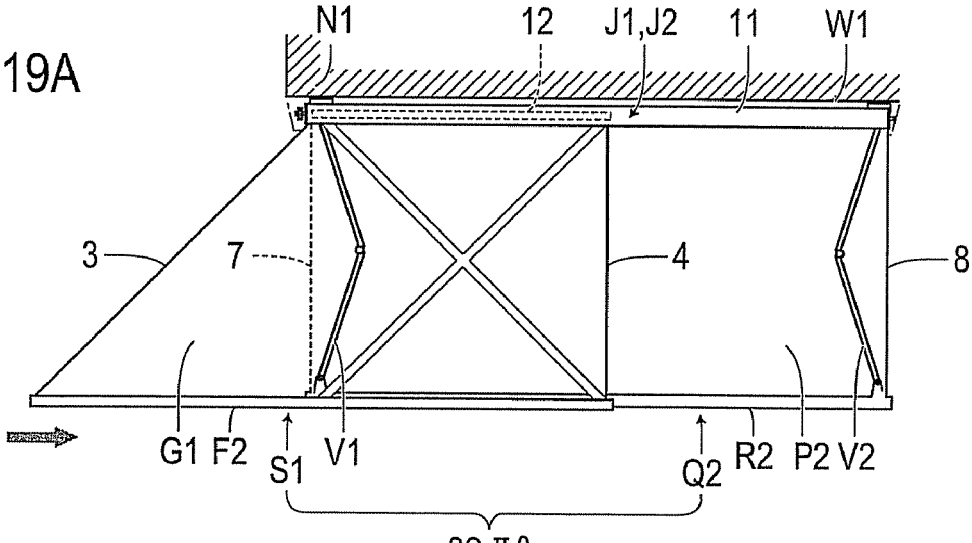
Figure 19B:
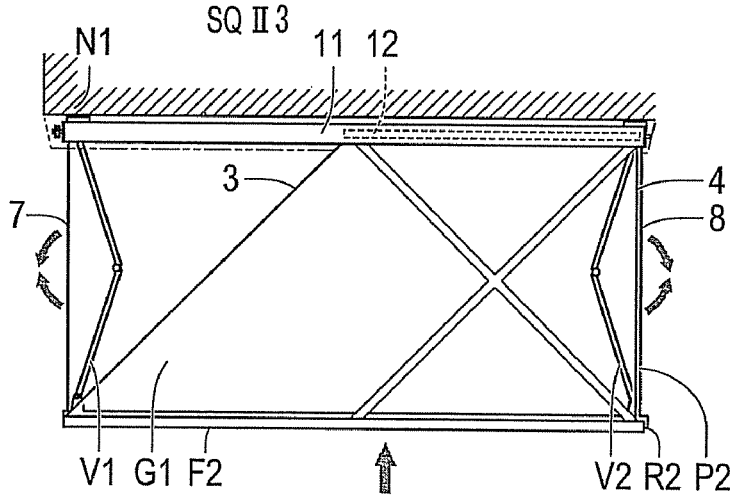
Figure 19C:
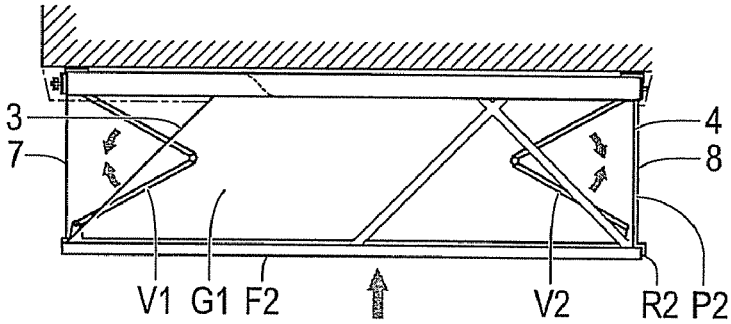
Figure 19D:
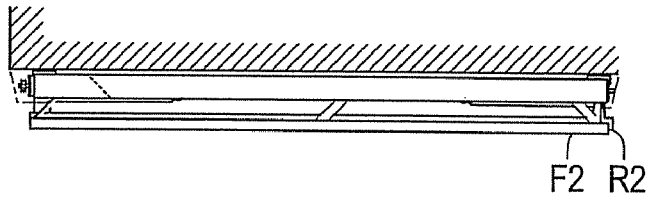
Figure 22A:
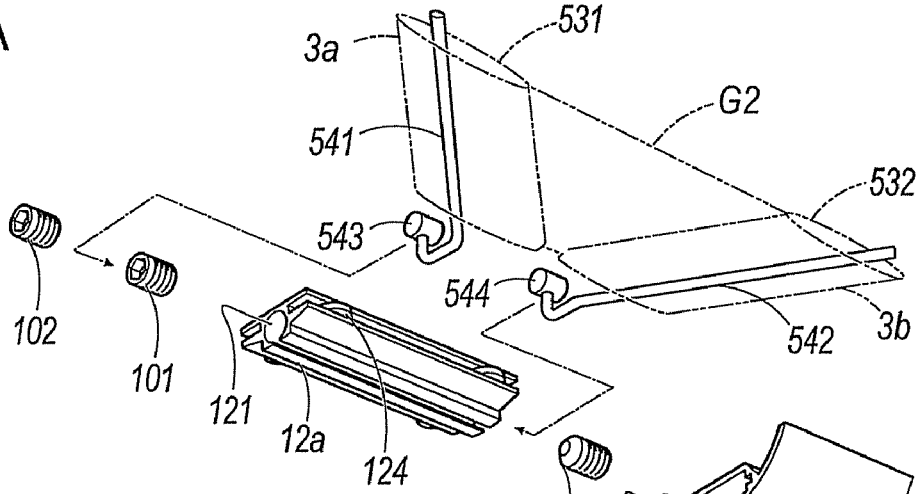
Figure 22B:
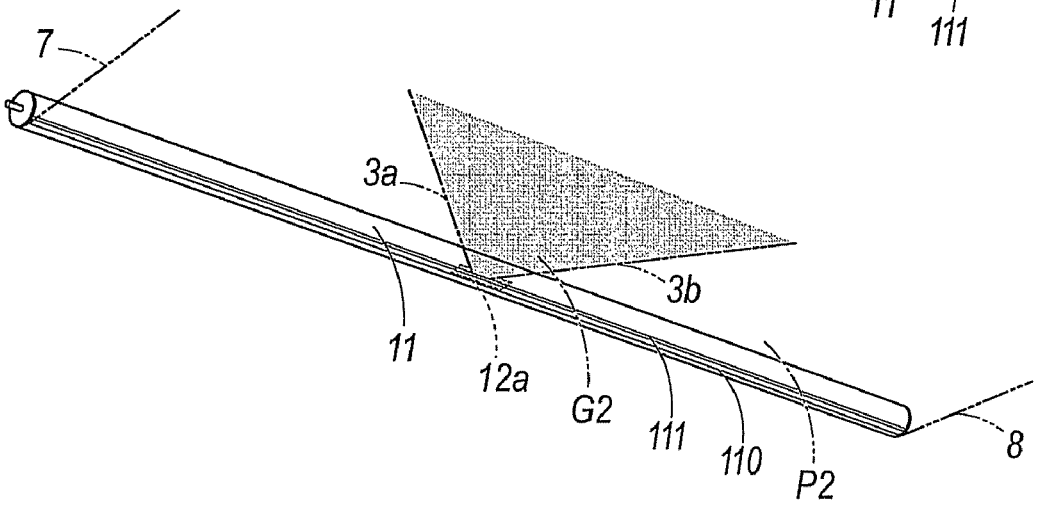
Figure 29A:
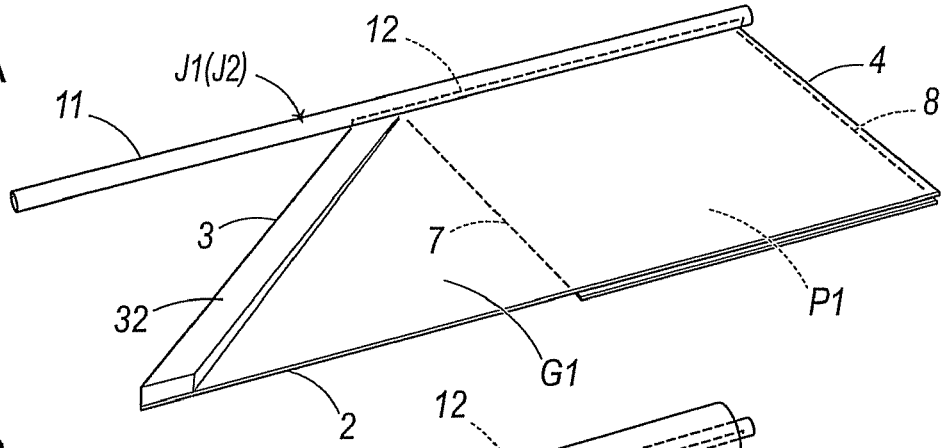
Figure 29B:
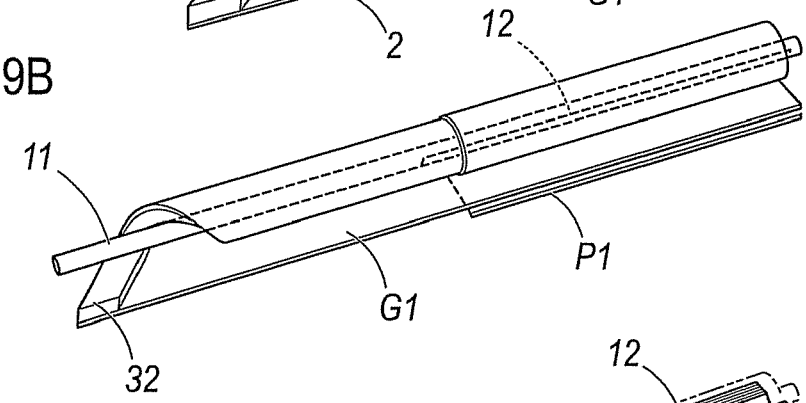
Figure 29C:
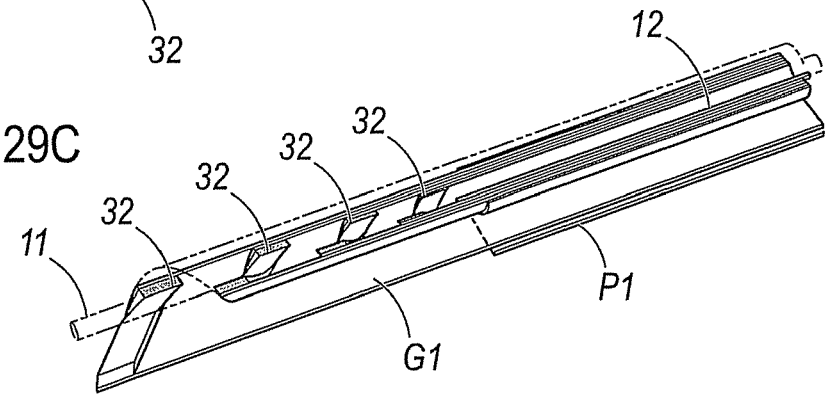
Figure 30A:
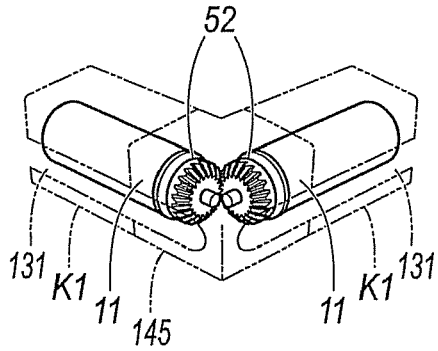
Figure 30B:
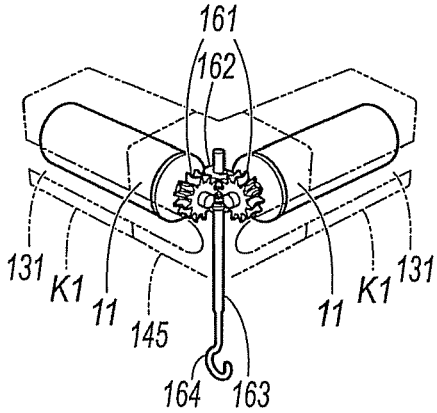
Figure 31A:
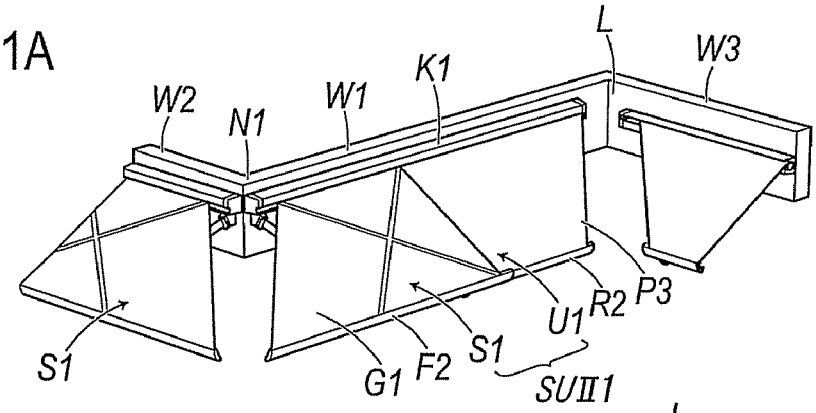
Figure 31B:
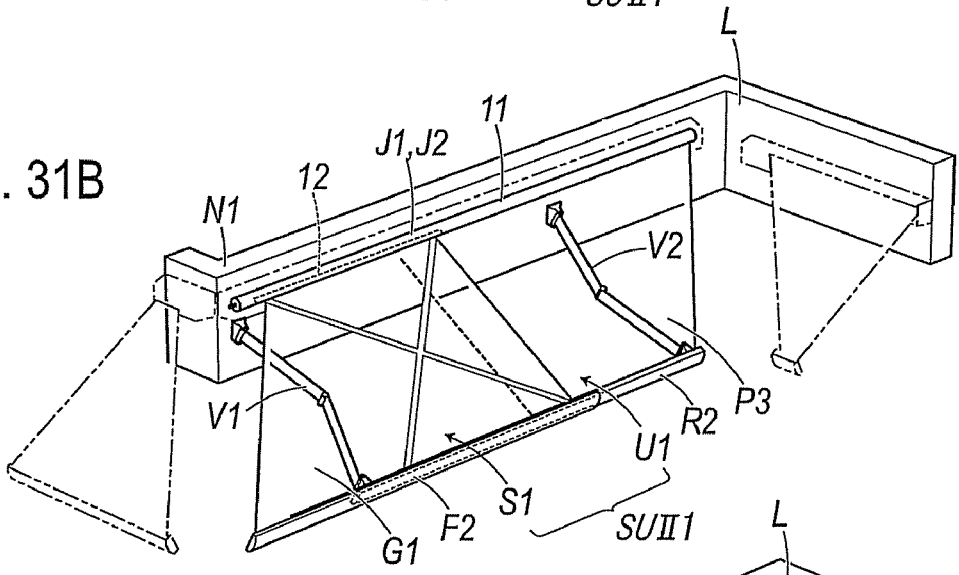
Figure 31C:
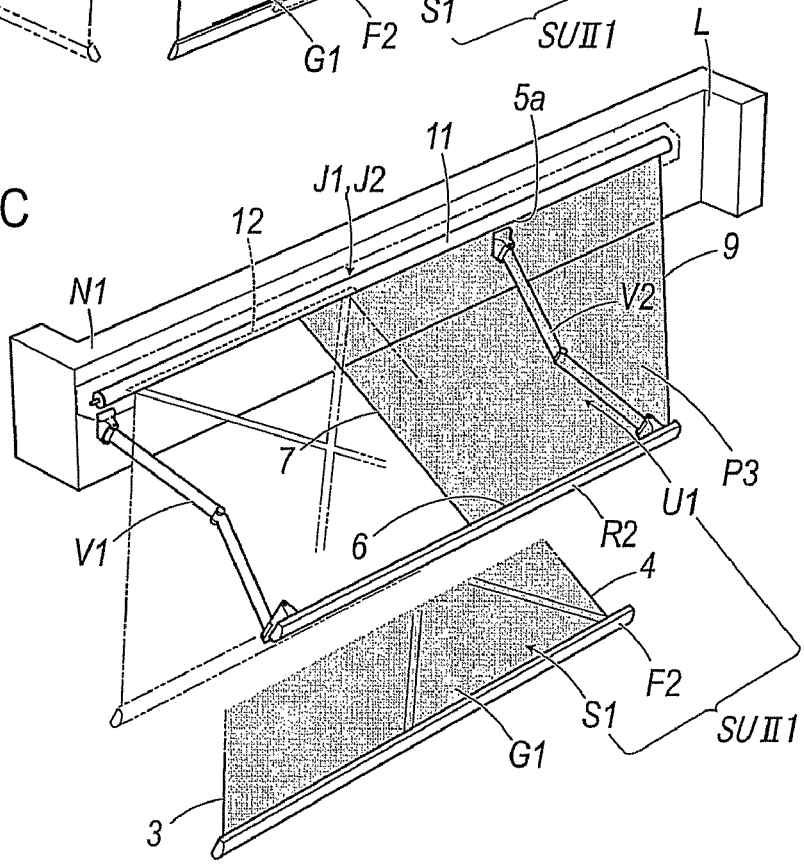
Figures 36A, 36B:
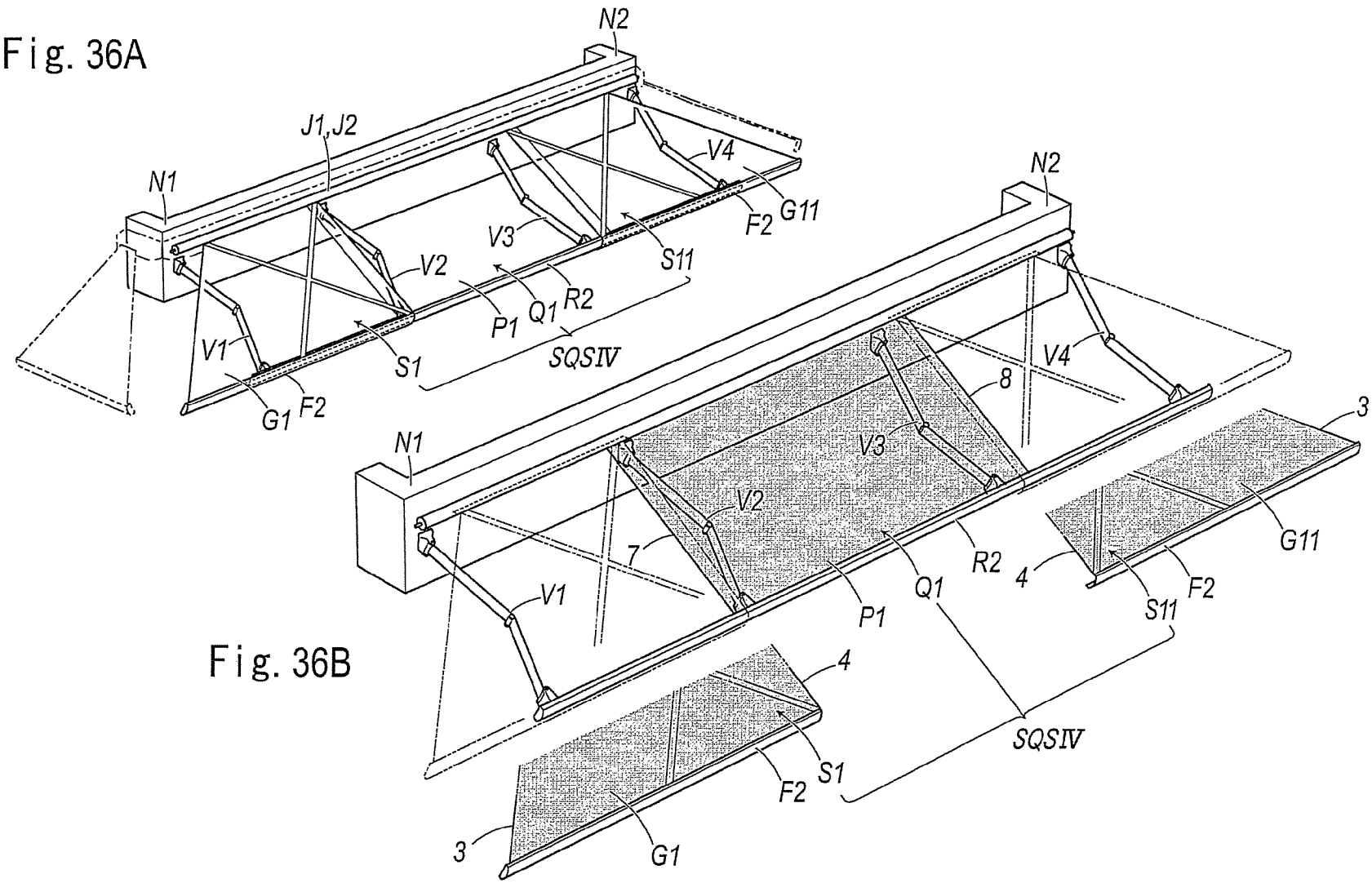
Figure 37A:
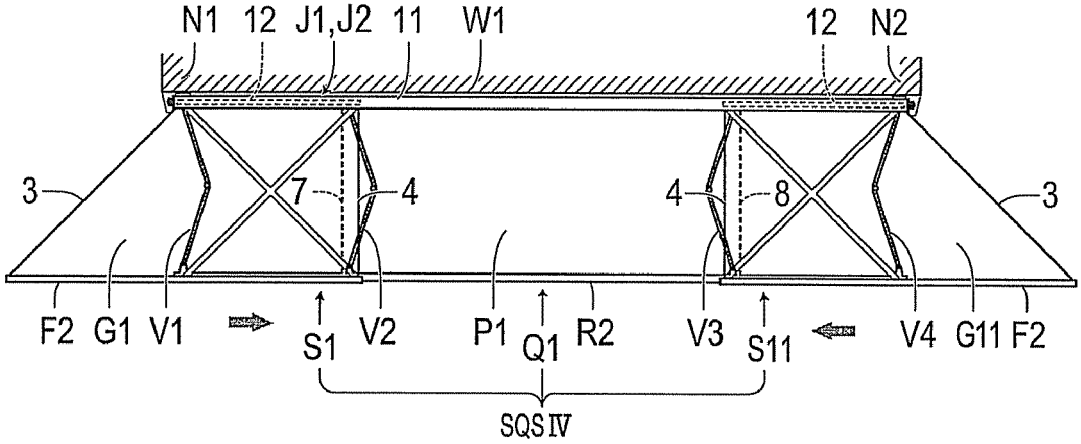
Figure 37B:
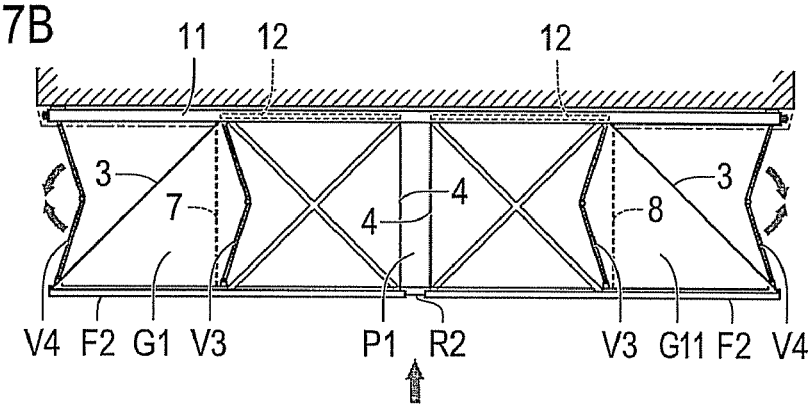
Figure 37C:
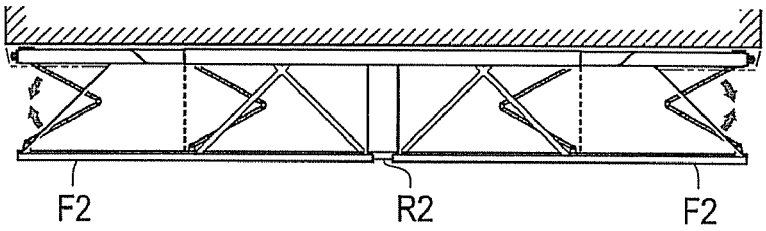
Figure 37D:
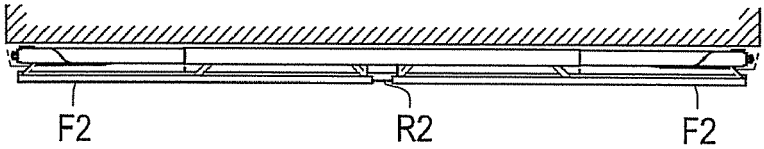
Figure 38A:
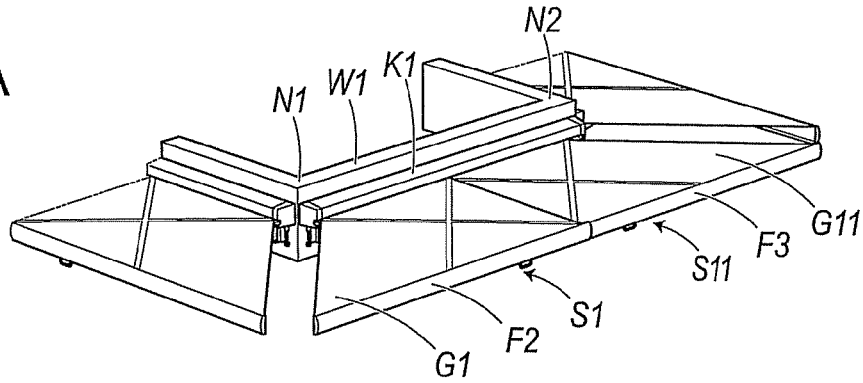
Figure 38B:
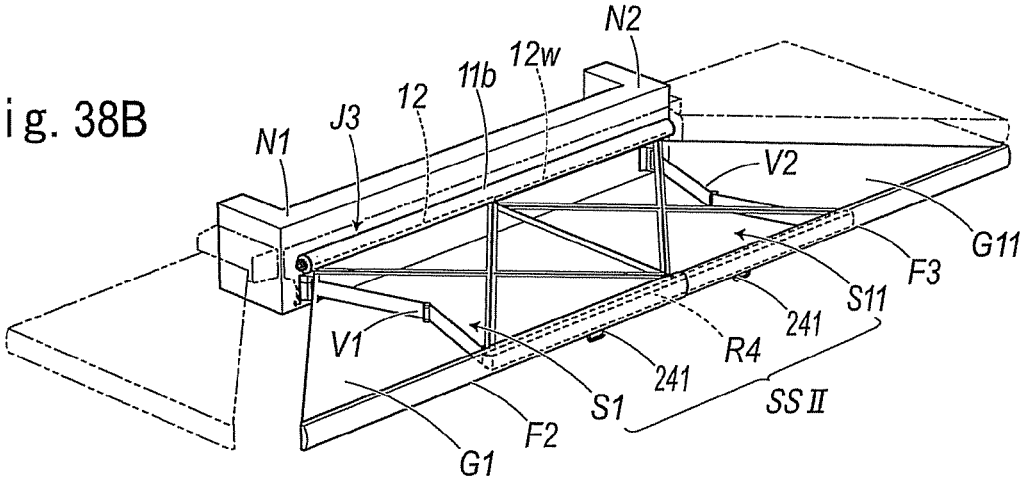
Figure 38C:
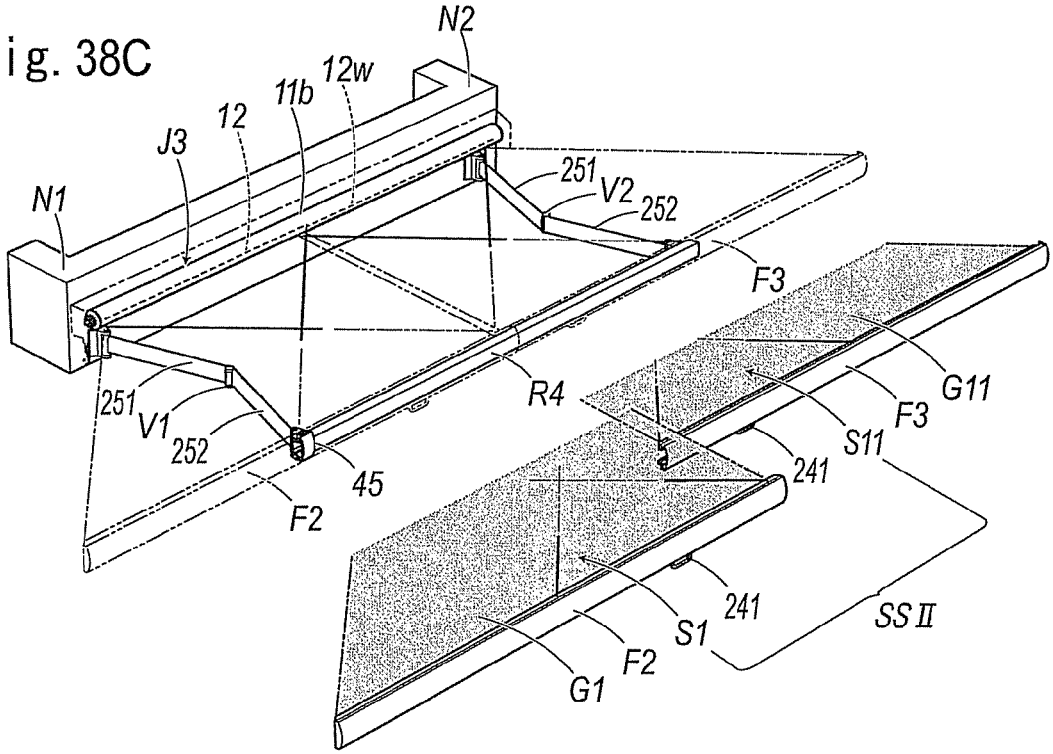
Figure 39A:
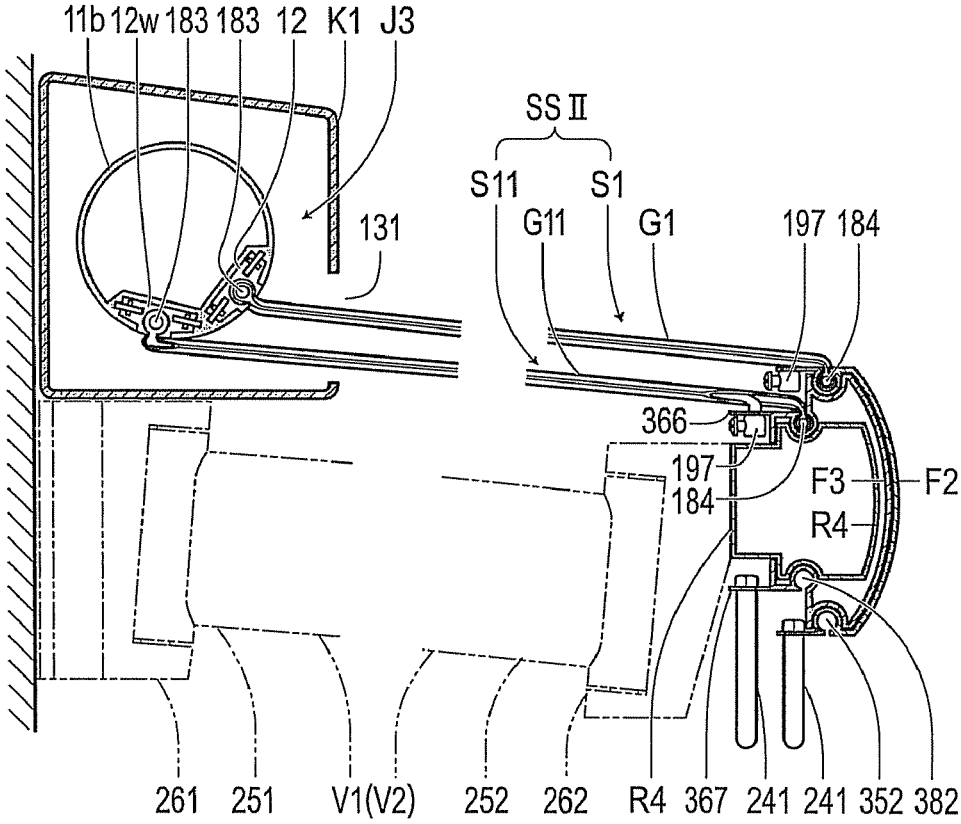
Figure 39B:
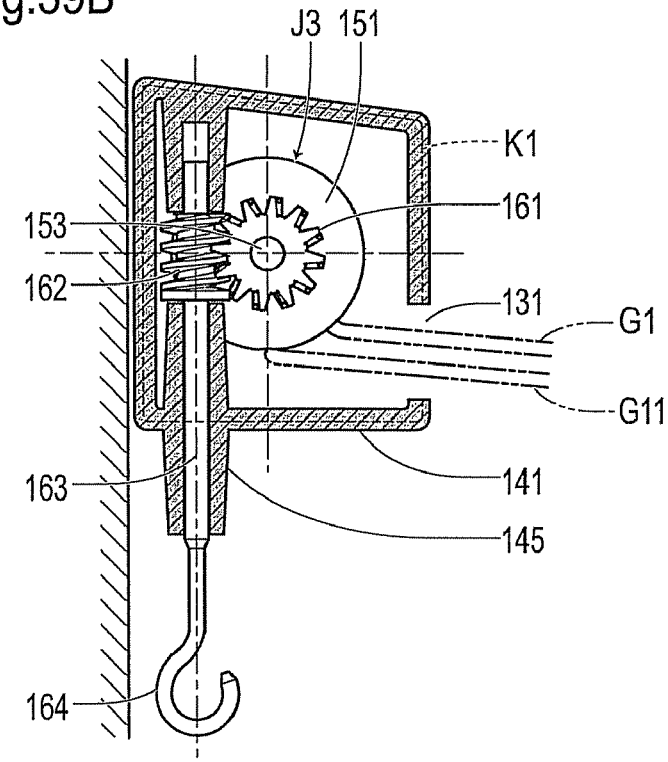
Figures 41A, 41B:
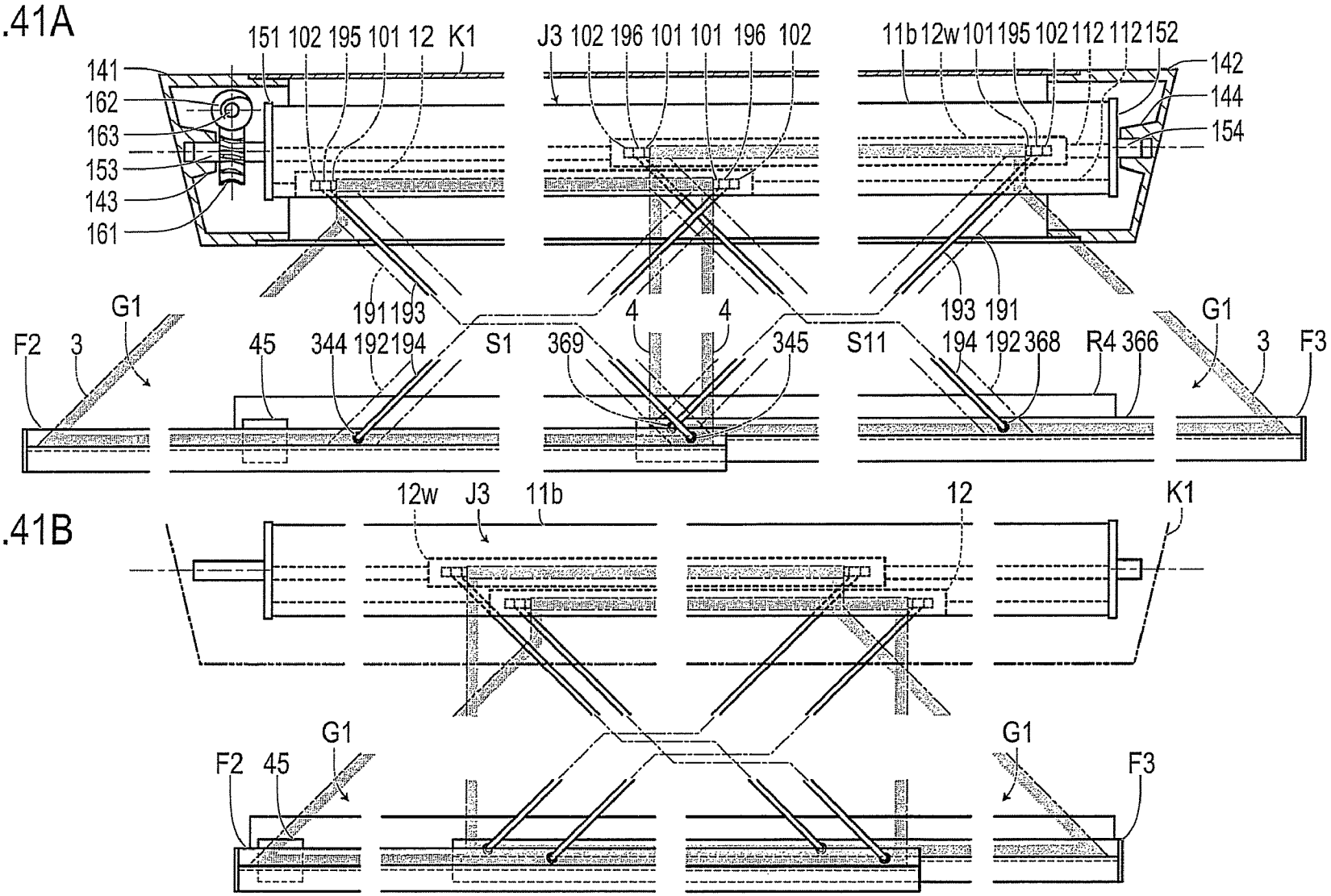
Figures 42A, 42B:
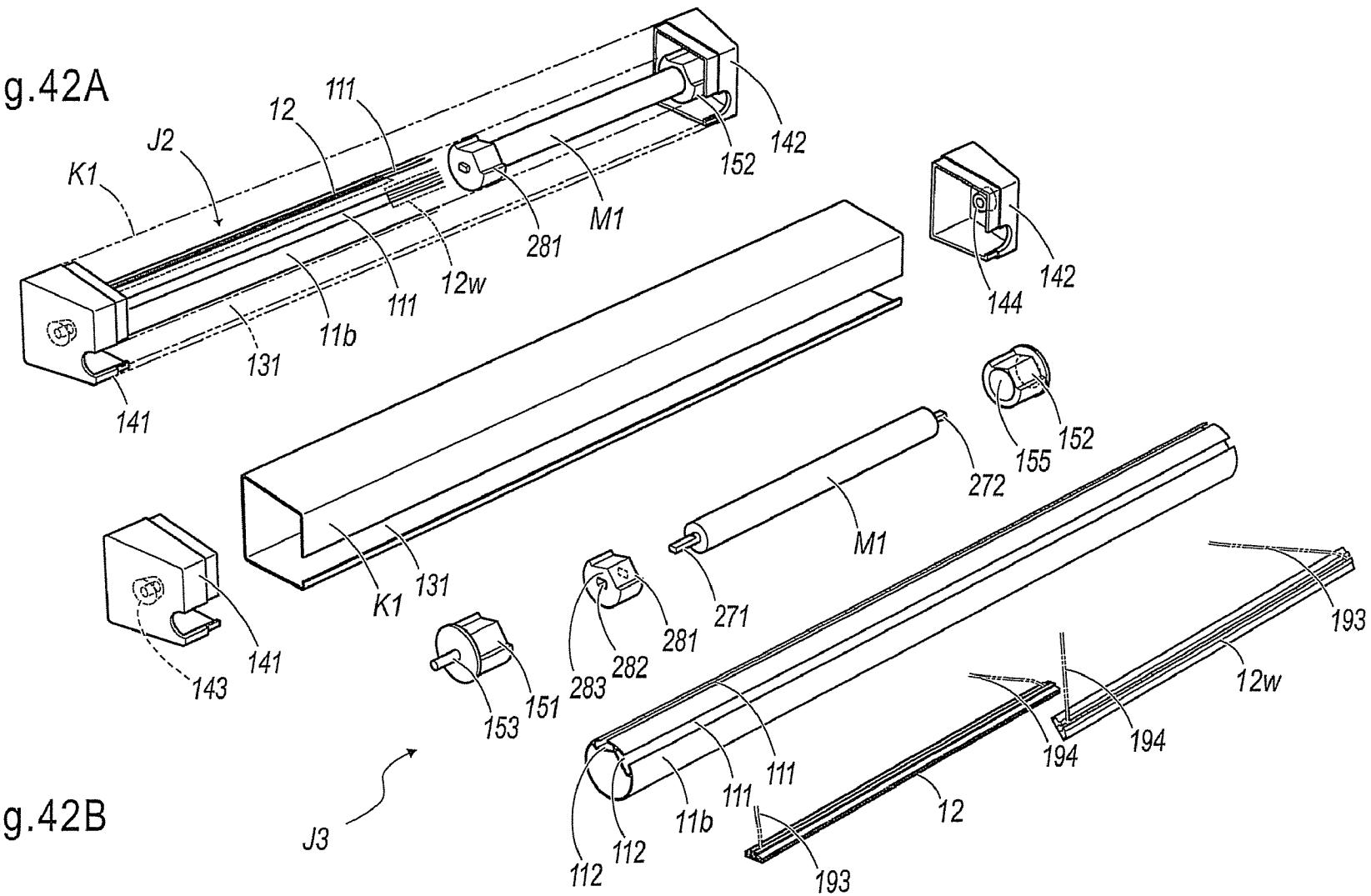
Figure 43A:
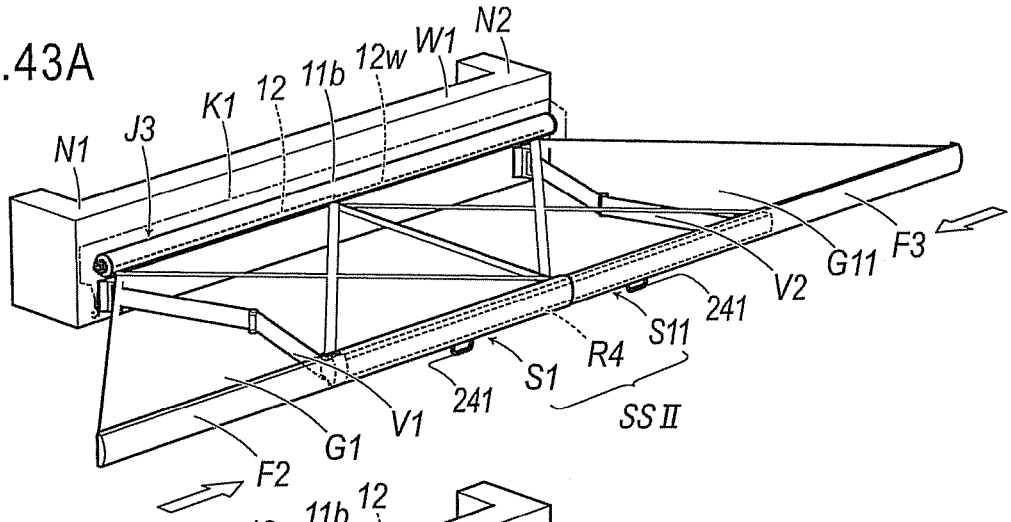
Figure 43B:
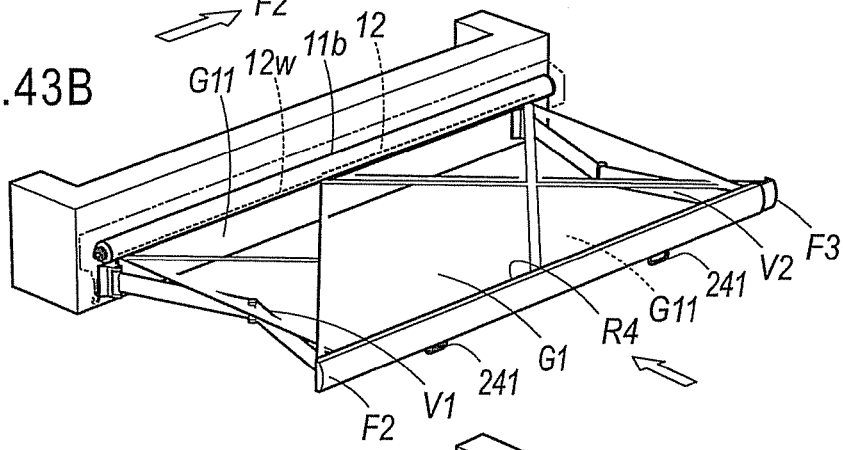
Figure 43C:
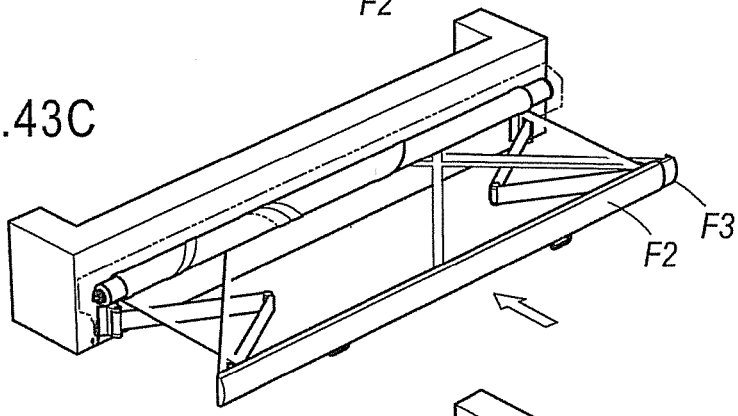
Figure 43D:
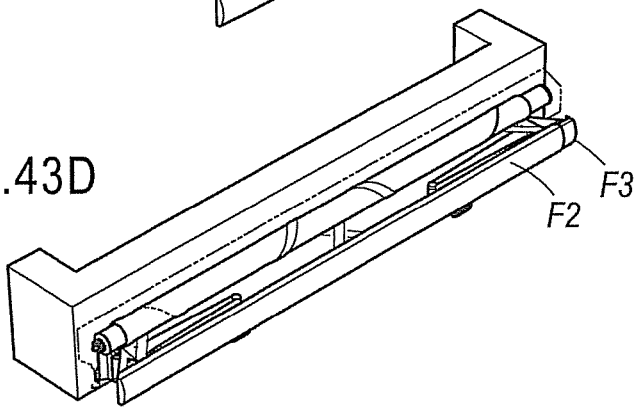
Figure 45A:
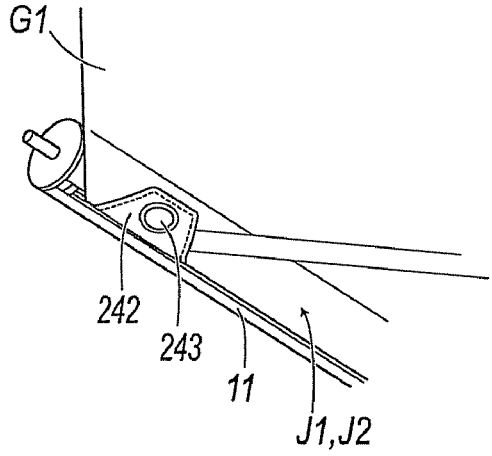
Figure 45B:
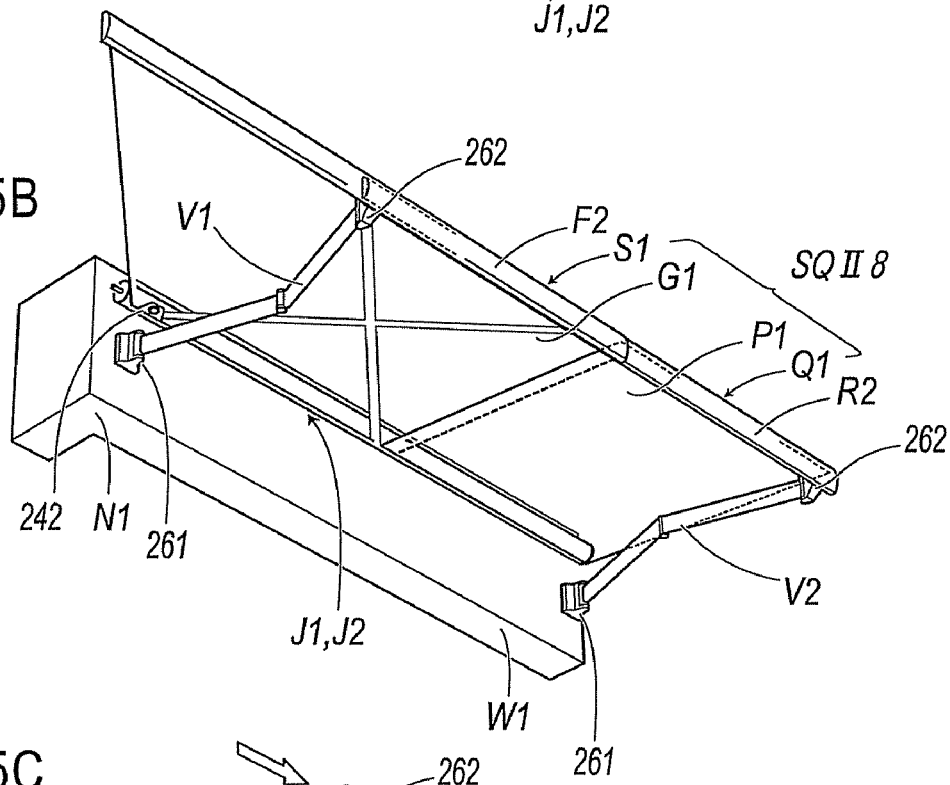
Figure 45C:
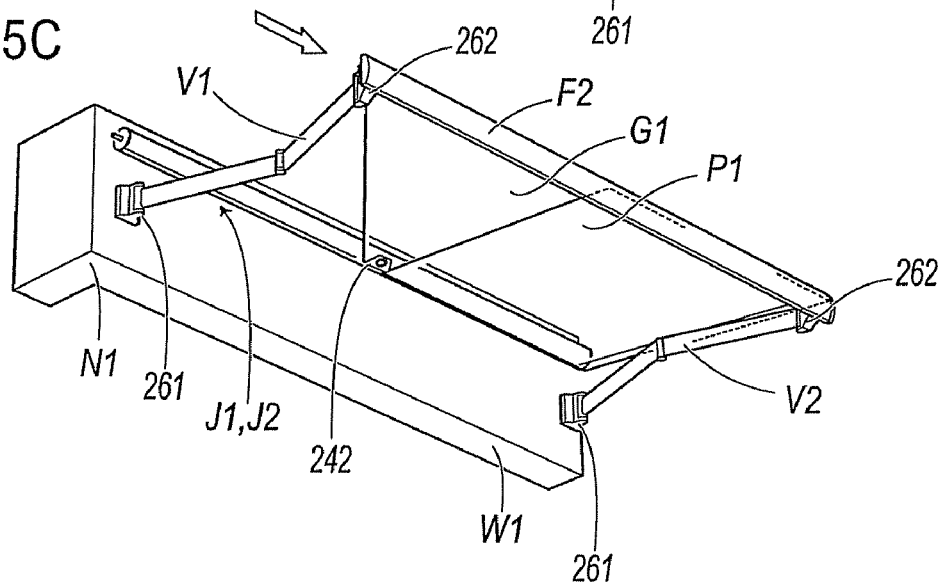
Figure 46A:
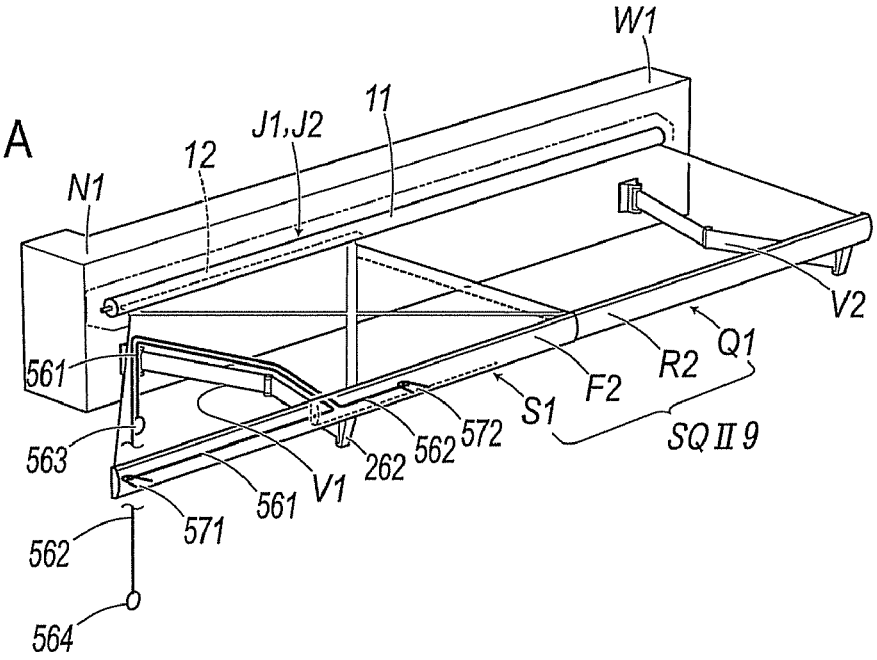
Figure 46B:
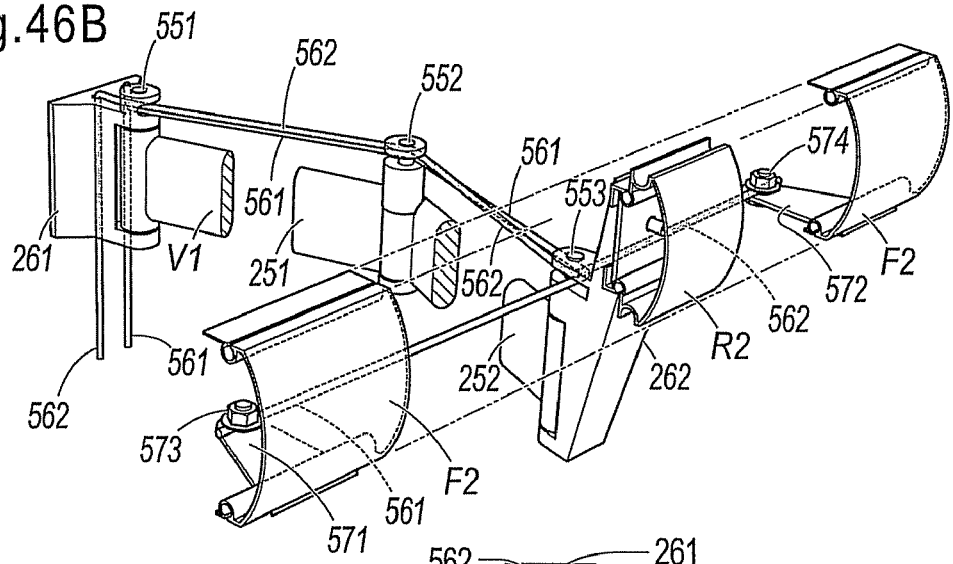
Figure 46C:
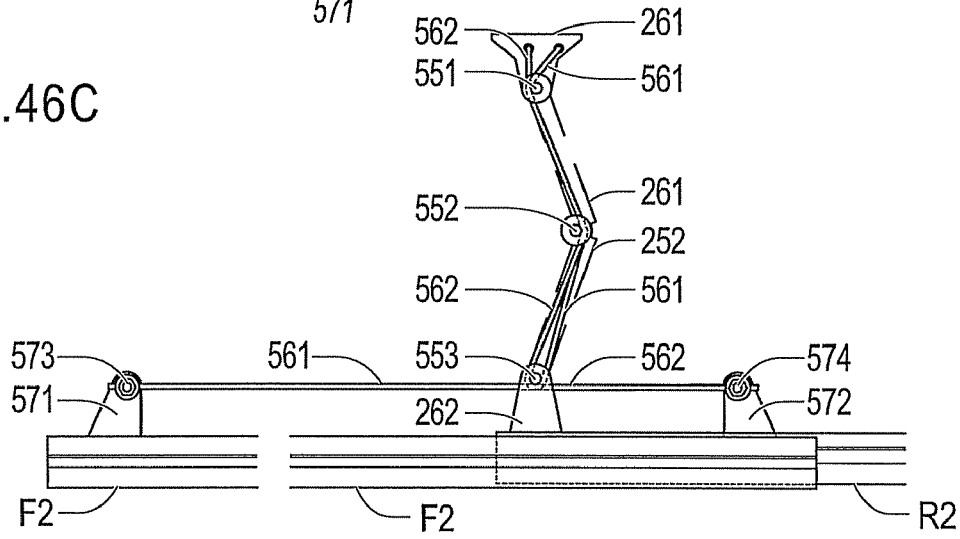
Figure 47A:
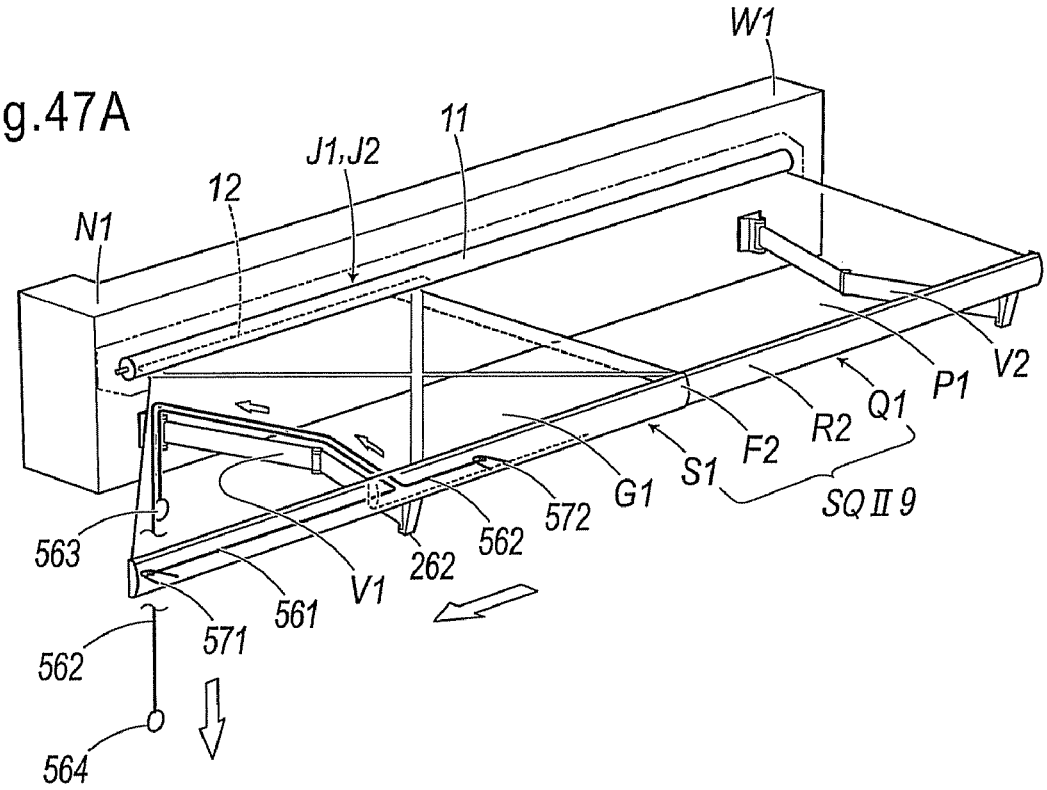
Figure 47B:
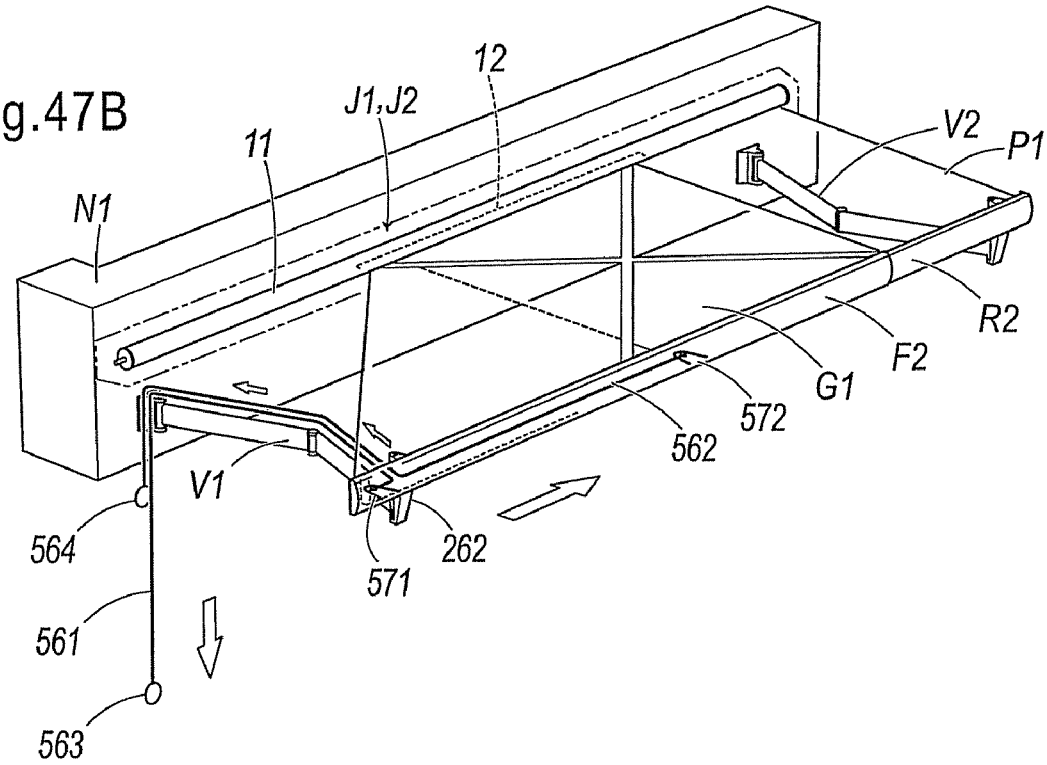
Figure 48A:
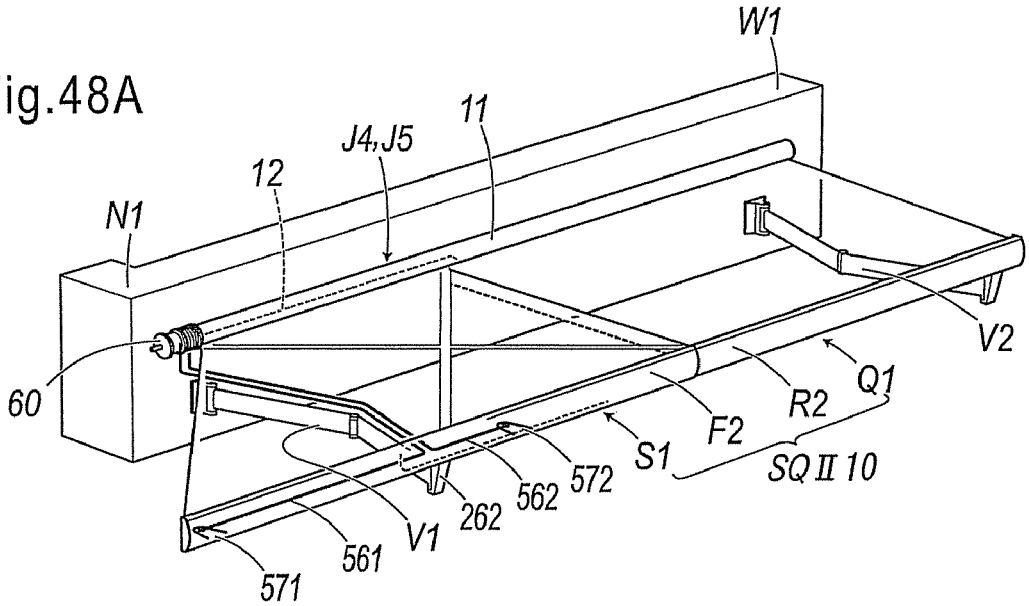
Figure 48B:
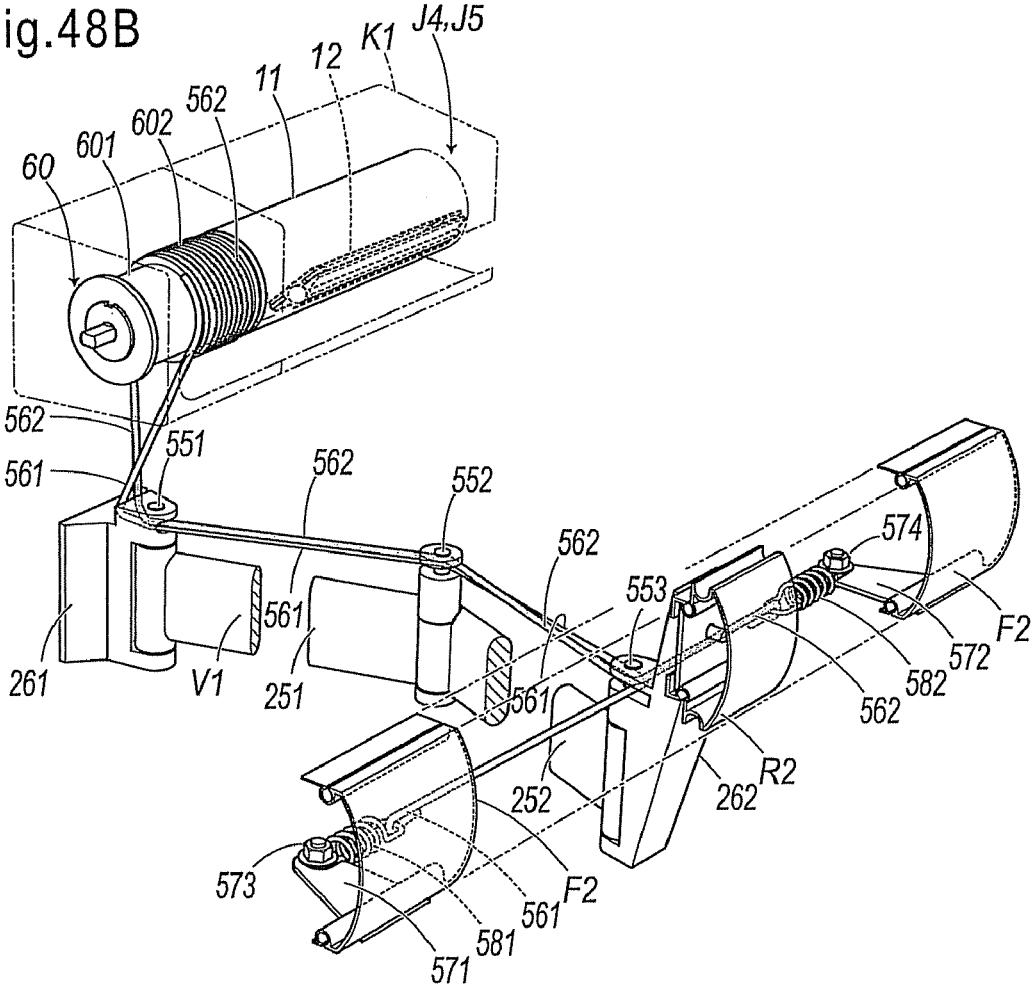
Figure 49A:
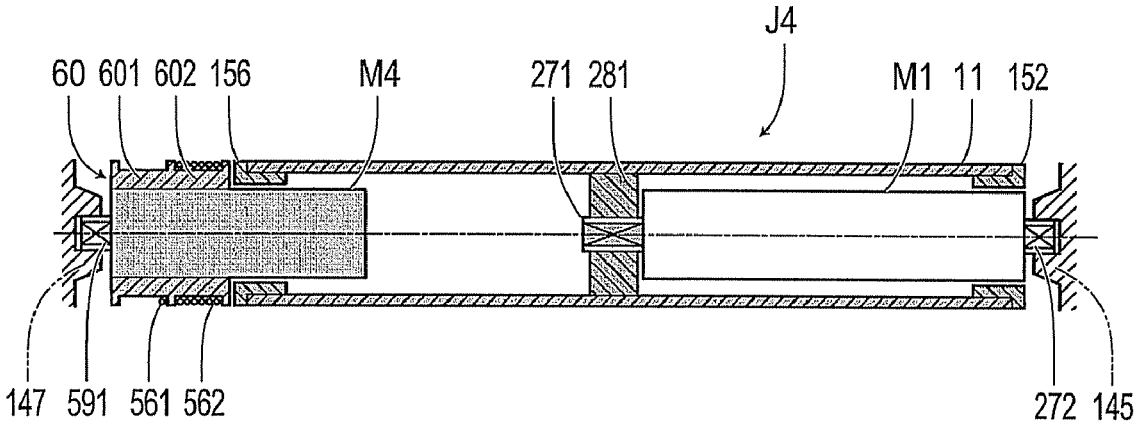
Figure 49B:
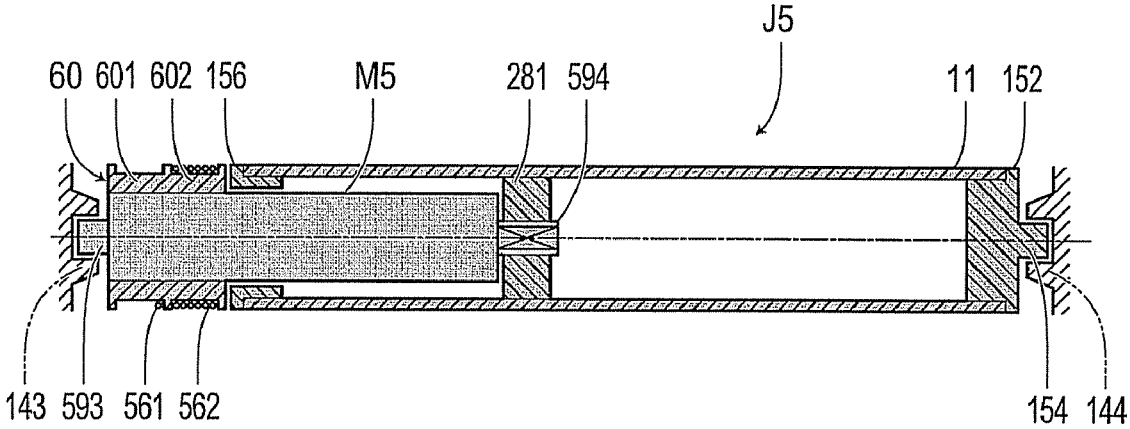
Figures 50A, 50B:
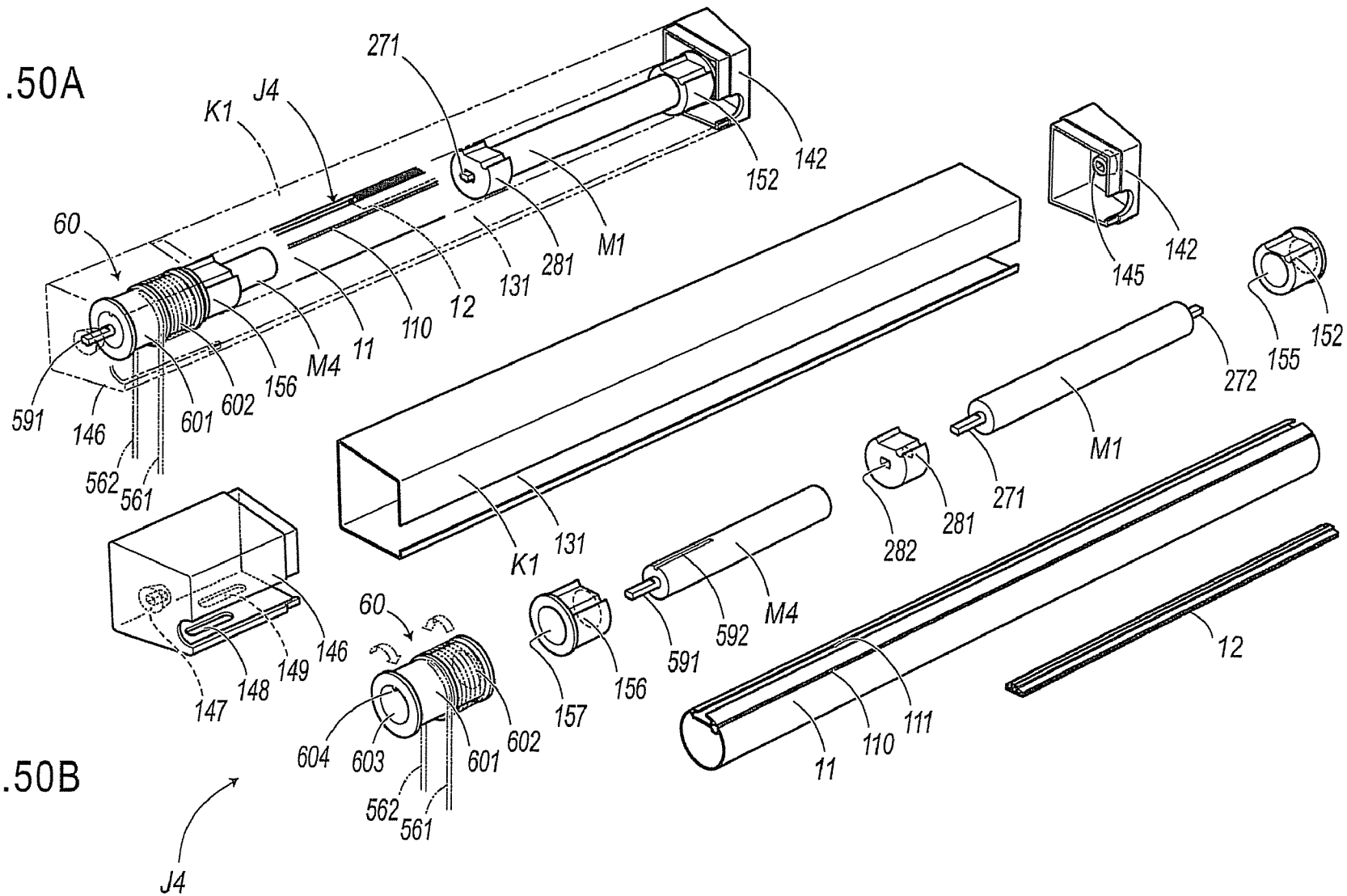
Figures 51A, 51B:
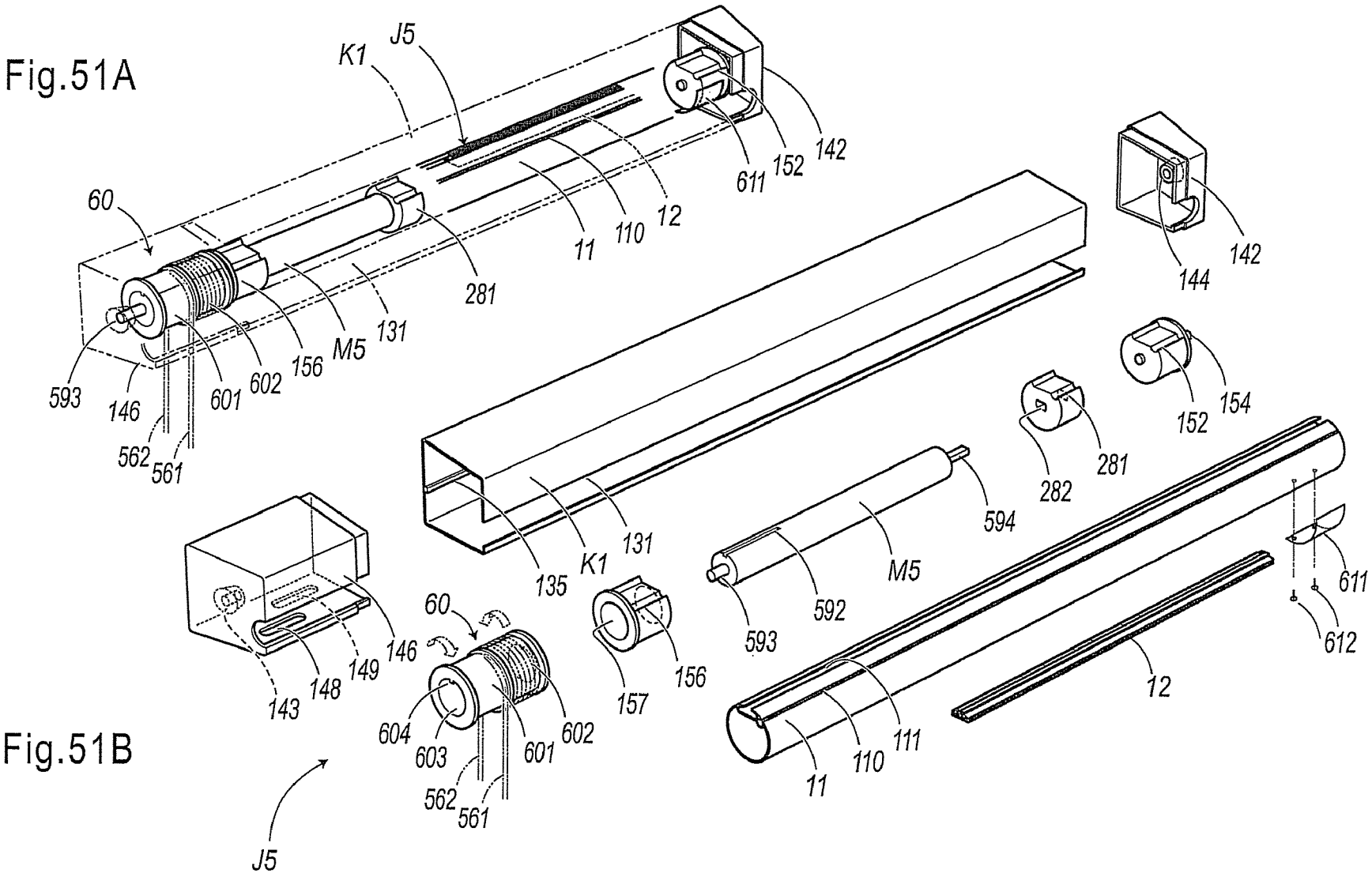
Figure 53A:
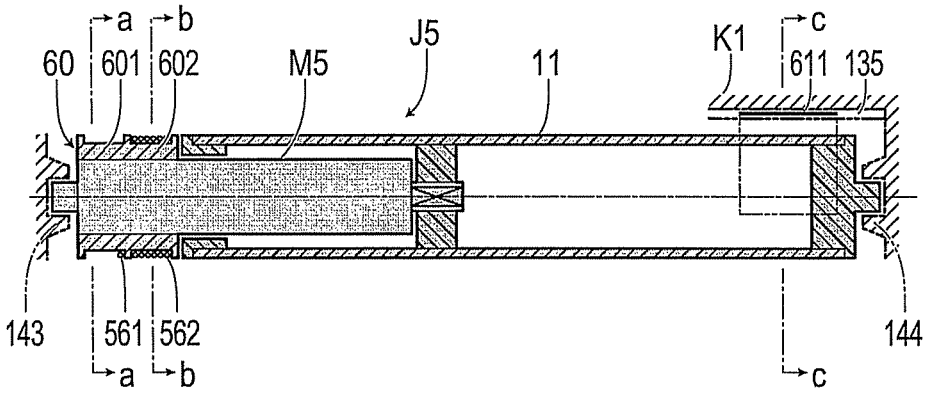
Figure 55A:
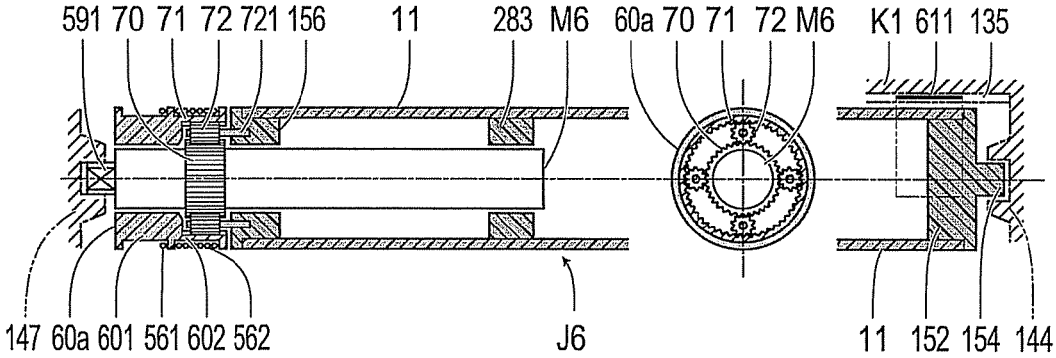
Figure 55B:
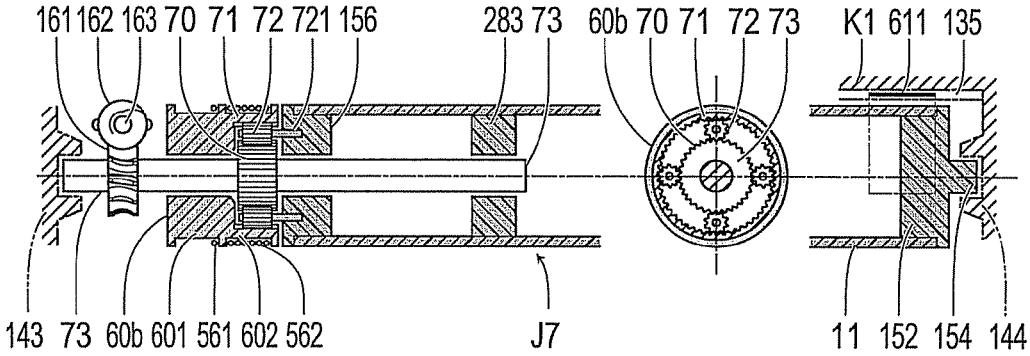
Figures 56A, 56B:
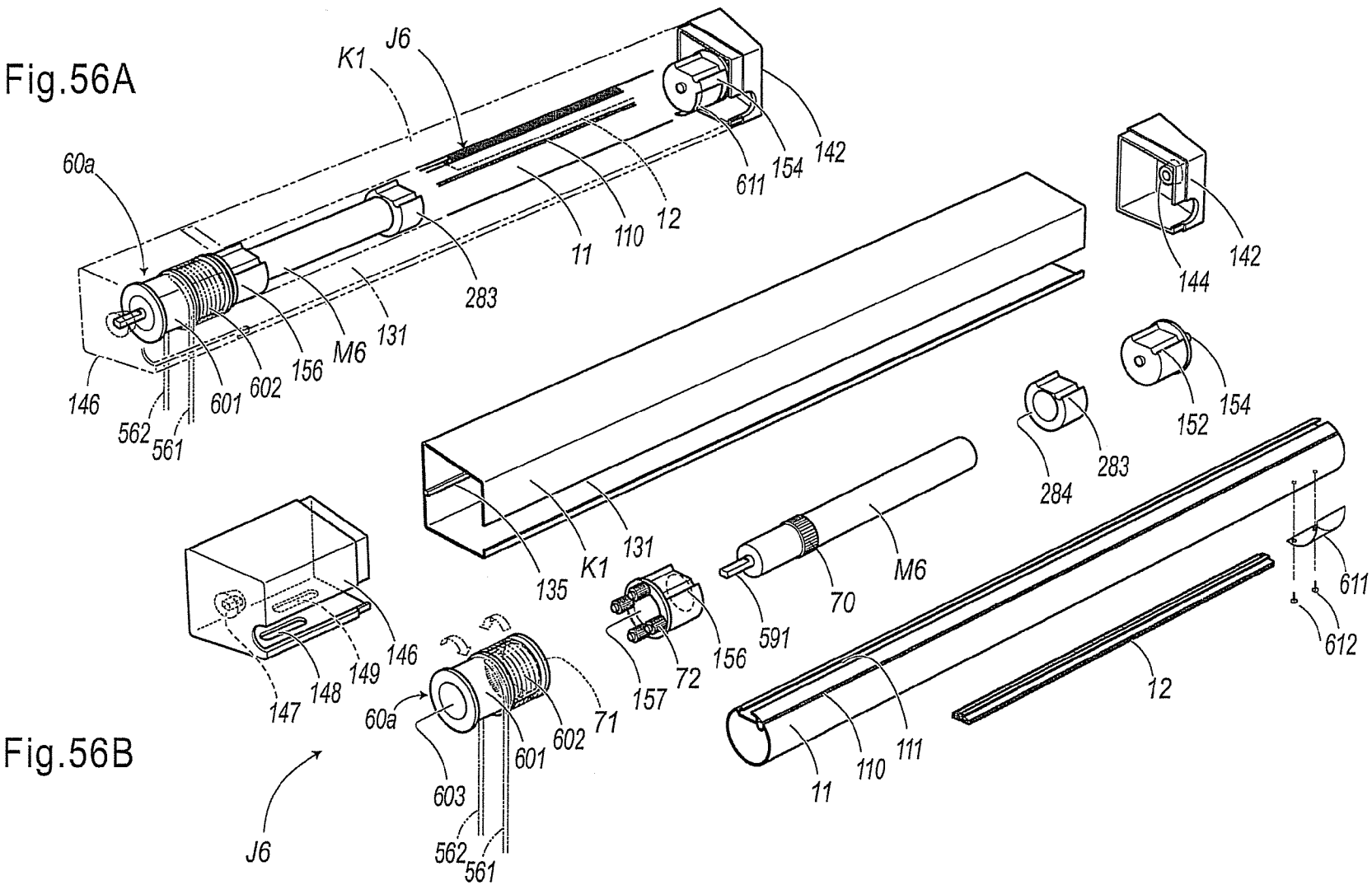
Figures 57A, 57B:
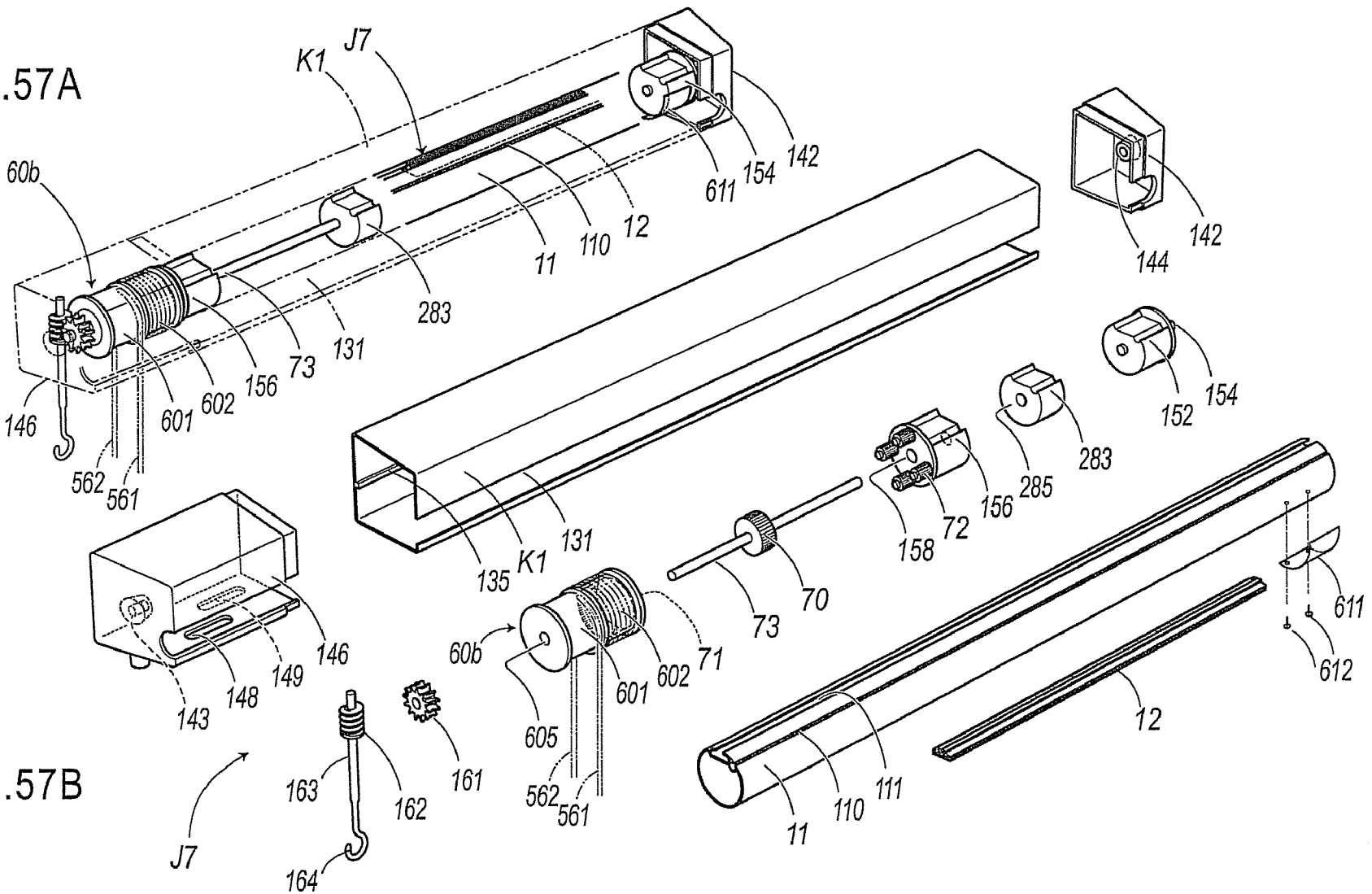
Figure 58A:
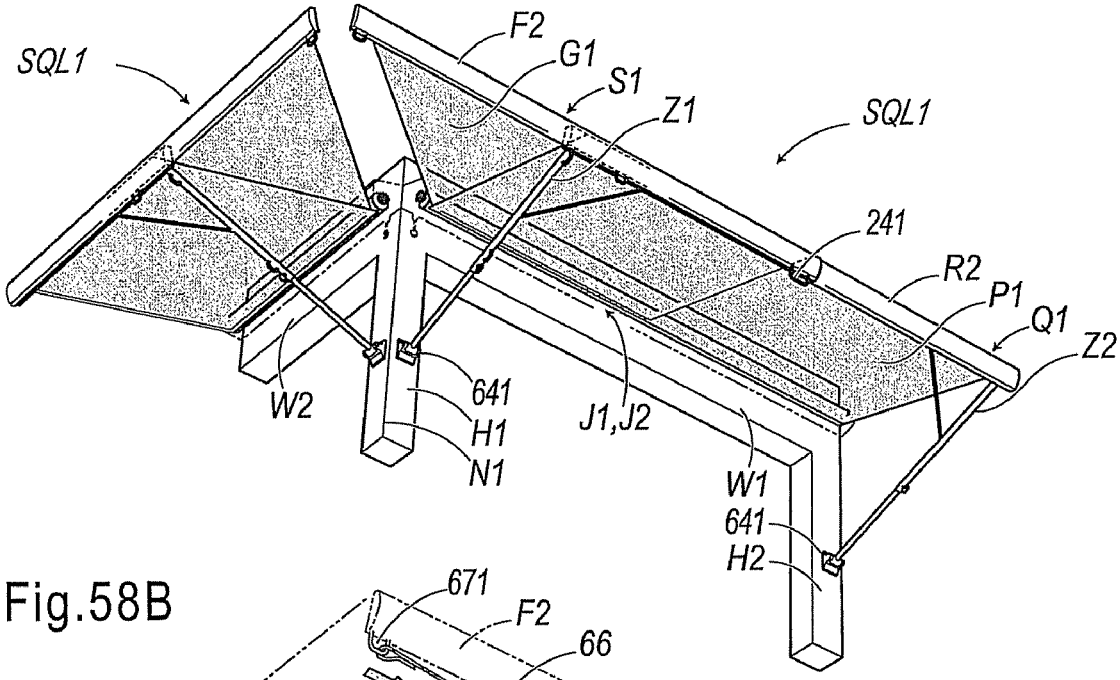
Figure 58B:
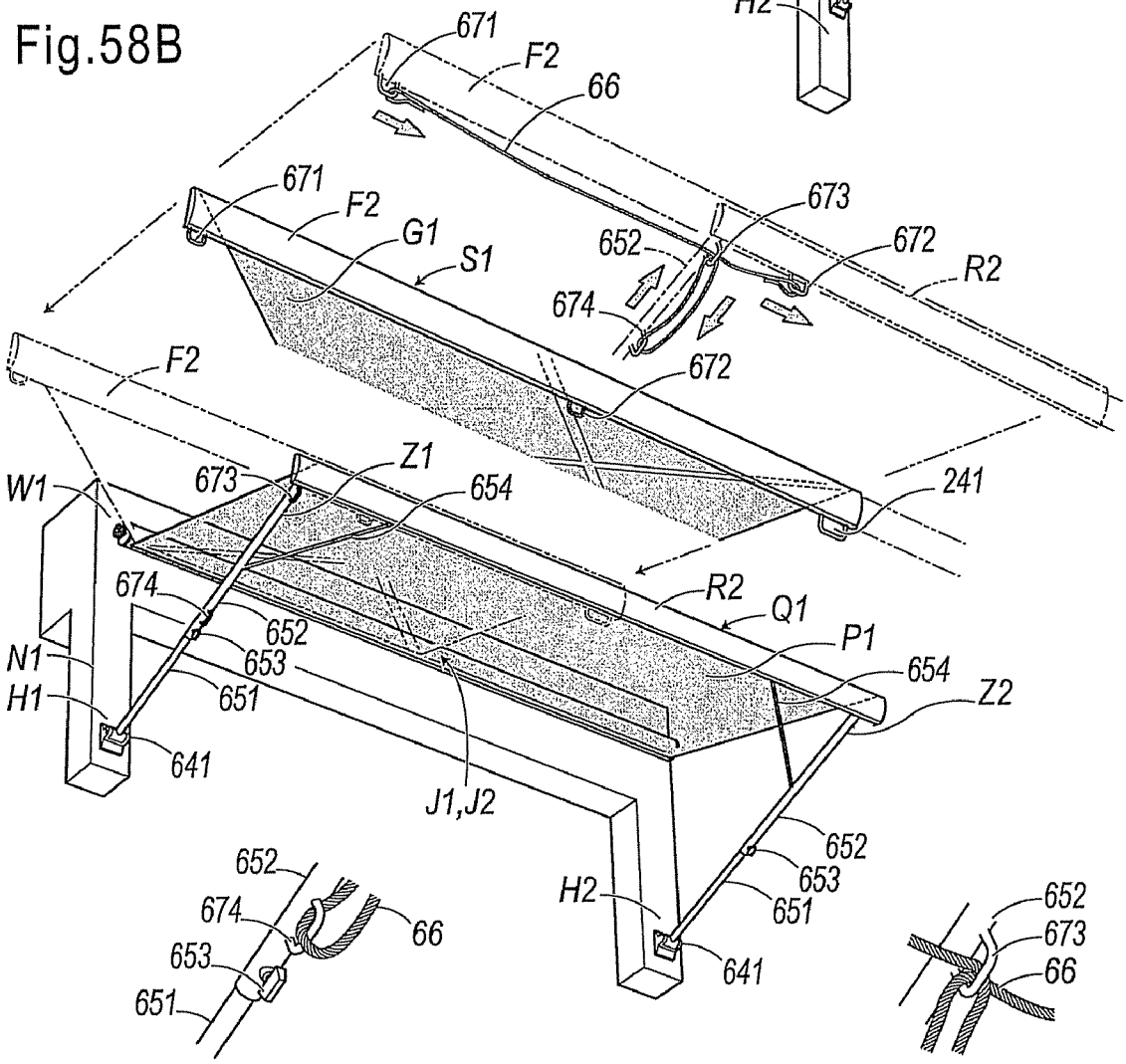
Figure 61A:
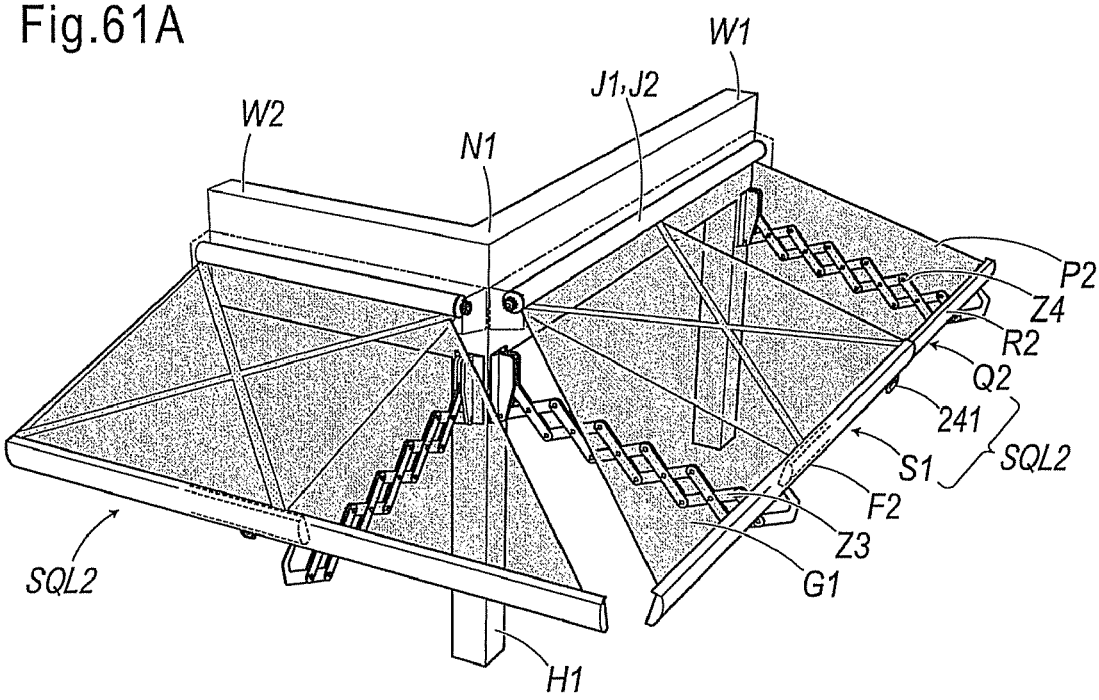
Figure 61B:
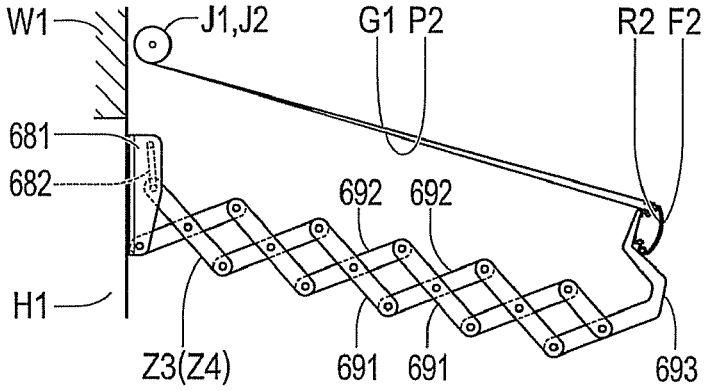
Figure 61C:
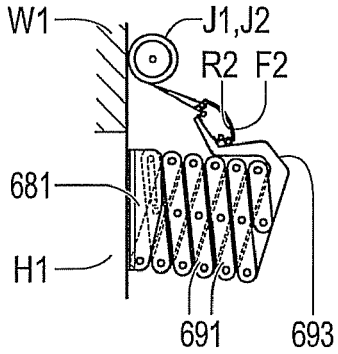
Figure 62A:
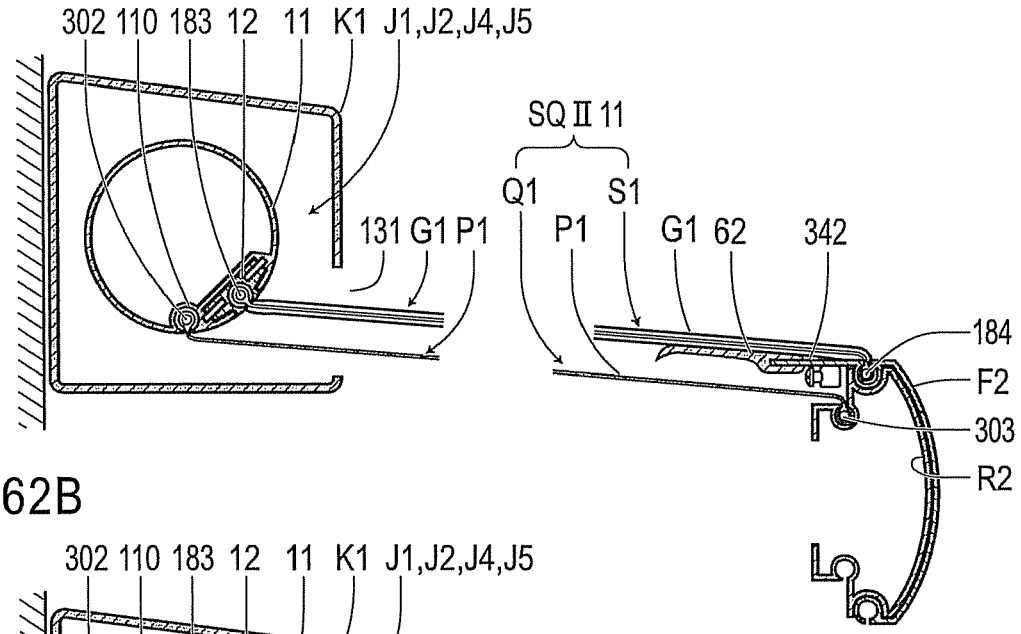
Figure 62B:
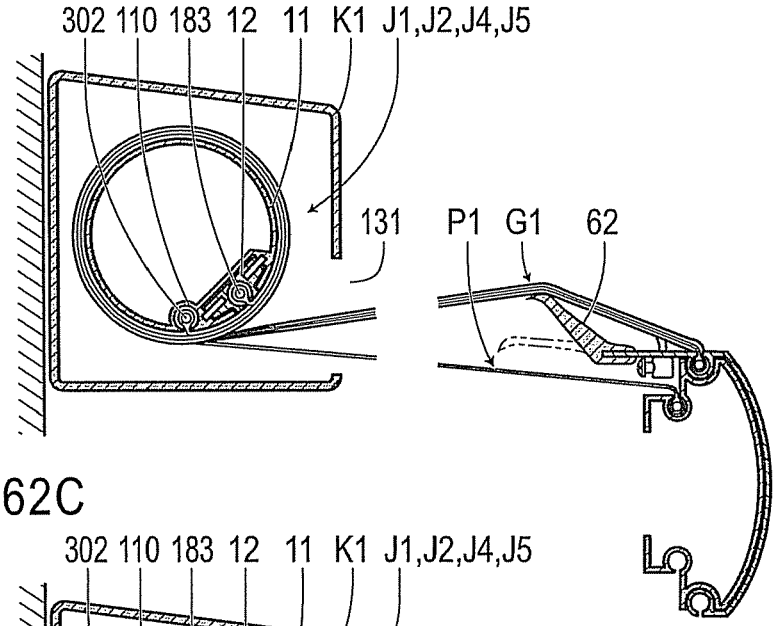
Figure 62C:
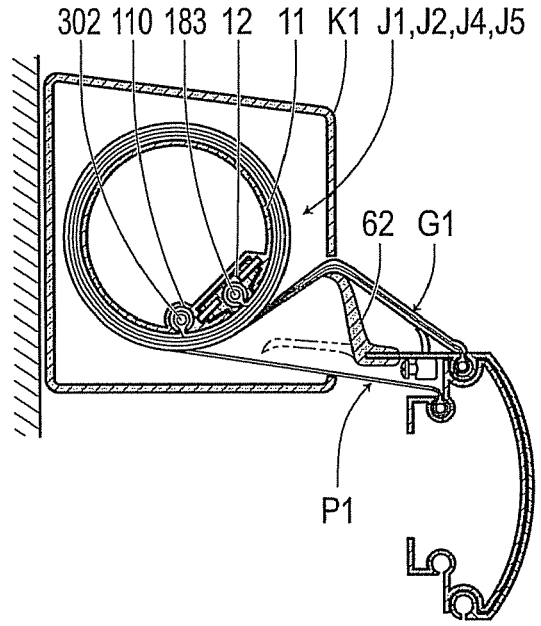
Figure 63A:
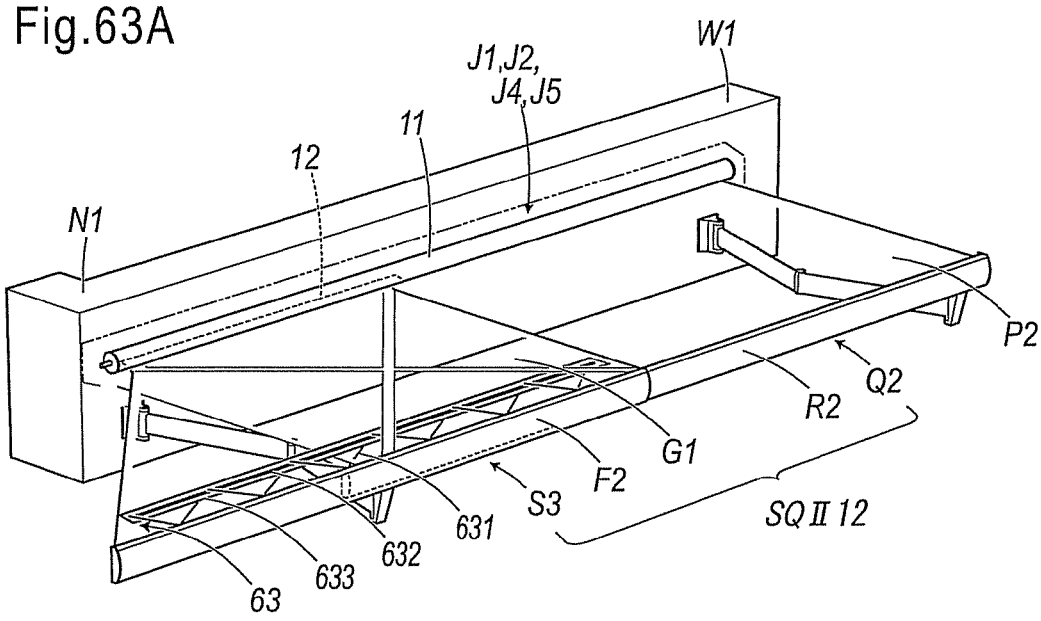
Figure 63B:
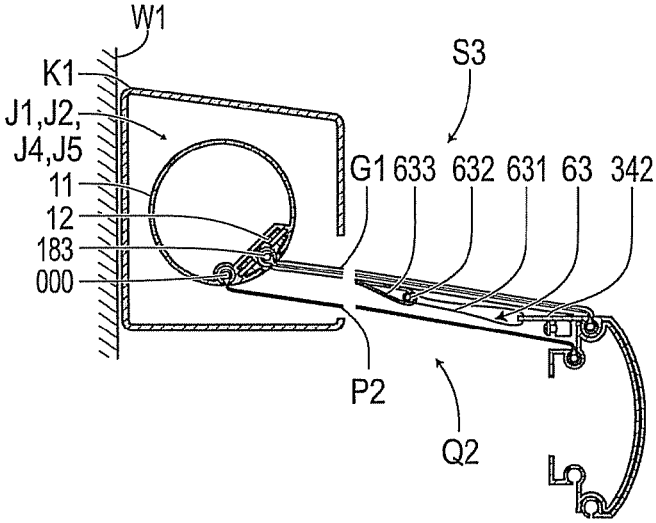
Figure 63C:
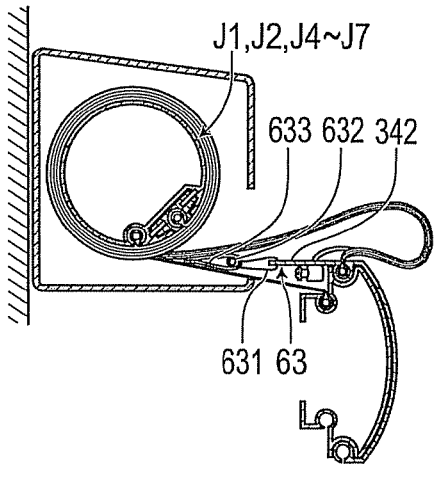
Figure 64A:
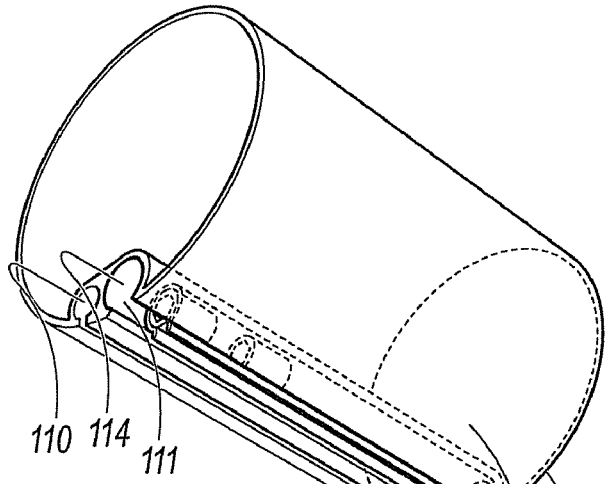
Figure 64B:
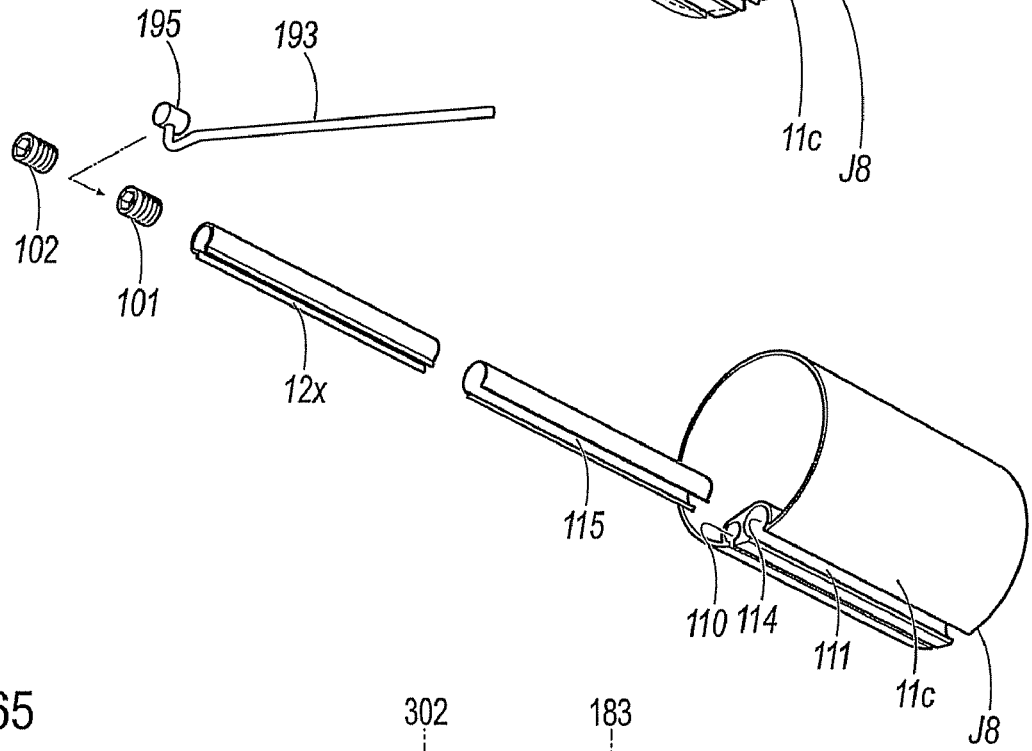
Figure 65:
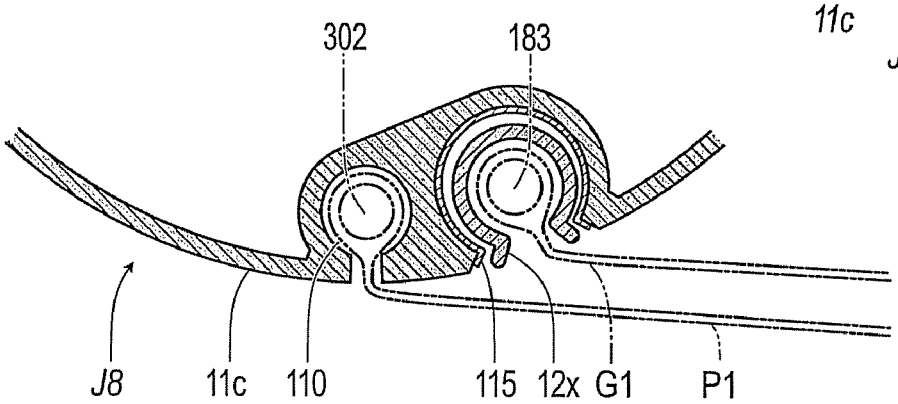
Figure 66A:
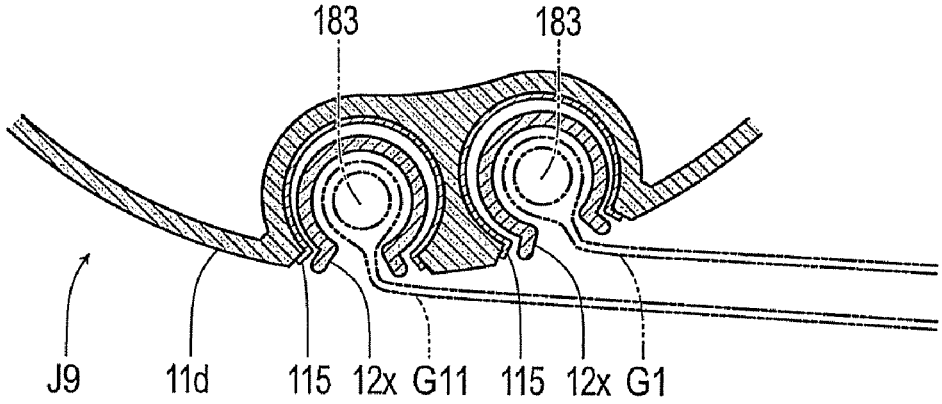
Figure 66B:
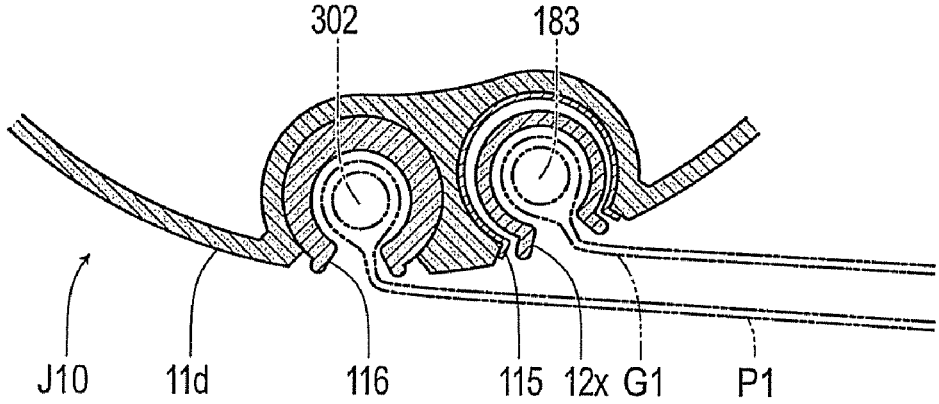
Figure 67A:
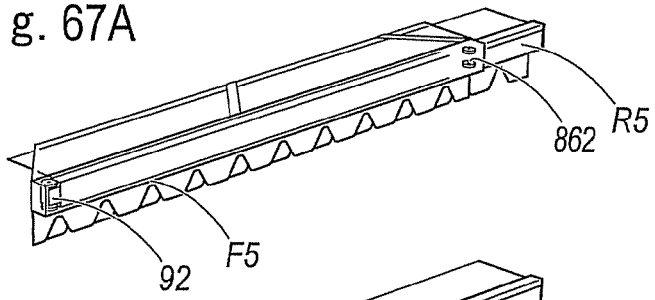
Figure 67B:
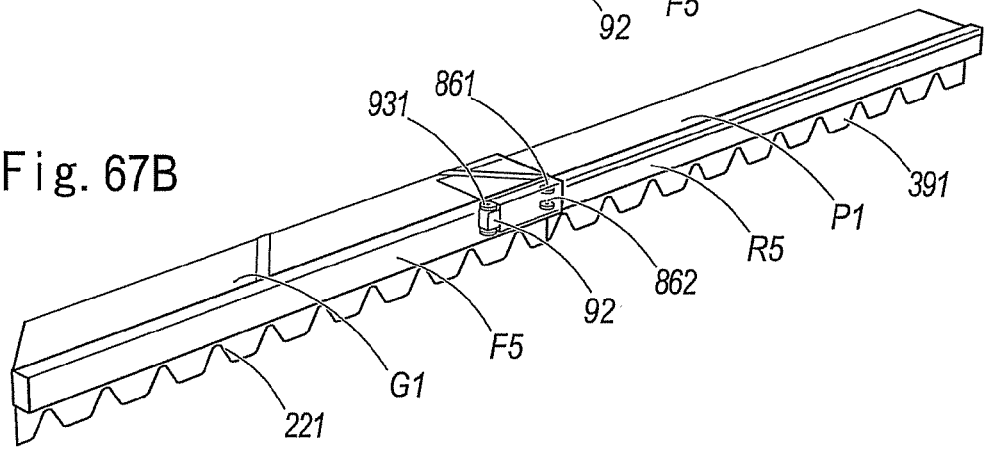
Figure 68:
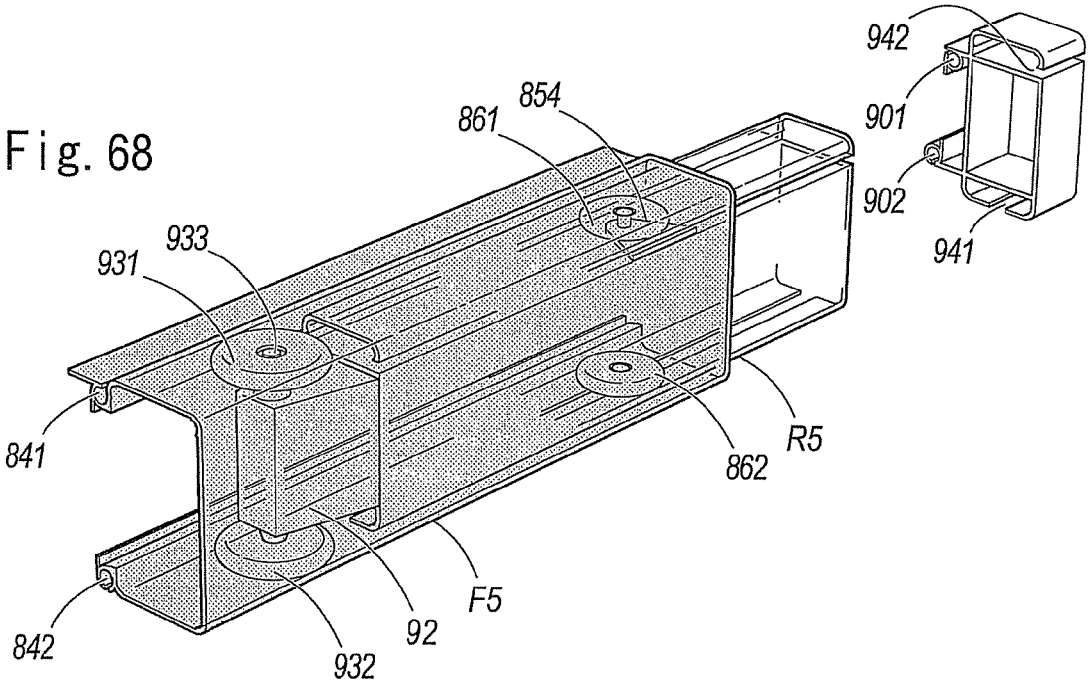
Figure 69A:
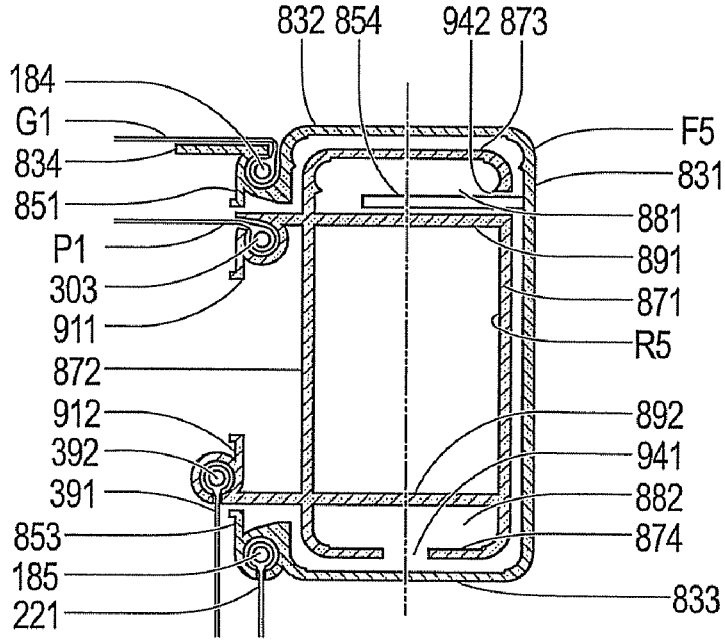
Figure 69B:
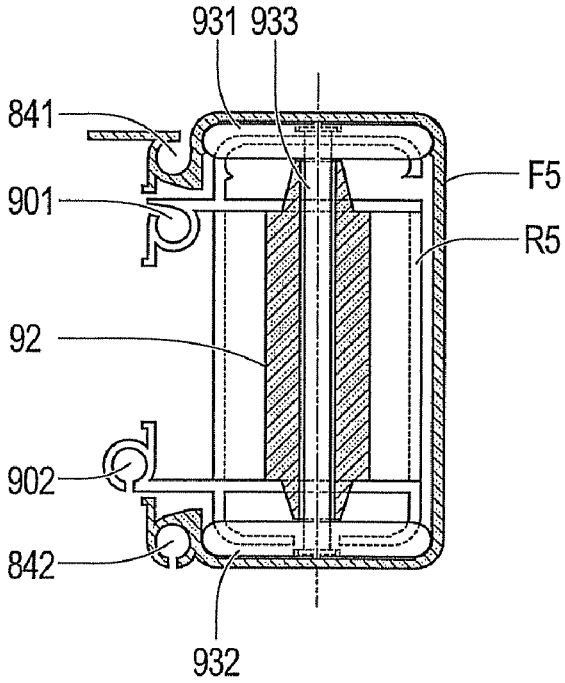
Figure 69C:
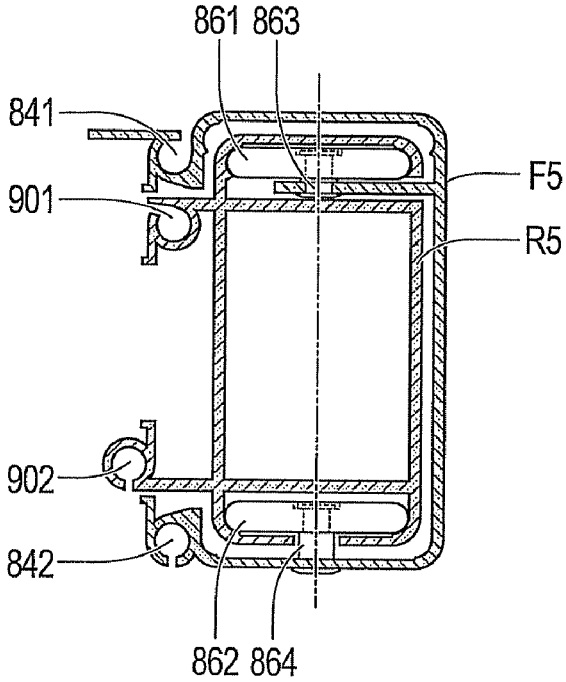

FIGS. 1(A) and 1(B) are perspective diagrams showing the first example of the complex device SQII1 where the portions on the two sides of a projected corner portion face each other, and FIG. 1(B) is a perspective diagram with a see-through portion;

FIGS. 2(A) and 2(B) are perspective diagrams showing the complex device SQII1 where the foldable arms are freely foldable into two in the case where the projected corner canvas which extends into a corner space portion and the rectangular canvas overlap through a relatively short margin, and FIG. 2(B) shows a state where the projected corner canvas and the front bar thereof are separated from the front bar of the rectangular canvas;

FIGS. 3(A) and 3(B) are longitudinal cross sectional side diagrams showing the main portion of the complex device SQII1, and FIG. 3(A) shows a foldable arm for supporting the front bar and brackets for the two end portions thereof, front and rear, with dotted lines. FIG. 3(B) shows a manually operable device for the winding roller;

FIGS. 4(A) to 4(C) are longitudinal cross sectional perspective diagrams and exploded perspective diagrams showing portions in the vicinity where the projected corner canvas and the rectangular canvas overlap, and FIG. 4(B) shows the lower half portion of the roller main body, the slider which is incorporated in it, the rear portion of the projected corner canvas, a connection wire which penetrates through this canvas and a rectangular canvas beneath the wire, which are located in different levels from top to bottom in this order. In addition, FIG. 4(C) shows the front bar of the projected corner canvas, the front bar of the rectangular canvas and the bracket for a foldable arm on the right, in the middle and on the left, respectively;

FIGS. 5(A) and 5(B) are cross sectional plan diagrams showing the complex device SQII1, and FIG. 5(A) shows a case where the spread projected corner canvas extends into a corner space portion and FIG. 5(B) shows a case where the projected corner canvas has receded in the rear portion of the winding roller;

FIGS. 6(A) to 6(C) are perspective diagrams showing the main portion of a canvas winding device into which a manually operable device is incorporated, and FIG. 6(B) shows component members such as a casing, a winding roller, a slider and a manually operable device in an exploded view. FIG. 6(C) shows partially enlarged main portions of the winding roller and the slider and screws for securing a base end portion of a connection wire between them;

FIGS. 7(A) to 7(C) are exploded perspective diagrams showing the projected corner canvas, the front skirt thereof and wires for these, and FIG. 7(C) shows partially enlarged two end portions of connection wires on the left and right;

FIGS. 8(A) and 8(B) are plan diagrams showing the projected corner canvas and a cross sectional diagram along line X-X showing enlarged wires which are inserted through crossing paths of this canvas. FIG. 8(C) shows a state where an engaging flap that is formed so as to protrude from the vicinity of the front end of the top hem of the projected corner canvas shown in FIG. 44(A) (which is described below) is cut with dotted lines and a state where this protrusion is folded, sewn and attached with broken lines;

FIGS. 9(A) and 9(B) are perspective diagrams showing the main portion of a canvas winding device where an electrically driven motor is incorporated into a winding roller and component members thereof;

FIGS. 10(A) to 10(D) and FIGS. 11(A) to 11(D) are perspective diagrams and plan diagrams showing the projected corner canvas that extends into a corner space portion, the projected corner canvas that has receded and the process for winding the rectangular canvas, and when the diagrams are viewed in the opposite order, the process for unwinding and spreading the two canvases and the process for moving the projected corner canvas toward the corner space portion are shown;

FIGS. 12(A) to 12(C) are a perspective view and longitudinal cross sectional diagrams showing a winding roller where a bulk ring is inserted and engaged, and FIG. 12(B) shows a bulk portion in a place close to the front end of the roller and FIG. 12(C) shows a cross section of the roller main body in a location in the rear half;

FIGS. 13(A) to 13(C) are perspective diagrams showing the process for winding the projected corner canvas and the rectangular canvas that have receded;

FIGS. 14(A) to 14(D) and FIGS. 15(A) to 15(D) are perspective diagrams and plan diagrams showing the operational process of the complex device SQII2 according to the second embodiment where a synchronizing belt is stretched;

FIGS. 16(A) to 16(D) are a perspective diagram and longitudinal cross sectional diagrams showing a winding roller where a bulk ring is inserted and engaged, and FIG. 16(B) shows the belt winding portion in a front end portion of the roller main body, FIG. 16(C) shows a bulk portion in a portion close to front end of the roller and FIG. 16(D) shows a cross section of the roller main body in a portion in the rear half;

FIGS. 17(A) to 17(C) are perspective diagrams showing the process for winding projected corner canvas, the rectangular canvas and the synchronizing belt that have receded;

FIGS. 18(A) to 18(D) and FIGS. 19(A) to 19(D) are perspective diagrams and plan diagrams showing the operational process of the complex device SQII3 according to the third embodiment where a long rectangular canvas of which the length is approximately the same as that of the winding roller and a projected corner canvas are combined;

FIGS. 20(A) to 20(D) and FIGS. 21(A) to 21(D) are perspective diagrams and plan diagrams showing the operational process of the complex device SQII4 according to the fourth embodiment where the projected corner canvas is a triangular canvas in an approximate triangular form;

FIGS. 22(A) and 22(B) are perspective diagrams showing a case where the triangular canvas is wound around the winding roller of the complex device SQII4 from beneath, and FIG. 22(A) shows an exploded state before the top hem of the triangular canvas is attached to the slider and FIG. 22(B) shows a case where the triangular canvas and the rectangular canvas are wound around the winding roller in such a manner so that the canvases overlap or a case where the canvases are unwound and spread;

FIGS. 23(A) to 23(D) and FIGS. 24(A) to 24(D) are perspective diagrams and plan diagrams showing the operational process of the complex device SQII5 according to the fifth embodiment where the foldable arms are in a reverse y shape;

FIGS. 25(A) to 25(D) and FIGS. 26(A) to 26(D) are perspective diagrams and plan diagrams showing the operational process of the complex device SQII6 according to the sixth embodiment where a synchronizing belt is stretched;

FIGS. 27(A) to 27(D) and FIGS. 28(A) to 28(D) are perspective diagrams and plan diagrams showing the operational process of the complex device SQII7 according to the seventh embodiment where a long rectangular canvas of which the length is approximately the same as the winding roller and a projected corner canvas are combined;

FIGS. 29(A) to 29(C) show a state where a projected corner canvas and a rectangular canvas, of which the bulk cloth is sewn and attached, overlap and are wound around the winding roller and a state in the middle of being wound in a cross section;

FIGS. 30(A) and 30(B) are diagrams showing a linking structure in a complex device of which parts on the two sides of a projected corner portion face each other, and FIG. 30(A) shows a structure where diagonal gears or bevel gears engage with each other, and FIG. 30(B) shows a manually operable gear linking device;

FIGS. 31(A) to 31(C) are perspective diagrams showing the complex device SUII1 in the second group according to the first embodiment which is made up of an awning device for a projected corner and an awning device for a recessed corner, and FIG. 31(C) shows a state where the projected corner canvas and the front bar thereof are moved to the front and separated;

FIGS. 32(A) to 32(D) and FIGS. 33(A) to 33(D) are perspective diagrams and plan diagrams showing the operational process of the complex device SUII1 in the case where a margin through which the projected corner canvas and the recessed corner canvas overlap is relatively short;

FIGS. 34(A) to 34(D) and FIGS. 35(A) to 35(D) are perspective diagrams and plan diagrams showing the operational process of the complex device SUII2 according to the third embodiment where a long recessed corner canvas of which the length is approximately the same of that of the winding roller and a projected corner canvas are combined;

FIGS. 36(A) and 36(B) are perspective diagrams showing a complex device SQSIV1 in the third group which is attached between two projected corner portions according to the first embodiment; FIG. 36(B) shows a rectangular awning device in a middle portion in such a state that the front portion of the awning device for a projected corner in front and rear portions is separated to the front;

FIGS. 37(A) to 37(D) are plan diagrams showing the operational process of the complex device SQSIV1, and FIGS. 37(B) to 37(D) show the process for winding two projected corner canvases, front and rear, and a rectangular canvas which have receded in the vicinity of the center of the device;

FIGS. 38(A) to 38(C) are perspective diagrams showing a complex device SSII in the fourth group, where two awning devices for a projected corner which are combined in front-rear symmetry so that the backs face each other are attached between the two projected corner portions so as to shift in the up-down direction; FIG. 38(C) shows the front bars of the awning devices for a projected corner in the front and rear portions in such a state as to be separated to the front from the transverse guide rail in the middle portion;

FIGS. 39(A) and 39(B) are longitudinal cross sectional side diagrams showing a main portion of the complex device SSII where two sliders are incorporated into a winding roller, and FIG. 39(A) shows a foldable arm for supporting the front bar and brackets in the two end portions, front and rear of the arm with dotted lines. FIG. 39(B) shows a manually operable device for the winding roller;

FIGS. 40(A) to 40(C) are longitudinal cross sectional perspective diagrams and an exploded perspective diagram showing a portion in the vicinity where two projected corner canvases overlap, and FIG. 40(B) shows the lower half portion of the roller main body, one slider which is incorporated into it, the rear portion of a projected corner canvas, a connection wire which penetrates through the canvas, another slider located beneath the wire and a projected corner canvas which are located in different levels from top to bottom in this order. In addition, FIG. 40(C) shows the front bar of one projected corner canvas, the front bar of the other projected corner canvas and brackets for the transverse guide rail and the foldable arm, on the right, in the middle and on the left, respectively;

FIGS. 41(A) and 41(B) are cross sectional plan diagrams showing the complex device SSII, and FIG. 41(A) shows a case where the two spread projected corner canvases extend into corner space portions on the two sides, front and rear and FIG. 41(B) shows a case where the two projected corner canvases are drawn down from the corner space portions so as to overlap;

FIGS. 42(A) and 42(B) are perspective diagrams showing a main portion of a canvas winding device where an electrically driven motor is incorporated into a winding roller and the component members thereof;

FIGS. 43(A) to 43(D) and FIGS. 44(A) to 44(D) are perspective diagrams and plan diagrams showing the operational process of the complex device SSII, and FIGS. 43(B) to 43(D) show the process for making the two projected corner canvases that have receded from two corner space portions overlap and winding the canvases;

FIGS. 45(A) to 45(C) are perspective diagrams showing a complex device SQII1, where an engaging flap for the operation of moving a projected corner canvas transversely is formed; FIG. 45(A) shows an enlarged portion of the engaging flap; FIGS. 45(B) and 45(C) show the projected corner canvas in a projected state in a corner space portion and in a state where the canvas has slid backward;

FIGS. 46(A) to 46(C) are a perspective diagram and a plan diagram showing the entirety and a main portion of a complex device SQII1*a*, where a movement conveying rope for manual operation which transversely slides the projected corner canvas stretches between a V-shaped arm and the front bar;

FIGS. 47(A) and 47(B) are perspective diagrams showing the process through which the projected corner canvas slides backward and forward by means of a movement conveying rope;

FIGS. 48(A) and 48(B) are perspective diagrams showing the entirety and a main portion of a complex device SQII1*b* in which a movement conveying wire which stretches between a V-shaped arm and the front bar and a winding reel for the wire are incorporated;

FIGS. 49(A) and 49(B) are schematic diagrams showing a longitudinal cross section of a winding roller in which a winding reel is incorporated; FIG. 49(A) shows a case where the winding reel and the winding roller are individually rotated by means of two electrically driven motors, and FIG. 49(B) shows a case where the winding reel and the winding roller are driven by one electrically driven motor, which rotates in both directions;

FIGS. 50(A) and 50(B) are exploded perspective diagrams showing a main portion of a canvas winding device in which the winding roller shown in FIG. 49(A) according to the fourth example is incorporated, and the component members thereof;

FIGS. 51(A) and 51(B) are exploded perspective diagrams showing a main portion of a canvas winding device in which the winding roller shown in FIG. 49(B) according to the fifth example is incorporated, and the component members thereof;

FIGS. 52(A) to 52(D) are perspective diagrams showing the operational process of the complex device SQII1*b* in which a winding reel is incorporated operates, the process through which the projected corner canvas which is extended into a corner space portion slides backward, the receded projected corner canvas, and the process through which the rectangular canvas is wound;

FIG. 53(A) is a cross sectional plan diagram schematically showing the winding roller according to the fifth example and a rotational stopper thereof and FIG. 53(B) to FIG. 53(F) are diagrams showing the process in which a projected corner canvas that has extended into a corner space portion moves and recedes and is wound around the winding roller so as to be stored step by step, where each diagram shows the cross sections along lines a-a, b-b, c-c in FIG. 53(A) in this order from left and at the same time a perspective diagram showing the main portion in each stage is added on the right;

FIGS. 54(G) to 54(K) are diagrams showing the process through which the projected corner canvas is unwound and spread, and furthermore, the process through which the canvas moves forward toward the corner space portion so as to be extended in a tense state step by step and laid out in the same positional relationship as in the case of FIGS. 53(B) to 53(F);

FIGS. 55(A) and 55(B) are schematic diagrams showing longitudinal cross sections of winding rollers according to the sixth and seventh examples, where a differential gear mechanism is incorporated; FIG. 55(A) shows a case where the winding reel and the winding roller are driven by means of one electrically driven motor, and FIG. 55(B) shows a case where the winding reel and the winding roller are driven by means of a manually operable device;

FIGS. 56(A) and 56(B) are exploded perspective diagrams showing a main portion of a canvas winding device in which the winding roller according to the sixth example shown in FIG. 55(A) is incorporated, and the component members thereof;

FIGS. 57(A) and 57(B) are exploded perspective diagrams showing a main portion of a canvas winding device in which the winding roller according to the seventh example shown in FIG. 55(B) is incorporated, and the component members thereof;

FIGS. 58 to 61 are diagrams showing the complex devices SQL1•2 according to the first and second embodiments of lateral arm type;

FIGS. 58(A) and 58(B) are perspective diagrams showing the complex device SQL1, where devices are on the two sides of a projected corner portion as viewed from beneath; FIG. 58(B) is an exploded diagram showing a projected corner canvas, the front bar thereof and a movement conveying rope for operating and sliding the projected corner canvas in a hung state, as well as enlarged portions through which the movement conveying rope penetrates in the left and right portions of the lowest portion;

FIGS. 59(A) to 59(D) and FIGS. 60(A) to 60(D) are perspective diagrams and side diagrams showing the projected corner canvas which is projected into a corner space portion, the receded projected corner canvas and the process through which the rectangular canvas is wound, and when the diagrams are seen in reverse order, they show the process through which the two canvases are unwound and spread and the process through which the spread projected corner canvas moves transversely forward to the corner space portion;

FIGS. 61(A) to 61(C) are diagrams showing the complex device SQL2 according to the second embodiment, where the foldable arms for the front bar are replaced with extendable links having a pantograph structure; FIG. 61(B) is a side diagram showing an extendable link in such a state as to be extended so as to pull out and spread the canvases on the upper portion side and the lower portion side, and FIG. 61(C) is a side diagram showing the two canvases in a rolled-up state and the extendable link in a pushed in and folded state;

FIGS. 62(A) to 62(C) are diagrams showing the operational process of an elastic fluctuation flap which is attached to the front bar of the projected corner canvas;

FIGS. 63(A) to 63(C) are diagrams showing the rear surface close to the bottom hem of the projected corner canvas in the case where an extendable net for supporting the projected corner canvas in a tense state is spanned; FIG. 63(B) shows the longitudinal cross section when the canvas is spread; FIG. 63(C) shows the longitudinal cross section when the canvas is wound and stored;

FIGS. 64(A) and 64(B) are a perspective diagram and an exploded diagram showing the winding roller according to the eighth example where the sliders that are incorporated into the winding rollers according to the first to seventh examples are replaced with slide caps;

FIG. 65 is a cross sectional diagram showing a rectangular canvas or a recessed corner canvas which is engaged in a canvas engaging trench created in the roller main body and an enlarged main portion where a slide cap engaged in the top hem of a projected corner canvas is incorporated into the slide guide trench that is created in a location adjacent to the rectangular canvas or the recessed corner canvas in a movable state;

FIGS. 66(A) and 66(B) show a case where two slide guide trenches are created in the roller main body, where FIG. 66(A) shows a cross section of an enlarged main portion of the fourth type complex device to which two projected corner canvases are attached in a spread state and FIG. 66(B) shows a case where a projected corner canvas and another canvas are attached to the first to third types of complex devices;

FIGS. 67(A) and 67(B) are perspective diagrams showing the front portion of a complex device in a case where the front bar is replaced with a structure which moves while rotating, where FIG. 67(A) shows the complex device when the outer portion recedes and is stored and FIG. 67(B) shows the complex device when the outer portion has moved forward and is pushed out;

FIG. 68 is a perspective diagram showing the main portion in such a state that the front bar shown in FIG. 67(B) is inserted and engaged; and FIGS. 69(A) to 69(C) are longitudinal cross sectional side diagrams showing the respective parts in FIG. 68, and FIG. 69(B) shows a cross section in the location through which upper and lower guide wheels which are incorporated in the inner front end portion are connected and FIG. 69(C) shows a cross section in the location where upper and lower guide wheels which are incorporated in the outer rear end portion are connected.

BEST MODE FOR CARRYING OUT THE INVENTION

In the following, the embodiments of the present invention are described in reference to the accompanying drawings. First, foldable arm type complex device shown in FIGS. 1(A) to 44(D) and the configurations relating to this are described.

Second, embodiments are described in the case where a projected corner canvas in the complex device is transversely slid by means of a manual operable movement conveying rope as shown in FIGS. 46(A) to 47(B), the projected corner canvas is transversely slid by means of an electrically driven motor or a manually operable device shown in FIGS. 48(A) to 57(B) and winding or unwinding drive is carried out.

Third, the lateral arm type complex device shown in FIGS. 58(A) to 61(C) and configurations relating to this are described. In addition to this, fourth, a device for supporting a canvas in a tense state when the canvas is stored and the canvas is spread for the complex device is described.

Finally, the winding roller for a number of canvases according to another embodiment is described.

Concerning Foldable Arm Type Complex Device

This type of complex devices can be divided into first to fourth groups for the sake of convenience, and from among these the complex devices SQII1 to 7 in the first group are attached as shown in FIGS. 1(A) to 28(D) in a place where the front end portion of the device is, for example, a projected corner portion N1 on one side of a building and the front wall W1 and the side wall W2 which continue to rear of the corner portion are straight line sections (slight curve sections are also possible).

As shown in FIGS. 31(A) to 35(D), the complex devices SUII1 and 2 in the second group are attached to a straight line section in a portion on the outer wall W1 where one side is a projected corner portion N1 and the other side is a recessed corner portion L.

As shown in FIGS. 36(A) to 37(D), the complex device SQSIV in the third group is attached to portions of outer walls W1 and W2 where the two end portions, front and rear are projected corner portions N1 and N2 and the straight line section between these is relatively long.

As shown in FIGS. 38(A) to 44(D), the complex device SSII in the fourth group is attached to a straight line section where the distance between one projected corner portion N1 and the other project corner portion N1 is relatively short in comparison with the case of the third group.

In the following, the complex devices in the first to fourth groups are described in sequence in reference to the accompanying drawings.

Concerning Complex Devices in First Group

In the complex devices in this group, awning devices S1 and S2 for projected corner canvases G1 and G2 which cover the corner space portion in the projected corner portion N1 (hereinafter referred to as awning devices for projected corner) and awning devices Q1 and Q2 for rectangular canvases P1 and P2, which are either long or short, for covering the outside of a building in straight line sections (hereinafter referred to as rectangular awning devices) are combined and integrated.

FIRST EMBODIMENT

The configurations of the respective portions in the awning device S1 for a projected corner and a rectangular awning device Q1 in the complex device SQII1 according to the first embodiment shown in FIGS. 1(A) to 11(D) and the relationship between the respective portions which are organically combined are described.

(1) Concerning Canvas Winding Device

K1 is a casing for supporting the winding roller J1 via bearings, which is directly attached to a wall portion on the outer walls W1 (front wall) and W2 (side wall) in the straight line section between the portion close to the corner of the projected corner portion N1 and the rear in an approximate horizontal state or indirectly attached via an appropriate support bracket (not shown) so as to be secured in such a manner so that the angle at which it is inclined is variable and freely adjustable if necessary.

As shown in FIGS. 6(B) and 6(C), the winding roller J1 is made up of a roller main body 11 in hollow cylindrical form that has been extruded in a mold and a slider 12 which is inserted and supported inside the roller main body so as to be freely slidable and so that the projected corner canvases G1 and G2 and the rectangular canvases P1 and P2 can be wound or unwound in such a state that the canvases overlap.

111 is a slit created on the surface of the roller main body 11 are in the direction of the axis line and 112 is a guide path for the slider 12 that is formed inside the slit (hereinafter referred to as slide guide path) where the center protrusion of the slider 12 is engaged in the above described slit 111 and the main body portion of the slider 12 is engaged in the slide guide path 112. 110 is a canvas engaging trench in Ω shape to which the rectangular canvases P1 and P2 are attached, and which is created parallel to the direction of the axis line so as to be adjacent to the above described slide guide path 112. 121 is a canvas engaging trench in Ω shape which is created in the center protrusion of the slider 12 and to which the projected corner canvas G1 is attached.

123 indicates wing plate portions having a slit 122, which extend from both sides of the main body portion of the slider 12. 124 indicates small wheels which are engaged in the slits 122 with an appropriate gap, which are attached by means of pins 125 so as to be freely rotatable and guide the rail trenches 113 created on the side wall portions of the above described slide guide path 112 while rotating.

131 indicates an opening through which a canvas is drawn out and which is created in the front of the casing K1, 141 and 142 indicate end caps which are engaged with the two end portions, front and rear, of the casing K1, and have bearing portions 143 and 144 which protrude in the inside of the end caps and where round holes are provided. 151 and 152 indicate end caps which are engaged with the two end portions, front and rear of the roller main body 11, and support axes 153 and 154 which penetrate through the cap main body portion so as to be secured are engaged with the above described bearing portions 143 and 144, respectively, so as to be freely rotatable.

161 indicates a worm gear which is engaged with and secured to the support axis 153 of the end cap 151, and 162 is a worm gear which engages with the worm gear 161 in such a manner so that, as shown in FIG. 3(B), the rotational axis 163 of the worm gear is supported horizontally to the upper and lower bearing portions 145 inside the end cap 141 and a hook 164 which engages with the operation rod (not shown) is formed in the lower end portion. As a result, the winding roller J1 can be manually operated so as to be freely rotatable forward and backward.

Here in the case of the above, the casing K1 is not necessary when the end caps 141 and 142 are attached so as to protrude from the outer walls W1 and W2 as the brackets for the bearings of the winding roller J1.

(2) Concerning Corner Canvas

Here, the configuration of the projected corner canvas G1 shown in FIGS. 7(A) to 7(C) and 8(A) and 8(B) and wires which are incorporated are described.

The projected corner canvas G1 is raw fabric for a tent made of plain cloth or a synthetic resin in trapezoid form with approximate right angles in a spread state, and made up of the canvas main body portion X1 in rectangular form and a canvas protrusion X2 in the form of a right angled triangle which is projected from one side.

In terms of the outer shape, the top side 1 of the upper end portion of the canvas (hereinafter referred to as "top hem of canvas") and the bottom side 2 of the lower end portion of the canvas (hereinafter referred to as "bottom hem of canvas") are parallel to each other, and a diagonal side 3 of which the angle of inclination is at approximately 45 degrees is placed between the front end portion of the bottom hem of the canvas 2 and the front end portion of the top hem 1 of the canvas so as to spread toward the bottom, and in addition, a perpendicular side 4 (hereinafter referred to as perpendicular portion of canvas) is placed between the rear end portion of the bottom hem 2 of the canvas and the rear end portion of the top hem 1 of the canvas.

181 and 182 are through holes in bag form which are created in the top hem 1 of the canvas and the bottom hem 2 of the canvas, and fixing members, such as a wire 183 or 184, a tube or a rope, penetrate through the inside of the holes.

191 and 192 are through holes in bag form which are created so as to cross along diagonal lines connecting the four corner portions of the canvas main body portion X diagonally, and canvas tensing members, such as a connection wire 193 or 194, a connection belt or a rope, penetrate through the inside of the holes. An engaging piece 195 or 196 of the front end portion of the wire is drawn out diagonally upward from the opening through which the top hem of the crossing through holes 191 and 192. The bottom end portion of the wire and the fixture for the wire 197 or 198 are drawn out diagonally downward from the opening at the bottom of the crossing through holes 191 and 192.

Therefore, in order to attach the projected corner canvas G1 to the winding roller J1, first, the top hem 1 of the canvas is placed in such a manner so as to face the canvas engaging trench 121 for the slider 12, and the attachment wire 183 penetrates through the hole 181, and thus, the top hem 1 of the canvas is fixed so that the end is prevented from returning.

Next, screws 101 are screwed in front and rear portions of the canvas engaging trench 121 as shown in FIGS. 4, 5 and 6(C) so that engaging pieces 195 and 196 of the connection wires 193 and 194 that have been drawn out from the opening through which the top hem is drawn out are engaged in the above described engaging trench 121 and screws 102 are screwed from the outside the engaging pieces 195, and thus, the engaging pieces 195 and 196 are pinched and the position thereof is secured.

On the other hand the rectangular canvas P1 is raw fabric for a tent made of cloth or a synthetic resin in the same manner as the projected corner canvas G1 and in long rectangular form when spread. As shown in FIGS. 4(B), 5(A) and 5(B), through holes in bag form are created in the top hem 5 and the bottom hem 6 of the canvas which are parallel and the two end portions, front and rear, are perpendicular portions 7 and 8 of the canvas.

Thus, the top hem 5 of the canvas faces the canvas engaging trench 110 in the rear half portion of the winding roller J1 and the attachment wire 302 penetrates through the through hole in the hem and the end is prevented from returning, and thus, the rectangular canvas P1 is attached to the winding roller J1.

As a result, the top hem 1 of the projected corner canvas G1 is attached to one winding roller J1 so as to be freely slidable and the top hem 5 of the rectangular canvas P1 is secured.

(3) Concerning Front Bars

F2 indicates a front bar to which the bottom hem 2 of the projected corner canvas G1 is attached, and the front plate portion 341 thereof has a surface in arched form (perpendicular surface is also possible) and the rear surface portion has an opening created therein.

In FIGS. 3(A), 4(A) and 4(C), 351 and 352 indicate an upper engaging trench having an opening facing upwards and a lower engaging trench having an opening facing downwards, which are created in the upper plate portion 342 and the lower plate portion 343 which extend from the upper and lower portions in the front of the front bar F2 towards the rear in the longitudinal direction. 344 and 345 indicate through holes created in the vicinity of the center and in the vicinity of the rear end of the upper plate portion 342.

R2 indicates a front bar to which the bottom hem 6 of the rectangular canvas P1 is attached and which slides and guides the front bar F2 of the projected corner canvas G1, and the front plate portion 361 thereof has a surface in arched form (perpendicular surface is also possible) which is approximately the same as the above described front bar F2 and the front bar F2 can be inserted into, engaged with and supported by this front bar R2.

371 and 372 indicate an upper guide trench and a lower guide trench created in the upper plate portion 362 and the lower plate portion 363 of the front bar R2, and the protrusion of the upper engaging trench 351 in the front bar F2 and the protrusion of the above described lower engaging trench 352 are inserted into and engaged with the upper guide trench 371 and the lower guide trench 372, respectively. 381 and 382 indicate an upper engaging trench having an opening facing upwards and a lower engaging trench having an opening facing downwards, which are created in a portion with steps formed in the rear half portions of the upper plate portion 362 and the lower plate 363 in the above described front bar R2 in the longitudinal direction. 364 and 365 are flange portions which are formed in the rear surface portions of the upper and lower plate portions 362 and 363 of the front bar R2 and arm attaching plates 264 are engaged with and supported by portions on the rear surface which are close to the two end portions, front and rear, of the front bar R2.

Thus, as shown in FIGS. 3(A) and 4(A) to 4(C), the bottom hem 6 of the rectangular canvas P1 faces the upper engaging trench 381 in the front bar R2 and the attachment wire 303 penetrates through the hem and the end is prevented from returning. In addition, the bottom hem 2 of the projected corner canvas G1 faces the upper engaging trench 351 in the front bar F2 and the attachment wire 184 penetrates through the through hole 182 in the hem, and thus, the end of the wire is prevented from returning through the bottom hem 2 of the canvas.

Next, the end portions of the connection wires 193 and 194 that have been drawn out through the opening at the bottom penetrate through the holes 344 and 345 shown in FIGS. 4(C), 5(A) and 5(B), the projected corner canvas G1 is stretched in an appropriately tense state and fixtures 197 and 198 are secured with screws.

As a result, the bottom hem 3 of the projected corner canvas G1 and the bottom hem 6 of the rectangular canvas P1 are attached to the front bar F2 and the front bar R2, respectively.

In FIGS. 3(A) and 7(A), 221 is a front skirt which is formed so as to hang from the front bar F2, where the through hole 222 created in the top hem of this skirt faces the lower engaging trench 352 in the front bar F2 and the attachment wire 185 penetrates through the hole and the end is prevented from returning.

391 indicates a front skirt which is formed so as to hang from the front bar R2, where the top hem of this skirt faces the lower engaging trench 382 and the attachment wire 392 penetrates through the hole and prevents the end from returning.

Here 241 indicates an engaging portion (engaging hole is also possible) which is formed so as to protrude from the location at the bottom of which is close to the rear end in the middle area of the front bar F2, and the front end portion of the operational rod (not shown) is engaged with this engaging portion 241 so that the operation for transversely moving the spread projected corner canvas G1 becomes easy.

(4) Concerning Foldable Arms

V1 and V2 indicate lateral V-shaped foldable arms (hereinafter referred to as V-shaped arms), which are a pair of arms that are foldable into two and support the portions of the front bar R2 on the two sides, front and rear, and the rear link 251 and the front link 252 are connected so as to be freely foldable into two inwards, and a spring or a pulling wire (not shown) is incorporated into this connection portion that is foldable into two so that these V-shaped arms V1 and V2 are pressed in the direction in which they extend.

261 indicates brackets for supporting the base end portions of the V-shaped arms V1 and V2, that is to say, the base end portions of the rear links 251 around pins, which are attached to the outer walls W1 and W2 in the locations of the above described casing K1 at the bottom, and the bracket 261 for one V-shaped arm V1 and the bracket 261 for the other V-shaped arm V2 are attached to a location in the front end portion of the winding roller J1 close to the corner of projected corner portion N1 and a portion in the vicinity of the rear portion of the winding roller J1, respectively, with a space in between.

262 indicates brackets for supporting the front end portions of the V-shaped arms V1 and V2, that is to say, the front end portions of the front links 252 around pins, and as shown in FIG. 4(C), the front end portions of the brackets 262 are pressed against the rear surface portion of the front bar R2 so that the brackets 262 are secured to the front bar R2 by means of screws 265 which are screwed into the arm attaching plate 264 that is engaged with a portion on the rear surface of the front bar R2.

(5) Concerning Electrically Driven Structure of Winding Rollers

The above described winding roller J1 is manually operable through rotation, while the winding roller J2 in the second example shown in FIGS. 9(A) and 9(B) is rotated forward and backward by means of an electrically driven motor M1 in columnar form which is incorporated in the roller main body 11.

In these figures, the electrically driven motor M1 penetrates through the rear portion of the roller main body 11, and a motor output axis 271 and an axis portion for fixture 272 protrudes from the front end portion and the rear end portion of the motor, respectively.

281 indicates a movement conveying socket with a notch 283 which engages with the roller main body 11, and a motor output axis 271 is engaged in a hole 282 in this axis. 155 indicates a through hole in the end cap 152 and the rear portion of the electrically driven motor M1 is supported by this through hole 155 via a bearing.

Thus, the movement conveying socket 281 is engaged with and secured to the motor output axis 271 and the electrically driven motor M1 penetrates through the rear portion of the roller main body 11 while the end cap 152 penetrates through the rear portion of the main body of the electrically driven motor M1, and in addition, is engaged with the rear end portion of the roller main body 11, and thus, the rear end axis portion 272 of the electrically driven motor M1 is engaged in and secured in a long hole (square hole is also possible) in the bearing portion 145 of the end cap 142. As a result, the electrically driven motor M1 is incorporated in the roller main body 11.

Accordingly, when the electrically driven motor M1 is driven, the output axis 271, the movement conveying socket 281 and the roller main body 11 rotate forward and backward together, so that the operation of winding and unwinding the projected corner canvas G1 and the rectangular canvas P1 are automated and energy is conserved.

Figure 10A:
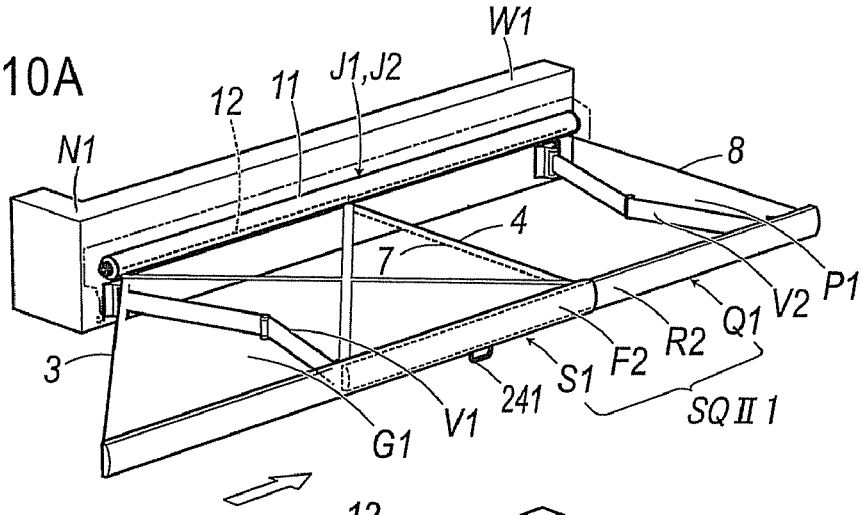
Figure 11A:
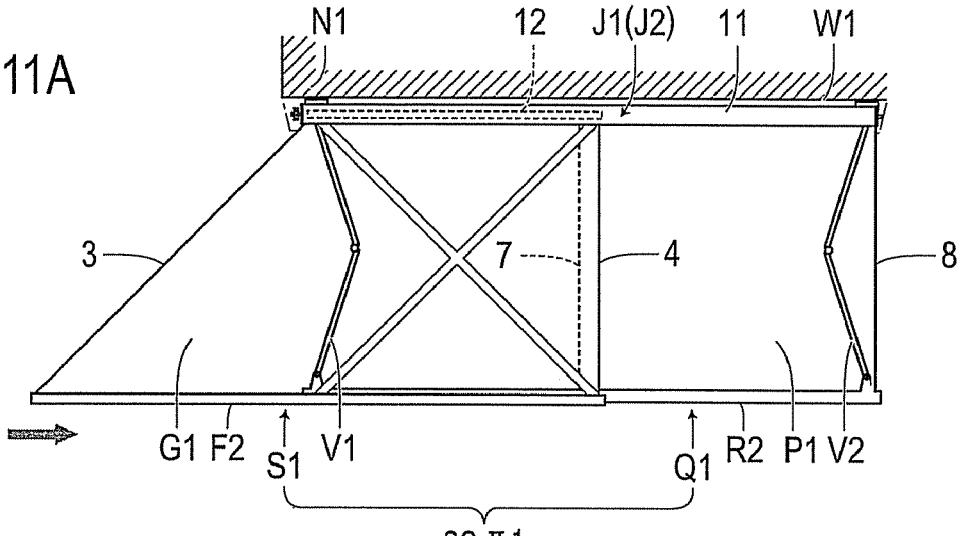

Concerning Process for Winding and Storing Projected Corner Canvas and Rectangular Canvas As shown in FIGS. 10(A) and 11(A), when the projected corner canvas G1 which extends into the corner space portion and the rectangular canvas P1 which spreads to the front are wound up and stored, first an end hook portion of an operation rod (not shown) is hooked from below onto the engaging portion 241 of the front bar F2, and then the rod is operated so as to slide to the rear. At this time, in the case where the engaging portion 241 is at such a level that it can be reached from below by hand, the engaging portion 241 is held and pulled backward through operation.

Thus, the projected corner canvas G1 is pulled down to the rear while remaining in a spread state, and at this time, the front bar F2 of the bottom hem 2 of, the canvas recedes along the front bar R2 of the rectangular canvas P1, and together with this, the slider 12 of the top hem 1 of the canvas recedes along the slide guide path 112.

Figure 10B:
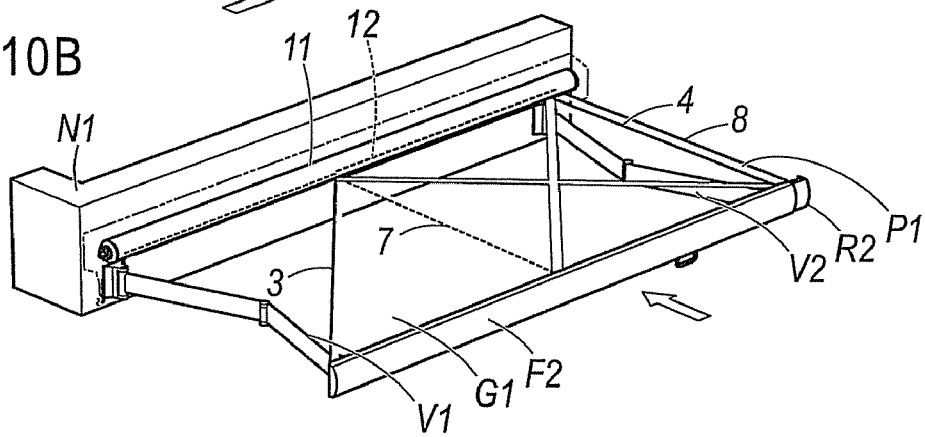
Figure 10C:
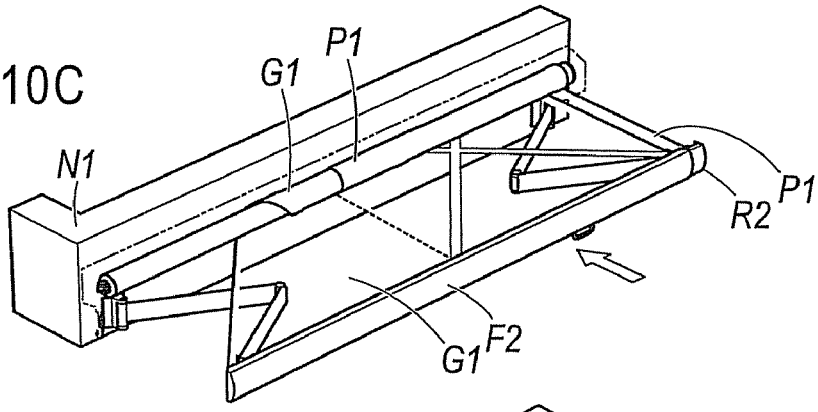
Figure 10D:
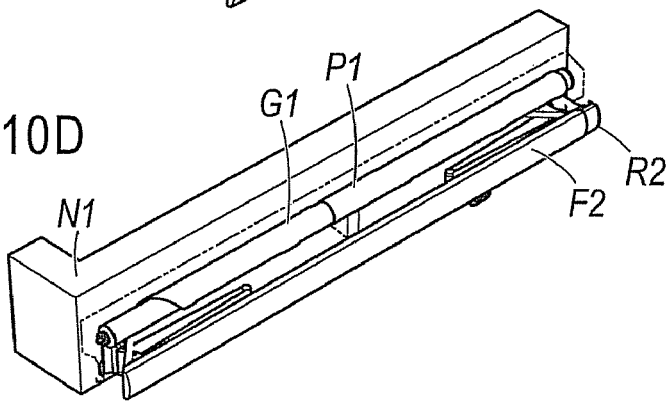
Figure 11B:
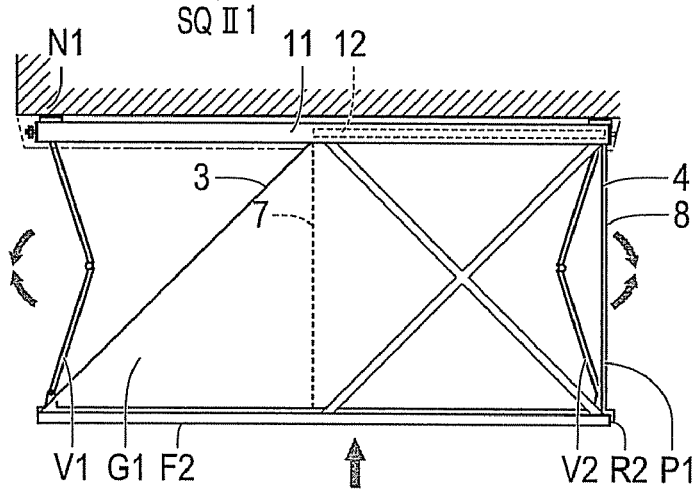
Figure 11C:
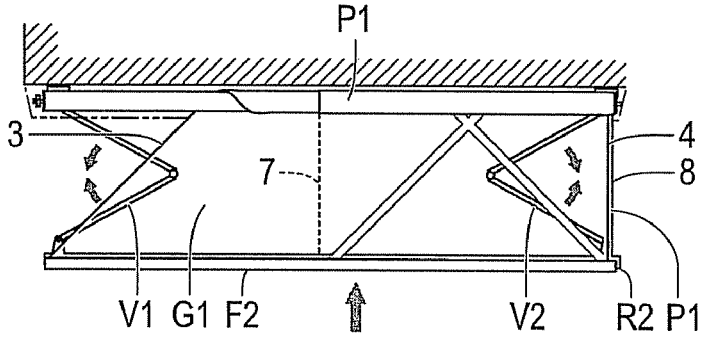
Figure 11D:
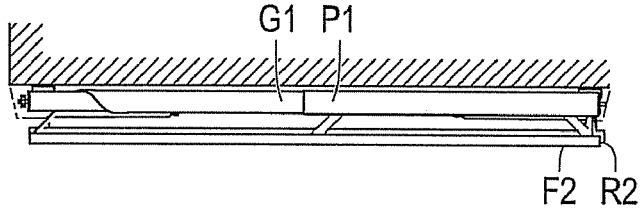

As a result, the projected corner canvas G1 transversely slides parallel to the rear portion of the device, as shown in FIGS. 10(B) and 11(B), and thus overlaps with the rectangular canvas P1 on the upper side.

Naturally, the slider 12 of the top hem 1 of the canvas recedes to the rear half portion of the roller main body 11, or at least the canvas protrusion X2 in triangular form is pulled down to a location in the rear to such a degree that it does not protrude from the projected corner portion N1 along the lines connecting side walls W2.

Next, in the case of the winding roller J1 in the first example shown in FIG. 6, an operation rod (not shown) is engaged with the hook 164 of the manually operable device for rotatary operation. In addition, in the case of the winding roller J2 in the second example shown in FIG. 9, the electrically driven motor M1 is driven for winding.

Thus, the projected corner canvas G1 and the rectangular canvas P1 are wound around the winding rollers J1 and J2 from below in such a state so as to overlap with the surface of the respective top hems 1 and 5 of the canvases facing inward and the rear surface facing outward and wound up, as shown in FIGS. 10(C), 10(D), 11(C) and 11(D).

At this time, the V-shaped arms V1 and V2 are folded against an opening and pressing force resulting from a spring incorporated in the connection portions, which are foldable in two, and folded into a compact space for storing the canvases with the front bar R2 and the front bar F2, which is inserted and engaged with the front bar R2 moving linearly and in parallel to the wall portion.

In the case of the above, the connection wires 193 and 194 cross between and connect the front bar F2 and the slider 12 so as to support the projected corner canvas G1 in a spread and tense state. Therefore, the canvas main body portion X1 can be prevented from being deformed within the surface when the spread projected corner canvas G1 moves transversely through operation, and thus, smooth forward and backward movement of the projected corner canvas G1 can be ensured.

Concerning Process for Unwinding and Spreading Projected Corner Canvas and Rectangular Canvas Next, in the case where the projected corner canvas G1 and the rectangular canvas P1 wound around the winding rollers J1 and J2 are spread to the front of the building, the operation rod, which is engaged with the hook 164 of the manually operable device, is operated so as to be rotated in the direction opposite to that above, or the electrically driven motor M1 is driven so as to be rotated in the direction for unwinding.

Thus, the projected corner canvas G1 and the rectangular canvas P1 wound around the winding rollers J1 and P1 are unwound, and in addition, an elastic, pressing force for the V-shaped arms V1 and V2 folded into the wall portion is released, and this force moves and rotates the V-shaped arms V1 and V2 in such a direction that they extend and spread, and as shown in FIGS. 10(D) to 10(B) and 11(D) to 11(B), the front bar R2, in which the front bar F2 is inserted and engaged, is linearly pushed out to the front while translating.

As a result, the projected corner canvas G1 and the rectangular canvas P1 are unwound to the front of the front wall W1 so as to be supported in a spread and tense state.

Next, the front end hook portion of an operation rod (not shown) is hooked onto the engaging portion 241 of the front bar F2 from below, and then the canvases are operated so as to slide toward the corner space portion, or in the case where the engaging portion 241 is at such a level as to be reachable by hand, the engaging portion 241 is held and pushed forward for the operation.

Thus, the projected corner canvas G1 translates and is pushed out into the corner space portion while remaining in a spread state. At this time, the front bar F2 of the bottom hem 2 of the canvas transversely slides along the front bar R2 and the slider 12 of the top hem 1 of the canvas transversely slides along the slit 111 and the slide guide path 112.

As a result, the projected corner canvas G1 moves forward in parallel, as shown in FIGS. 10(B), 10(A), 11(B) and 11(A), and the canvas spreading portion X2 extends into the corner space portion.

Accordingly, as shown in FIGS. 1(A) and 1(B), two sets of such complex devices SQII1 are attached to the corner location of the front wall W1 of the projected corner portion N1 and the corner location of the side wall W2 in such a manner so that they make contact at a right angle (obtuse or acute angle is also possible), and the two complex devices are independently operated for spreading the canvases, or the two are linked for the operation of spreading the canvases, and thus, the outside of the building, which includes the corner space portions of the projected corner portions N1, is covered, so that the appearance improves.

Concerning Uniform Winding of Projected Corner Canvas

When the projected corner canvas G1 and the rectangular canvas P1 are wound around the winding rollers J1 and J2, the canvas main body portion X1 and the rectangular canvas P1 are wound around the rear half portion of the rollers in such a state that the canvases overlap, and the canvas protrusion 2 for the projected corner canvas G1, where the width for winding gradually increases, is wound around the front half portion of the roller in a rolled-up state.

Therefore, when a side of the canvas protrusion X2 is wound, the canvas is deformed as it is wound, which creates conspicuous wrinkles on the spread canvas protrusion X2 when the projected corner canvas G1 is drawn out, and the appearance becomes poor.

Therefore, a means for preventing this problem is described in the following.

Concerning Bulk Ring

In FIGS. 12(A) and 12(B), 331 indicates a bulk ring which is wound around or engaged with the outer peripheral surface in approximately the front half portion of the roller main body 11 in spiral form, and the bulk ring is formed in spiral form with the outer diameter of the roller gradually increasing toward the front end portion of the roller from in the vicinity of the middle of the winding rollers J1 and J2, as required by the thickness of the raw material for the canvas.

A portion of the bulk ring 331 along the same line as the slide engaging trench 111 is formed so as to have a notch opening portion 332 in V shape in order to ensure that the spread projected corner canvas G1 slides transversely.

Accordingly, the bulk ring 331 is attached to the front half portion of the winding rollers J1 and J2 in steps, and thus, the bottom hem 2 of the canvas which spreads toward the bottom can be wound uniformly and with good balance in comparison with the top hem 1 of the canvas, as shown in FIGS. 13(A) to 13(C).

In the case of the above, the bulk ring 33 in spiral form is wound around or engaged in the front half portion of the winding rollers J1 and J2 in steps, and as a second-best measure, a bulk pipe (not shown) where the outer diameter of the surface of the cylinder gradually and continuously increases can be engaged in the roller so as to extend from the vicinity of the middle to the front end portion.

Concerning Bulk Cloth

In FIGS. 29(A) to 29(C), 32 indicates a bulk sheet with hems which is secured on the front surface side, close to the diagonal portion 3 of the canvas, and the film thickness gradually increases continuously from the top hem 1 to the bottom hem 2 of the projected corner canvas G1.

Figure 21A:
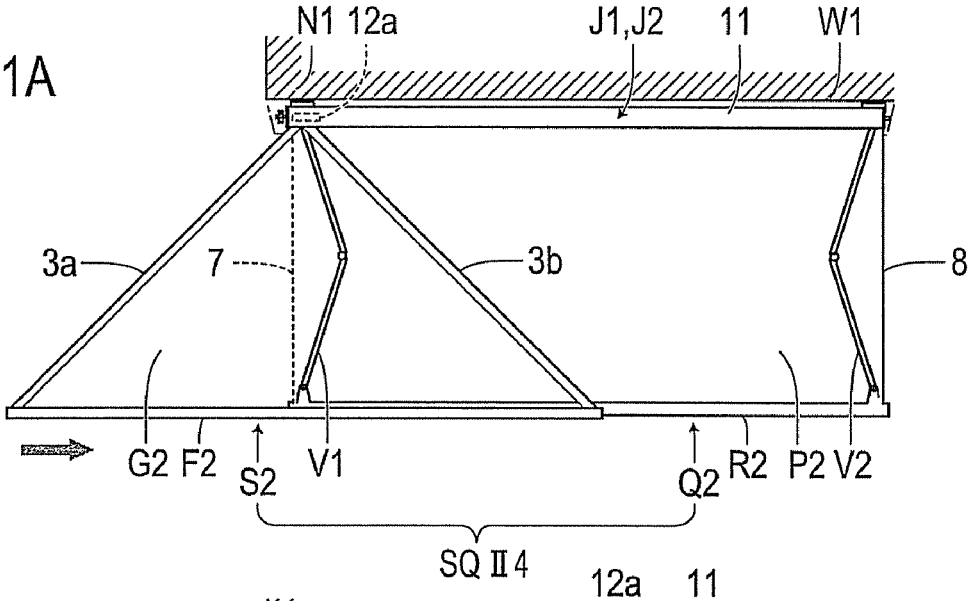
Figure 21B:
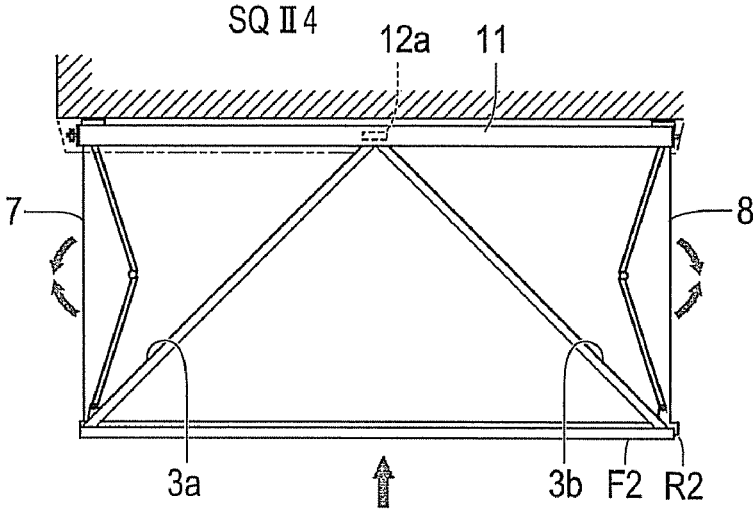
Figure 21C:
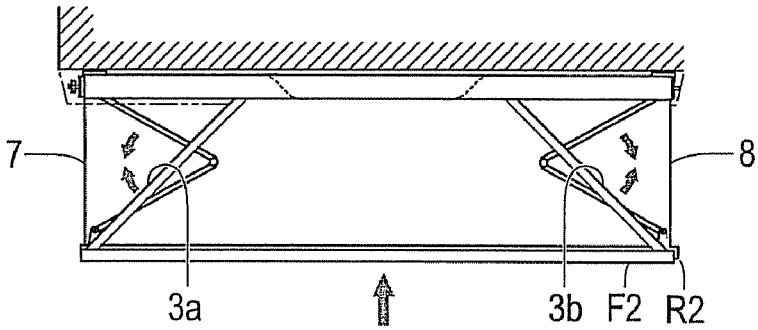
Figure 21D:
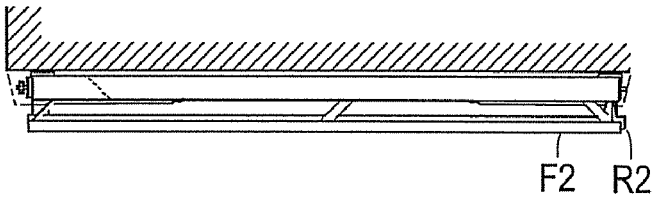

When the canvas protrusion X2 with this bulk sheet 32 is wound around the outer peripheral portion of the winding rollers J1 and J2 having the same diameter in roll form, a portion of the above described sheet 32 functions as a type of spacer, and is wound so as to be a bulk in spiral form, as shown in FIG. 21(C).

Here, though in the case of the above, the film thickness of the bulk sheet 32 increases gradually, the thickness can be increased in steps for every winding or every two windings.

SECOND EMBODIMENT

In FIGS. 14(A) to 14(D) and FIGS. 15(A) to 15(D) showing the complex device SQII2 in the second embodiment, 391 indicates a synchronizing belt, and the base end portion is attached to the front end portion of the roller main body 11, and the front end portion of the belt is attached to the front end portion of the front bar R2.

Figure 14A:
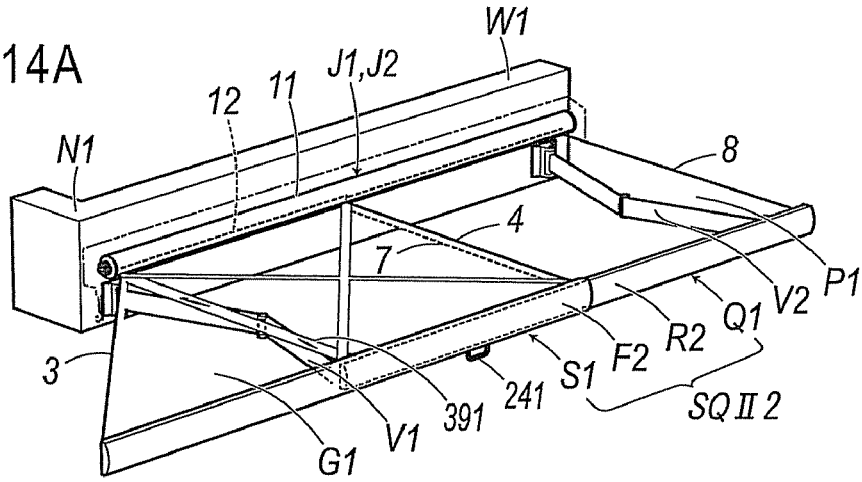
Figure 14B:
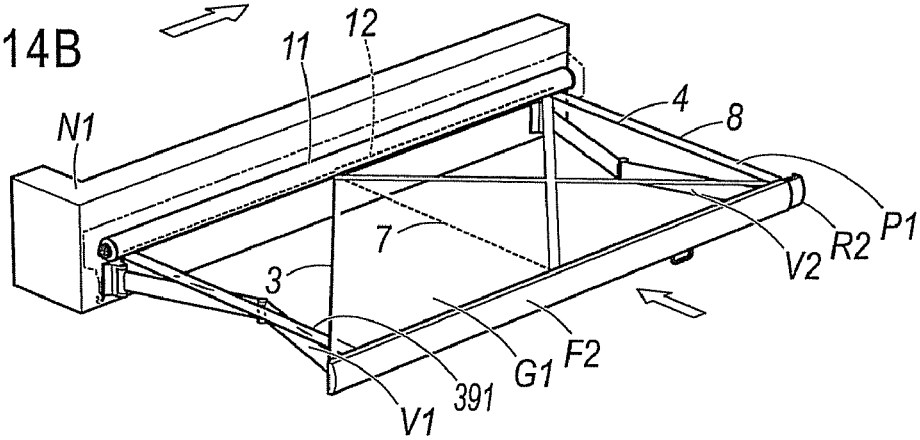
Figure 14C:
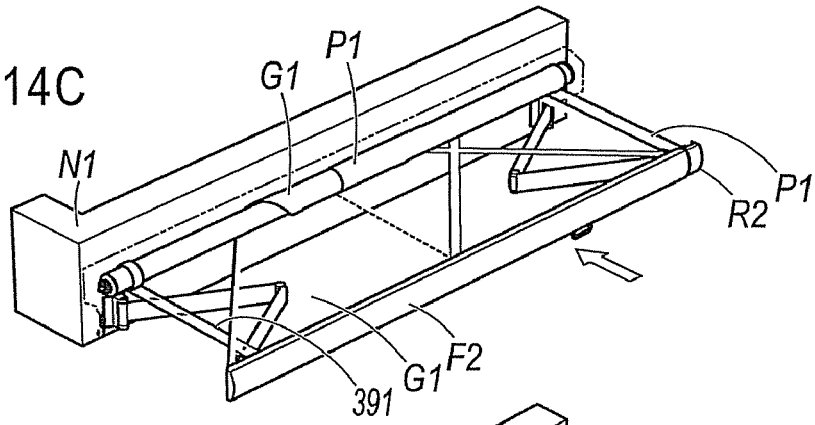
Figure 14D:
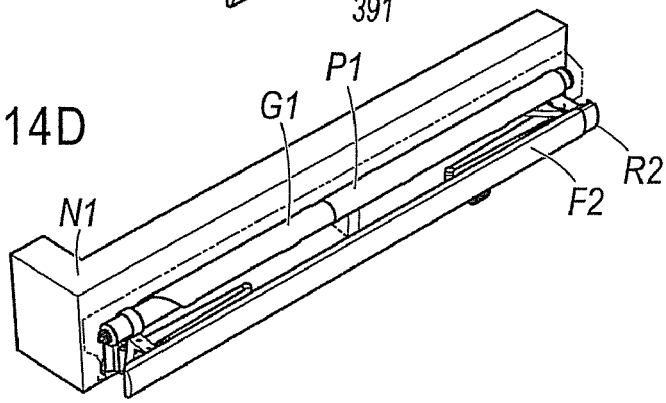
Figure 15A:
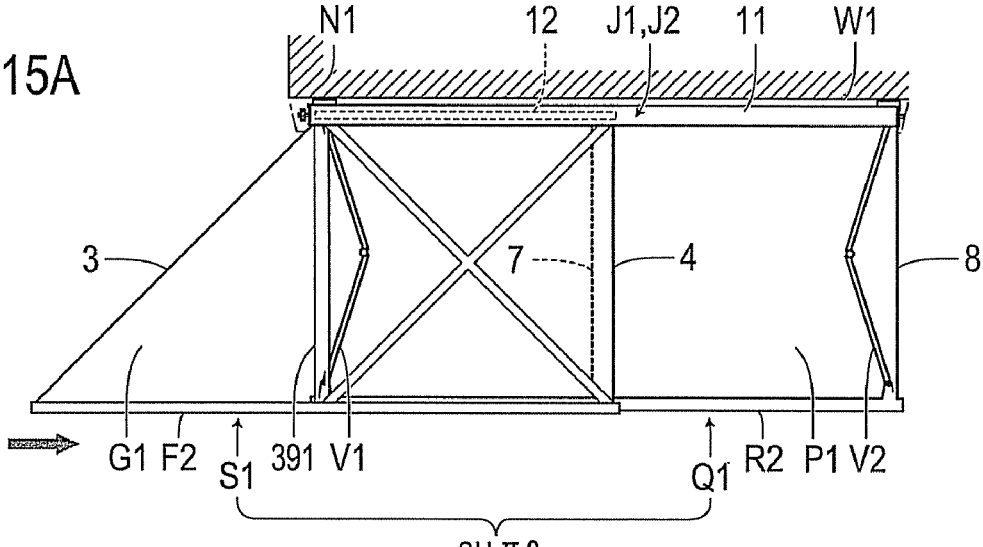
Figure 15B:
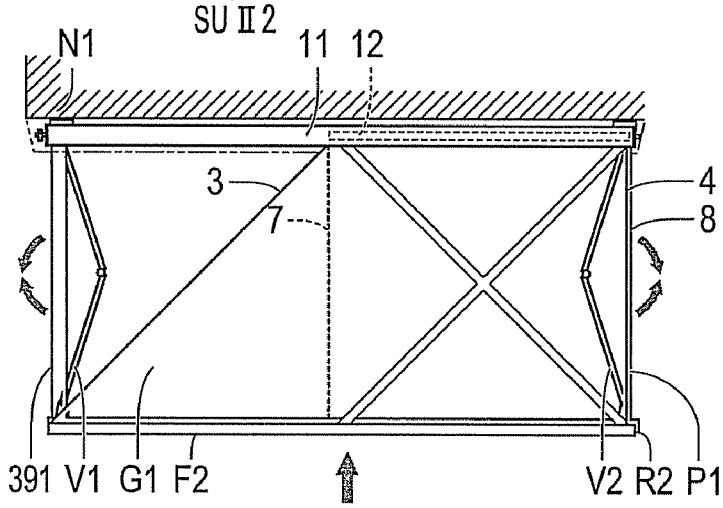
Figure 15C:
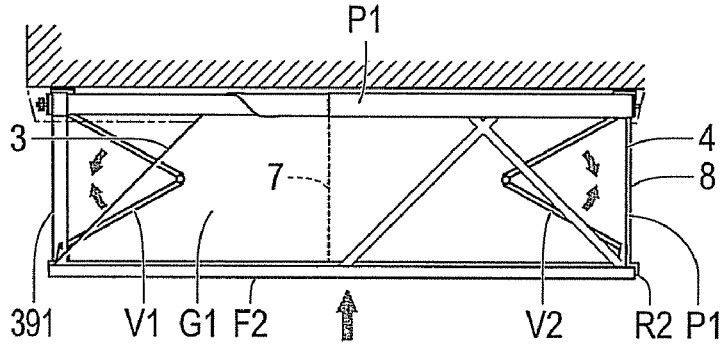
Figure 15D:
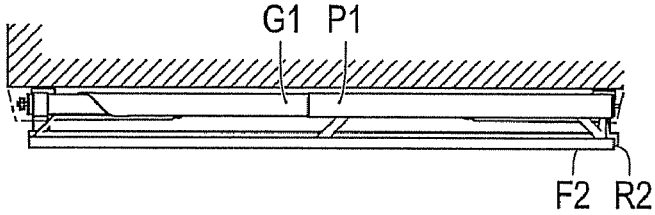

Accordingly, as shown in FIGS. 14(B) and 15(B), the projected corner canvas G1 and the rectangular canvas P1 that have moved to the rear half portion of the device are wound or unwound in such a state that the canvases overlap, or wound or unwound in the front end portion of the device with a synchronizing belt 391 synchronized.

This belt winding device synchronizes when the projected corner canvas G1 and the rectangular canvas P1 are wound and unwound, particularly, the front end portion of the device can be prevented from becoming out of balance relative to the rear portion of the device, and thus, the two front bars R2 and F2 translate in the forward and backward direction with good balance, smoothly and without failure.

In this case also, as shown in FIGS. 16(A) and 16(C), a bulk ring 331 is formed in the front half portion, excluding the front end portion of the roller main body 11, as in the first embodiment, and in addition, the synchronizing belt 391 is wound around the front end portion of the roller main body 11, as shown in FIGS. 17(A) to 17(C).

The configuration of other parts is the same as in the first embodiment, and therefore, the same symbols are attached in the drawings, and description thereof is omitted.

THIRD EMBODIMENT

In the case of the above described first and second embodiments, a relatively small area of the rear end portion of the projected corner canvas G1 which extends into the corner space portion and the front end portion of the rectangular canvas P1 overlap, that is to say, the length of the rectangular canvas P1 is short, and thus, the canvas is of a short type.

In contrast, the complex device SQII3 according to the third embodiment shown in FIGS. 18(A) to 18(D) and 19(A) to 19(D) is a case where a long, rectangular canvas P2 is attached over the entirety of the winding rollers J1 and J2, where the main body portion of the projected corner canvas G1 which extends into the corner space portion, and a larger area of the rectangular canvas P1 than necessary overlaps, and thus, the canvas is of a long type.

In the figures, Q2 indicates a rectangular awning device for a long, rectangular canvas P2.

As a result, the belt winding device shown in the above described second embodiment is unnecessary, and the projected corner canvas G1 and the rectangular canvas P2 can be wound or unwound with good balance in such a state that the canvases overlap, and in addition, an advantage is that it is excellent in terms of the effects of preventing rain from entering.

The configuration of other parts is the same as in the case of the first embodiment.

FOURTH EMBODIMENT

In the complex device SQII4 in the fourth embodiment shown in FIGS. 20(A) to 20(D) and 21(A) to 21(D), the projected corner canvas G1 in trapezoid form with right angles when spread in the complex device SQII3 in the above described third embodiment is replaced with a projected corner canvas G2 in an approximate triangular form when spread (hereinafter referred to as "triangular canvas").

In FIG. 22(A), 531 and 532 indicate through holes in bag form created in diagonal portions 3*a* and 3*b* of the triangular G2 and connection wires 541 and 542 penetrate through the holes and engaging pieces 543 and 544 in the wire front end portions are engaged in the engaging trench 121 of the relatively short slider 12*a* and secured between screws 101 and 102. The front end portions of the wires 541 and 542 are attached to the two end portions, front and rear, of the front bar F2 to which the bottom hem 2*a* of the triangular canvas G2 is attached. Here, S2 indicates an awning device for a projected corner made of the triangular canvas G2.

Figure 20A:
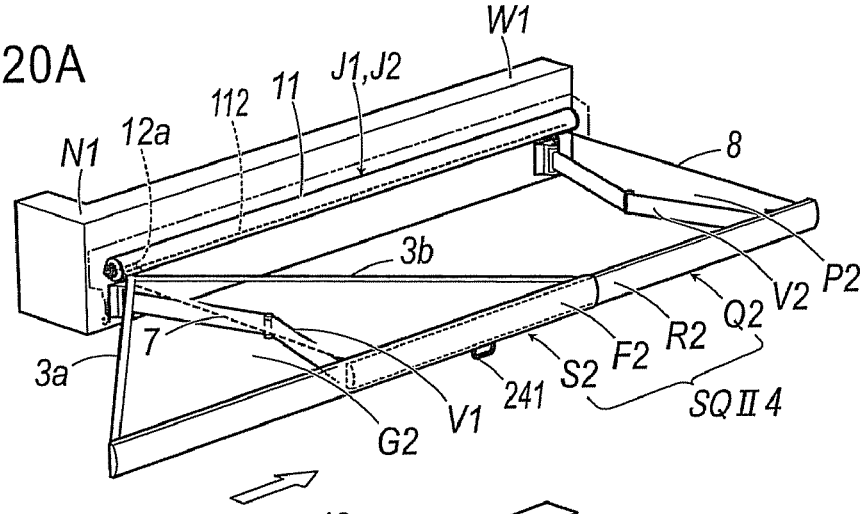
Figure 20B:
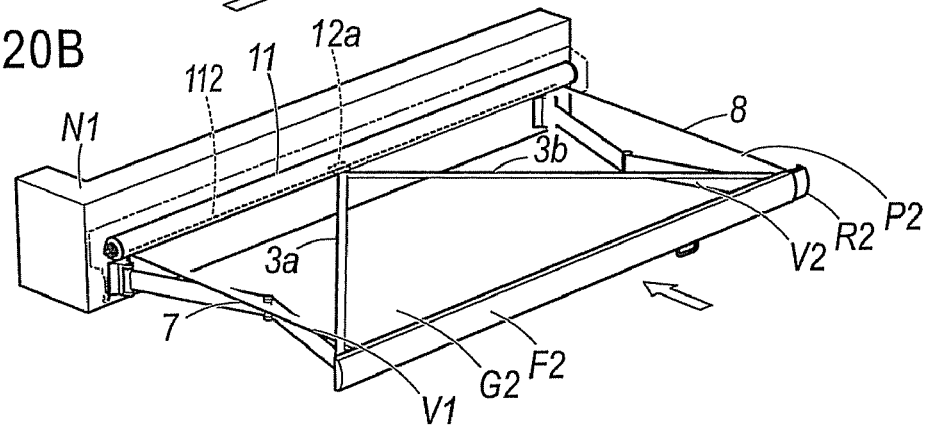
Figure 20C:
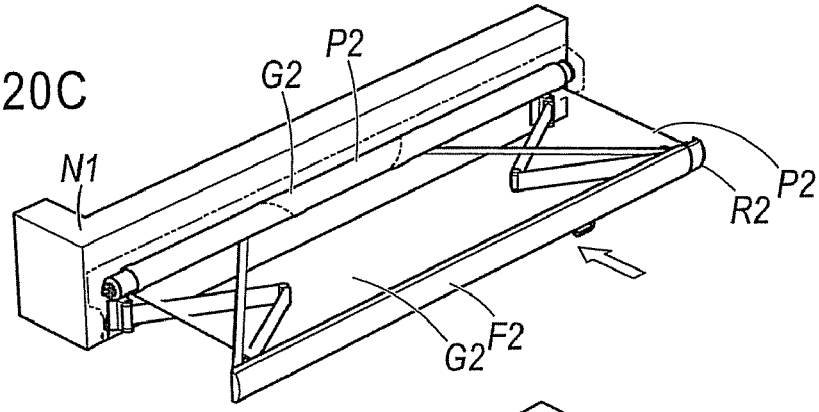
Figure 20D:
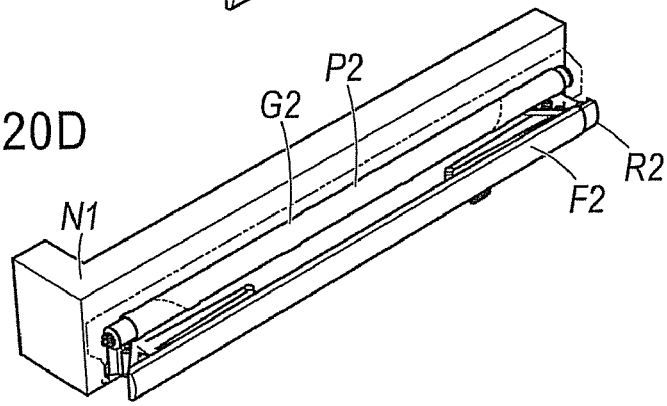

Thus, as shown in FIGS. 20(B) and 21(B), the triangular canvas G2 is moved so as to recede to the vicinity of the middle of the roller main body 11 of the winding rollers J1 and J2 and then the triangular canvas G2 and the rectangular canvas P2 are wound around one winding roller J1 or J2 in such a state that the canvases overlap as shown in FIGS. 20(C), 20(D), 21(C) and 21(D).

In this case, the triangular canvas G2 which is spread by means of the connection wires 541 and 542 which penetrate through the diagonal portions 3*a* and 3*b* of the canvas is supported in a tense state and therefore the canvas can be effectively prevented from changing in the form within the plane when the canvas is wound or slid transversely.

In this case, however, there are few advantages for adding a bulk wing 331 in spiral form as shown FIGS. 12(A) and 16(A) and a bulk cloth 32 as shown in FIG. 29(A).

FIFTH EMBODIMENT

In the complex device SQII5 in the fifth embodiment shown in FIGS. 23(A) to 23(D) and 24(A) to 24(D), the V-shaped arms V1 and V2 in the complex device SQII1 in the above described first embodiment are replaced with foldable arms (hereinafter referred to as Y-shaped arms Y1 and Y2) which are in reversed y shape in the plan view, supported so as to be freely extendable and spreadable with force being applied and symmetric between the front and the rear.

These Y-shaped arms Y1 and Y2 are made up of a main link 291 which is long and a sub-link 292 of which the length is approximately half of the above described main link 291, where the rear end portion of the sub-link is supported in the vicinity of the middle portion of the main link so as to rotate around a pin.

The front end portion of the sub-link 292 is attached to the bracket 262 which is secured to the two end portions, front and rear, of the front bar R2, and the bracket 263 which is supported by the front end portion of the main link 291 so as to rotate around a pin is attached to the front bar R2 so as to freely slidable along the front bar R2 or so as to be freely movable through rotation.

Figure 23A:
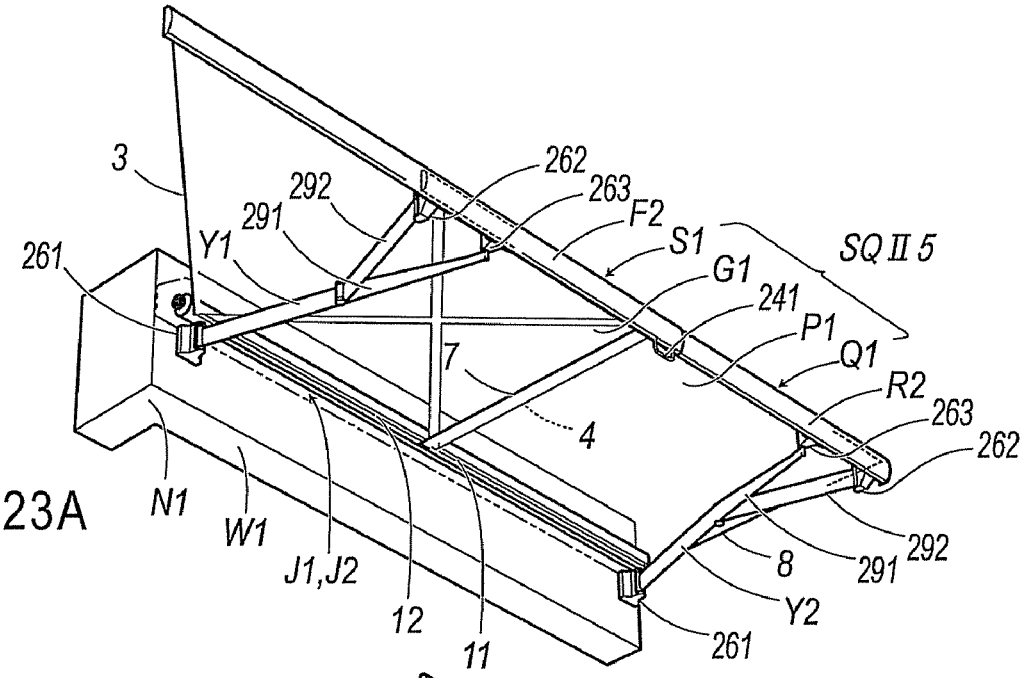
Figure 23B:
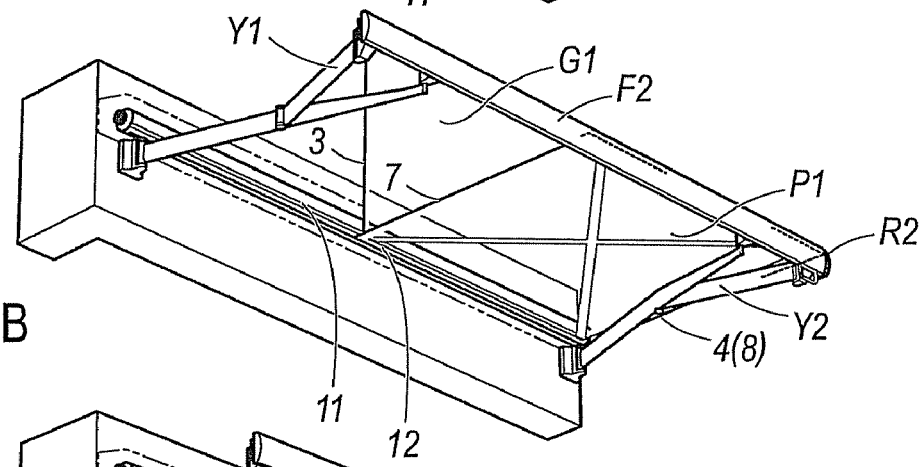
Figure 23C:
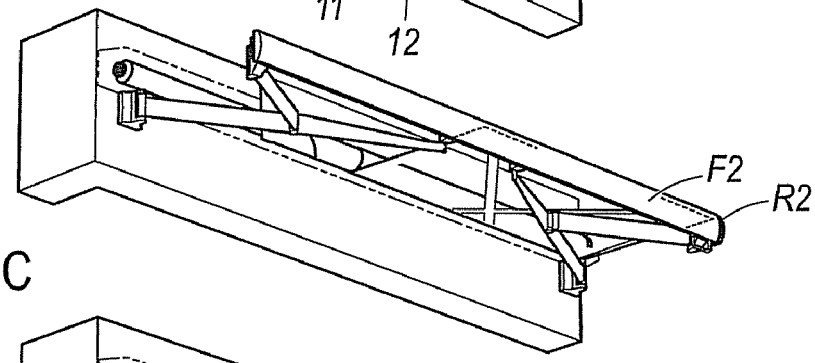
Figure 23D:
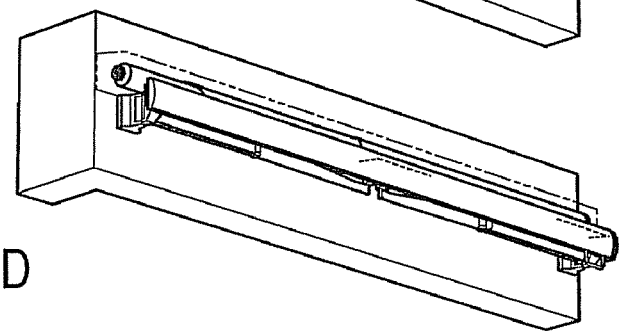
Figure 24A:
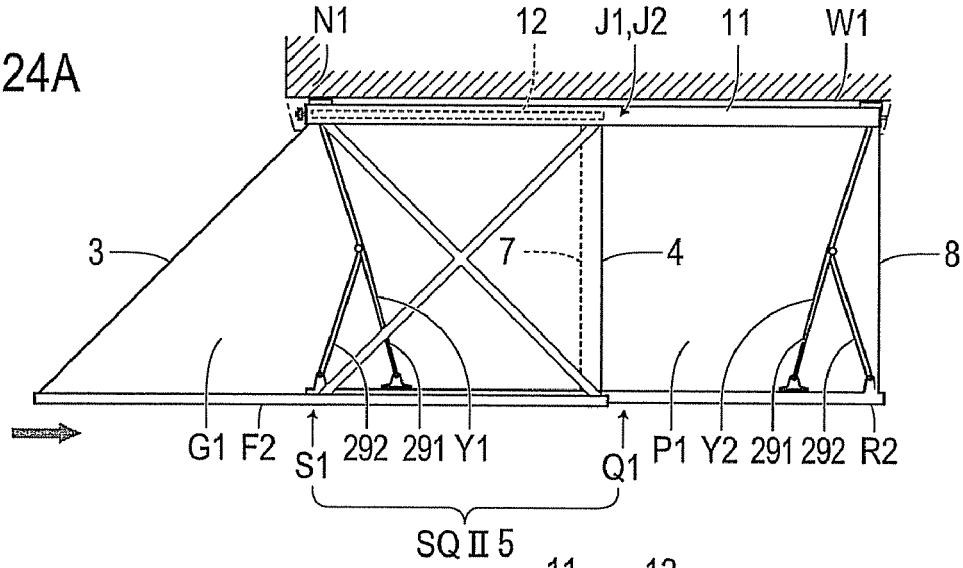
Figure 24B:
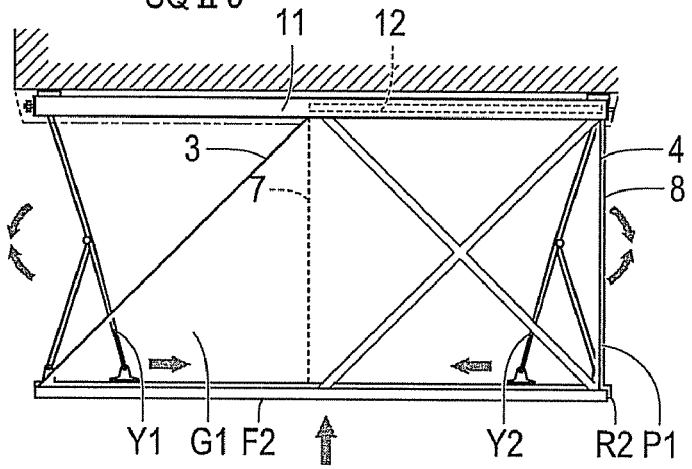
Figure 24C:
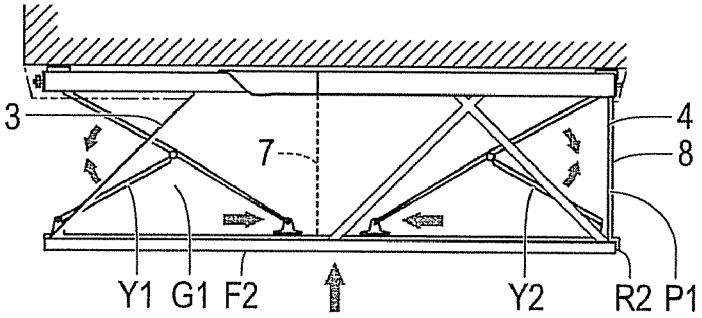
Figure 24D:
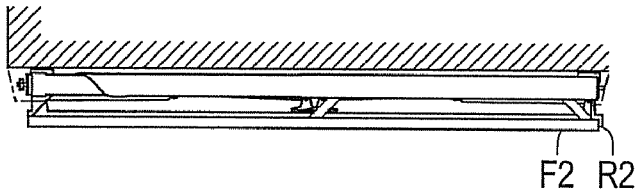

Thus, a spring (not shown) having an appropriate elasticity is incorporated in the portion with an axis in the base end portion of the main link 291, and this elastic force is applied so that the main link 291 moves in such a direction as to extend and open. In addition, a spring and a drawing wire (not shown) are incorporated in the connection portion that is foldable into two between the link middle portion of the main link 291 and the sub-link 292 and thus the connection portion is pressed by an applied force in the direction in which the arms extend and open. Thus, as shown in FIGS. 23(B) and 24(B), when the projected corner canvas G1 and rectangular canvas P1 that have moved and receded in the rear half portion of the device are wound in such a state that the canvases overlap, as shown in FIGS. 23(B) to 23(D) and 24(B) to 24(D), the link portions made of the rear half portion of the main link 291 and a sub-link 292 from among the Y-shaped arms Y1 and Y2 are folded into two against a force applied to extend and open the arms by means of springs and the like incorporated in these connection portions which are foldable into two, and in addition, the front end portion of the main link 291 are slid along and guided by the front bar R2 and is folded.

As a result, the projected corner canvas G1 and the rectangular canvas P1 are wound around the winding rollers J1 and J2 in such a state that the canvases overlap, and the entirety of the device is folded and stored in a compact space in the wall.

Accordingly, in the case where the foldable arms are Y-shaped arms Y1 and Y2, transverse movement of the spread projected corner canvas G1 is smooth and without failure in comparison with the case of the V-shaped arms V1 and V2 shown in the first embodiment, and in addition, it becomes easier for the front bar R2 where the front bar F2 is inserted and engaged to translate in the forward and backward directions.

SIXTH EMBODIMENT

In the complex device SQII6 in the sixth embodiment shown in FIGS. 25(A) to 25(D) and 26(A) to 26(D), V-shaped arms V1 and V2 in the complex device SQII2 in the second embodiment are replaced with Y-shaped arms Y1 and Y2, or a synchronizing belt 391 is stretched between the front end portion of the roller main body 11 and the front end portion of the front bar R2 in the complex device SQII5 in the fifth embodiment.

Figure 25A:
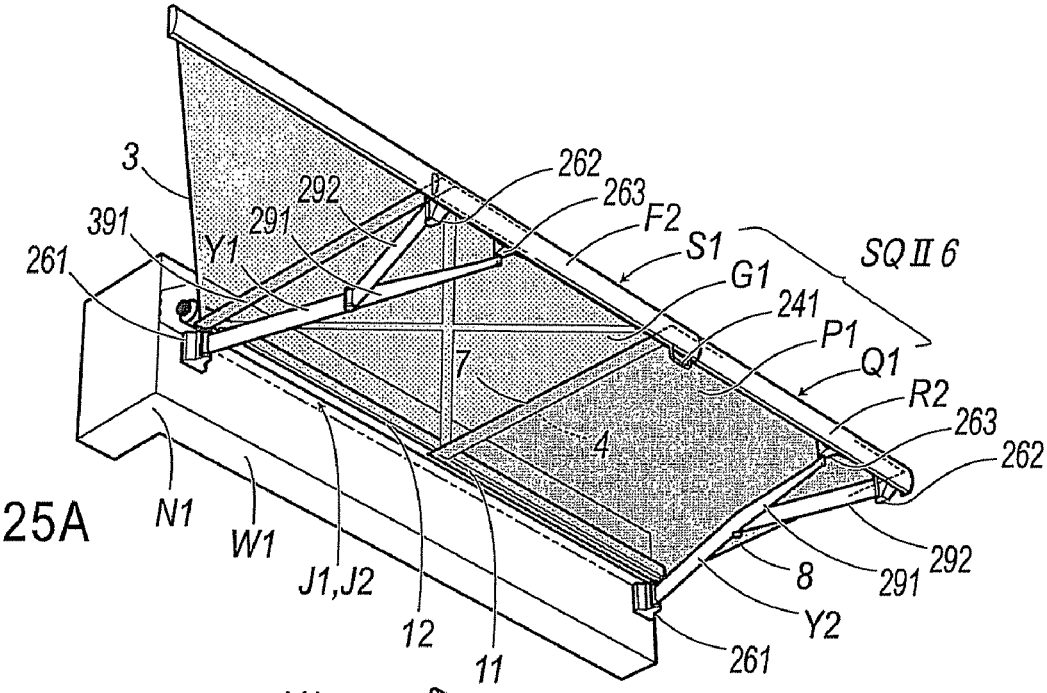
Figure 25B:
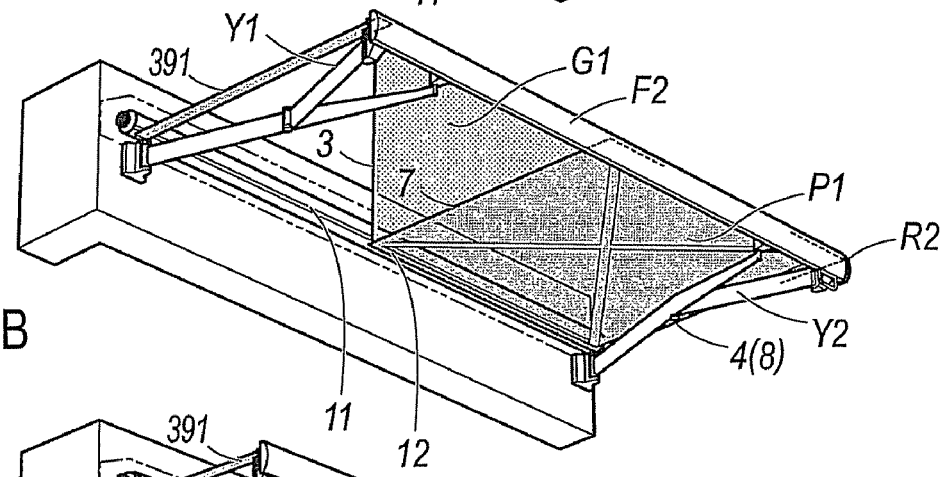
Figure 25C:
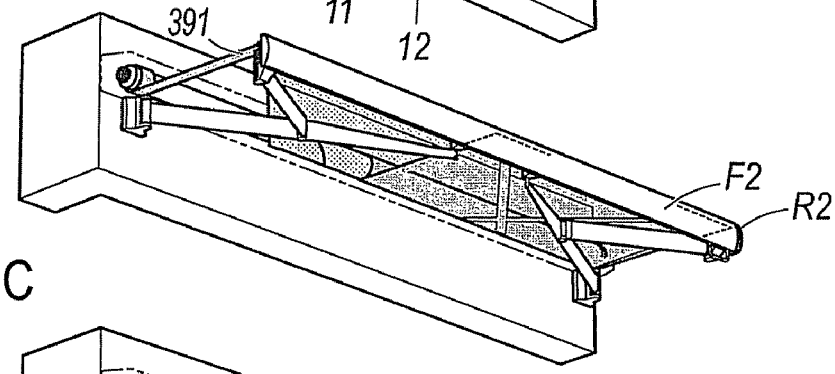
Figure 25D:
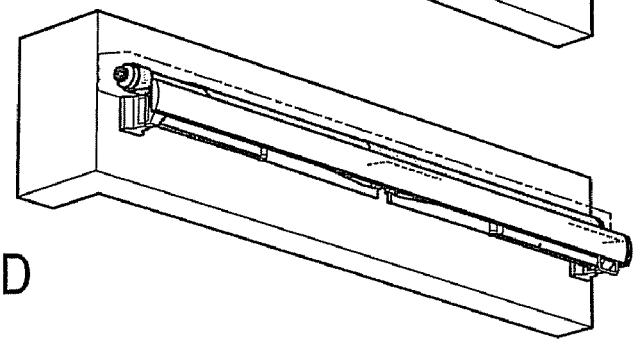
Figure 26A:
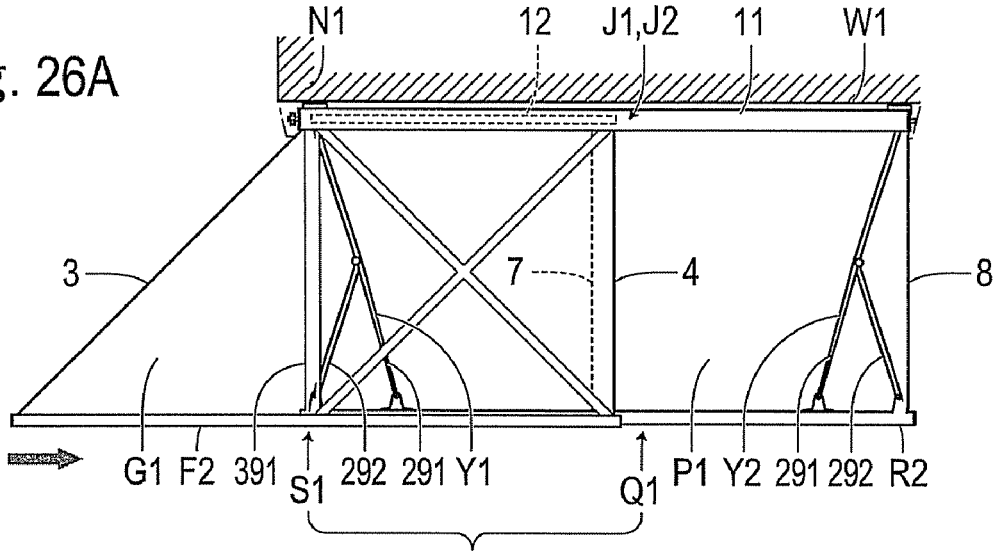
Figure 26B:
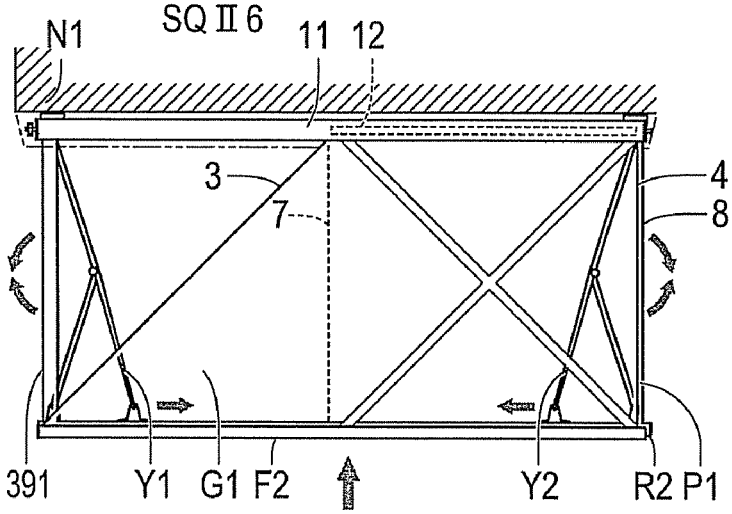
Figure 26C:
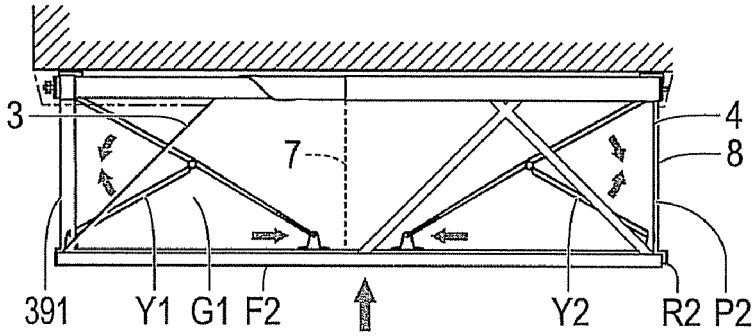
Figure 26D:
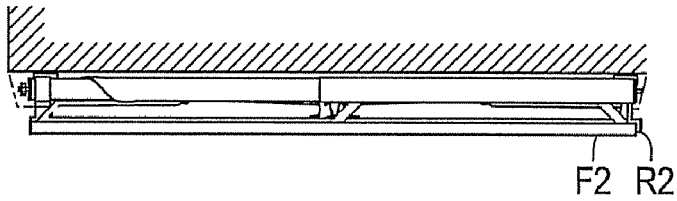
Figure 27A:
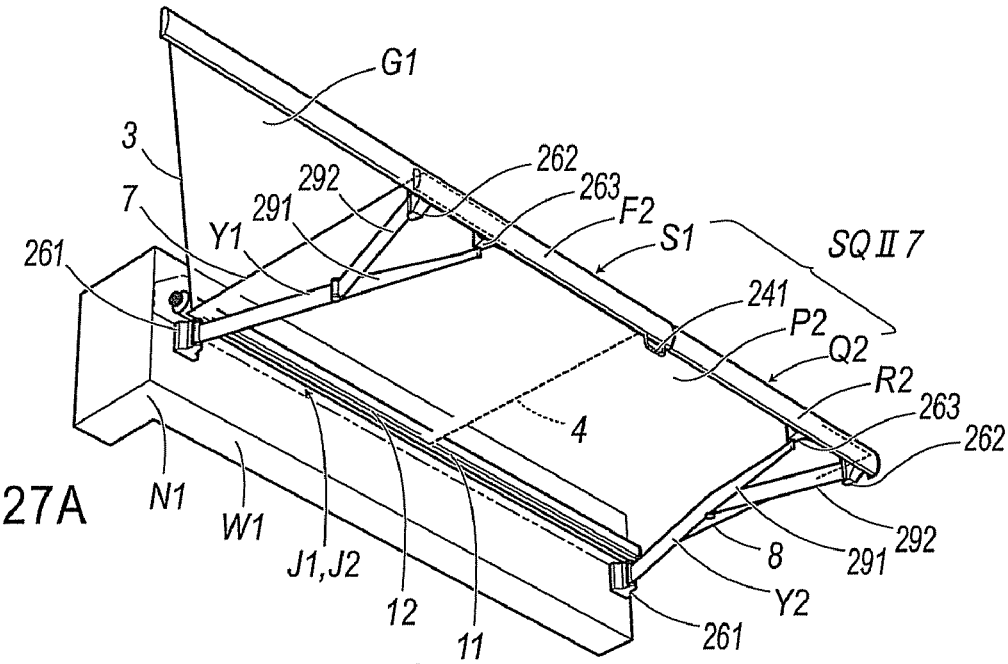
Figure 27B:
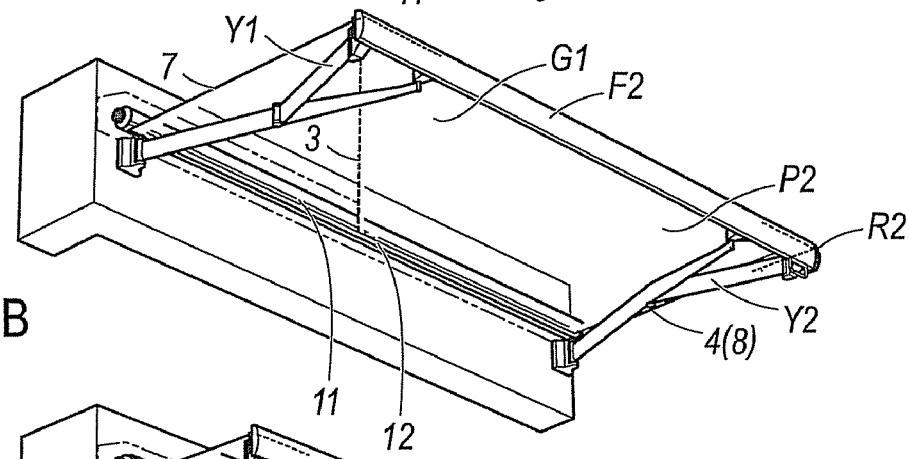
Figure 27C:
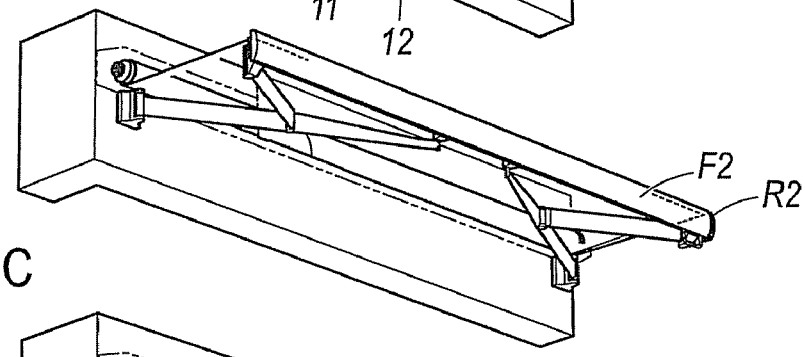
Figure 27D:
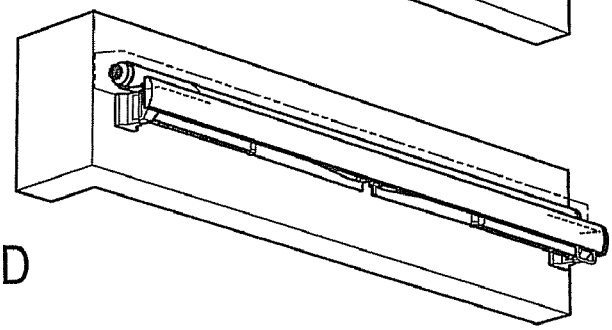
Figure 28A:
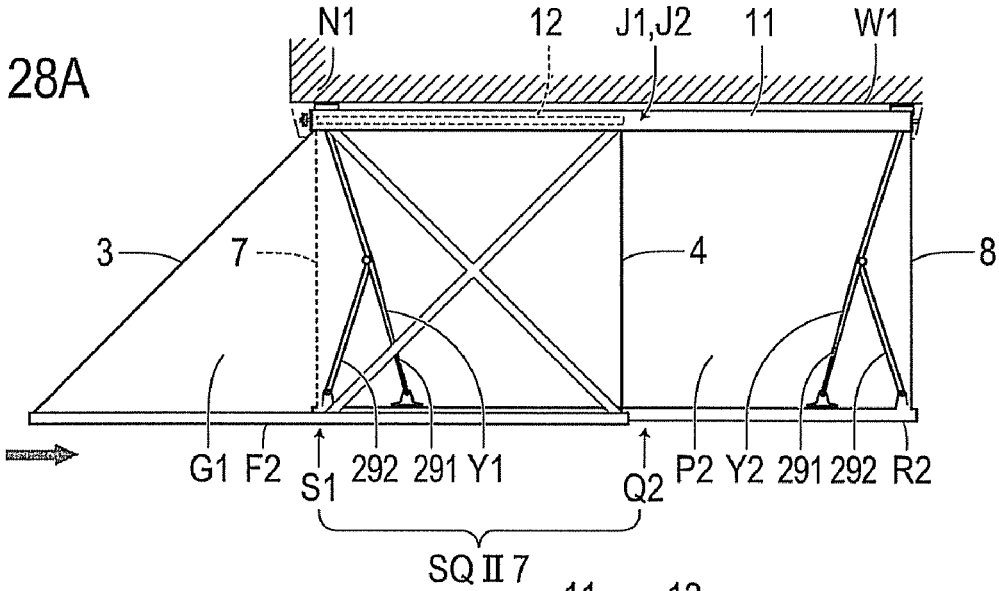
Figure 28B:
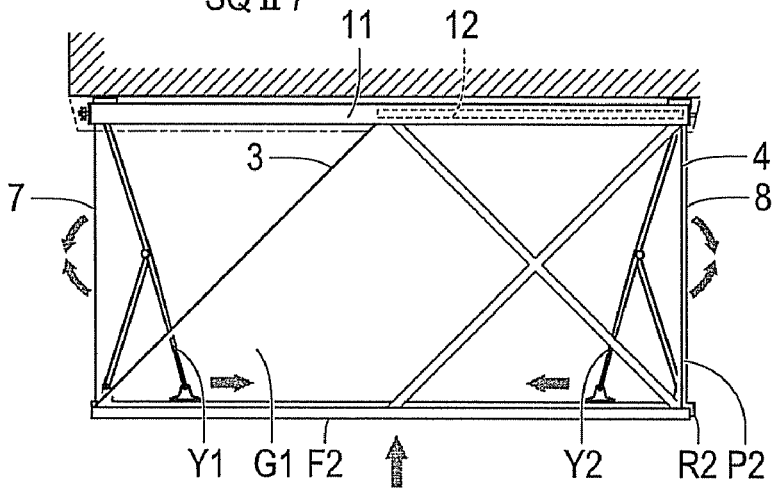
Figure 28C:
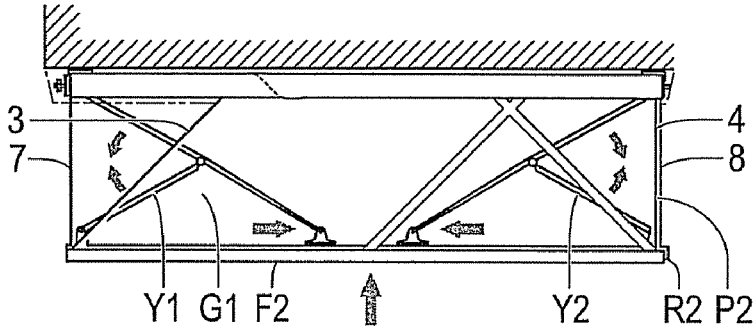
Figure 28D:
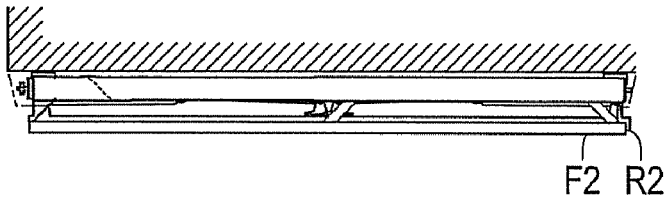

Accordingly, as shown in FIGS. 25(B) and 26(B), the projected corner canvas G1 and the rectangular canvas P1 that have moved in the rear half portion of the device are wound or unwound in such a state that the canvases overlap while a synchronizing belt 391 is wound or unwound in sync in the front end portion of the device. In particular, the front end portion of the device is prevented from losing balance with the rear end portion of the device, and thus, the two front bars R2 and F2 translate in the front and rear directions with good balance, smoothly and without failure.

Furthermore, the spread projected corner canvas G1 translates smoothly and without failure, and in addition, it becomes easier for the front bar R2 where the front bar F2 is inserted and engaged to translate in the front and rear directions.

The configuration of other parts is the same as in the second embodiment and the fifth embodiment.

SEVENTH EMBODIMENT

In the complex device SQII7 in the seventh embodiment shown in FIGS. 27(A) to 27(D) and 28(A) to 28(D), the V-shaped arms V1 and V2 in the complex device SQII3 in the third embodiment are replaced with the Y-shaped arms Y1 and Y2 or a long rectangular canvas P2 is adopted in place of the short rectangular canvas P1 in the complex device SQII5 in the fifth embodiment.

Therefore, the above described belt winding device in the sixth embodiment becomes unnecessary, and in addition, the projected corner canvas G1 and the rectangular canvas P2 are wound and unwound with a good balance in such a manner so that the canvases overlap, and in addition, there is the advantage of preventing rain from entering.

Here, though in the complex devices SQII5 to 7 in the fifth to seventh embodiments, all the foldable arms in the two end portions, front and rear are Y-shaped arms Y1 and Y2, the front end portion of the front bar R2 may be supported by a Y-shaped arm Y1 and the rear end portion thereof may be supported by a V-shaped arm V2 as a result of the combination with the V-shaped arms V1 and V2 in the complex devices SQII1 to 4 in the first to fourth embodiments.

In addition, in the case of the fifth to seventh embodiments, it is desirable to incorporate the winding rollers J1 and J2 with a bulk ring 331 shown in FIGS. 12(A) and 16(A).

Concerning Linking Structure

Though the cases where the winding rollers J1 and J2 in the complex devices SQII1 to 7 are manually rotated or rotated with electrical power are described in the above, two of the complex devices SQII1 to 7 face two projected corner portions N1 respectively as shown in FIGS. 1(A) and 1(B), and furthermore the two face each other as shown in FIGS. 30(A) and 30(B) so that the front end portion of the device inside the corner cap 145 has a structure where diagonal gears 52 (bevel gears are also possible) are engaged with each other as shown in FIG. 30(A) or a structure where a worm 162 and a worm gear 161 are engaged with each other as shown in FIG. 30(B), and thus the operations of winding and unwinding the projected corner canvases G1 and G2 as well as the rectangular canvases P1 and P2 can be linked. As a result, one electrically driven device becomes unnecessary or the manually driven device can be simplified.

Concerning Complex Devices in Second Group

The complex devices SUII1 and 2 in this group are applied to linear sections with one end being the projected corner portion N1 and the other end being the recessed corner portion L, where long and short corner canvases P3 and P4 (hereinafter referred to as recessed corner canvases) in an approximate trapezoid form with right angles in a spread state which cover the corner space portion of the recessed corner portion L combined in place of the rectangular canvases P1 and P2 in the complex devices SQII1 to 7 of the first type, as shown in FIGS. 31 to 35.

In summary, the awning devices for a projected corner S1 and S2 and awning devices U1 and U2 for recessed corner canvases P3 and P4 which are either long or short (hereinafter referred to as awning devices for a recessed corner) are combined, and furthermore, the front bar F2 for the projected corner canvases G1 and G2 is inserted into, engaged with and supported by the front bar R2 for the recessed corner canvases P3 and P4 so as to be freely slidable, and the two front bars F2 and R2 are freely translatable linearly to the front by means of the V-shaped arms V1 and V2 in the configuration.

FIRST EMBODIMENT

In the complex device SUII1 in the first embodiment shown in FIGS. 31(A) to 31(C) and 33, the rectangular canvas P1 in the complex device SQII1 in the first group is replaced with a recessed corner canvas P3, and the top hem 5*a* of the recessed corner canvas P3 is attached to the canvas engaging trench 110 in the rear half of the winding rollers J1 and J2 which are located between the projected corner portion N1 in the front end portion of the device and the recessed corner portion L in the rear end portion of the device.

The recessed corner canvas P3 is in an approximate reversed trapezoid form having right angles when spread in a plane wherein, as shown in FIG. 31(C), the top hem 5*a* of the canvas which is longer than the bottom hem 6 of the canvas, the diagonal portion 9 of the canvas ranges from the rear end portion of the bottom hem 6 of the canvas to the rear end portion of the top hem 5*a* of the canvas at approximately 45 degrees, and the front end portions of the top hem 5*a* of the canvas and the bottom hem 6 of the canvas are formed as the perpendicular portion 7 of the canvas, respectively in the outer form of the canvas.

Figure 32A:
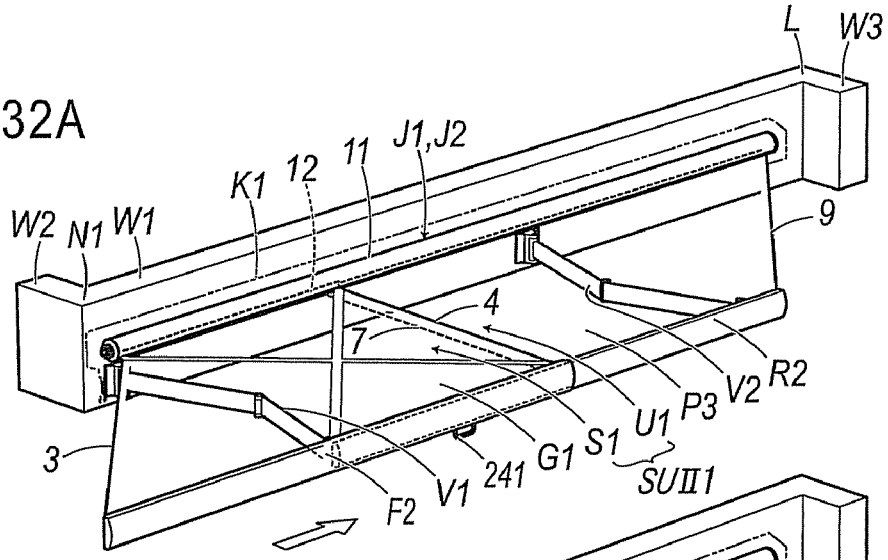
Figure 32B:
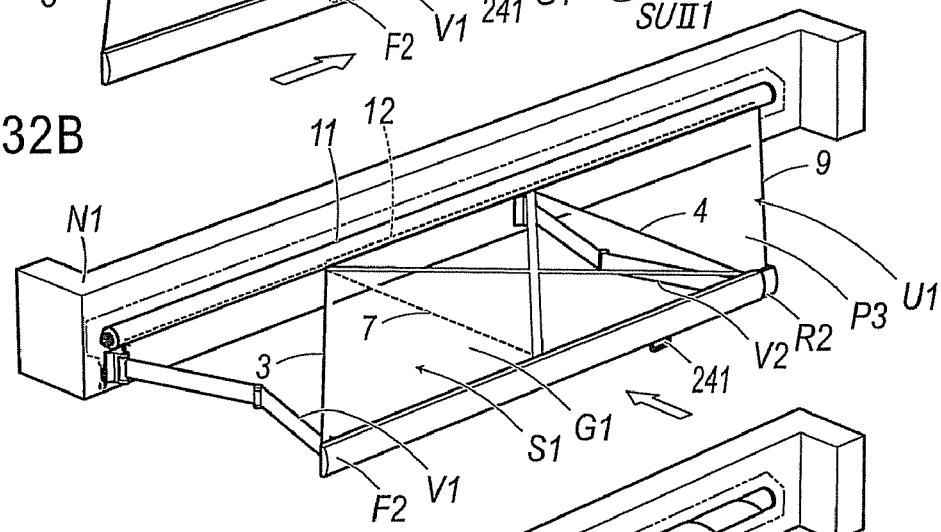
Figure 32C:
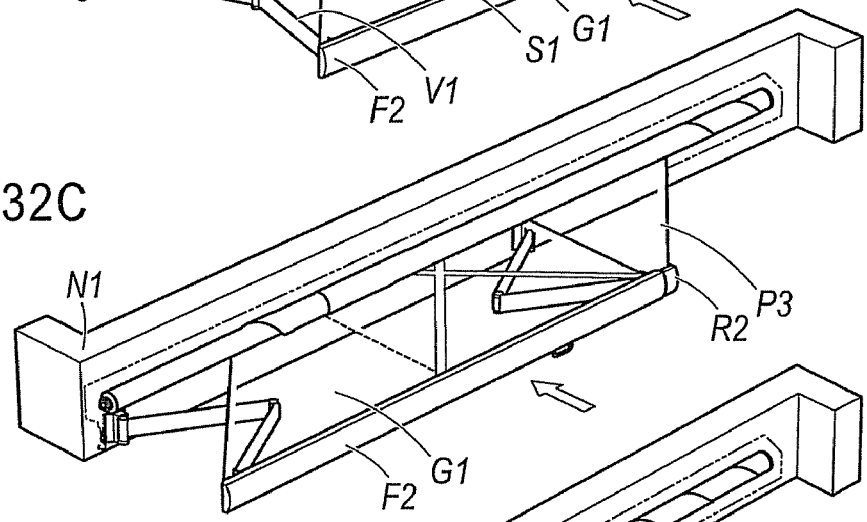
Figure 33A:
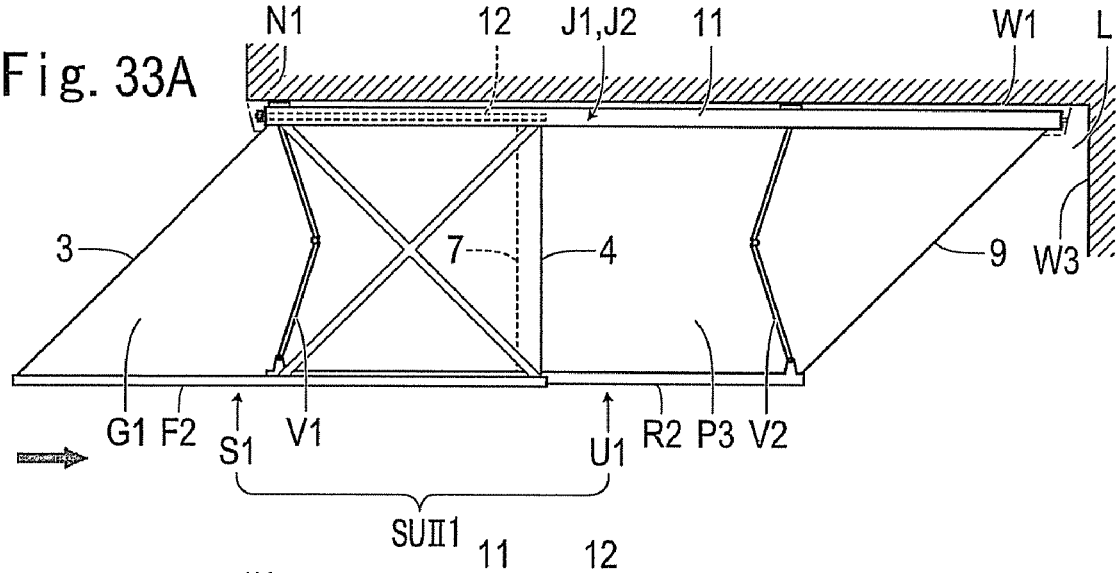
Figure 33B:
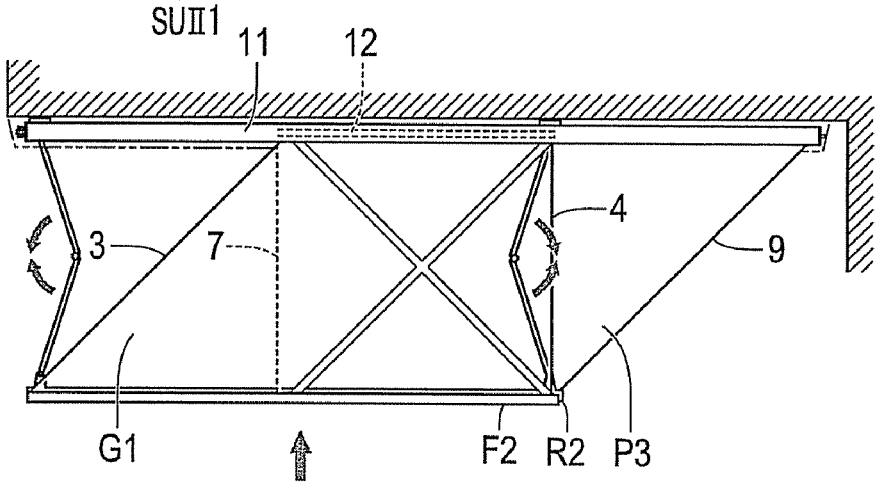
Figure 33C:
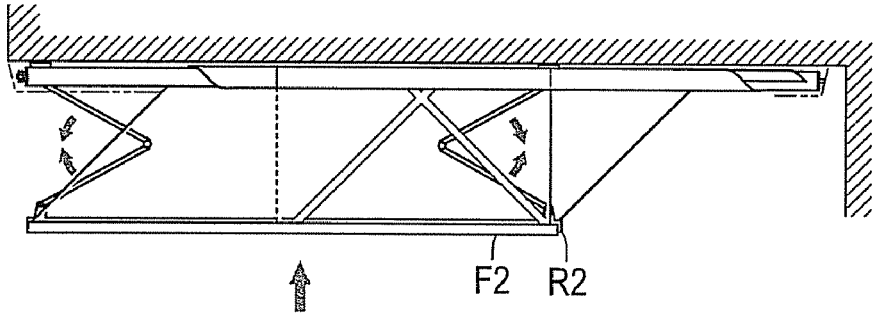

Therefore, as shown in FIGS. 32(A) and 33(A), the spread projected corner canvas G1 is slid to the rear of the device through the operation remaining in a spread state as shown in FIGS. 32(B) and 33(B), and drawn back to a portion in the rear to such a degree that the protruding end portion of the canvas protrusion X2 does not protrude from the projected corner portion N1 in order to wind and store the projected corner canvas G1 which extends into the corner space portion of the projected corner portion N1 and the recessed corner canvas P3 which spreads to the front of the front wall W1 including the corner space portion of the recessed corner portion L.

Next, when the projected corner canvas G1 and the recessed corner canvas P3 are driven and wound in such a state that the canvases overlap, the projected corner canvas G1 and the recessed corner canvas P3 are wound around one winding roller J1 or J2 as shown in FIGS. 32(B) to 32(D) and 33(B) to 33(D) and at the same time the front bar R2 and the front bar F2 which is inserted into and engaged with the front bar R2 are translated linearly toward the wall portion with the V-shaped arms V1 and V2 being folded into two.

Figure 32D:
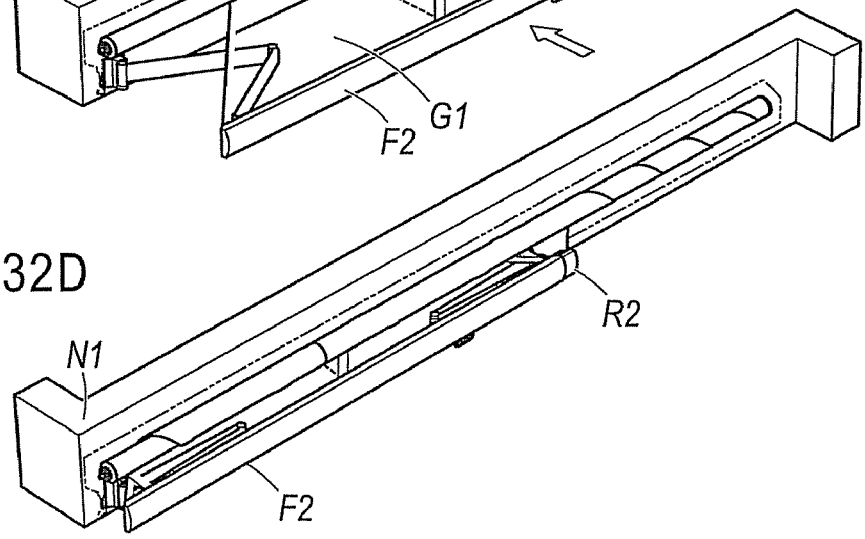
Figure 33D:
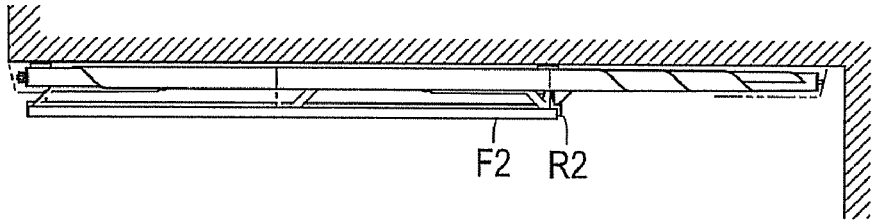
Figure 34A:
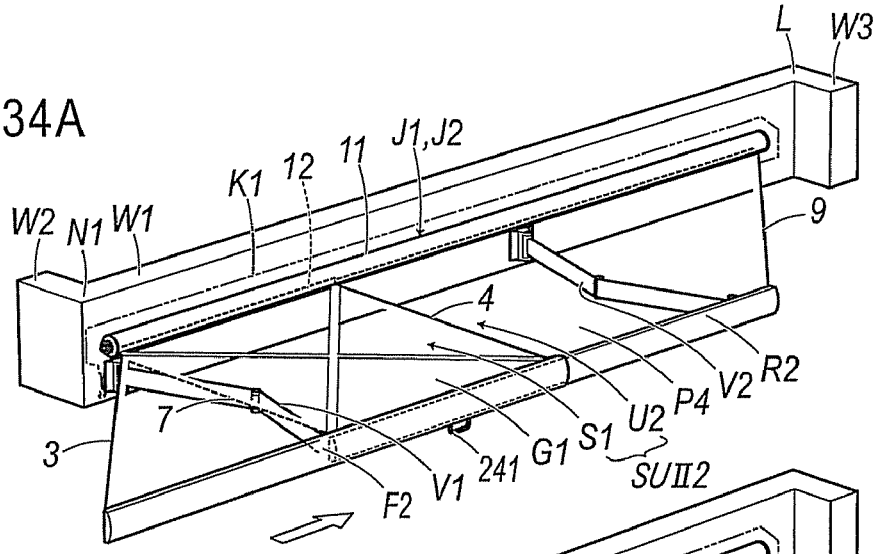
Figure 34B:
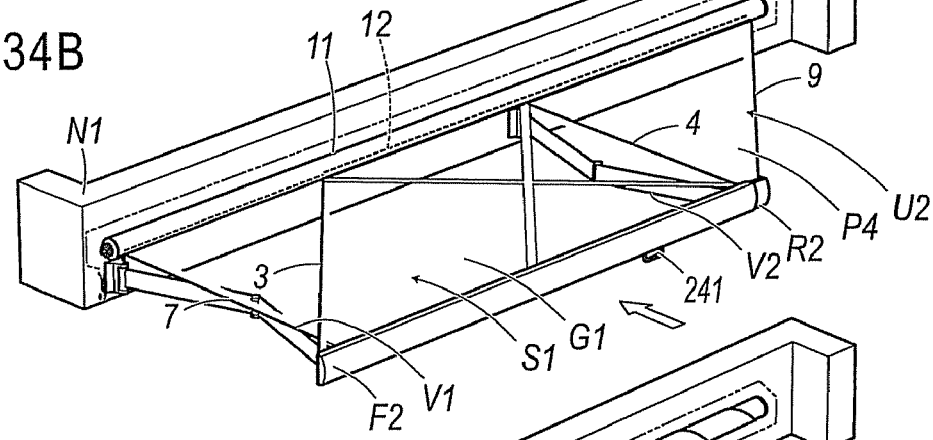
Figure 34C:
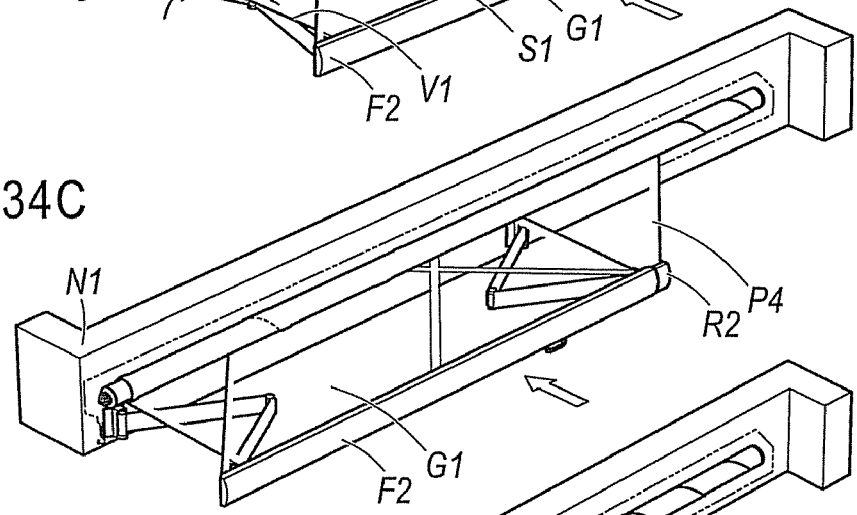
Figure 34D:
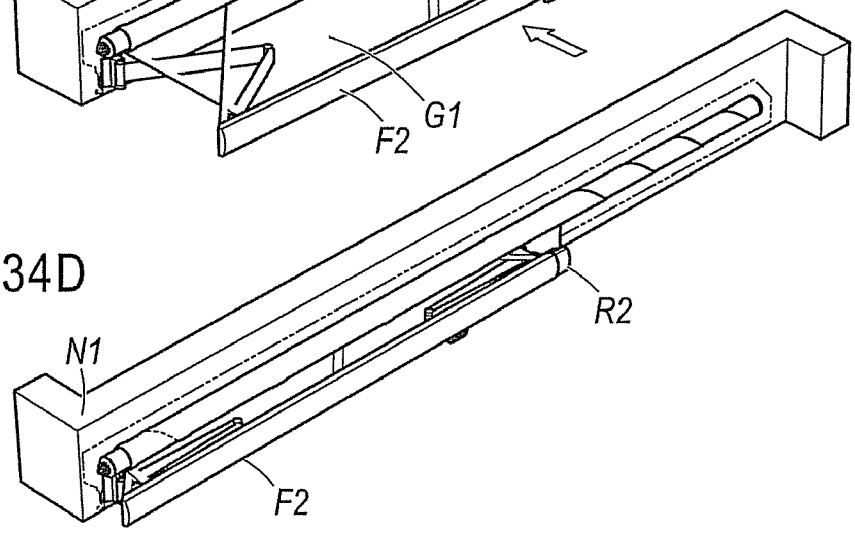
Figure 35A:
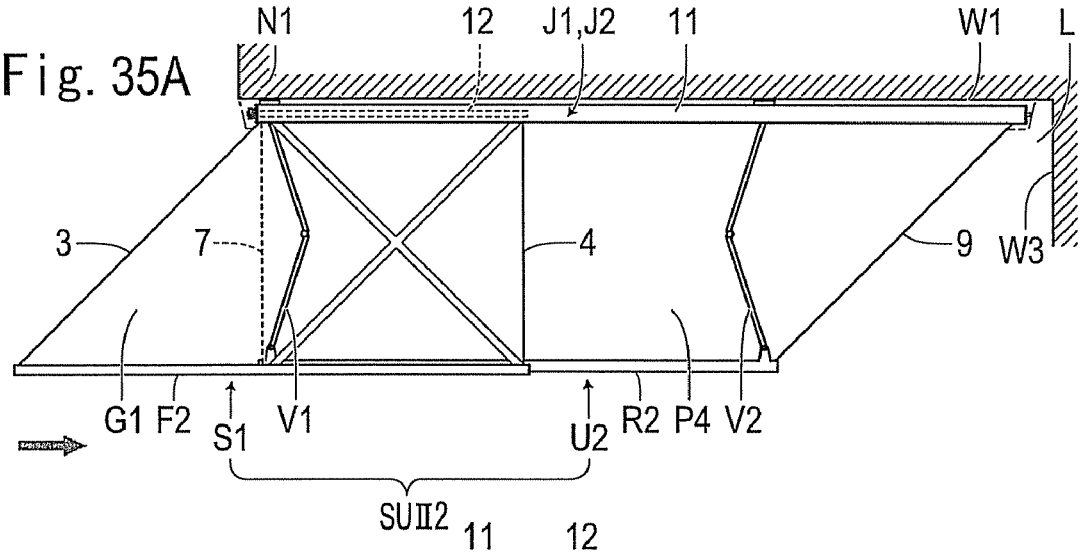
Figure 35B:
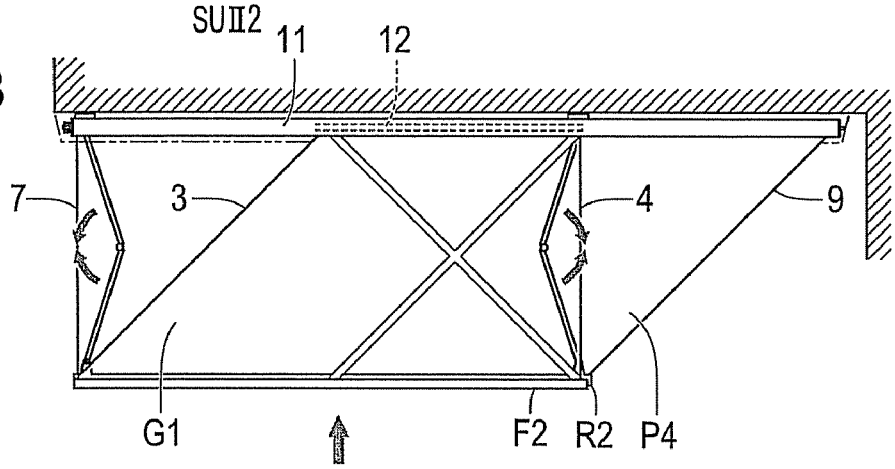
Figure 35C:
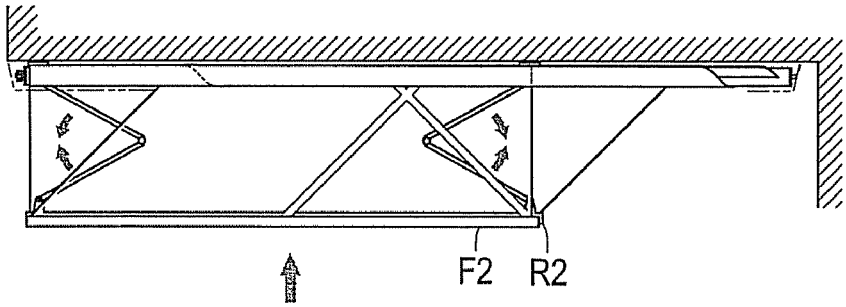
Figure 35D:
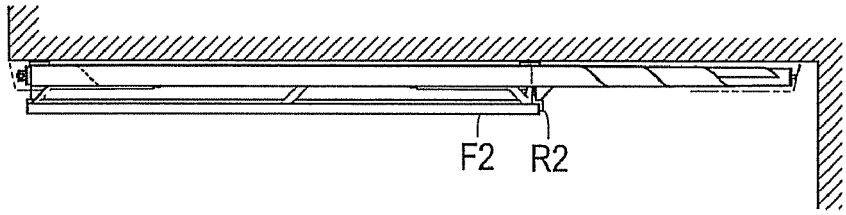

As a result, the entirety of the device is stored in a compact space in the wall portion between the projected corner portion N1 and the recessed corner portion L as shown in FIGS. 32(D) and 33(D).

SECOND EMBODIMENT

In the complex device SUII2 in the second embodiment shown in FIGS. 34(A) to 34(D) and 35(A) to 35(D), a long recessed corner canvas P4 is approximately attached over the entirety of the winding rollers J1 and J2 in the same manner as in the complex device SQII3 in the above described first group, providing a long type wherein a portion over which the main body portion of the projected corner canvas G1 which extends into the corner space portion of the projected corner portion N1 and the main body portion in long rectangular form of the recessed corner canvas P4 which spreads to the front into the corner space portion of the recessed corner portion L overlap is longer than necessary. In addition, the bottom hem of the recessed corner canvas P4 is attached over the entirety of the length of the front bar R2. In the figures, U2 indicates a recessed corner awning device for a long recessed canvas P4.

The configuration of other parts is the same as in the case of the above described first embodiment.

Here, embodiments using the complex device SUII1 and 2 in the second group are not limited to the above described first and second embodiments, and a great number of embodiments are possible in the same manner as in the case of the first group where the rectangular canvases P1 and P2 in the complex devices SQII2 to 7 in the first group are replaced with recessed corner canvases P3 and P4 in a trapezoid form with right angles and the foldable arms are replaced with Y-shaped arms Y1 and Y2 or a combination of a Y-shaped arm Y1 and a V-shaped arm V2.

Concerning Complex Devices in Third Group

In the complex device SQSIV in this group, as shown in FIGS. 36(A) and 36(B), an awning device S1 for a projected corner which covers the corner space portion of one projected corner portion N1, an awning device S11 for a projected corner which is symmetrical with the awning device S1 in the front and rear directions and covers the corner space portion of the other projected corner portion N2, and a rectangular awning device Q1 which covers the outside of the building between the two awning devices S1 and S11 are integrally combined.

That is to say, a long casing K1 is attached to the linear section of the front wall W1 between the two projected corner portions N1 and N2, and one long winding roller J1 or J2 is supported inside the casing via a bearing.

Next, the front end portions of a pair of two from among V-shaped arms V1 to V4 are attached to the front half portion and the rear half portion of the long front bar R2 which has approximately the same length as the winding roller J1 or J2 so as to be symmetrical with a distance in between, and the rear end portions of the V-shaped arms V1 to V4 are attached to the front half portion and the rear half portion of the casing K1 with a distance in between.

Thus, the top hem 5 of the rectangular canvas P1 is attached to a canvas engaging trench 110 in the middle section of the winding roller J1 or J2 and the bottom hem 6 of this canvas is attached to the canvas engaging trench 381 in the middle section of the front bar R2. As a result, the rectangular awning device Q1 is formed in the middle section.

In addition, two sliders 12 are inserted into and engaged with the front half portion and the rear half portion of the slide guide path 112 of the winding roller J1 or J2, and the top hems 1 of the projected corner canvases G1 and G11 are attached to the canvas engaging trenches 121 of the respective sliders 12 so as to be symmetrical in the front and rear directions, and in addition, the respective bottom hems 2 of the canvas are attached to the canvas engaging trenches 351 of the front bar F2 which is inserted into and engaged with the front half portion and the rear half portion of the front bar R2. As a result, the awning devices S1 and S11 for a projected corner are formed in the front half portion and the rear half portion of the device so as to be symmetric.

Thus, in order to wind and store the two projected corner canvases G1 and G11 which extend into the corner space portions of the two projected corner portions N1 and N2 and the rectangular canvas P1 which spreads to the front of the front wall W1 as shown in FIGS. 36(A) and 37(A), the projected corner canvas G1 on one projected corner portion N1 side is slid toward the vicinity of the center of the device through the operation and the projected corner canvas G11 on the other projected corner portion N2 side is slid toward the vicinity of the center of the device through the operation, as shown FIGS. 37(A) and 37(B). As a result, the two projected corner canvases G1 and G11, front and rear, are drawn down from the projected corner portions N1 and N2 so as overlap the front half portion and the rear half portion of the rectangular canvas P1.

Thus, when the two projected corner canvases G1 and G11 and the rectangular canvas P1 are driven and wound in sync, the above described three canvases G1, G11 and P1 are wound around one winding roller J1 or J2 in such a manner so that the canvases overlap as shown in FIGS. 37(C) and 37(D), and at the same time, the front bar R2 and the front bar F2 which is inserted to and engaged with the front bar R2 are translated linearly toward the wall portion with the V-shaped arms V1 to V4 being folded into two.

As a result, the entirety of the device is stored in a compact space in the wall portion between the projected corner portions N1 and N2, as shown in FIG. 37(D).

Here, in the above described case, an awning device S2 for a projected corner where the two projected corner canvases G1 and G11 are replaced with triangular canvases G2 as shown in FIGS. 20 to 22 can be provided. In this case, a long rectangular canvas P2 is attached to a long winding roller J1 or J2 and a long front bar R2.

In addition, the foldable arms may be changed to Y-shaped arms Y1 to Y4 from the V-shaped arms V1 to V4, or Y-shaped arms Y1 and Y4 can be provided in the two end portions, front and rear of the device and V-shaped arms V2 and V3 can be provided in locations on the inside.

In this case, transverse movement of the spread projected corner canvas G1 can be achieved smoothly and without failure in comparison with the case where the V-shaped arms V1 to V4 are used, and in addition, it becomes easier for the front bar R2 to translate.

Concerning Complex Devices in the Fourth Group

In the complex device SSII in this group, as shown in FIGS. 38 to 44, the distance between one projected corner portion N1 and the other projected corner portion N1 is short in comparison with the case of the complex device SQSIV in the third group, and two awning devices S1 and S11 for a projected corner are made to make contact with each other back-to-back so as to be symmetric in the front and rear directions with a slight discrepancy in the up and down directions, and thus, combined and integrated.

Therefore, in the winding roller J3 in the third embodiment which is supported by the casing K1 via a bearing, as shown in FIGS. 39(A), 40 and 42, two slits 111 are created in parallel in the direction of the axis line on the surface of the roller main body 11*b* at a distance from each other, and a slide guide path 112 is formed through extrusion molding in the inner side portion. Sliders 12 and 12*w* are respectively engaged in these slide guide paths 112 in two columns, and the top hems 1 of the respective projected corner canvases G1 and G11 are attached to the canvas engaging trenches 121 of the sliders 12 and 12*w*.

The configuration of other parts is approximately the same as in the winding device shown in FIG. 9, and therefore, the same symbols are attached and the description thereof is omitted.

R4 indicates a transverse guide rail which supports the front bars F2 and F3 for the two projected corner canvases G1, front and rear, in such a manner so that they are engaged with each other through insertion so as to be freely slidable relative to each other, and the front end portions of the two V-shaped arms V1 and V2 are attached to the two end portions, front and rear, and the rear end portions are attached to the wall portion W1.

The transverse guide rail R4 has a cross section in square cylindrical form, and an upper guide trench 441 and a lower guide trench 442 are created in the longitudinal direction of the upper plate portion and the lower plate portion so that protrusions of the upper guide trench 381 and the lower guide trench 382 of the front bar F3, which are formed so as to have approximately the same cross section as the above described front bar R2, are engaged with the two guide trenches 441 and 442 so as to be freely slidable.

In addition, a spacer 45 with a small width which has approximately the same cross section as the front bar F3 and functions as a slide stopper is engaged with and secured to the front end portion of the transverse guide rail R4 in the vicinity of the front end portion of the V-shaped arm V1.

Thus, the front bar F3 of the projected corner canvas G11 is inserted into the transverse guide rail R4 from the rear portion of the device, and then, the projected corner canvas G1 is inserted into the above described spacer 45 and the front bar F3 from the front end portion of the device, and as a result, the front bars F2 and F3 for the respective projected corner canvases G1 and G11 are inserted into, engaged with and supported by the transverse guide rail R4 so as to be freely slidable relative to each other.

In FIG. 40(C), 366 and 367 indicate eaves which protrude from upper and lower locations on the rear surface of the front bar F3, and 368 and 369 are wire engaging holes which are created in the eaves 367 so that the bottom hem 2 of the projected corner canvas G1 is attached to the canvas engaging trench 381 of the front bar F3 and the front end portions of the wires 193 and 194, which are drawn out from the canvas G1, are inserted and secured.

Figure 44A:
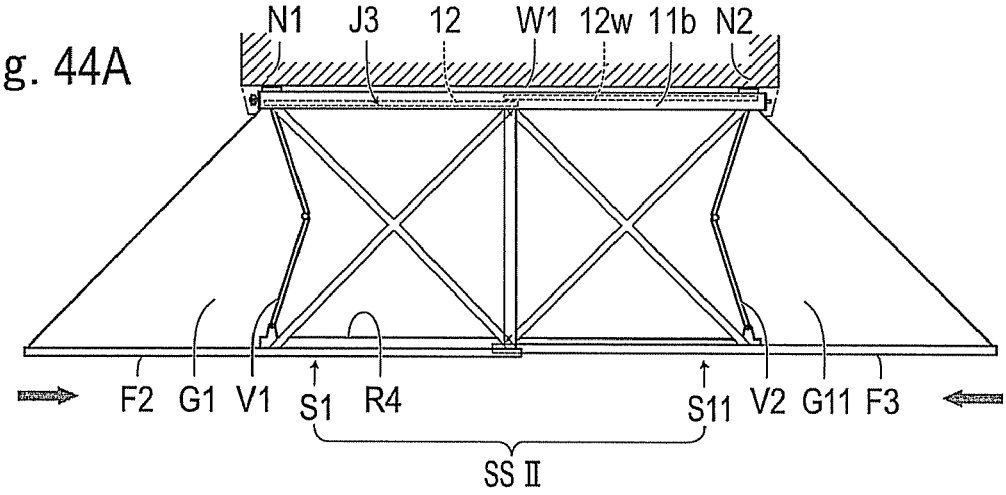

Thus, as shown in FIGS. 43(A) and 44(A), in order to wind and store the two projected corner canvases G1 and G11 which extend into the corner space portions of the two projected corner portions N1 and N2 so as to be symmetric in the front and rear directions, the projected corner canvas G1 on the projected corner portion N1 side is slid toward the rear end of the device through the operation while the projected corner canvas G11 on the projected corner portion N2 side is slid toward the front end of the device through the operation.

Figure 44B:
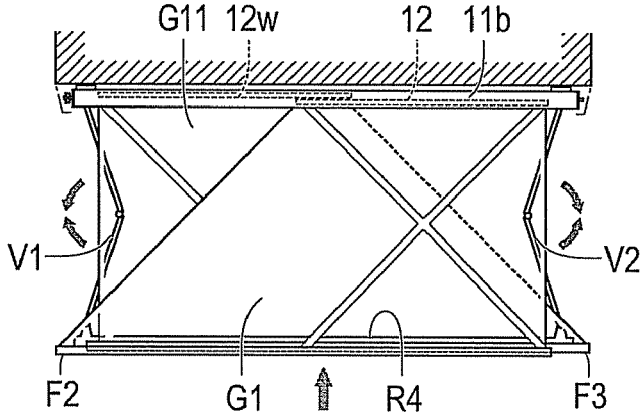
Figure 44C:
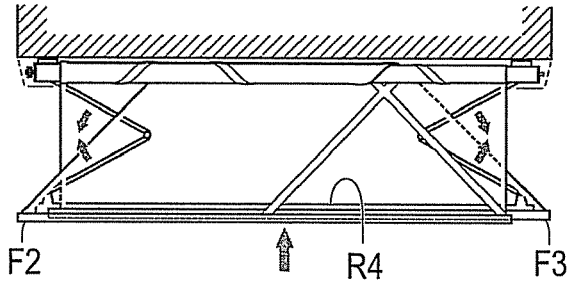
Figure 44D:
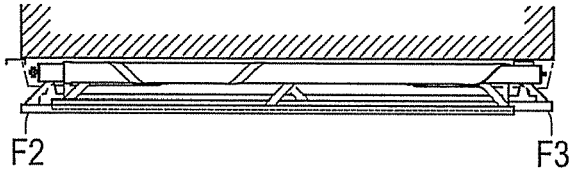

As a result, the two projected corner canvases G1 and G11, front and rear, are drawn down from the relative projected corner portions N1 and N2, and thus, overlap in the up and down directions, as shown in FIGS. 43(B) and 44(B).

Thus, when the two overlapping projected corner canvases G1 and G11 are driven and wound, the projected corner canvases G1 and G11 are wound around one winding roller J3 in such a state that the canvases overlap, as shown in FIGS. 43(C) and 43(D), and at the same time, the front bar R4 and the front bars F2 and F3, which are inserted and engaged with the front bar R4, are translated linearly toward the wall portion with the V-shaped arms V1 and V2 being folded. As a result, the entirety of the device is stored in a compact space in the wall portion without protruding from the projected corner portions N1 and N2.

Though the transverse guide rail R4 is supported by the V-shaped arms V1 and V2 in the above described complex device SSII, they can be replaced with Y-shaped arms Y1 and Y2.

Concerning Transverse Device for Projected Corner Canvas

In the above described complex devices SQII1 to 7, SUII1 and 2, SQSIV and SSII, the projected corner canvases G1, G2 and G11 which are unwound and spread to the front are transversely slid through the operation in which an operation rod (not shown) is hooked to the engaging portion 241 formed on the front bars F2 and F3, or in the case where the engaging portion is at such a level that it can be reached by hand, the user grips it.

Here, manually operable devices using an engaging flap or a movement conveying rope other than the above, and moreover, the embodiments of a canvas winding device with a winding reel are described below in sequence.

Concerning Engaging Flap

In the complex device SQII8 shown in FIGS. 45(A) to 45(C), 242 is an engaging flap formed on the rear surface in the vicinity of the front end portion of the top hem 1 of the projected corner canvas G1, and an engaging hole 243 is provided in the vicinity of the center. This engaging flap 242 can be formed by cutting the canvas cloth, as shown by two dotted chain lines in FIG. 8(C), and after that, bending the portion protruding to the above to the rear and sewing.

Thus, an operation rod is hooked in the above described engaging hole 243, and the projected corner canvas G1 is transversely slid through the operation.

Here, in the case of the above, a slit (not shown) for guiding an operation rod, into which the operation rod is inserted, is created in the center portion of the bottom plate of the casing K1 in the longitudinal direction, or it may be necessary to use a casing K1 without the bottom plate portion. In the case where the above described engaging hole 243 is created in a location which is exposed from the opening through which the canvas is drawn out 131 in the casing K1, it is, of course, not necessary to provide a slit as described above.

Concerning Manually Operable Device Using Movement Conveying Rope

In the complex device SQII9 shown in FIGS. 46(A) to 46(C) and 47(A) and 47(B), a movement conveying rope (wire is also possible) is stretched using a V-shaped arm V1 in the front end portion of the device, and the movement conveying rope is manually operated.

In the figures, 551 to 553 indicate slide guides formed at the upper end of the portion for supporting the V-shaped arm V1 around an axis, where the two movement conveying ropes 561 and 562 are stretched so as to face a trench in annular form created in the upper end portion of the slide guides 551 to 553 and prevent disengagement.

571 is a protruding piece formed on the rear surface in the front end portion of the front bar F2, and the front end portion of one rope 561 which is wound from the rear portion of the slide guide 553, which is formed in the upper portion of the bracket 262 of the V-shaped arm V1, to the front is bound to the protruding piece by a nut 573 so as to be fixed.

572 is a protruding piece formed in the middle portion between the front and the rear of the front bar F2 towards the rear surface in the rear portion, and the front end portion of the other rope 562 which is wound from the front of the slide guide 553 to the rear is bound to the protruding piece by a nut 574 so as to be fixed.

In addition, the base end portions of the movement conveying ropes 561 and 562 on the wall side lead out through a through hole created vertically to the main body portion of the bracket 261 of the V-shaped arm V1 and are hung downwards. 563 and 564 are handles for operating base end portions of the movement conveying ropes 561 and 562 and are formed in aring or node form.

Thus, when one of the movement conveying ropes 561 and 562 which runs in the complex device SQII9 shown in FIG. 46(A), for example, the handle 563 of the movement conveying rope 561, is pulled down, the bracket 571 in the front end portion of the front bar F2 is pulled towards the rear of the device. As a result, the corner projected canvas G1 transversely slides to the rear while being kept in a spread state from the corner space portion, as shown in FIGS. 47(A) and 47(B), and is pulled down to a location in front of the front wall W1. At this time, the handle 564 of the other movement conveying rope 562 is naturally pulled up from the bottom to the top.

In contrast, when the handle 564 of the other movement conveying rope 562 is pulled downwards, the bracket 572 in the rear portion of the middle of the front bar F2 is pulled towards the front end of the device. As a result, the corner projected canvas G1 transversely slides towards the corner space portion, and thus, moves forward while being kept in a spread state, as shown in FIGS. 47(B) and (A), and then, is projected to the outside of the building including the corner space portion. At this time, the handle 563 of the other movement conveying rope 561 is pulled up from the bottom to the top.

Accordingly, one movement conveying rope 561 functions as a means for moving the projected corner canvas G1 backwards, and the other movement conveying rope 562 functions as a means for moving the projected corner canvas G1 forwards.

In the case of the above, though two movement conveying ropes 561 and 562 are stretched, they can be replaced with one rope, for example, an endless rope where the portions of the operation handles 563 and 564 are directly connected.

Here, though in the above described case, the movement conveying ropes 561 and 562 are stretched to the V-shaped arm V1, this can be stretched between the rear half portion of the main link 291 and the sub-link 292 in the Y-shaped arm Y1 shown in the complex devices SQII5 to 7, and thus, can be incorporated in the same manner as the above.

Concerning Canvas Winding Device Having Winding Reel

Next, in the complex device SQII10 shown in FIGS. 48(A) and 48(B), 60 is a winding reel engaged in the front end portion of the roller main body of the roller 11 so as to be freely rotatable forward and backward, which is divided into a front reel 601 and a rear reel 602 which are located in the front and in the rear with an annular brim portion formed in the middle of the outer periphery as a border. From among these, one of the movement conveying wires 561 and 562 is wound around either reel 601 or 602, while the other movement conveying wires 561 or 562 wound around the other reel 601 or 602 is unwound, and thus, the projected corner canvas G1 is transversely slid and moved forward and backward.

Thus, one wire for forward movement 562 from among the movement conveying wires 561 and 562 that lead out from the slide guide 551 in the base end portion is wound around the rear reel 602 located approximately directly above the bracket 261 in spiral form, as shown in FIG. 48(B), and the base end portion of the wire is fixed to the rear portion of the rear reel. In addition, the base end portion of the other wire for backward movement 561 is fixed to the rear portion of the front reel 601.

581 and 582 are coil springs which are attached to the front end portions of the respective movement conveying wires 561 and 562 so as to press and support the movement conveying wires 561 and 562 which stretch between the front bar F2, the V-shaped arm V1 and the winding reel 60 in a tense state.

Other parts of the structure of the movement conveying wires 561 and 562 are the same as in the case of the above described movement conveying rope, and therefore, the same symbols are attached, and description thereof is omitted.

Next, the schematic diagram of FIG. 49(A) shows a case where two electrically driven motors M1 and M4, which are incorporated in the roller main body 11 of the winding roller J4, are individually rotated as a driving system for the canvas winding device in which the above described winding reel 60 is incorporated, wherein one electrically driven motor M1 allows the projected corner canvas G1 and the rectangular canvas P1 to be wound or unwound in such a state that the canvases overlap, while the other electrically driven motor M4 allows the winding reel 60 to rotate forward and backward so that the spread projected corner canvas G1 moves transversely.

In addition, in the case of the schematic diagram shown in FIG. 49(B), one electrically driven motor M5 is incorporated in the roller main body 11, and when the operation of one of the winding roller J5 and the winding reel 60 is regulated from the outside so that the rotation is stopped, one of the other winding roller J5 and the winding reel 60 recoils.

As a result, the winding and unwinding of the projected corner canvas G1 and the rectangular canvas P1 as well as the transverse movement of the projected corner canvas G1 can be carried out by one electrically driven motor M5.

Thus, the winding roller J4 in the fourth example for individually rotating the two electrically driven motors M1 and M4 shown in FIG. 50 and the winding roller J5 in the fifth example, which is a recoil type into which one electrically driven motor M5 shown in FIG. 51 is incorporated, are described below.

Furthermore, cases where differential gear mechanisms shown in FIGS. 55(A) and 55(B) are incorporated, and the winding roller J6 in the sixth example having one electrically driven motor M6 shown in FIG. 56 and the winding roller J7 in the seventh example into which the manually driven device shown in FIG. 57 is incorporated where the differential gear mechanisms are implemented are described below.

(1) Concerning Fourth Example of Winding Roller

In FIG. 50, 156 is an end cap in the front end portion of the roller main body 11, 157 is a circular hole in the cap, 603 is a circular hole in the winding reel 60, 604 is a protrusion formed in the inner wall portion of the circular hole 603, 591 is a front end axial portion of the electrically driven motor M4, 592 is a trench created in the front half portion of the main body of the electrically driven motor M4, and 146 is an end cap which functions as a casing for the winding reel 60, where long guide holes 148 and 149 through which the movement conveying wires 561 and 562 penetrate are created in parallel at the bottom.

Thus, the rear half portion of the main body of the electrically driven motor M4 penetrates through the front end portion of the roller main body 11, and the winding reel 60 is engaged in the front half portion of the main body of the electrically driven motor M4 so as to be fixed, and in addition, the front end axial portion 591 of the electrically driven motor M4 is engaged in an long hole in the bearing portion 147 of the end cap 146 so as to be secured. Other parts of the configuration are the same as in the winding roller J2 in the second example shown in FIG. 9, and therefore, the same symbols are attached in the drawings, and description thereof is omitted.

Thus, the electrically driven motor M4, which is incorporated as described above, is rotated in either direction, forward and backward, for example it is rotated so that the main body of the motor rotates, the winding reel 60 rotates together in such a manner so that one wire, that is to say, the wire for backward movement 561, is wound around the front reel 601 in spiral form, and at the same time, the other wire wound around the rear reel 602, that is to say, the wire for forward movement 562, is unwound.

Figure 52A:
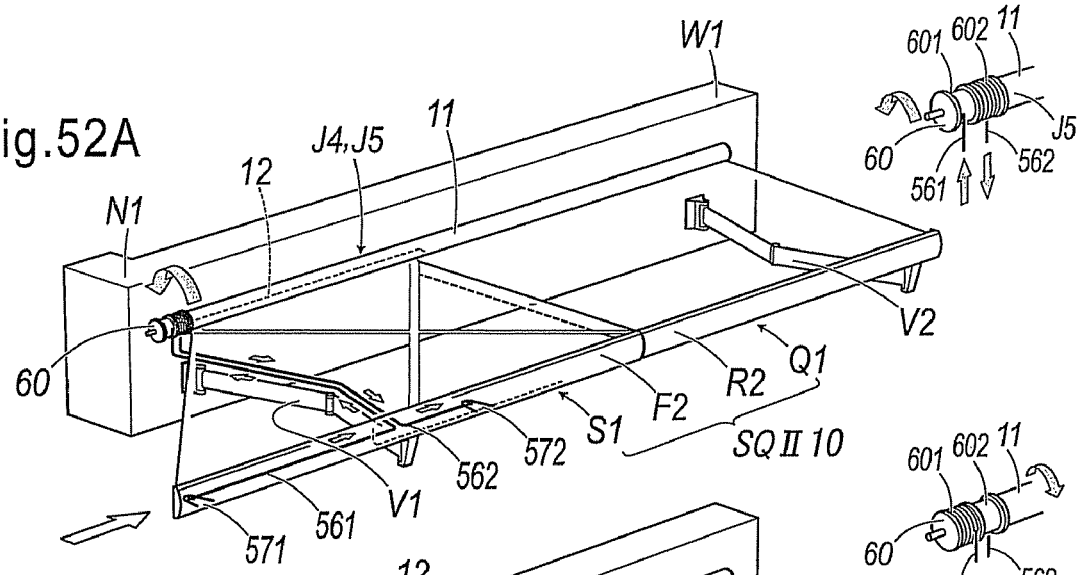
Figure 52B:
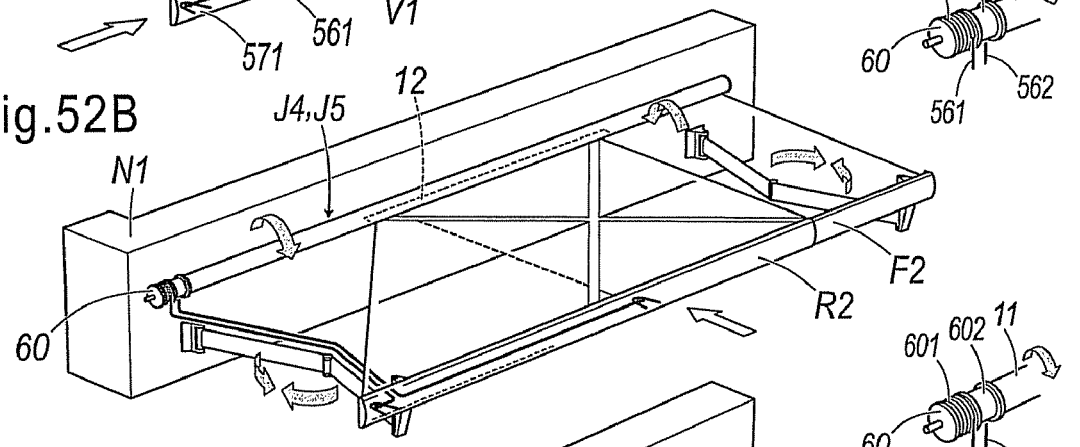

As a result, as shown in FIG. 52(A), the projected corner canvas G1, which extends into the corner space portion, transversely slides, moves and recedes to the location shown in FIG. 52(B), and thus, overlaps the rectangular canvas P1 from the above.

Figure 52C:
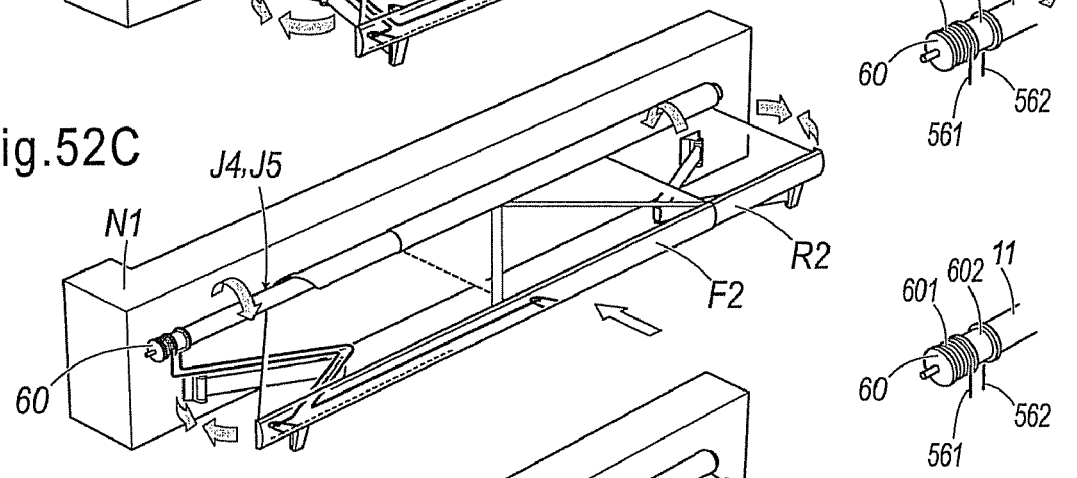
Figure 52D:
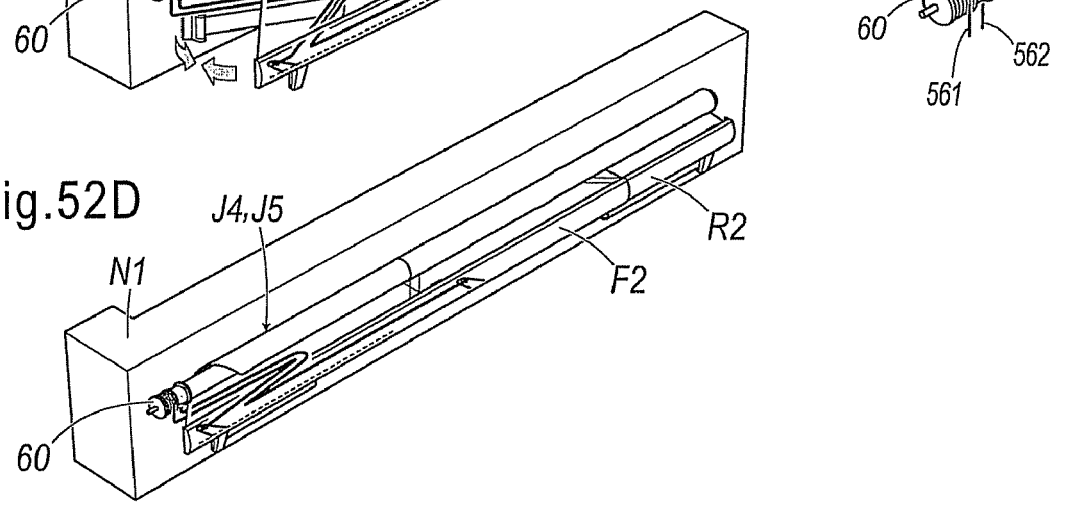

When this is sensed, the electrically driven motor M1 shown in FIG. 49(A) rotates, and the projected corner canvas G1 and the rectangular canvas P1 are wound around the winding roller J4 in such a manner so that the canvases overlap with the arms V1 and V2 being folded against the force for extending and opening the V-shaped arms V1 and V2, as shown in FIGS. 52(B) to 52(D), and thus, the two canvases G1 and P1 are wound and stored.

In addition, when the electrically driven motor M1 is driven so as to rotate in the opposite direction so that the two canvases G1 and P1 which are wound around the winding roller J4 are unwound, the front bars F2 and R2 are translated and pushed linearly toward the front so that the two canvases G1 and P1 are unwound to the front so as to spread when a force for extending and spreading works by means of the V-shaped arms V1 and V2.

When this is sensed, the electrically driven motor M4 rotates in the direction opposite to the above so that the winding reel 60 rotates and the wire 562 for the forward movement is wound around the rear reel 602, and at the same time, the wire 561 for the backward movement, which is wound around the front reel 601, is unwound.

As a result, the projected corner canvas G1 transversely slides towards the corner space portion so as to protrude, and thus, the outside of the building, which includes the corner space portion of the projected corner portion N1, is covered with the projected corner canvas G1 and the rectangular canvas P1.

(2) Concerning Fifth Example of Winding Roller

In FIG. 51, a support axis 593 is formed in the front end portion of the electrically driven motor M5, and a motor output axis 594 is formed in the rear end portion.

Thus, a protrusion 604 formed in the inner wall portion of the winding reel 60 is engaged in a trench 592 created in the front half portion of the main body of the electrically driven motor M5, the rear half portion of the main body of the electrically driven motor M5 is inserted into the front end portion of the roller main body 11, and the motor output axis 594 is inserted into, engaged with and secured to a through hole 282 of the movement conveying socket 281, which is engaged in the roller main body 11.

In addition, the support axis 593 of the electrically driven motor M5 is supported by the bearing portion 143 of the end cap 146, which functions as the casing of the winding reel 60, so as to be freely rotatable.

135 indicates a guide protrusion which protrudes from the inner wall surface of the rear surface plate portion of the casing K1 in the lateral direction, and 611 indicates a rotation stopper in band plate form having the elasticity of a spring, where the base end portion is secured to the rear end portion of the roller main body 11 with a screw 612, and the front end portion of the stopper is engaged with the above described guide protrusion 135 so as to move and be guided together with the roller main body 11 or make contact with the outer periphery surface of the roller main body 11 and be wound around it when the engagement is released.

The configuration of the other parts is the same as in the winding roller J2 in the second example shown in FIG. 9 and the winding roller J4 in the fourth example shown in FIG. 50, and therefore, the same symbols are attached to the same components in the drawings, and the description thereof is omitted.

Thus, the process for operation using one electrically driven motor M5, which is incorporated as described above, is described below in reference to FIGS. 53(B) to 53(F) and 54(G) to 54(K). FIG. 53(A) is a cross sectional plan diagram showing the winding roller J5 for the canvases G1 and P1 and the casing K1 at the point in time when the spread projected corner canvas G1 extends into the corner space portion of the projected corner portion N1.

FIGS. 53(B) to 53(F) show the process step by step where the projected corner canvas G1 moves and recedes starting from a state of protrusion into the corner space portion and overlaps the rectangular canvas P1, and after that, is wound around the winding roller J5 so as to be stored. In each of FIGS. 53(B) to 53(F), cross sections along lines a-a, b-b and c-c in FIG. 53(A) are shown from the left, and a perspective diagram showing the main portion at each point in time is added on the right.

In addition, FIGS. 54(G) to 54(K) show the process step by step where the projected corner canvas G1 and the rectangular canvas P1, which are wound around the winding roller J5, are unwound so as to spread to the front in the manner opposite to the above, and after that, the projected corner canvas G1, moves forward toward the corner space portion so as to protrude.

Here, in each figure, gray arrows indicate the actual operation and white arrows having a two-dotted chain line indicate the reaction force generated at that time.

Figure 53B:
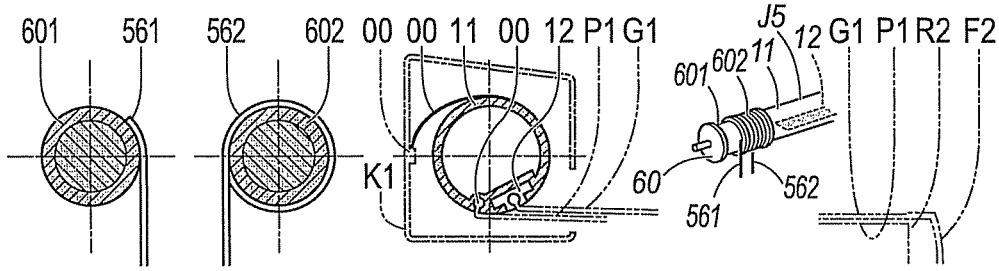

Concerning Process in which Projected Corner Canvas Slides and Recedes and Process for Winding and Storing a Number of Canvases FIG. 53(B) shows a state where the projected corner canvas G1 in the complex device SQII10 shown in FIG. 48(A) extends into the corner space portion and the front bar F2 is drawn out to the frontmost portion.

Figure 53C:
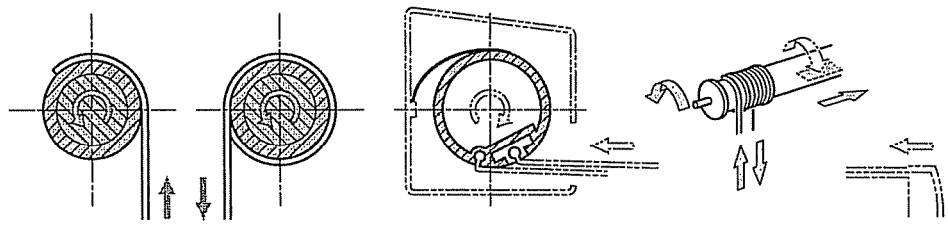

Thus, when the projected corner canvas G1 is wound and stored from this state, first, the electrically driven motor M5 is driven, and then the roller J5 and the reel 60 are rotated relative to each other so that the winding roller J5 rotates clockwise, as seen in FIG. 53(C) (winding reel 60 rotates counterclockwise as seen in the figure).

At this time, the load applied by the wire 562 for backward movement, which pulls the front bar F2 for the counterclockwise rotation of the winding reel 60 as seen in the figure, is approximately the same as the resistance due to friction created between the front bars F2 and R2, which is extremely small.

In contrast, the load applied to the front bars F1 and F2, which is pressed to extend and open in the right direction, as seen in FIG. 53(C), by the V-shaped arms V1 and V2 and the load applied for the clockwise rotation of the winding roller J5, as seen in the figure, by the spread projected corner canvas G1 are extremely large.

Figure 53D:
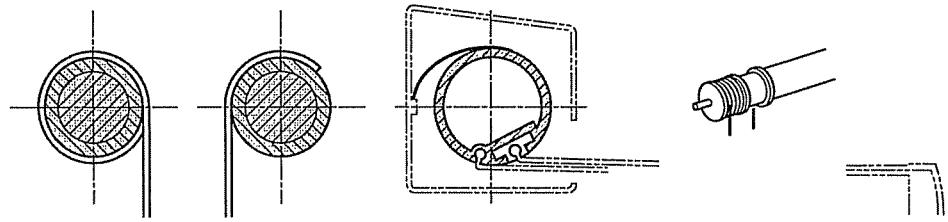

Therefore, the winding roller J5 stays still without rotating and only the winding reel 60 rotates counterclockwise, as seen in FIGS. 53(C) and 53(D).

Thus, the wire 561 for the backward movement is wound around the front reel 601 and the wire 562 for the forward movement wound around the rear wheel 602 is unwound so that the force for driving is conveyed in such a direction that the front bar F2 of the projected corner canvas G1 is pulled to the rear. As a result, as shown in FIG. 52(A), the projected corner awning device S1 which protrudes into the corner space portion operates as shown by the respective arrows shown in the figures and transversely moves to a predetermined location for receding, as shown in FIG. 52(B), and thus, the projected corner canvas G1 overlaps the rectangular canvas P1.

As shown in FIG. 53(D), this operation continues even when the winding of the wire 561 for the backward movement around the front reel 601 is completed, or even after the backward movement of the front bar F2 stops, that is to say, the rotation in the same direction by means of the electrically driven motor M5 continues while the winding reel 60 cannot rotate counterclockwise anymore.

Figure 53E:
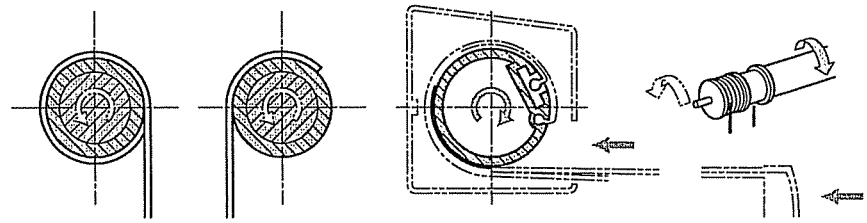

As a result, as shown in FIG. 53(E), the winding roller J5 rotates clockwise, as seen in the figure, against the above described force for extending and opening the canvas by means of the V-shaped arms V1 and V2, that is to say, the load applied to the front bar F2 so that the winding operation of the projected corner canvas G1 and the rectangular canvas P1 around the winding roller J5 is started.

Figure 53F:
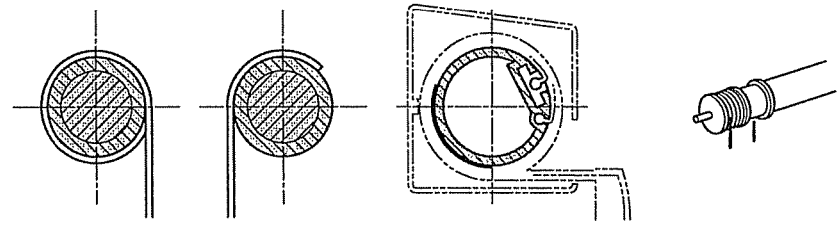

In the initial stage of this winding, as shown in FIG. 53(E), the rotation stopper 611 is positioned in such a state so as to make contact with the rear end portion of the roller main body 11 as a result of the winding of the projected corner canvas G1, and after that, the winding operation of the projected corner canvas G1 and the rectangular canvas P1 is carried out, as shown in FIG. 53(F).

Figures 54G, 54H, 54I, 54J, 54K:
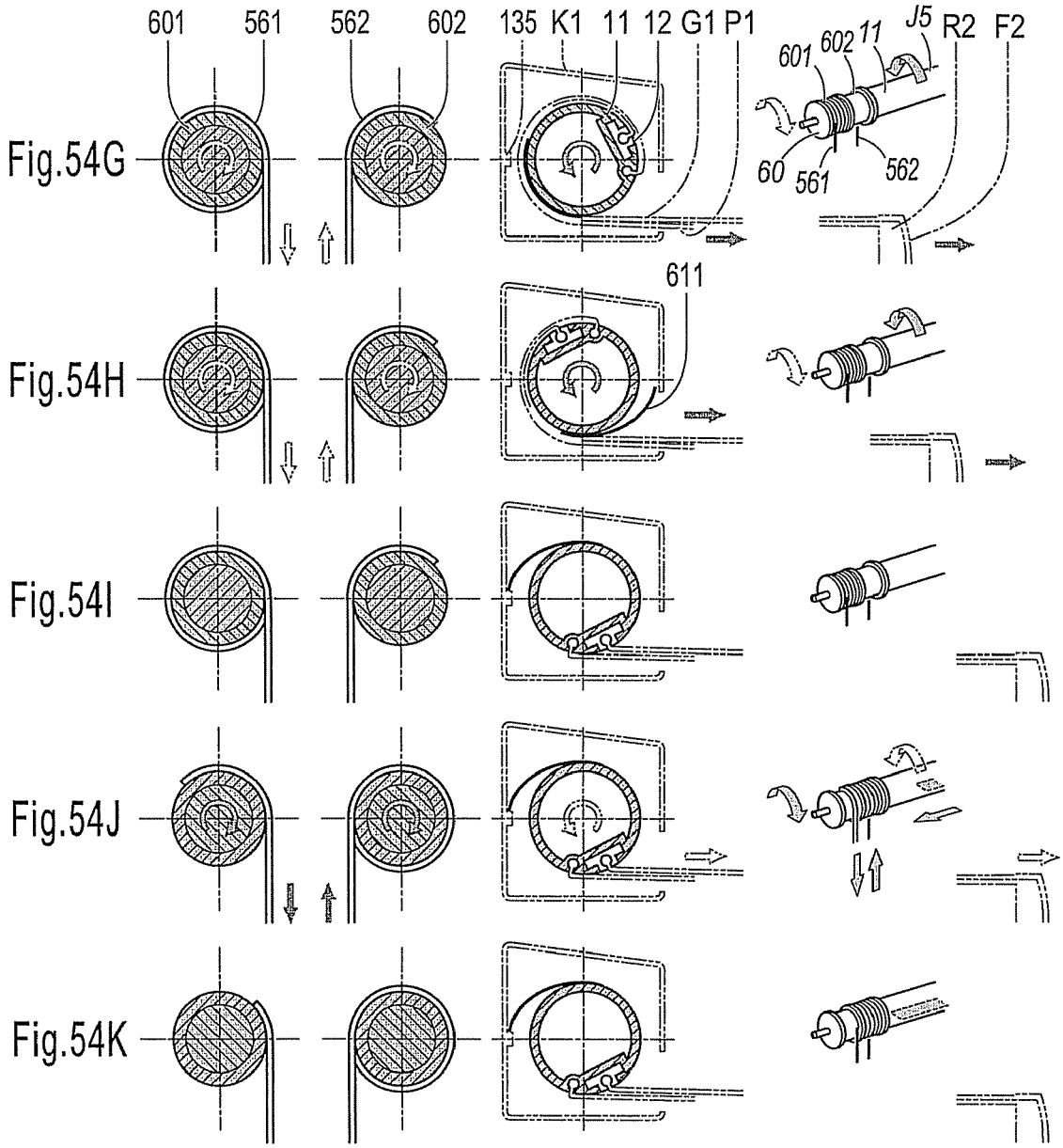

Concerning Process for Unwinding and Spreading a Number of Canvases and Process for Sliding Projected Corner Canvas Forward In order to spread the projected corner canvas G1 and the rectangular canvas P1 wound and stored as described above, the electrically driven motor M5 is rotated in the direction opposite to that above, and the winding roller J5 and the winding reel 60 rotate relative to each other so that the winding roller J5 rotates counterclockwise, as seen in FIG. 54(G) (winding reel 60 rotates clockwise as seen in the figure).

At this time, a force for extending and opening the V-shaped arms V1 and V2 forward works on the winding roller J5 and the force for spreading and tensing the front bar F2 and the projected corner canvas G1 make the torque for counter-clockwise rotation as seen in the figure work on the winding roller J5.

At this point in time, the wire for forward movement 562 and the wire for backward movement 561 are not in such a state as to work as a load for preventing rotation or torque for accelerating rotation, in terms of clockwise rotation of the winding reel 60 as seen in the figure.

When the winding roller J5 and the winding reel 60 rotate relative to each other in this state, as shown in FIGS. 54(G) and 54(H), the winding reel 60 remains stationary, and only the winding roller J5 starts rotating counterclockwise as seen in the figure, so that the projected corner canvas G1 and the rectangular canvas P1 are unwound, and the canvases spread to the front through the operation.

Thus, as shown in FIG. 54(H), when spreading of the projected corner canvas G1 to the front is in the last stage, where only the final winding is left, the rotation stopper 611, which is pressed by the projected corner canvas G1, is released and stands with a force applied, so that the front end portion engages with the guide protrusion 135 of the casing K1 in the stage in FIG. 54(I), and thus, counter-clockwise rotation of the winding roller J5 is prevented, and the operation of spreading the projected corner canvas G1 and the rectangular canvas P1 is completed.

The electrically driven motor M5 still continues rotating, and as a result, the winding reel 60 starts rotating clockwise as seen in FIG. 54(J) the next moment.

Thus, the wire for forward movement 562 is wound around the rear reel 602, and in addition, the wire for backward movement 561 is unwound from the front reel 601, and thus, the front bar F2 transversely slides in the forward direction and the spread projected corner canvas G1 extends into the corner space portion.

Though the process for operating the winding rollers J4 and J5 in the fourth and fifth embodiments as a driving device in the complex device SQII10 shown in FIG. 48(A) is described above, the winding rollers can be adopted as a device for driving other complex devices in the second to fourth groups. The description of these processes for operation is the same as in the above described case, and therefore omitted.

Concerning Winding Roller in Sixth Example

The winding roller J6 in the sixth example, in which the differential gear mechanism shown in FIGS. 55(A) and 56 is incorporated, is described below. 70 indicates an external gear formed in a location in the main body portion of the electrically driven motor M6 close to the front end (hereinafter referred to as "sun gear"), and this external gear 70 is engaged in and secured to this portion or integrally formed with the main body portion of the motor. 71 indicates an internal gear formed on the inner peripheral surface of the rear reel 602 in the winding reel 60*a*, and 72 indicates approximately four small gears (hereinafter referred to as planetary gears) which engage with the internal gear 71 and the sun gear 70, and the support axes 721 of the small gears are located in the end caps 156, which are engaged with the front end portion of the roller main body 11.

Accordingly, in the case of this winding reel 60*a*, protrusions 604 formed on the above described winding reel 60 become unnecessary and the trench 592 created in the main body portion of the electrically driven motor M6 is also unnecessary. 283 indicates a bearing socket for supporting the rear end portion of the electrically driven motor M6, and 284 indicates a through hole in this socket. Thus, the rear half portion of the main body of the electrically driven motor M6 penetrates through the front end portion of the roller main body 11, and the rear end portion of the motor penetrates through and is supported by the bearing socket 283, which is engaged with the roller main body 11.

Next, the end cap 156, from which a planetary gear 72 protrudes, is engaged with the front end portion of the roller main body 11, and the planetary gear 72 is engaged with the sun gear 70.

Thus, the winding reel 60*a* is engaged with the front end portion of the electrically driven motor M6 and the inner gear 71 is engaged with the planetary gear 72, so that a differential gear column is formed.

In addition, the support axis 591 for securing the front end portion of the electrically driven motor M6 is engaged with and secured to the long hole in the bearing portion 147 of the end cap 146.

The configuration of other parts is the same as for the winding roller J5 in the fifth example shown in FIG. 51, and therefore, the same symbols are attached in the drawings, and description thereof is omitted.

In this case, when the operation of either the winding roller J6 or the winding reel 60*a* is restricted, so that rotation is stopped, as is the winding roller J5 in the above described fifth example, the structure allows the other to rotate in the opposite direction.

Accordingly, when the electrically driven motor M6 is driven and rotated, and then the winding reel 60*b* is prevented from rotating, the winding roller J6 rotates with reduced speed in the same direction as the electrically driven motor M6, so that the projected corner canvas G1 and the rectangular canvas P1 are wound and stored or unwound and spread to the front through operation.

In addition, when the winding roller J6 is prevented from rotating, the winding reel 60*b* rotates in the opposite direction at the same speed and operates in such a manner so that the spread projected corner canvas G1 is pulled out into the corner space portion or drawn back to the rear.

In the case of the above described differential gear column, the rotational speed of the winding reel 60*b* becomes two times greater than that of the winding roller J6, and therefore, the transverse sliding operation of the front bar F2 with a small load is carried out, due to the high-speed rotation with low torque, and in addition, the operation of winding the canvas with a large load is carried out, due to the low-speed rotation with high torque, and thus, the operations are carried out efficiently.

Here, the process for sliding the projected corner canvas G1 to the rear when driven by the electrically driven motor M6 and the process for winding the projected corner canvas G1 and the rectangular canvas P1 around the winding roller J6 include the process shown in FIGS. 53(B) to 53(F), as with the winding device having the above described electrically driven motor M5, and thus, the canvases are wound and stored.

In addition, the process for unwinding and spreading the projected corner canvas G1 and the rectangular canvas P1 and the process for sliding the projected corner canvas G1 forward include the process shown in FIGS. 54(G) to 54(K), and thus, the canvases extend into the corner space portion.

Concerning Winding Roller in Seventh Example

The winding roller J7 in the seventh example, in which the differential gear mechanism shown in FIGS. 55(B) and 57 is incorporated, is described below. 73 indicates a driving axis, the sun gear 70 is engaged with and secured in a location close to the center, and the driving axis 73 is formed so as to rotate forward and backward by means of the manually operable device formed in the front end portion of the axis.

Thus, the bearing socket 283 is engaged inside the roller main body 11 and the end cap 156, from which the planetary gear 72 protrudes, is engaged in the front end portion of the roller main body 11.

Next, the rear half portion of the main body of the driving axis 73 with which the sun gear 70 is engaged is inserted into the roller main body 11 from the through hole 158 of the end cap 156, so that the rear end portion of the driving axis 73 is inserted in the through hole 285 of the bearing socket 283 so as to be supported, and the planetary gear 72 and the sun gear 70 are engaged with each other. In addition, the winding reel 60*b* is engaged with the driving axis 73 and the internal gear 71 formed in the inner periphery portion of this rear reel 602 is engaged with the above described planetary gear 72, and thus, a differential gear column is formed.

In addition, a worm gear 161 is engaged in a location in the driving axis 73 close to the front end, and the roller 163, with which the worm gear 162 which is engaged with the gear 161 is engaged, is supported by a bearing in such a manner so as to be perpendicular to the end cap 146, and in addition, the front end portion of the driving axis 73 is supported by the bearing portion 143 of the end cap 146 in such a manner so as to be freely rotatable.

The configuration of other parts is the same as in the case of the winding roller J6 in the sixth example shown in FIG. 56, and therefore, the same symbols are attached in the drawing, and description thereof is omitted.

This is a case where a manually driven device for rotating the driving axis 73 forward and backward through manual operation is used in place of the electrically driven motor M6 for driving the winding roller J6 in the sixth example. The process for operation is the same as in the case of the sixth example, and therefore, description thereof is omitted.

Concerning Lateral Arm Type Complex Device

This is a complex case where the awning device S1 for a projected corner according to the present invention is organically incorporated in the lateral arm type movable awning device where the front bar R2 of the rectangular canvas P1 is supported by foldable arms which freely extend upward in the vertical direction, or by an extendable link having a pantograph structure, and this is mainly incorporated in the projected corner portion N1 of shops located at the corner of a building.

Concerning First Embodiment

In the complex device SQL1 shown in FIGS. 58 to 60, Z1 and Z2 are foldable arms which support the two end portions of the front bar R2 and freely extend (hereinafter referred to as extendable arms) where the inner pipe 651 and the outer pipe 652 are supportably inserted so as to be freely slidable so that the two pipes are fixed with a thumb screw 653 or a ring nut (not shown).

641 is a bracket fixed to pillars H1 and H2 or a gate type frame or a longitudinal wall portion in portions on the two sides of the shop, and the lower end portion of the above described inner pipe 651 is supported around a pin. The upper end portion of the outer pipe 652 is attached to the two end portions of the front bar R2. 654 is a reinforcing rod for the extendable arms Z1 and Z2 which is diagonally fixed to a portion where the outer pipe 652 and the front bar R2 are put in the corner.

Next, a configuration where a movement conveying rope 66 for operating and sliding the front bar F2 is stretched is described. 671 and 672 are engaging portions which are attached to the bottom of the front end and the bottom in the vicinity of the middle of the front bar F2, and 673 and 674 are engaging portions which are attached to the upper and lower two end portions of the outer pipe 652, and one movement conveying rope 66 stretches around these engaging portions 671 to 674.

One front end portion of the movement conveying rope 66 is tied to the engaging portion 671 at the front end of the front bar F2, and the other is pulled along the front bar F2 to the vicinity of the middle of the front bar so as to penetrate through the engaging portion 673 at the upper end of the outer pipe 652 and bend downward, pulled downward along the outer pipe 652, penetrates through the engaging portion 674 at the lower end, returns, and after that is pulled up, again penetrates through the engaging portion 673 at the upper end, and is bent to the rear, and then the rear end portion of this rope is tied to the engaging portion 672 in the middle of the front bar F2.

Here, engaging portions 241 which are operated manually are also formed in the vicinity of the rear portion and the middle portion of the front bar F2.

Figures 59A, 59B, 59C, 59D:
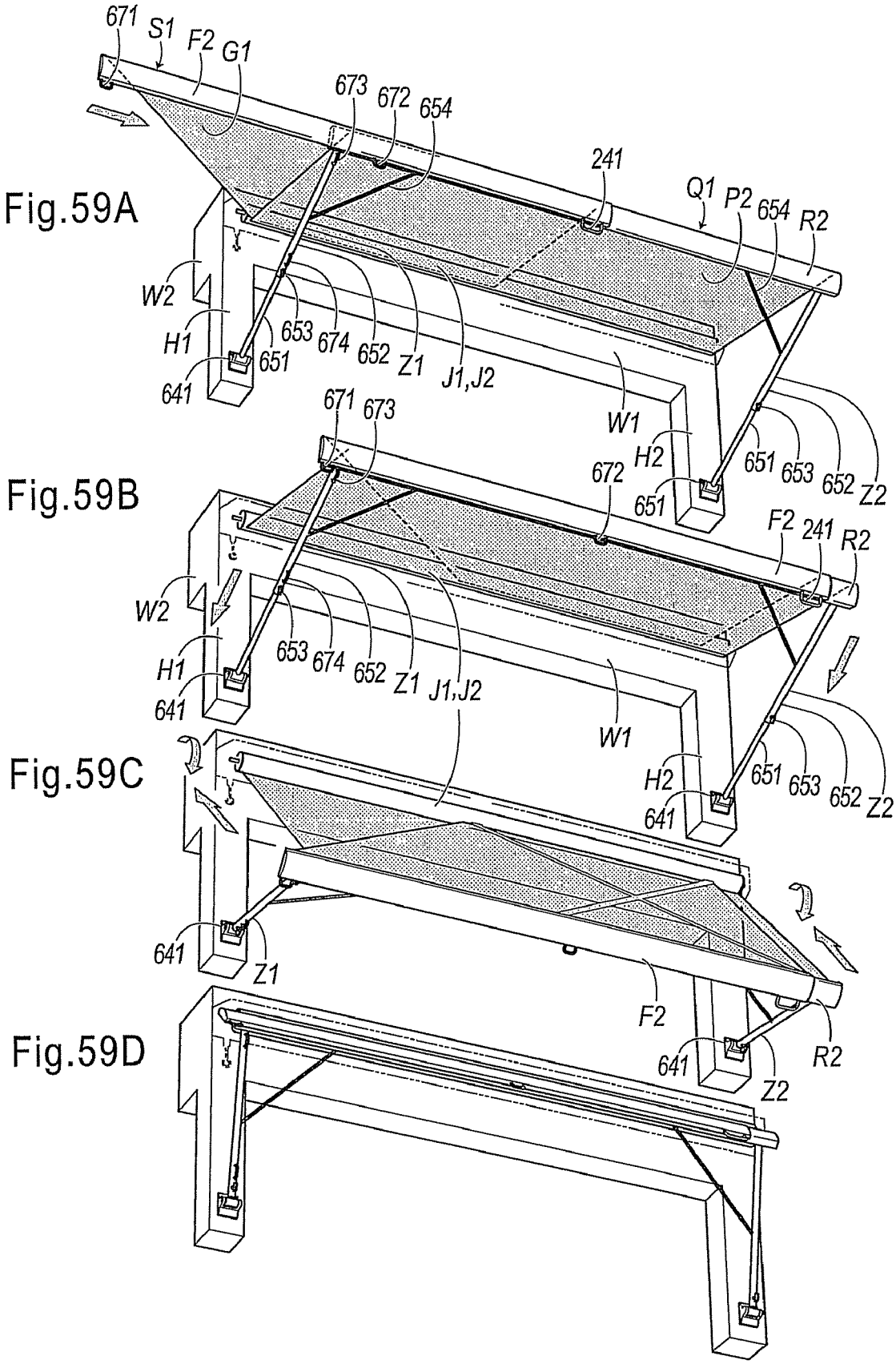

Thus, as shown in FIGS. 58(A) and 59(A), in order to operate and slide the projected corner canvas G1 which is extended into the corner space portion, first an operation rod (not shown) is hooked onto the engaging portion 241 from beneath so as to be pulled to the rear, and thus transversely slid. Alternatively, in the case where the movement conveying rope 66 for manual operation is stretched as described above, as shown in the upper portion of FIG. 58(B), one of the double loop movement conveying ropes 66 that returns is pulled down toward the lower side of the outer pipe 652 through the operation.

Thus, the force pulling in the direction of the arrows in the figure is conveyed and the front bar F2 of the projected corner canvas G1 transversely slides along the front bar R2 of the rectangular canvas P2 and the slider 12 to which the top hem 1 of the projected corner canvas G1 is secured transversely slides to the rear along the slide guide path 112 of the roller main body 11 in parallel.

As a result, the projected corner canvas G1, which is pulled down to such a degree that the canvas does not protrude from the corner projected portion N1, overlaps with the long, rectangular canvas P2 from the top.

Figure 60A:
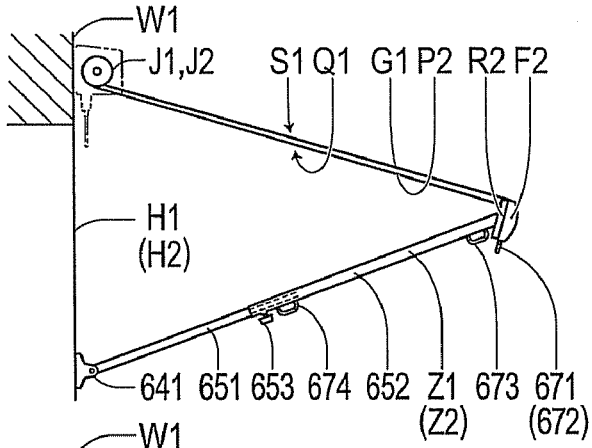
Figure 60B:
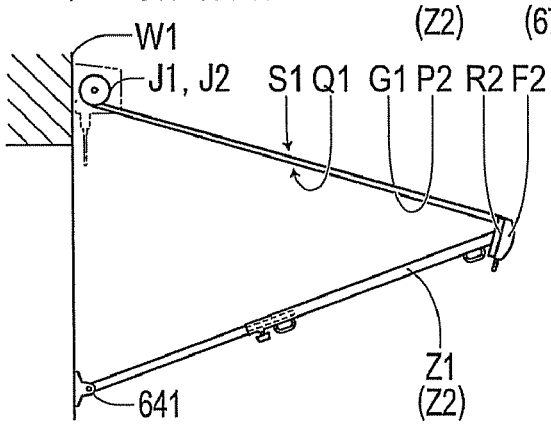
Figure 60C:
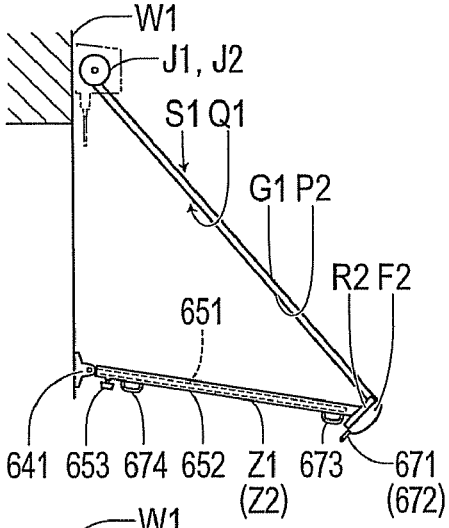

Next, the thumb screw 653 or the ring nut is loosened, before winding the two canvases G1 and P2, and in addition, the front bars F2 and R2 are pulled down, as shown in FIG. 59(B), and the outer pipe 652 is stored in the inner pipe 651 through sliding, as shown in FIGS. 59(C) and 60(C), and thus, the extendable arms Z1 and Z2 retract toward the wall side.

Figure 60D:
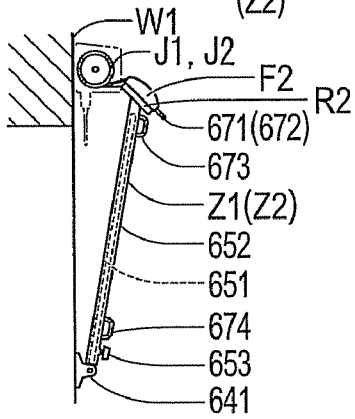

Next, when the projected corner canvas G1 and the rectangular canvas P2 are wound around one winding roller J1 or J2, as shown in FIGS. 59(D) and 60(D), the two canvases G1 and P1 are wound, and at the same time, the extendable arms Z1 and Z2 are pulled up in the vertical direction, and thus, the canvases are stored in a compact space in the wall portion in a standing position.

In addition, when the two canvases G1 and P2 are unwound, the two canvases spread forward with a relatively steep inclination, that is to say, in a state where the front lowers a considerable degree, as shown in FIGS. 60(D) and 60(C).

Next, as shown in FIGS. 60(C) and 60(B), the front bar F2 and R2 are pulled up to the front, and thus, the retracted extendable arms Z1 and Z2 extend and the thumb screw 653 or ring nut is bound for fixture.

In addition, an operation rod (not shown) is hooked onto the engaging portion 241 from beneath and pulled toward the front end of the device, and thus, the projected corner canvas G1 is transversely slid so as to extend into the corner space portion.

Alternatively, as shown in the top of FIG. 58(B), one of the two loops of the movement conveying rope 66 on the lower side of the outer pipe 652 is pulled down through operation.

Thus, the tenseness is conveyed in the direction opposite to the arrows in the figure, and the front bar F2 of the projected corner canvas G1 transversely slides along the front bar R2 of the rectangular canvas P2, and the slider 12 for the top hem of the projected corner canvas G1 transversely slides along the slide guide trenches 111 and 112 of the roller main body 11 in parallel, and thus, the projected corner canvas G1 extends into the corner space portion.

Though a case where the foldable arms are extendable arms Z1 and Z2 which stand in the vertical direction and lie down through operation is described above, the front bar R2 can be pushed up by pushing arms (not shown) having a constant length, so that the projected corner canvas G1 and the rectangular canvas P2 which spread to the front can be supported with tenseness, for example.

Here, though a case where a long, rectangular canvas P2 is attached to the winding roller J1 or J2 and the front bar R2 is described above, a short, rectangular canvas P1 having a margin with a small width where the rear end portion of the projected corner canvas G1 which extends into the projected corner portion N1 and the front end portion of the rectangular canvas P1 overlap can be provided.

Concerning Second Embodiment

In the complex device SQL2 shown in FIG. 61, Z3 and Z4 are foldable arms having a pantograph structure formed of links that are freely extendable (hereinafter referred to as extendable links) where several pairs of links 691 and 692 having the same length are connected in X shape and the base end portions are attached to the bracket 681, which is secured to the upper portion of the support pillars H1 and H2 in such a manner so as to be rotatable.

682 is a long guide hole which is longitudinally provided in an upper portion of the bracket 681, and the rear end portion of the equal length link 691 in the rear portion is provided in the long guide hole. In addition, a rising link 693 which is appropriately bent is formed in the front end portion of the other equal length link 692 in the front portion, and the front bar R2 of the long rectangular canvas P2 is attached to this front end portion.

In this case, the front bars F2 and R2 are held with both hands and pulled to the front so that the extendable links Z3 and Z4 extend through operation, and thus, the projected corner canvas G1 and the rectangular canvas P2 are spread to the front, and in contrast, they are pushed to the rear so that the two canvases G1 and P1 can be wound and stored in the wall.

Though in the case of the above, the front bars F2 and R2 are pulled out or pushed in through manual operation, the above described extendable links Z3 and Z4 can be operated so as to extend or be drawn in by means of an electrically driven device (not shown).

Other parts of the configuration are the same as in the above described complex device SQL1, and therefore, the same symbols are attached in the drawings, and description thereof is omitted.

In the case of the above described various types of complex devices, top hems 1, 5 and 5*a* of a number of canvases G1, G2 and P1 to P4 are attached in the circumference of one winding roller J1 to J7 at appropriate intervals in parallel, and in addition, the front bars F2, F3 and R2 to R4 for supporting the bottom hems 2, 2*a* and 6 of a number of canvases G1, G2 and P1 to P4 usually spread to the front in such a state that the front lowers at an appropriate angle of inclination.

Therefore, in the case where the tenseness of the number of canvases is set so as to be approximately the same when spread, the canvas on the upper side is finally wound in such a state that slack of several centimeters to approximately 10 cm remains, unlike with the canvas on the lower side, when the number of canvases are wound and stored in such a state as to overlap.

A simple means for solving this problem is described on the basis of the complex devices SQII11 and the embodiment of the complex devices SQII11 shown in FIGS. 62 and 63.

Concerning Fixture for Supporting Canvas in Tense State, that is, Fixture for Preventing Slack when the Canvas is Stored In FIG. 62, 62 indicates an fluctuation flap having elasticity, and the base end portion thereof is attached to the rear end of the upper plate portion 342 of the front bar F2 for the projected corner canvas G1, and as shown in FIG. 62(A), the front end portion of this fluctuation flap 62 presses the bottom hem 2 of the projected corner canvas G1 in such a manner so as to push it up from the bottom.

Accordingly, as the projected corner canvas G1 and the rectangular canvases P1 and P2 of the complex device SQII11 are wound in such a state that the canvases overlap, as shown in FIG. 62(B), the front end portion of the fluctuation flap 62 gradually stands when pressed, and stands as shown in FIG. 62(C) when the canvases are finally wound and stored, and thus, the bottom hem 2 of the wound canvas is pushed up and supported in a tense state.

As a result, the projected corner canvas G1 can be prevented from slacking when the canvas is wound and stored, and thus, an appropriate tenseness can be maintained.

In the case of the above, the upper side is the projected corner canvas G1 and the lower side is the rectangular canvases P1 and P2 or the recessed corner canvases P3 and P4 in combination, while in the case of a complex device (not shown) where these canvases are placed in the opposite top-bottom relation in the layout, the bottom hems 6 of the rectangular canvases P1 and P2 on the upper side are pressed and pushed up by the fluctuation flap 62.

Concerning Device for Supporting Canvas in Tense State, that is to say, Device for Absorbing Slack Canvas at Time of Storage In FIG. 63, 63 is an extendable net made of rubber for supporting the projected corner canvas G1 in a tense state, and provided on the rear surface of the projected corner canvases G1 and G2 close to the bottom hem 2.

633 is a flat ring string attached to the rear portion in the vicinity of the bottom hem 2 with a space, and a rod 632 penetrates through this ring string 633 and a rubber string 631 which is freely extendable crosses in zigzag form between the rod 632 and the rear end portion of the upper plate portion 342 of the front bar F2, and thus, the extendable net 63 is created.

Accordingly, as shown in FIG. 63(B), the elastic force resulting from the extendable net 63 is effectively applied when the projected corner canvas G1 in the complex device SQII12 is spread to the front to the maximum, and thus, the projected corner canvas G1 is kept in a tense state.

In contrast, when the projected corner canvas G1 is wound and stored, as shown in FIG. 63(C), the extendable net 63 contracts and force with appropriate tenseness is maintained, while extra hem 2 of the canvas is bent so as to be layered, and thus, the portion which becomes loose when wound is absorbed so as to provide a good appearance.

The above described case provides a so-called inner slider structure where sliders 12, 12*a* and 12*w* which transversely slide in the axis line direction are incorporated in the winding rollers J1 to J7 for the projected corner canvases G1 and G2, and the winding rollers J8 to J10 in the eighth to tenth examples, which have the same functions and of which the configuration is simplified, are described in reference to FIGS. 64 to 66.

Concerning Eighth Example of Winding Roller

In FIGS. 64(A), 64(B) and 65, 110 indicates canvas engaging trenches for rectangular canvases P1 and P2 or recessed corner canvases P3 and P4, 114 indicates a slide guide path which is a recess of which the cross section is in Ω form, and is created inside the roller main body 11*c* of the winding roller J8 in the direction of the axis line.

115 indicates a thin cover cap having a cross section in Ω form which lines the slits 111 and the inner wall surface of the slide guide path 114 inside the slits.

12*x* indicates a slide cap which is engaged with the top hems 1 of the projected corner canvases G1 and G2, and the slide cap is engaged in a lining cover cap 115 in such a state that the slide cap and the cover cap move relative to each other.

Thus, as shown in FIG. 65, the top hems 5 and 5*a* of the rectangular canvases P1 and P2 or the recessed corner canvases P3 and P4 are attached to the canvas engaging trench 110, and in addition, the slide cap 12*x* is engaged with the top hems 1 of the projected corner canvases G1 and G2, an attachment wire 183 is inserted into the top hem 1 of the above described canvases and prevented from being pulled out, and the slide cap is engaged in the cover cap 115 which lines the slide guide path 114 in such a state that the slide cap and the cover cap move relative to each other.

In the case of the above, the cover cap 115 reduces the sliding resistance when the slide cap 12*x* which is engaged with the top hem 1 of the canvas transversely slides, and prevents the slide guide path 114 from making direct contact with the slide cap 12*x*, and thus, sliding is made easy.

As a result, the cover cap has the same function as the winding rollers J1 and J2 having the slider 12 and 12*a* structure for the complex devices in the first to third groups, and contributes to simplification of the configuration.

Concerning Ninth and Tenth Examples of Winding Rollers

The winding roller J9 in the ninth example shown in FIG. 66(A) is formed in the direction of the axis line of the roller main body 11*d* in such a manner so that two columns of slide guide paths 114 having slits 111 are adjacent and parallel to each other, and the cover caps 115 are engaged with the inner wall surface of the respective guide paths 114. In addition, slide caps 12*x* are engaged with the top hems 1 of the projected corner canvases G1 and G11 which are engaged in the above described cover cap 115 in such a state that the slide cap and the cover cap move relative to each other. This winding roller J9 can be used in place of the winding roller J3 in the complex device SSII in the fourth group.

The winding roller J10 in the tenth example shown in FIG. 66(B) is provided in such a manner so that the roller main body 11*d* having the same cross section as that above can be used, and a thick spacer cap 116 in Ω form is engaged in one slide guide path 114, and the top hems 5 and 5*a* of the rectangular canvases P1 and P2 or the recessed corner canvases P3 and P4 are attached on the inside of the spacer cap. This can be used in place of the winding rollers J1 and J2 in the complex devices SQII1 to 10, SUII1 and 2 and SQSIV in the first to third groups.

Concerning Front Bar Having Structure that is Movable Through Rotation

Though in the case of the above described complex devices SQII1 to 12, the front bar F2 on the outside is formed on the front bar R2 on the inside in such a manner so as to be guided and freely slidable, the relationship between the two can be replaced with that of the front bars F5 and R5 having a structure that is movable through rotation, as shown in FIGS. 67(A), 67(B), 68 and 69(A) to 69(C).

The front bar F5 on the outside is made of a steel material and has an opening in the center portion on the rear surface, as well as a front plate portion 831, an upper plate portion 832 and a lower plate portion 833, and furthermore, an upper engaging trench 841 to which the bottom hem 2 of the projected corner canvases G1 and G2 is attached is created in the border portion between the upper plate portion 832 and an eave plate portion 834 which extends to the rear. An engaging flange 851 is formed so as to hang from beneath the upper engaging trench 841. The lower engaging trench 842 to which the front skirt 221 is attached is created in a rear portion of the bottom plate portion 833, and the engaging flange 853 is formed in the upper portion so as to protrude perpendicularly. 854 indicates a bracket which protrudes from an upper portion on the inside of the rear end portion of the front plate portion 831.

861 and 862 are guide wheels incorporated in upper and lower portions on the inside of the rear end portion of the front bar F5, and from among these, the upper wheel 861 is secured to and supported by the above described bracket 854 in such a manner so as to be freely rotatable horizontally around an axis pin 863. The lower wheel 862 is secured to and supported by the lower plate portion 833 in such a manner so as to be freely rotatable horizontally around an axis pin 864.

The front bar R5 on the inside is made of a steel material and has a cross section in square cylindrical form, as well as a front plate portion 871, a rear plate portion 872, an upper plate portion 873 and a lower plate portion 874, and furthermore, wheel chambers 881 and 882 for containing the above described upper wheel 861 and lower wheel 862 so that they are guided and move through rotation and formed in sections with partitions 891 and 892 on the upper side and the lower side of the front bar R5.

Thus, an upper engaging trench 901 to which the bottom hems 6 of the rectangular canvases P1 and P2 or the recessed corner canvases P3 and P4 are attached and the lower engaging trench 902 to which the front skirt 391 is attached are respectively created in the end portions of the partitions 891 and 892 which protrude to the rear from the rear plate portion 872. An engaging flange 911 is formed at the bottom of the upper engaging trench 901 in such a manner so as to protrude downward, and an engaging flange 912 which faces upward protrudes from the upper portion of the lower engaging trench 902.

92 indicates a wheel holder which is engaged with and secured to the front end portion of the front bar R5, and guide wheels 931 and 932 are supported above and below the protrusion at the front end in such a manner so as to be freely rotatable horizontally around the wheel axes 933. 941 indicates a guide slit created in the center portion of the lower plate portion 874, and guides the axis pin 864 of the lower wheel 862 so that it moves freely. 942 indicates an upward facing guide slit in the front plate portion 871, and the above described bracket 854 is inserted and guided in the slit.

Thus, the front bar F5, where guide wheels 861 and 862 are incorporated in upper and lower locations in the rear end portion, is inserted into and engaged with the front bar R5, where guide wheels 931 and 932 are provided in the front end portion and wheel chambers 881 and 882 are provided in upper and lower portions. As a result, one guide wheel 931 or 932 is engaged in the front bar F5 in the up-down direction and the other guide wheel 861 or 862 is engaged in the above described wheel chamber 881 or 882, and thus, the front bar R5 and the front bar F5 are combined so as to be guided and able to move freely through rotation.

Accordingly, in the case where the front bars F5 and R5 having the above described structure which moves through rotation are incorporated in the complex devices SQII1 to 7, SUII1 and 2 and SQSIV in the first to third groups, the sliding resistance when the front bar F5 moves forward and backward can be greatly reduced, so that the smoothness of the operation further increases.

Here, though according to the present invention, the outside of buildings that include projected corer portions and recessed corner portions are covered by the complex devices in the first to fourth groups so that the appearance of the building becomes excellent, in the case where the linear sections around the outside of the building are long, the foldable arm type movable awning device described at the beginning of the present specification, where the top hem of the rectangular canvas is attached to a winding roller and the bottom hem of the canvas is attached to a front bar is incorporated.

In addition, in the case of a simple recessed corner portion or in the case where the distance between two recessed corner portions is relatively short, a single movable awning device for winding or unwinding either a recessed corner canvas in a reverse trapezoid form with right angles or a recessed corner canvas in a reverse trapezoid form is incorporated, as disclosed in FIGS. 69 and 70 showing a "complex awning device" in the above described International Patent Application 2.

Accordingly, complex devices according to the present invention can be laid out freely in accordance with the appearance of the building, and thus, the outside of various types of buildings including a projected corner portion and a recessed corner portion can be made uniform so as to provide good design and a good appearance, and in addition, an awning system which can be freely built for a gallery can be provided in the industry.

INDUSTRIAL APPLICABILITY

The present invention provides a novel complex awning device which is technologically advanced and very useful, as described above, and a winding roller for a number of canvases which forms the main portion of the complex awning device, and therefore, the appearance of the outside of various types of buildings including projected corner portions and recessed corner portions improves significantly, and thus, the invention can contribute to progress and development in the industry a great deal.

The invention claimed is:

1. A complex awning device to be attached to an exterior of a structure, comprising:

a protruded corner canvas adapted to cover a protruded portion of the exterior of the structure;

a substantially rectangular canvas adapted to cover a straight portion of the exterior of the structure;

a hollow winding roller for winding and unwinding said protruded corner canvas and said substantially rectangular canvas;

a slider to which said protruded corner canvas is attached, the protruded corner canvas and the rectangular canvas being positioned one over the other, said slider being axially slidably housed within said hollow winding roller; and a plurality of foldable arms, wherein said substantially rectangular canvas is provided with a first front bar which is supported translatably on said foldable arms, and wherein said protruded corner canvas is provided with a second front bar which is inserted into and held by said first front bar.

2. The complex awning device of claim 1, wherein the protruded corner canvas and the substantially rectangular canvas are unwound and spread, and the spread protruded corner canvas transversely slides along said hollow winding roller and the first front bar, and wherein the protruded corner canvas is projected to the out side of the protruded portion of the exterior of the structure.

3. The complex awning device of claim 1, the protruded corner canvas being transversely slidable along said hollow winding roller and said first front bar, wherein the protruded corner canvas and the substantially rectangular canvas are wound around the hollow winding roller so as to have the protruded corner canvas and the substantially rectangular canvas overlap one another.

4. A complex awning device to be attached to an exterior of a structure, comprising:

a protruded corner canvas adapted to cover a protruded portion of the exterior of the structure;

a recessed corner canvas adapted to cover a straight portion and a recessed portion of the exterior of the structure;

a hollow winding roller for winding and unwinding said protruded corner canvas and said recessed corner canvas;

a slider to which said protruded corner canvas is attached, the protruded corner canvas and the recessed corner canvas being positioned one over the other, said slider being axially slidably housed within said hollow winding roller; and a plurality of foldable arms, wherein said recessed corner canvas is provided with a first front bar which is supported translatably on said foldable arms, and wherein said protruded corner canvas is provided with a second front bar which is inserted into and held by said first front bar.

5. The complex awning device of claim 4, wherein the protruded corner canvas is transversely slidable along said hollow winding roller and said first front bar, and wherein the protruded corner canvas is projected to the out side of the protruded portion of the exterior of the structure.

6. The complex awning device according to claim 4, wherein the protruded corner canvas transversely slides in a rearward direction along the hollow winding roller and the first front bar of the recessed corner canvas, and wherein the protruded corner canvas and the recessed corner canvas are wound around said hollow winding roller causing said protruded corner canvas and the recessed corner canvas to substantially overlap.

7. A complex awning device according to claim 1, wherein the hollow winding roller comprises:

a first opening therein and a second opening therein, wherein the first opening and the second opening are formed in a substantially parallel relationship with each other and substantially along a longitudinal axis of the hollow winding roller;

said first opening defining a slide guide path therein;

said slide guide path and said first opening being sized to accommodate the slider; and said second opening engaging at least part of the substantially rectangular canvas.

8. The complex awning device according to claim 7, the slider comprising:

two sides substantially parallel to a longitudinal axis of the slider;

each side defining a wheel groove therein; and at least two wheels, wherein said at least two wheels are each configured to be adapted to freely rotate in each of the wheel grooves, and wherein said at least two wheels engage said slide guide path.

9. A complex awning device according to claim 1, wherein the protruded corner canvas comprises a substantially trapezoidal canvas body having an upper side and a lower side, which is comprised of a substantially rectangular canvas portion and a substantially triangular canvas portion, said upper side of the trapezoidal canvas body is secured to said slider and said lower side of the trapezoidal canvas body is secured to the second front bar.

10. The complex awning device according to claim 9, wherein at least one connection member is attached between the slider and the second front bar.

11. A complex awning device according to claim 1, wherein said protruded corner canvas comprises a substantially triangular canvas body, and wherein said triangular canvas body is reinforced by two flexible connection wires attached thereto along two sides of the substantially triangular canvas body, the proximal ends of said two flexible connection wires being attached independently to said slider, the distal ends of the two flexible connection wires being attached to said second front bar at both ends thereof respectively.

12. The complex awning device according to claim 7, wherein a manually operable device and/or an electrically driven device is configured to rotate the hollow winding roller, and wherein said rotation winds or unwinds at least said substantially rectangular canvas.

13. The complex awning device according to claim 1, wherein the first front bar is on the outside and the second front bar is on the inside relative to a front side and a back side of the complex awning device.

14. The complex awning device according to claim 13, wherein said first front bar and said second front bar each define at least one set of grooves therein respectively, and wherein said respective grooves are formed substantially parallel to a longitudinal axis of said first front bar and said second front bar respectively, and wherein the grooves engage a bottom hem and a front skirt of the protruded corner canvas and the substantially rectangular canvas respectively.

15. The complex awning device according to claim 14, wherein said second front bar is configured so as to slidably engage said first front bar in a direction substantially parallel to said first front bar.

* * * * *